US007316287B2

(12) United States Patent
Ohashi et al.

(10) Patent No.: US 7,316,287 B2
(45) Date of Patent: Jan. 8, 2008

(54) HYDRAULIC PUMP UNIT, HYDRAULIC PUMP SET, AND WORKING VEHICLE

(75) Inventors: Ryota Ohashi, Amagasaki (JP); Manabu Kawakami, Amagasaki (JP); Shigenori Sakikawa, Amagasaki (JP); Takeaki Nozaki, Amagasaki (JP)

(73) Assignee: Kanzaki Kokyukoki Mfg. Co., Ltd., Hyogo (JP)

( * ) Notice: Subject to any disclaimer, the term of this patent is extended or adjusted under 35 U.S.C. 154(b) by 264 days.

(21) Appl. No.: 11/102,708

(22) Filed: Apr. 11, 2005

(65) Prior Publication Data

US 2005/0226747 A1 Oct. 13, 2005

(30) Foreign Application Priority Data

| | | |
|---|---|---|
| Apr. 13, 2004 | (JP) | 2004-117796 |
| Apr. 15, 2004 | (JP) | 2004-119824 |
| Apr. 19, 2004 | (JP) | 2004-123240 |
| Apr. 22, 2004 | (JP) | 2004-127248 |
| Jun. 14, 2004 | (JP) | 2004-175877 |
| Jun. 17, 2004 | (JP) | 2004-179234 |

(51) Int. Cl.

| | |
|---|---|
| ***B60K 17/00*** | (2006.01) |
| ***B60K 17/30*** | (2006.01) |
| ***B60K 3/00*** | (2006.01) |
| ***B60K 11/24*** | (2006.01) |
| ***B60K 11/02*** | (2006.01) |

(52) U.S. Cl. ..... 180/307; 180/305; 180/308; 180/6.3; 180/6.48

(58) Field of Classification Search ..... 180/307, 180/305, 308, 6.3, 6.48
See application file for complete search history.

(56) References Cited

U.S. PATENT DOCUMENTS

| | | | | |
|---|---|---|---|---|
| 3,645,349 | A * | 2/1972 | Nichter | 180/6.48 |
| 6,056,074 | A * | 5/2000 | Heal et al. | 180/6.48 |
| 6,332,393 | B1 * | 12/2001 | Trimble | 92/12.2 |
| 6,935,454 | B1 * | 8/2005 | Hauser et al. | 180/242 |

* cited by examiner

*Primary Examiner*—Christopher P. Ellis
*Assistant Examiner*—John R. Olszewski
(74) *Attorney, Agent, or Firm*—Sterne, Kessler, Goldstein & Fox P.L.L.C.

(57) ABSTRACT

There is provided a working vehicle having first and second hydraulic pump units operatively driven by a driving source and arranged away to each other in a width direction of the vehicle. In the working vehicle, each of the first and second hydraulic pump units includes a pump body; a port block formed with an oil passage for supplying/discharging an operating fluid to/from said pump body; a pump case connected to the port block so as to define a pump body accommodating space for surrounding the pump body; and a pump shaft for rotatably driving the pump body, the pump shaft having an input end operatively connected to said driving source. A drain port for opening the pump body accommodating space outward and a charge suction port for drawing in an oil from an oil tank in order to supply a charge oil to a hydraulic circuit fluidly connecting with the corresponding hydraulic motor unit are provided respectively in first and second assemblies formed by the corresponding pump case and port block. The drain port is provided on a wall surface other than an opposing wall surface facing each other of the wall surfaces of said first and second assemblies when arranging the first and second assemblies so that the input ends of each pump shaft are directed in the same direction.

14 Claims, 99 Drawing Sheets

(a)

(b)

(a)

(b)

(a)

(b)

(a)

(b)

HYDRAULIC PUMP UNIT, HYDRAULIC PUMP SET, AND WORKING VEHICLE

BACKGROUND OF THE INVENTION

1. Field of the Invention

The present invention relates to a working vehicle comprising a pair of hydraulic pump units being separate to each other, a hydraulic pump set comprising a pair of hydraulic pump units arranged apart from each other, a hydraulic pump unit fluidly connected to a hydraulic actuator such as a hydraulic motor unit arranged spaced apart, and a hydraulic pump unit comprising a pump body and an auxiliary pump body driven by a pump shaft.

2. Related Art

There has been conventionally known to arrange an HST formed by a hydraulic pump unit and a hydraulic motor unit for each pair of driving wheels to independently speed-change drive each of the pair of driving wheels.

Particularly, in a working vehicle such as a riding mower tractor capable of performing zero turn, requiring a space between a pair of driving wheels in order to stabilize a vehicle position during turning, there has been proposed a configuration that first and second hydraulic motor units are distributed and arranged in the width direction of the vehicle so as to be positioned in the vicinity of the corresponding driving wheel (see, for example, U.S. Pat. No. 6,332,393, hereinafter referred to as a cited reference).

In the vehicle disclosed in the cited reference, first and second hydraulic pump units that form HSTs in cooperation with the first and second hydraulic motor units respectively, are independently attached to a vehicle frame.

Specifically, each of the first and second hydraulic pump units forms an independent unit with respect to the corresponding hydraulic motor units, and the first and second hydraulic pump units are arranged at an arbitrary position spaced apart from the first and second hydraulic motor units. The space between the first and second hydraulic pump units is utilized as a space for accommodating vehicle-mounted-components such as an oil tank and a battery.

As mentioned above, the degree of freedom of design of the vehicle can be improved by arranging the first and second hydraulic pump units independently. However, the conventional configuration does not sufficiently take into consideration an aspect of maximally utilizing the free space between the first and second hydraulic pump units.

That is, a drain port for returning a drain oil to an oil tank, and a charge suction port for sucking a charge oil from the oil tank must be provided in each of the first and second hydraulic pump units.

Therefore, in order to maximally utilize the free space between the first and second hydraulic pump units, conduits for such ports must be considered. However, in the conventional configuration, this aspect is not taken into consideration.

A first aspect of the present invention, in view of the conventional art, aims to provide a working vehicle in which first and second hydraulic pump units are distributed and arranged in the width direction of the vehicle and which is configured to effectively utilize a space between the first and second hydraulic pump units.

Further, there has been conventionally known to form a pair of HSTs by fluidly connecting between a pair of hydraulic pump units arranged apart from each other and a pair of driven side actuators such as hydraulic motor units arranged apart from each other.

This configuration is particularly effective in a working vehicle in which a space must be formed between a pair of driving wheels, like a center discharge-type mower tractor.

That is, in the working vehicle, by arranging a pair of hydraulic pump units spaced apart along the width direction of the vehicle and, also, arranging a pair of hydraulic motor units spaced apart along the width direction of the vehicle, a free space can be secured at the center in the width direction of the vehicle without enlarging the vehicle width.

Each of the pair of hydraulic pump units comprises a pump shaft operatively connected to a driving source, a pump body driven by the pump shaft, a port block supporting the pump body and formed with a supply/discharge oil passage for the pump body, and a pump case removably connected to the port block so as to accommodate the pump body.

For instance, the following proposals have been made in the cited reference in an aim to have the components of the pair of hydraulic pump units common.

That is, in the hydraulic pump unit disclosed in the cited reference, the port block is connectable to the pump case in both a state where the pump case is positioned at a first position about the pump shaft and a state where the pump case is positioned at a second position rotated by 180 degrees about the pump shaft from the first position.

The port block has an operating oil port provided on a first side in the front-to-rear direction of the vehicle and a drain port provided on both sides in the width direction of the vehicle.

Of the pair of port blocks in one port block connected to the pump case positioned at the first position, the drain port on one side in the width direction of the vehicle is closed by a plug. On the other hand, in the other port block, the drain port on the other side in the width direction of the vehicle is closed by the plug.

The pair of hydraulic pump units disclosed in the cited reference allow the components to be common and direct both drain ports toward the outside in the width direction of the vehicle, but have the following disadvantages.

That is, the port block and the pump case are connected by way of a connecting hole arranged on the same radius about the pump shaft.

In this configuration, there arises a possibility that both of the pair of pump cases connect to the corresponding port block at the first position during the assembling work of the hydraulic pump units.

Particularly, the hydraulic pump unit is assembled by a hydraulic equipment manufacturer and, then, is shipped to a vehicle manufacturer after being subjected to various adjustment works.

That is, in the hydraulic manufacturer, the hydraulic pump unit is not actually attached to the vehicle frame, but the port block and the pump case are assembled.

Therefore, the aforementioned assembling error likely occurs, and attention must be given to such assembly error thereby worsening the assembling work efficiency.

A second aspect of the present invention, in view of the conventional art, aims to provide a hydraulic pump set which comprises a pair of hydraulic pump units separate with respect to each other and which can prevent the assembling error while having the components as common as possible.

The second aspect of the present invention also aims to provide a hydraulic pump unit capable of changing the direction of an operating oil port without changing the relative position of a port block and a pump case.

Further, there has been utilized in various devices such as a working vehicle to arrange a hydraulic actuator such as a hydraulic motor and a hydraulic pump unit fluidly connected to the hydraulic actuator spaced apart from each other (see, for example, the cited reference).

This configuration is particularly effective in a working vehicle in which a space must be formed between a pair of driving wheels in order to stabilize the vehicle position during turn, such as a riding mower tractor capable of performing zero turn.

A device provided with the above hydraulic pump unit requires a configuration for replenishing an operating oil flowing between the hydraulic pump unit and the hydraulic actuator and, also, storing a drain oil from the hydraulic pump unit.

Regarding the above, the cited reference discloses an oil tank attached to a vehicle frame independent from the hydraulic pump unit.

However, the configuration disclosed in the cited reference requires the installation work of the oil tank aside from the installation work of the hydraulic pump unit, and the hydraulic pump unit and the oil tank must be connected with conduits after being installed; thus, there arises a disadvantage in terms of installation workability of the entire hydraulic pump unit.

A third aspect of the present invention, in view of the conventional art, aims to provide a hydraulic pump unit which comprises an oil tank for storing a drain oil from a pump body and acting as a charge oil source for the pump body, and is capable of eliminating the conduit connecting work and improving the installation working efficiency of the entire hydraulic pump unit including the oil tank.

As mentioned above, in the vehicle disclosed in the cited reference, the first and second hydraulic pump units in the pair of HSTs are arranged independently with respect to the corresponding hydraulic motor unit to improve the degree of freedom of design of the vehicle. However, a sufficient consideration is not made to replenishing the pressure oil to the pair of HSTs.

That is, in the conventional configuration, a dedicated charge pump unit is provided to each of the pair of hydraulic pump units.

With the above configuration, the charge pump unit itself must be prepared in pairs, and a hydraulic circuit such as a relief valve for setting the oil pressure of each charge line must also be prepared in pairs.

A fourth aspect of the invention, in view of the conventional art, aims to provide a hydraulic pump set which comprises first and second hydraulic pump units arranged apart from each other, and is capable of efficiently performing the replenishing of a pressure oil to the first and second hydraulic pump units at a low cost.

The fourth aspect of the present invention also aims to provide a hydraulic pump unit which efficiently performs the replenishing of a pressure oil to oneself in addition to supply of an operating oil to an external hydraulic device.

In the vehicle disclosed in the cited reference, the first and second hydraulic pump units configuring a pair of HSTs in cooperation with the first and second hydraulic motor units are independently attached to the vehicle frame.

Specifically, the first and second hydraulic pump units independently form a unit, and the first and second hydraulic pump unit are arranged at an arbitrary position spaced apart from the first and second hydraulic motor units.

The conventional configuration enables to improve the degree of freedom of the vehicle by independently arranging the first and second hydraulic pump units; however, a sufficient consideration is not made other than replenishing the pressure oil to the HST.

That is, in the working vehicle such as a mower tractor, various external hydraulic devices such as a hydraulic lift device is annexed. However, in the conventional configuration, only the charge pump unit is arranged in each of the pair of hydraulic pump units, and supplying the operating oil to the external hydraulic device is not considered.

A fifth aspect of the present invention, in view of the conventional art, aims to provide a hydraulic pump set which comprises first and second hydraulic pump units arranged apart from each other, and is capable of efficiently performing replenishing of a pressure oil to the first and second hydraulic pump units and, also, efficiently performing supply of an operating oil to an external hydraulic device.

The fifth aspect of the present invention also aims to provide a hydraulic pump set which can efficiently perform the replenishing of the pressure oil to oneself in addition to supply of the operating oil to the external hydraulic device.

As mentioned above, the cited reference discloses a configuration that the hydraulic actuator such as a hydraulic motor and the hydraulic pump unit fluidly connected to the hydraulic actuator are arranged apart from each other.

Specifically, the cited reference discloses, as one example of the independent-type hydraulic pump unit, a hydraulic pump unit comprising a pump shaft operatively connected to a driving source, a pump body rotatably driven by the pump shaft, a pump case for accommodating the pump body, a port block connected to the pump case while supporting the pump body, and an auxiliary pump body driven by the pump shaft.

The conventional hydraulic pump unit eliminates an additional transmission mechanism from the driving source to the auxiliary pump body by being configured so as to rotatably drive the auxiliary pump body using the pump shaft rotatably driving the pump body, but still needs improvement in the following points.

That is, the conventional hydraulic pump unit has an operating oil port serving as an operating fluid connecting port to the actuator, a suction port serving as a fluid draw-in port to the auxiliary pump body, and a drain port for drawing out the drain oil from the pump body, which are all formed in the port block.

Therefore, the oil passage configuration in the port block is complicated.

A sixth aspect of the present invention, in view of the conventional art, aims to provide a hydraulic pump unit which comprises a pump body and an auxiliary pump body driven by the pump shaft, and is capable of satisfactorily forming a fluid connecting port to the outside.

SUMMARY OF THE INVENTION

According to the first aspect of the present invention, there is provided a working vehicle having first and second hydraulic pump units operatively driven by a driving source and arranged away to each other in a width direction of the vehicle.

In the working vehicle, each of the first and second hydraulic pump units includes a pump body; a port block formed with an oil passage for supplying/discharging an operating fluid to/from said pump body; a pump case connected to the port block so as to define a pump body accommodating space for surrounding the pump body; and a pump shaft for rotatably driving the pump body, the pump shaft having an input end operatively connected to said driving source.

A drain port for opening the pump body accommodating space outward and a charge suction port for drawing in an oil from an oil tank in order to supply a charge oil to a hydraulic circuit fluidly connecting with the corresponding hydraulic motor unit are provided respectively in first and second assemblies formed by the corresponding pump case and port block.

The drain port is provided on a wall surface other than an opposing wall surface facing each other of the wall surfaces of said first and second assemblies when arranging the first and second assemblies so that the input ends of each pump shaft are directed in the same direction.

According to the above configuration, in the working vehicle having the first and second hydraulic pump unit distributed and arranged in the width direction of the vehicle, the drain ports of the first and second hydraulic pump units are arranged on the wall surface other than the opposing surface facing each other; thus, the free space between the first and second hydraulic pump units can be effectively used.

Particularly, in the case of arranging the oil tank between the pump units, a conduit for fluidly connecting between the drain port and the oil tank can be satisfactorily arranged.

Preferably, the charge suction port is provided on the wall surface other than the opposing wall surface facing each other of the wall surfaces of the first and second assemblies when arranging the first and second assemblies so that the input ends of each pump shaft are directed in the same direction.

Preferably, the drain port is provided on a wall surface other than the wall surface where the input end of the pump shaft is positioned of the wall surfaces of said corresponding assembly.

In the various configurations, in a case of that each of the first and second hydraulic pump units is of a variable displacement type including a control shaft for changing suction/discharge rates of the pump body, preferably, each control shaft extends outward from the wall surface on the opposite side of the opposing wall surface of the wall surfaces of the corresponding assembly.

According to this configuration, the interference between the conduit connected to the drain port and the link mechanism connected to the control shaft can be effectively prevented.

More preferably, the drain port is provided on the wall surface other than the wall surface where the control shaft is positioned of the wall surfaces of the corresponding assembly.

Further, if the drain port is provided at the wall surface other than the wall surface provided with the operating oil port, the interference between the operating oil conduit connected to the operating oil port and the drain conduit connected to the drain port can be effectively prevented.

More preferably, the drain port and the charge suction port are provided on the same wall surface of the corresponding assembly.

For example, the drain port may be provided in the pump case.

In the various configurations, for example, the charge suction port is provided in the port block.

Alternatively, in a case that at least one of the first and second hydraulic pump units has a charge pump unit including a charge pump body driven by the pump shaft, and a charge pump case connected to the pump case or the port block so as to surround the charge pump body, the charge pump case configuring the assembly along with the pump case and the port block, the hydraulic pump unit including the charge pump unit has the charge suction port provided in the charge pump case.

Preferably, the hydraulic pump unit including the charge pump unit also has the drain port provided in the charge pump case.

In the various configurations, the oil tank fluidly connected with the drain port and the charge suction port may be arranged between the opposing wall surfaces of the first and second assemblies.

The first aspect of the present invention further provides a working vehicle having first and second hydraulic pump units arranged away from each other in a width direction of the vehicle.

In the working vehicle, each of the first and second hydraulic pump units includes a drain port on a wall surface other than the opposing surface facing each other.

Preferably, each of the first and second hydraulic pump units includes a charge suction port on a wall surface other than the opposing surface.

In a case that each of the first and second hydraulic pump units is of a variable displacement type including a control shaft, the control shaft may extend toward an outside in the width direction of the vehicle from the wall surface on the opposite side of the opposing surfaces of the first and second hydraulic pump units, and the drain port is provided on the wall surface facing a front-to-rear of the vehicle.

Preferably, each of the first and second hydraulic pump units has the charge suction port and the drain port provided on the wall surface facing one side in the front-to-rear direction of the vehicle, and an operating oil port provided on the wall surface facing the other side in the front-to-rear of the vehicle.

According to the second aspect of the present invention, there is provided a hydraulic pump set that includes first and second hydraulic pump units operatively driven by a driving source and arranged approximately symmetrical with respect to each other with a reference plane interposed therebetween.

The hydraulic pump set includes a pair of common pump bodies; first and second port blocks capable of supporting the corresponding common pump body; first and second pump shafts each having an input end operatively connected to the driving source, the first and second pump shafts rotatably driving the corresponding common pump body; and a pair of common pump cases removably connected to the first and second port blocks, respectively, so as to accommodate the corresponding common pump body, the pair of common pump cases including an asymmetrical connected part with an axis line of the corresponding pump shaft as a reference.

The first port block of the first hydraulic pump unit includes a first connecting part capable of connecting to the connected part of the common pump case only when the common pump case is positioned at a first relative position about the pump shaft in the case of being directed in a specific direction.

The second port block of the second hydraulic pump unit includes a second connecting part capable of connecting to the connected part of the common pump case only when the common pump case is positioned at a second relative position about the pump shaft in the case of being directed in the same direction as the first port block.

In this hydraulic pump set, the first and second hydraulic pump units include a common pump body and a common pump case. Therefore, the manufacturing cost and the managing cost can be reduced.

Further, in the first and second hydraulic pump units, the disadvantage of mistaking the relative position of the port block and the pump case when connecting them can be effectively prevented; thus, the assembling work efficiency can be improved.

In a case that each of the first and second hydraulic pump units is of a variable displacement type including a control shaft and is configured so as to be arranged apart along a width direction of the vehicle, the pair of common pump cases may support the control shaft so that the corresponding control shaft projects toward one side and the other side in the width direction of the vehicle when positioned in the first relative position and the second relative position, respectively.

Preferably, the first port block includes a pair of first operating oil ports opening toward a first direction while supporting one of the pair of common pump cases at the first relative position, and the second port block includes a pair of second operating oil ports opening toward the same direction as the pair of first operating oil ports while supporting the other one of the pair of common pump cases at the second relative position.

More preferably, the first port block includes a first charge suction port opening toward a second direction opposite the first direction while supporting one of the pair of common pump cases at the first relative position, and the second port block includes a second charge suction port opening toward the same direction as the first charge suction port while supporting the other one of the pair of common pump cases at the second relative position.

Alternatively, at least one of the first and second hydraulic pump units may further include a charge pump unit driven by an end on the opposite side of the input end of the corresponding pump shaft, the charge pump unit may include a charge pump body driven by the corresponding pump shaft and a charge pump case connected to the corresponding port block so as to surround the charge pump body, and the charge pump case may include a charge suction port for receiving the charge oil for the corresponding common pump body. The charge suction port opens toward a second direction opposite to the first direction.

In the various configurations, preferably, the first port block includes a pair of first operating oil passages each having a first end opened outward to form the pair of first operating oil ports and a second end communicated to a pair of suction/discharge ports in the corresponding hydraulic pump body, the second port block includes a pair of second operating oil passages each having a first end opened outward to form the pair of second operating oil ports and a second end communicated to a pair of suction/discharge ports in the corresponding hydraulic pump body. Each of the pair of first operating oil passages extends in a direction orthogonal to the corresponding control shaft and is arranged so as to have the corresponding pump shaft therebetween, and each of the pair of second operating oil passages extends in a direction orthogonal to the corresponding control shaft and is arranged so as to have the corresponding pump shaft therebetween.

More preferably, the pair of first operating oil passages and the pair of second operating oil passages have respective second ends extending toward the opposite side of the operating oil port with the corresponding pump shaft as a reference. Each of the first and second port blocks includes an oil passage for communicating between the corresponding operating oil passages, the oil passage forming a part of the charge oil passage, and a bypass oil passage for communicating between the corresponding operating oil passages. The oil passage and the bypass oil passage are distributed and arranged with the corresponding pump shaft interposed therebetween.

In the various configurations, the first and second pump shafts may have the same configuration.

Further the second aspect of the present invention provides a hydraulic pump unit operatively driven by a driving source.

The hydraulic pump unit includes a pump body; a port block capable of supporting the pump body; a pump case removably connected to the port block so as to accommodate the pump body; a pump shaft having an input end operatively connected to the driving source, the pump shaft rotatably driving the pump body; and a control shaft supported by the pump case so as to externally operate suction/discharge rates of the pump body.

The port block includes a pair of operating oil passages extending in a direction orthogonal to the control shaft in the state of being connected with the pump case. Each of the pair of operating oil passages has both ends opening outward and arranged away from each other with the pump shaft interposed therebetween.

According to this hydraulic pump unit, the relative position of the pair of operating oil passages and the control shaft is the same even when the assembly, configured by connecting the port block and the pump case, is rotated by 180 degrees about the pump shaft.

That is, by simply preparing a pair of hydraulic pump units of the same components and by connecting the same components with the same relative position, the control shaft and the operating port at one of the hydraulic pump units, and the control shaft and the operating oil port at the other hydraulic unit could be directed in the same direction.

Therefore, upon using the hydraulic pump set equipped with a pair of hydraulic pump units, the cost can be reduced by having the components common, while preventing the erroneous assembling of the port block and the pump case.

Preferably, the port block includes an oil passage for communicating between the pair of operating oil passages, the oil passage forming a part of the charge oil passage, and a bypass oil passage for communicating between the pair of operating oil passages. The oil passage and the bypass oil pass are arranged away from each other with the pump shaft interposed therebetween.

According to the third aspect of the present invention, there is provided a hydraulic pump unit operatively driven by a driving source and fluidly connected to a hydraulic actuator arranged apart away therefrom.

The hydraulic pump unit includes a pump shaft operatively connected to the driving source; a pump body driven by the pump shaft; a port block formed with an operating oil passage for supplying/discharging an operating oil to/from the pump body; a pump case connected to the port block so as to define an internal space for accommodating the pump body; and an oil tank for storing a drain oil from the pump body and acting as a charge oil source for the pump body.

The oil tank is supported by an assembly formed by the port block and the pump case.

According to this hydraulic pump unit, the oil tank is supported by the assembly configured by connecting the pump case and the port block; therefore, the installation work of the hydraulic pump unit including the oil tank can be carried out by simply attaching the assembly to the vehicle frame.

Particularly, in the present invention, the assembly and the oil tank are fluidly connected to each other in advance; therefore, the installation work of the hydraulic pump unit including the conduit connecting work can be extremely facilitated in comparison with the conventional configuration that an assembly of the pump case and the port block, and the oil tank are attached independently to the vehicles frame, and then they are fluidly connected to each other.

In one example, the assembly includes a draw-in port leading to the operating oil passage and a draw-out port leading to the internal space. In this configuration, the oil tank includes an inlet port and an outlet port, and the inlet port and the outlet port are fluidly connected to the draw-out port and the draw-in port, respectively, by way of a conduit.

Preferably, the oil tank is supported at the assembly by the conduit.

In another example, one of the inlet port and the outlet port is directly connected to the corresponding draw-out port or draw-in port by way of a joint member, and the other one of the inlet port or the outlet port is fluidly connected to the corresponding draw-out port or draw-out port by way of a conduit.

Preferably, the oil tank is supported at the assembly by the joint member.

In the various configurations, a heat releasing fin may be provided on at least one of the outer walls of the conduit or the pump case.

In the above various configurations, the hydraulic pump unit may further include a filter arranged in the oil tank so as to surround an internal end opening of the outlet port.

Preferably, the oil tank may include a tank body formed with an access opening through which the filter can be inserted, the outlet port and the inlet port, and a lid removably connected to the tank body so as to liquid-tightly close the access opening.

More preferably, the access opening is formed so as to face the internal end opening of the outlet port, and the filter is configured to be held by a peripheral wall formed with the internal end opening of the outlet port and the lid connected to the tank body.

In the above various configurations, the hydraulic pump unit may further include an auxiliary pump body driven by the pump shaft; and an auxiliary pump case connected to the port block so as to surround the auxiliary pump body, the auxiliary pump case forming the assembly along with the port block and the pump case. The draw-in port is formed in the auxiliary pump case.

In still another example, the assembly may include an external port for opening the internal space outward, and an internal port for communicating the internal space to the operating oil passage of the port block. The oil tank may include a single port fluidly connected to the external port.

Preferably, the single port is directly connected to the external port by way of a joint member, and the oil tank is supported at the assembly by way of the joint member.

In place of or in addition to this configuration, a filter arranged in the internal space so as to surround the internal port may be provided.

In the above various configurations, the hydraulic pump unit may further include an attachment member connected to the assembly. The attachment member is configured to be capable of supporting the oil tank.

According to the fourth aspect of the present invention, there is provided a hydraulic pump set including first and second hydraulic pump units operatively driven by a driving source and arranged apart from each other.

Each of the first and second hydraulic pump units includes a pump body, a port block formed with an operating oil passage for supplying/discharging an operating fluid to/from the pump body, a pump case connected to the port block so as to liquid-tightly accommodate the pump body, and a pump shaft having a first end operatively connecting to the driving source, the pump shaft rotatably driving the pump body.

One of the first and second hydraulic pump units has an auxiliary pump unit including an auxiliary pump body operatively driven by the driving source. The auxiliary pump unit is configured to supply charge oil to both the first and second hydraulic pump units.

According to this configuration, the manufacturing cost and the assembling cost can be reduced.

In one example, the auxiliary pump unit may be configured so as to supply only the charge oil to the first and second hydraulic pump units.

Preferably, the auxiliary pump body is driven by the pump shaft of one of the hydraulic pump units.

In the above various configurations, first and second discharge ports leading to a discharge line of the auxiliary pump body are formed in the auxiliary pump unit, and the first and second discharge ports are fluidly connected to the operating oil passage in one of the hydraulic pump units and the operating oil passage in the other one of said hydraulic pump units, respectively.

In another example, the auxiliary pump unit can supply the operating oil to an external hydraulic device and, also, can supply a return oil from the external hydraulic device as the charge oil to the first and second hydraulic pump units.

According to this configuration, the pressure oil discharged by the auxiliary pump unit can be efficiently used.

In the another example, the auxiliary pump body may be driven by the pump shaft in one of the hydraulic pump units.

In addition to or in place of this configuration, the auxiliary pump unit is formed with an output port leading to a discharge line of the auxiliary pump body; the output port drawing out the operating oil for the external hydraulic device; a return line capable of receiving the return oil from the external hydraulic device; and first and second discharge ports leading to the return line. The first and second discharge ports are fluidly connected to the operating oil passage in one of the hydraulic pump units and the operating oil passage in the other one of the hydraulic pump units, respectively.

Preferably, the auxiliary pump unit includes a switching member capable of selectively taking an external hydraulic device operating position for fluidly connecting the output port to the external hydraulic device and an external hydraulic device stop position for fluidly connecting the output port to the return line.

In the above various configurations, the hydraulic pump set may further include a cooling fan driven by the pump shaft that does not drive the auxiliary pump body of the pump shafts of the first and second hydraulic pump units.

The fourth aspect of the present invention further provides a hydraulic pump unit operatively driven by a driving source.

The hydraulic pump unit includes a pump body; a port block formed with an operating oil passage for supplying/discharging an operating fluid to/from the pump body; a pump case connected to the port block so as to liquid-tightly accommodate the pump body; a pump shaft having a first end operatively connecting to the driving source, the pump shaft rotatably driving the pump body; and an auxiliary pump unit having an auxiliary pump body driven by the pump shaft, the auxiliary pump unit capable of supplying an operating oil to an external hydraulic device.

The auxiliary pump unit includes an output port leading to a discharge line of the auxiliary pump body; the output port drawing out the operating oil for the external hydraulic device, a return line for flowing a return oil from the external hydraulic device; and a switching member selectively taking an external hydraulic device operating position for connecting the output port to the external hydraulic device and an external hydraulic device stop position for connecting the output port to the return line.

According to this configuration, the charge oil can be obtained irrespective of the presence/absence of the external hydraulic device and irrespective of the operating state of the external hydraulic device, and the discharge oil from the auxiliary pump body can be efficiently used.

Preferably, first and second discharge ports leading to the return line are provided in the auxiliary pump unit. The first discharge port is fluidly connected to the operating oil passage. The second discharge port can output the fluid flowing through the return line outward.

According to the fifth aspect of the present invention, there is provided a hydraulic pump set that includes first and second hydraulic pump units operatively driven by a driving source and arranged apart from each other.

In the hydraulic pump set, each of the first and second hydraulic pump units includes a pump body; a port block formed with an operating oil passage for supplying/discharging an operating fluid to/from the pump body; a pump case connected to the port block so as to liquid-tightly accommodate the pump body; and a pump shaft having a first end operatively connected to the driving source, the pump shaft rotatably driving the pump body.

One of the first and second hydraulic pump units further includes an auxiliary pump body driven by the corresponding pump shaft. The auxiliary pump body supplies operating oil to the external hydraulic device.

The other one of the first and second hydraulic pump units further includes a charge pump body driven by the corresponding pump shaft. The charge pump body is capable of supplying charge oil to the other hydraulic pump unit.

According to this configuration, both the operating oil of the external hydraulic device and the charge oil of the hydraulic pump unit can be efficiently obtained.

In one example, the one hydraulic pump unit includes a return line for flowing return oil from the external hydraulic device and a discharge port leading to the return line. The discharge port is fluidly connected to the operating oil passage of the one hydraulic pump unit.

Preferably, the one hydraulic pump unit further includes an auxiliary pump case connected to the corresponding port block so as to surround said auxiliary pump body, and the return line and the discharge port are provided in the auxiliary pump case.

In another example, first and second discharge ports leading to a discharge line of the charge pump body are formed in the other hydraulic pump unit. The second discharge port is fluidly connected to the operating oil passage in the other hydraulic pump unit. The first discharge port is fluidly connected to the operating oil passage in the one hydraulic pump unit.

Preferably, the other hydraulic pump unit further includes a charge pump case connected to the corresponding port block so as to surround the charge pump body. The first and second discharge ports are provided in the charge pump case. The second discharge port is opened at a surface which is brought into contact with the corresponding port block, and the first discharge port is opened at one side face of the charge pump case.

The fifth aspect of the present invention further provides a hydraulic pump set including first and second hydraulic pump units operatively driven by a driving source and arranged apart from each other.

In the hydraulic pump set, each of the first and second hydraulic pump units includes a pump body; a port block formed with an operating oil passage for supplying/discharging an operating fluid to/from the pump body; a pump case connected to the port block so as to liquid-tightly accommodate the pump body; a pump shaft having a first end operatively connected to said driving source, the pump shaft rotatably driving the pump body; and a charge pump body driven by the pump shaft; the charge pump body supplying a charge oil to the corresponding operating oil passage.

One of the first and second hydraulic pump units further includes an auxiliary pump body arranged in a tandem form with the corresponding charge pump body so as to be driven by the corresponding pump shaft. The auxiliary pump body supplies operating oil to the external hydraulic device.

According to this configuration, both the operating oil of the external hydraulic device and the charge oil of the hydraulic pump unit can be efficiently obtained.

In one example, one of the hydraulic pump units includes a single suction port common for both the corresponding charge pump body and the auxiliary pump body.

Preferably, the one hydraulic pump unit further includes a charge pump case connected to the corresponding port block so as to surround the charge pump body, and an auxiliary pump case connected to the charge pump case so as to surround the auxiliary pump body. The single suction port is provided in the auxiliary pump case.

In another example, the one hydraulic pump unit includes a first suction port leading to a suction line of the corresponding charge pump body and a second suction port leading to a suction line of the auxiliary pump body.

The fifth aspect of the present invention further provides a hydraulic pump unit operatively driven by a driving source and including a pump body; a port block formed with an operating oil passage for supplying/discharging an operating fluid to/from the pump body; a pump case connected to the port block so as to liquid-tightly accommodate the pump body; a pump shaft having a first end operatively connected to the driving source, the pump shaft rotatably driving the pump body; a charge pump body driven by the pump shaft, the charge pump body supplying a charge oil to the operating oil passage; an auxiliary pump unit including an auxiliary pump body driven by the pump shaft, the auxiliary pump body supplying an operating oil to an external hydraulic device.

The auxiliary pump unit is provided with an output port leading to a discharge line for the auxiliary pump body, the output port drawing out the operating oil of the external hydraulic device; a return line for flowing a return oil from the external hydraulic device; and a switching member capable of selectively taking an external hydraulic device operating position for connecting the output port to the external hydraulic device and an external hydraulic device stop position for connecting the output port to the return line.

According to this configuration, the pressure oil can be supplied to the return line irrespective of the presence/absence of the external hydraulic device and irrespective of the operating state of the external device.

The pressure oil in the return line can be used as the charge oil of another hydraulic pump unit and/or the operating oil of another hydraulic device, if desired.

For example, a discharge port leading to the return line is provided in the auxiliary pump unit, and the discharge port is fluidly connected to the operating oil passage.

Alternatively, an output port leading to the return line is provided in the auxiliary pump unit, and pressure oil can be drawn out through the output port.

Still alternatively, first and second discharge ports leading to the return line are provided in the auxiliary pump unit, and the first discharge port is fluidly connected to the operating oil passage and the second discharge port can discharge the pressure oil outward.

According to the sixth aspect of the present invention, there is provides a hydraulic pump unit including a pump shaft operatively driven by a driving source; a pump body rotatably driven by the pump shaft; a port block for supporting the pump body in a freely rotating manner; a pump case connected to the port block so as to define a pump body accommodating space for surrounding the pump body; an auxiliary pump body rotatably driven by the pump shaft; and an auxiliary pump case connected to the port block so as to surround the auxiliary pump body.

An operating oil port leading to the pump body is provided in the port block, and a suction port leading to a suction part of the auxiliary pump body is provided in the auxiliary pump case.

According to this configuration, the operating oil port serving as a fluid connecting port to the hydraulic actuator is provided in the port block, and the suction port serving as a charge oil draw-in port is provided in the auxiliary pump case so as to communicate with the suction part of the auxiliary pump body; thus, these ports can be satisfactorily arranged.

In one example, a drain port for opening the pump body accommodating space outward is provided in the auxiliary pump case.

Preferably, the auxiliary pump case includes an auxiliary pump case-side drain oil passage having a first end opened at an external surface so as to form the drain port and a second end opened at a surface which is brought into contact with the port block. The port block includes a port block-side drain oil passage having a first end opened at a surface, which is brought into contact with the auxiliary pump case, so as to fluidly connect to the second end of the auxiliary pump case-side drain oil passage and a second end opened to the pump body accommodating space.

In another example, a drain port for opening the pump body accommodating space outward is provided in the pump case.

Preferably, the pump case includes an end wall for supporting the pump shaft and a peripheral wall extending from the end wall in an axis line direction of the pump shaft. At least two through holes opened in different directions are formed in the peripheral wall, and one of the through holes of the at least two through holes is used as the drain port and the remaining through holes are closed by plugs.

In the above various configurations, the auxiliary pump case may include a pair of kidney ports each fluidly connected to a suction part and a discharge part of the auxiliary pump body; and a first oil passage having a first end opened at one external surface so as to form the suction port and a second end fluidly connected to one of the pair of kidney ports. The port block includes a pair of operating oil passages fluidly connected to a suction port and a discharge port, respectively, of the pump body, the pair of operating oil passages having respective one end opened at one external surface; and a charge oil passage having a first end opened at a surface, which is brought into contact with the auxiliary pump case so as to fluidly connect to the discharge part of the auxiliary pump body to form the charge suction port and a second end communicated to each operating oil passage.

Preferably, the auxiliary pump case further includes a second oil passage having a first end opened at another external surface different from the one external surface and a second end fluidly connected to the other one of the pair of kidney ports. The auxiliary pump case is connectable to the port block at a first orientation in which the first open end of the first oil passage is directed in a first direction and a second orientation in which the first open end of the second oil passage is directed in the first direction.

For example, the first orientation and the second orientation are displaced by 180 degrees about the axis line of the pump shaft.

More preferably, the auxiliary pump case includes a first auxiliary oil passage communicated to the first oil passage; a second auxiliary oil passage communicated to the second oil passage; and a communicating oil passage for communicating between the first and second auxiliary oil passages. The first auxiliary oil passage, the communicating oil passage and the second oil passage are configured so as to form an oil pressure setting line for setting an oil pressure of a pressure oil discharged from the auxiliary pump body.

More preferably, the first or second auxiliary oil passage has both ends opened at the external surface. A relief valve is attached from one of the open ends of the first auxiliary oil passage and the second auxiliary oil passage so as to be positioned between the first auxiliary oil passage and the communicating oil passage, or between the second auxiliary oil passage and the communicating oil passage. The remaining open ends of the first auxiliary oil passage and the second auxiliary oil passage are closed by plugs.

In the above various configurations, preferably, the pair of operating oil passages has the second end opening to the other external surface on the opposite side of the one external surface, and one open end of the pair of operating oil passages forms the operating oil port and the other open end is closed by the plug.

In the above various configurations, the charge oil passage includes a common charge oil passage having a first end forming the charge suction port, and a pair of branched charge oil passages each having a first end communicated to the common charge oil passage and a second end communicated to each operating oil passage. The port block includes a bypass oil passage for communicating the pair of operating oil passages at the opposite side of the pair of branched charge oil passages with the pump shaft interposed therebetween.

Preferably, the bypass oil passage has a first end opened at the external surface, and a switching valve for selectively communicating/blocking the bypass oil passage is attachable from the open end.

BRIEF DESCRIPTION OF THE DRAWINGS

The above, and other objects, features and advantages of the present invention will become apparent from the detailed description thereof in conjunction with the accompanying drawings wherein.

FIG. 2(*b*) is a partially developed plan view of a modified working vehicle of the present invention.

FIG. 6(*b*) is a transverse cross sectional view of a port block of the second hydraulic pump unit.

FIG. 7(*b*) is a transverse cross sectional view of a charge pump case in the second hydraulic pump unit.

DETAILED DESCRIPTION OF THE PREFERRED EMBODIMENTS

Embodiment 1

A preferred embodiment of a working vehicle 1A according to the first aspect of the present invention will now be described with reference to the accompanying drawings.

Figure 1:
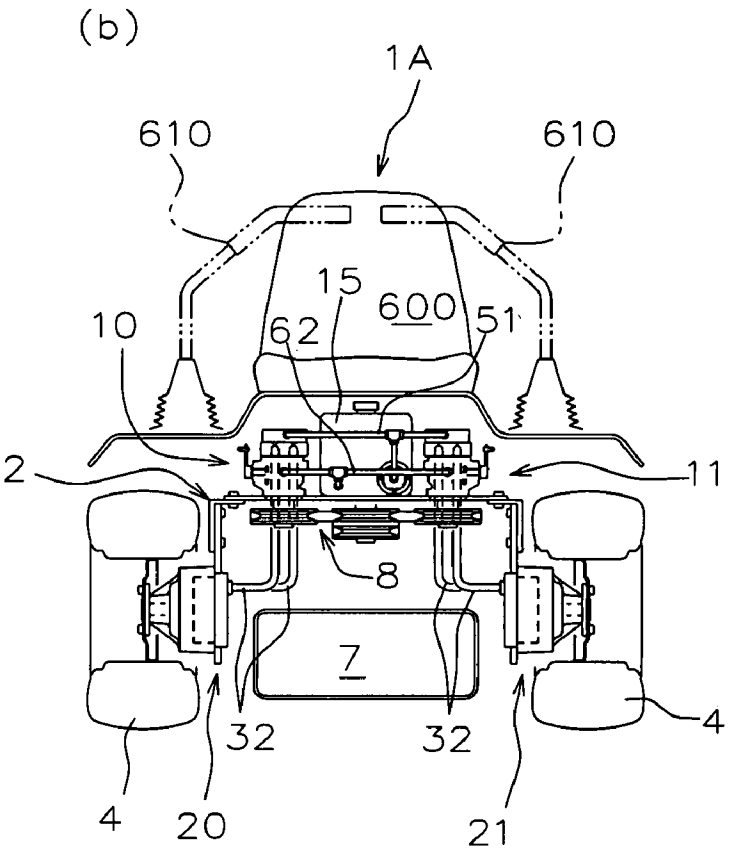
FIGS. 1(*a*) and 1(*b*) are a side view and a front view, respectively, of the working vehicle according to a first embodiment of the present invention.
Figure 1:
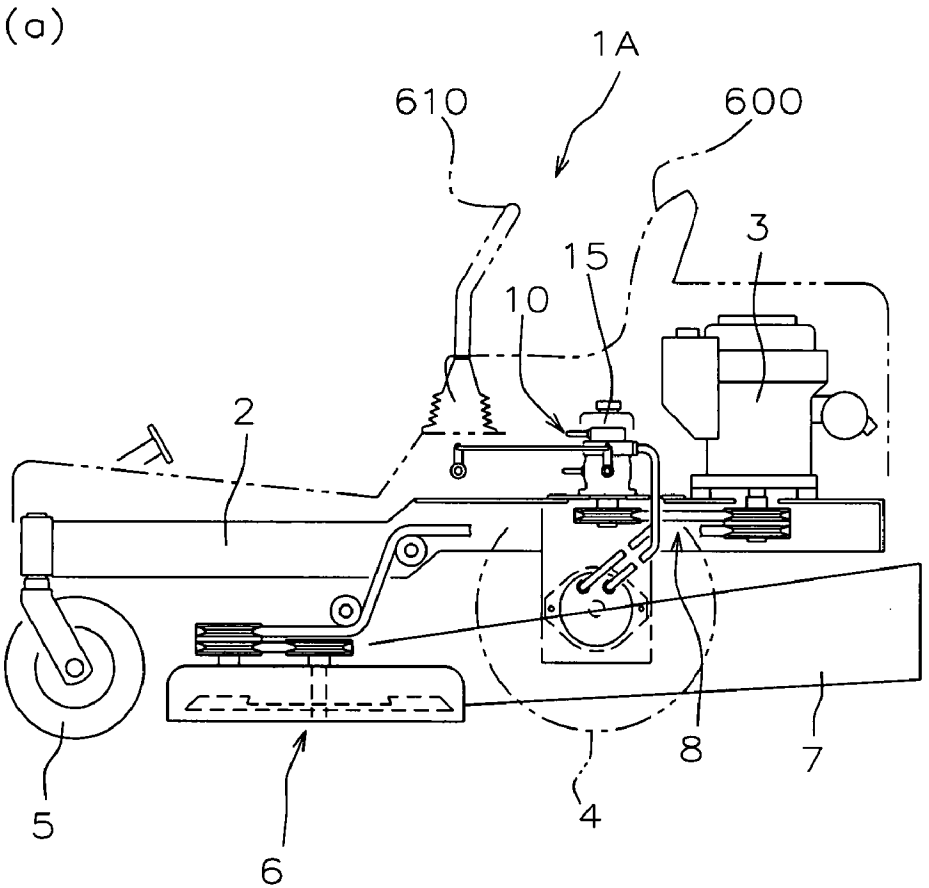
Figure 2:
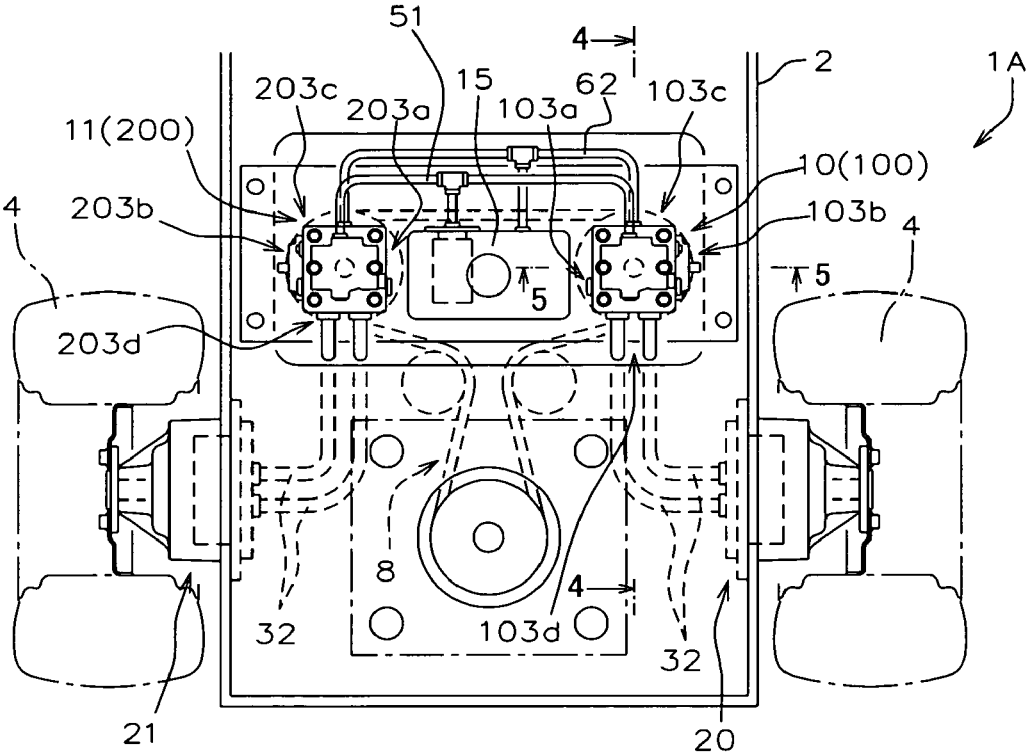
FIG. 2(*a*) is a partially developed plan view of the working vehicle of FIG. 1.
Figure 2:
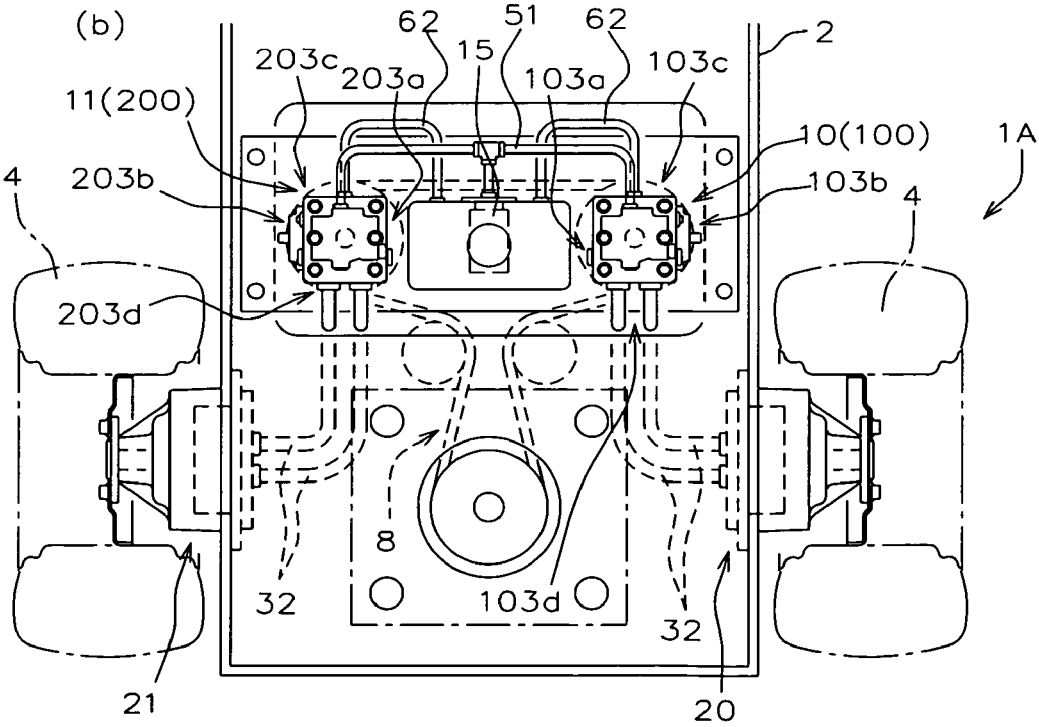

FIGS. 1(*a*) and 1(*b*) are a side view and a front view, respectively, of the working vehicle 1A according to this embodiment. FIG. 2(*a*) is a partially developed plan view of the working vehicle 1A.

As shown in FIG. 1 and FIG. 2, the working vehicle 1A is a rear discharge-type riding mower capable of performing zero turn.

Specifically, the working vehicle 1A comprises a frame 2, a driving source 3 supported by the frame 2, a pair of first and second hydraulic pump units 10, 11 arranged in the vicinity of the driving source 3 and operatively driven by the driving source 3 by way of a transmission mechanism 8, first and second hydraulic motor units 20, 21 fluidly connected with the first and second hydraulic pump units 10, 11, a pair of driving wheels 4 (rear wheel in this embodiment) driven by the first and second hydraulic motor units 20, 21, and a caster wheel 5 (front wheel in this embodiment).

In this embodiment, as shown in FIG. 1, the driving source 3 is of a vertical crankshaft type; thus, the first and second hydraulic pump units 10, 11 are arranged so that a rotating axis line of each pump shaft 110 extends along a vertical direction. However, if the driving source 3 is of a horizontal crankshaft type, the hydraulic pump units 10, 11 may be arranged so that the rotating axis line of each pump shaft 110 extends along a front-to-rear direction.

As shown in FIG. 1(*b*) and FIG. 2, the first and second hydraulic motor units 20, 21 are distributed and arranged in a width direction of the vehicle so as to define a space therebetween.

The working vehicle 1A comprises, in addition to the above configuration, a mower device 6 suspended and supported in a freely rising/lowering manner between the front and rear wheels 4, 5, and a duct 7 which is arranged in the above space and guides the mowed grass into a grass collecting bag (not shown) arranged at the rear of the vehicle body.

Further, in the working vehicle 1A, a driver's seat 600 is arranged above the center in the width direction of the frame 2 at the front of the driving source 3, and a pair of left and right steering handles 610 are arranged at the front of the driver's seat 600 in a freely forward/rearward tilting manner.

The pair of steering handles 610 are operatively connected with the first and second hydraulic pump units 10, 11 so as to operate the first and second hydraulic pump units 10, 11, and the outputs of the first and second hydraulic motor units 20, 21 fluidly connected through a pair of operating oil conduits 32 are controlled by operating the pair of steering handles 610.

Moreover, in the working vehicle 1A according to this embodiment, the first and second hydraulic pump units 10, 11 are also distributed and arranged in the width direction of the vehicle so as to define a space therebetween.

The working vehicle 1A comprises, in addition to the above configuration, an oil tank 15 arranged between the first hydraulic pump unit 10 and the second hydraulic pump unit 11.

The oil tank 15 stores drain oils of the first and second hydraulic pump units 10, 11 and, also, acts as a charge oil supply source for a pair of hydraulic lines 30, as will be described later.

Herein, a battery (not shown) for the driving source 3 is also arranged in the vicinity of the oil tank 15.

Figure 3:
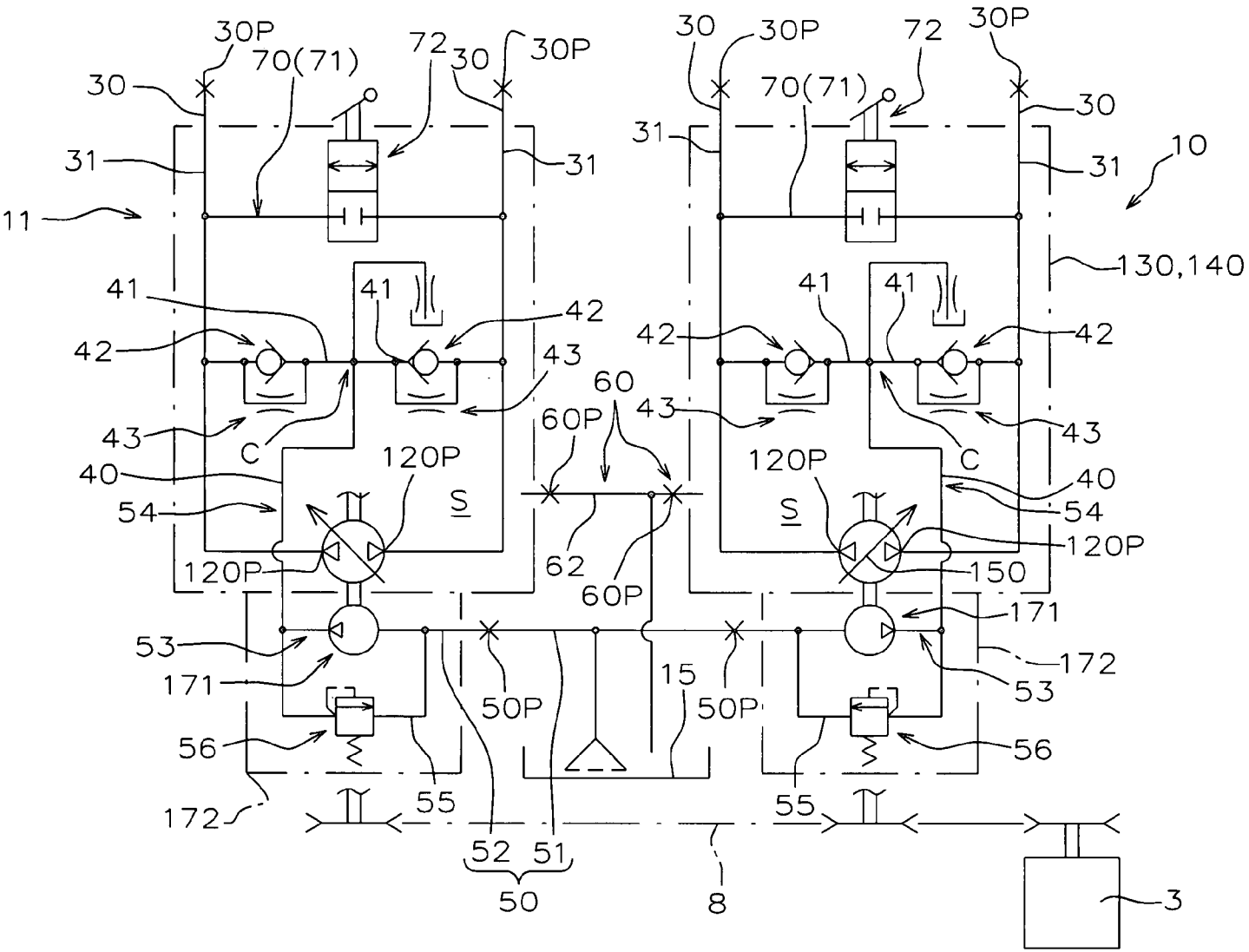
FIG. 3 is a hydraulic circuit diagram of first and second hydraulic pump units provided in the working vehicle according to the first embodiment of the present invention.

FIG. 3 shows a hydraulic circuit diagram of the first and second hydraulic pump units 10, 11.

The first hydraulic pump unit 10 is fluidly connected to the first hydraulic motor unit 20 by way of a hydraulic circuit (the pair of hydraulic lines 30 in this embodiment) so as to form a first HST in cooperation with the first hydraulic motor unit 20.

At least one of the first hydraulic pump unit 10 and the first hydraulic motor unit 20 is of a variable displacement type.

Similarly, the second hydraulic pump unit 11 is fluidly connected to the second hydraulic motor unit 21 by way of a hydraulic circuit (the pair of hydraulic lines 30 in this embodiment) so as to form a second HST in cooperation with the second hydraulic motor unit 21.

At least one of the second hydraulic pump unit 11 and the second hydraulic motor unit 21 is of a variable displacement type.

In this embodiment, the first and second hydraulic pump units 10, 11 are of a variable displacement type, and the first and second hydraulic motor units 20, 21 are of a fixed displacement type.

The configuration of the first hydraulic pump unit 10 will now be described in detail.

Herein, the second hydraulic pump unit 11 has substantially the same configuration as that of the first hydraulic pump unit 10. Therefore, in the figures, the same reference numerals as the first hydraulic pump unit 10 are denoted for the constituting members of the second hydraulic pump unit 11, and the description thereof will not be given herein.

Figure 4:
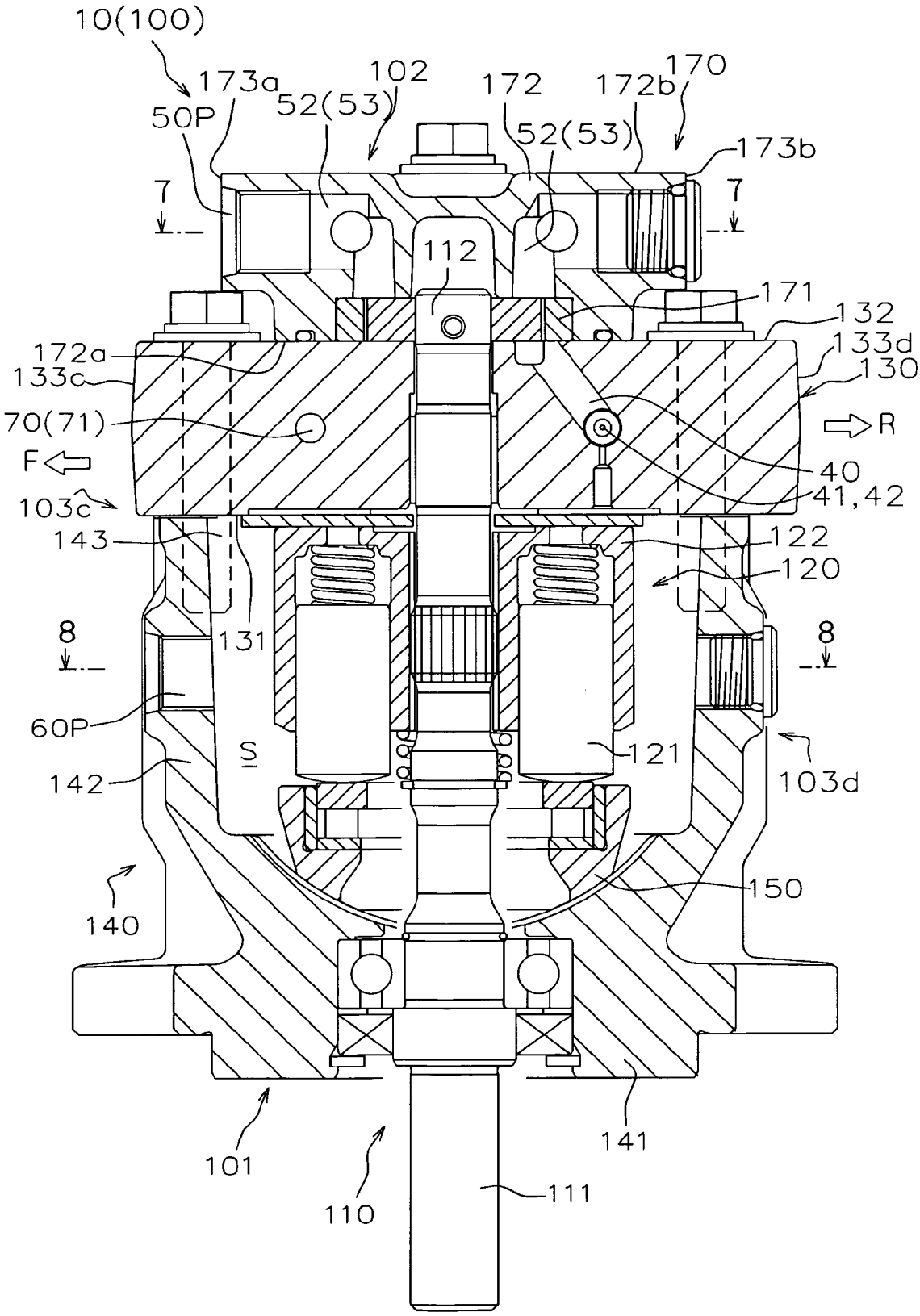
FIG. 4 is a longitudinal side view of the first hydraulic pump unit taken along line 5-5 of FIG. 2.
Figure 5:
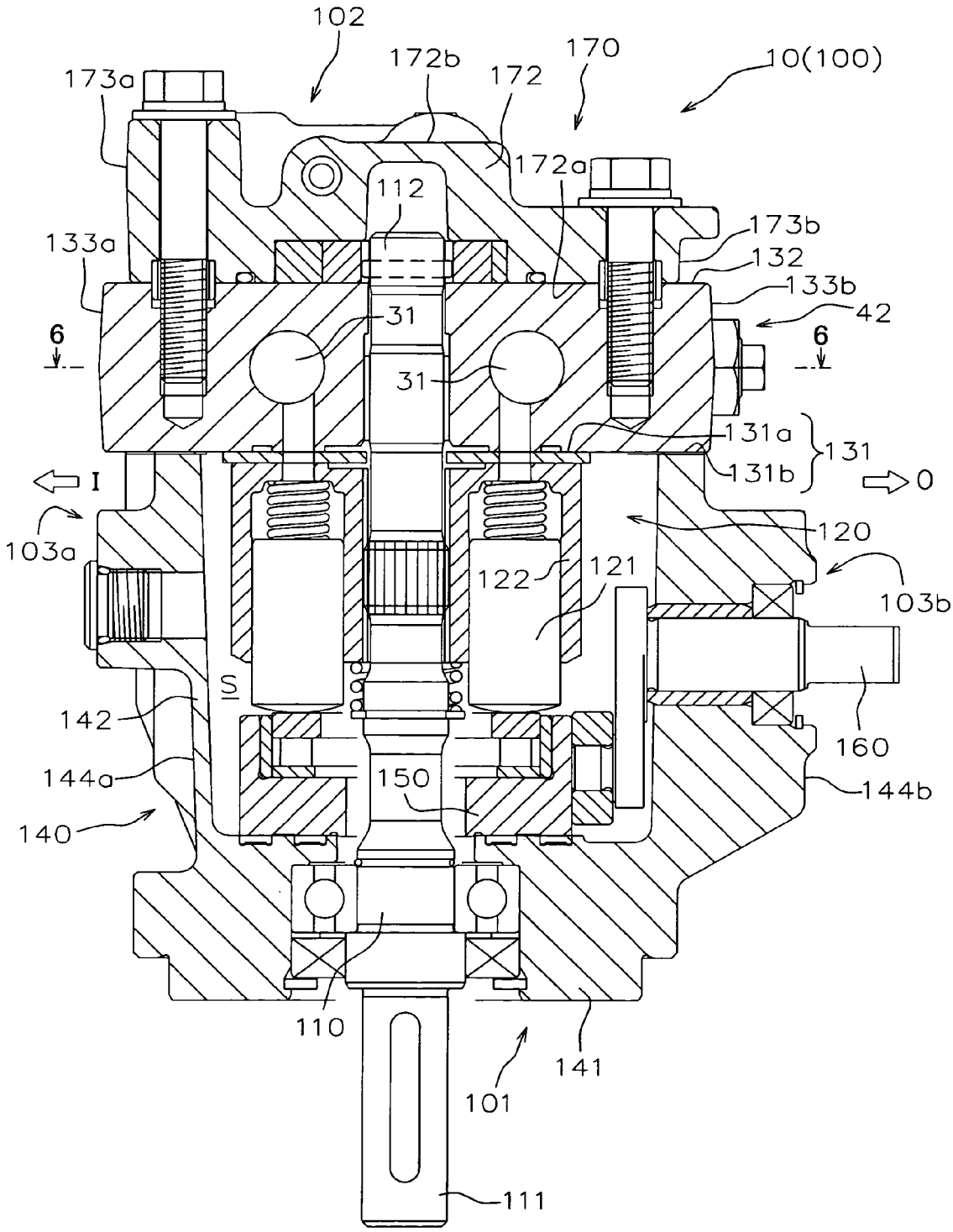
FIG. 5 is a longitudinal rear view of the first hydraulic pump unit taken along line 4-4 of FIG. 2.

FIG. 4 shows a longitudinal side view of the first hydraulic pump unit 10 taken along line 4-4 of FIG. 2. FIG. 5 shows a longitudinal rear view of the first hydraulic pump unit 10 taken along line 5-5 of FIG. 2. The symbols F and R in FIG. 4 each show the front and the rear in the longitudinal direction of the vehicle. Further, symbols O and I of FIG. 5 each show the outside and the inside in the width direction of the vehicle.

As shown in FIG. 4 and FIG. 5, the first hydraulic pump unit 10 comprises the pump shaft 110 operatively connected to the driving source 3, a pump body 120 driven by the pump shaft 110, a port block 130 formed with an oil passage for supplying/discharging the operating oil to/from the pump body 120, and a pump case 140 connected to the port block 130 so as to accommodate the pump body 120.

The pump shaft 110 is supported by an assembly, configured by connecting the pump case 140 and the port block 130, so that a first end 111 extends outward from the assembly.

In this embodiment, the first end 111 extends downward from the assembly.

The first end 111 is operatively connected to the driving source 3 by way of an appropriate transmission mechanism 8 (pulley and belt in the embodiment shown in the figures) (see FIG. 1 and FIG. 2).

In this embodiment, the pump body 120 includes a piston unit 121 for performing a reciprocating movement by the rotation of the pump shaft 110, and a cylinder block 122 for supporting the piston unit 121 in a freely reciprocating manner.

As mentioned above, each of the first and second hydraulic pump units 10, 11 is of a variable displacement type in this embodiment.

Therefore, in addition to the above configuration, each of the first and second pump units 10, 11 comprises an output adjusting member 150 for changing the suction/discharge rates of the pump body 120, and a control shaft 160 for slanting the output adjusting member 150.

In this embodiment, a movable swash plate is used for the output adjusting member 150, and a trunnion shaft is used for the control shaft 160.

In this embodiment, the control shaft 160 extends toward the outside in the width direction of the vehicle, in order to prevent interference with the oil tank 15.

The port block 130 and the pump case 140 are connected to each other to configure the assembly for accommodating the pump body 120.

Specifically, the pump case 140 has an end wall 141 positioned on a first end side in a direction of the pump shaft, and a peripheral wall 142 extending from the end wall 141 toward a second end side in an axis line direction of the pump shaft 110.

The peripheral wall 142 has an opening 143 at the second end side in the axis line direction of the pump shaft 110. The opening 143 is sized to allow the pump body 120 to be inserted thereinto.

The port block 130 is connected to the pump case 140 so as to close the opening 143 while rotatably supporting the pump body 120 in cooperation with the pump case 140.

Specifically, the port block 130 has a first end face 131 (lower surface in this embodiment) which is orthogonal to the pump shaft 110 and faces the pump case 140.

The first end face 131 includes a support region 131*a* for supporting the pump body 120 in a freely rotating manner, and a contact region 131*b* which is positioned outward in the radius direction of the support region 131*a* and is brought into contact with the pump case 140.

A pump body accommodating space S for accommodating the pump body 120 is defined when the first end face 131 of the port block 130 is brought into contact with the end face of the peripheral wall 142 of the pump case 140.

The oil passage and the port formed in the port block 130 and the pump case 140 will be described later.

As shown in FIG. 3 to FIG. 5, in this embodiment, each of the first and second hydraulic pump units 10, 11 further includes a charge pump unit 170.

The charge pump unit 170 has a charge pump body 170 driven by the corresponding pump shaft 110, and a charge pump case 172 surrounding the charge pump body 171.

In this embodiment, the charge pump unit 170 is connected to the second end face 132 (upper surface in this embodiment) on the opposite side of the first end face 131 of the port block 130.

Specifically, the pump shaft 110 has the first end 111 forming the input end, passing through the end wall 141 of the pump case 140 and extending outward, and the second end 112 passing through the port block 130 and extending outward.

The charge pump body 171 is driven by the second end 112 of the pump shaft 110.

The charge pump case 172 is connected to the second end face 132 of the port block 130 so as to surround the charge pump body 171.

The hydraulic circuit of the first hydraulic pump unit 10 will now be described.

The hydraulic circuit of the second hydraulic pump unit 11 is substantially the same as the hydraulic circuit of the first hydraulic pump unit 10. Therefore, in the figures, the same reference numerals are denoted for the same members or the corresponding members and, accordingly, the description of the hydraulic circuit of the second hydraulic pump unit 11 will not be given herein.

As shown in FIG. 3, the first hydraulic pump unit 10 includes the pair of hydraulic lines 30 fluidly connected to the corresponding first hydraulic motor unit 20, a charge line 50 having a first end communicated to the oil tank 15 and a second end communicated to each hydraulic line 30, and a drain line 60 having a first end communicated to the pump body accommodating space S and a second end communicated to the oil tank 15.

Figure 6:
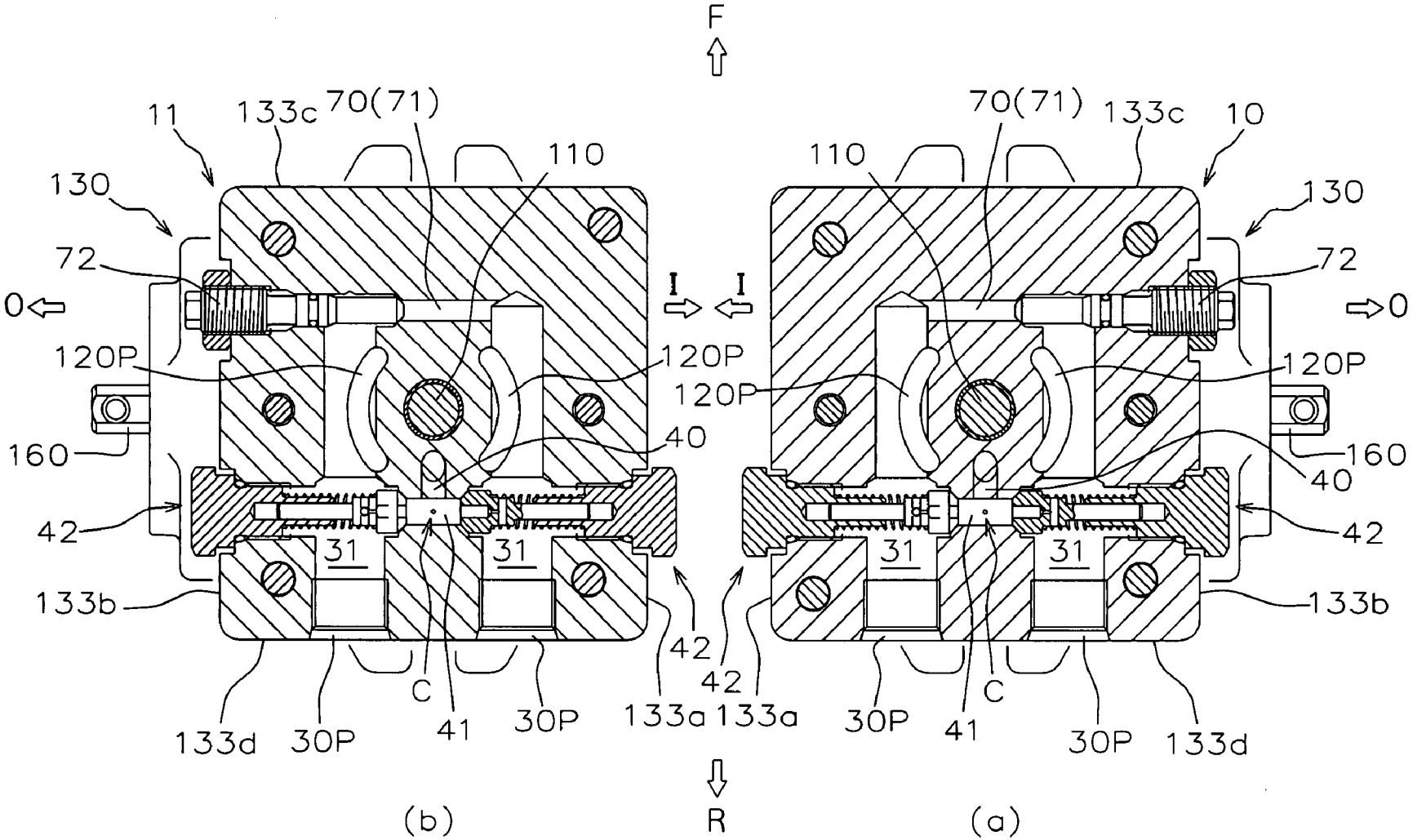
FIG. 6(*a*) is a transverse plan view of a port block of the first hydraulic pump unit taken along line 6-6 of FIG. 5.

FIG. 6(*a*) shows a transverse plan view of the port block 130 of the first hydraulic pump unit 10 taken along line 6-6 of FIG. 5. Further, FIG. 6(*b*) shows a transverse cross sectional view of the port block 130 of the second hydraulic pump unit 11.

The symbols F, R, O, and I of FIG. 6 show the front in the longitudinal direction of the vehicle, the rear in the longitudinal direction of the vehicle, the outside in the width direction of the vehicle and the inside in the width direction of the vehicle with the port block 130 as a reference, respectively.

As shown in FIG. 3 and FIG. 6, the pair of hydraulic lines 30 include a pair of operating oil passages 31 perforated in the port block 130, and a pair of operating oil conduits 32 (see FIG. 1 and FIG. 2) for communicating the pair of operating oil passages 31 to the first hydraulic motor unit 20.

Each of the pair of operating oil passages 31 has a first end opening outward to form an operating oil port 30P, and a second end communicated to each of a pair of kidney ports 120P in the pump body 120.

In this embodiment, the first end of each operating oil passage 31 is opened to any one of side faces 133*b* to 133*d* other than a side face 133*a* facing the other hydraulic pump unit (that is, second hydraulic pump unit 11) of the first to the fourth side faces 133*a* to 133*d* in the port block 130.

Specifically, the port block 130 has, in addition to the first and second end faces 131, 132, the first side face 133*a* to the fourth side face 133*d* extending parallel to the axis line direction of the pump shaft 110.

The first side face 133*a* faces the inside in the width direction of the vehicle so as to face the other hydraulic pump unit 11, and the second side face 133*b* faces a direction opposite the first side face 133*a* (that is, the outside in the width direction of the vehicle).

Further, the third side face 133*c* faces one side in the longitudinal direction of the vehicle (front in the longitudinal direction of the vehicle in this embodiment), and the fourth side face 133*d* faces a direction opposite the third side face 133*c* (that is, rear in the longitudinal direction of the vehicle).

The first end 30P of each operating oil passage 31 is opened outward at one of the side faces 133*b* to 133*d* (fourth side face 133*d* in this embodiment) other than the first side face 133*a*.

Figure 7:
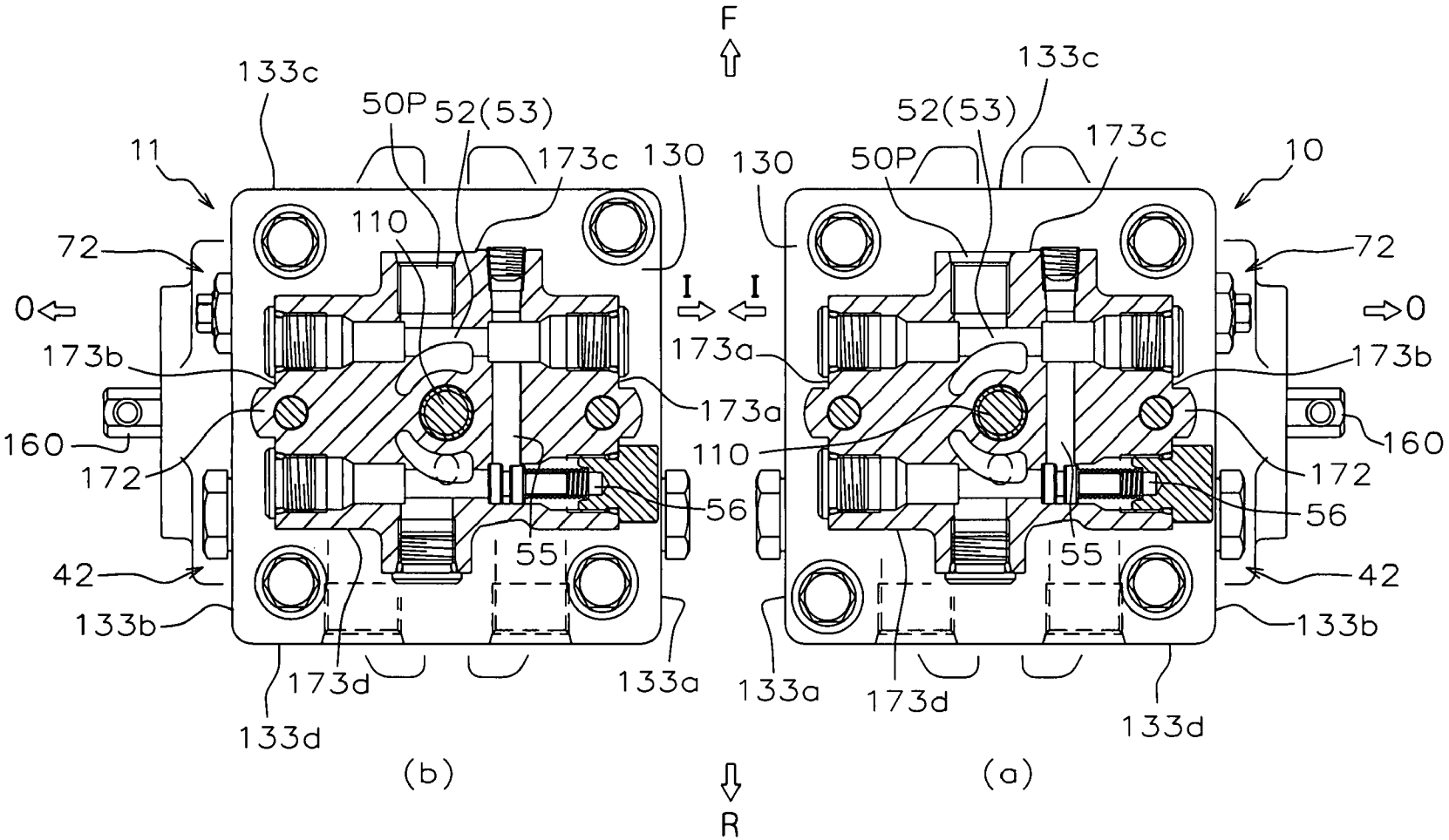
FIG. 7(*a*) is a transverse plan view of a charge pump case in the first hydraulic pump unit taken along line 7-7 of FIG. 4.

FIG. 7(*a*) shows a transverse plan view of the charge pump case 172 in the first hydraulic pump unit 10 taken along line 7-7 of FIG. 4. FIG. 7(*b*) shows a transverse cross sectional view of the charge pump case 172 in the second hydraulic pump unit 11.

As shown in FIG. 3, the charge line 50 includes a charge conduit 51 having a first end communicated to the oil tank 15, and a charge oil passage 52 having a first end opened at the external surface of the assembly to form a charge suction port 50P and a second end communicated to each operating oil passage 31.

In this embodiment, the charge oil passage 52 has a first charge oil passage 53 formed in the charge pump case 172, and a second charge oil passage 54 formed in the port block 130.

The first charge oil passage 53 has a first end forming the charge suction port 50P and opened to any one of the side faces 173*b* to 173*d* other than the side face 173*a* facing the other hydraulic pump unit (that is, second hydraulic pump unit 11) of the first to fourth side faces 173*a* to 173*d* in the charge pump case 172, and a second end opening at the surface 172*a* which is brought into contact with the port block 130.

That is, as shown in FIG. 4, FIG. 5 and FIG. 7, the charge pump case 172 has, similar to the port block 130, a first end face 172*a* (lower surface in this embodiment) which is orthogonal to the pump shaft 110 and faces the port block 130, a second end face 172*b* (upper surface in this embodiment) positioned on the opposite side of the first end face 172*a*, and first to fourth side faces 173*a* to 173*d* extending approximately parallel to the axis line direction of the pump shaft 110.

In this embodiment, the first end (charge suction port 50P) of the first charge oil passage 53 is opened at the third side face 173*c* of the charge pump case 172 (see FIG. 7), and the second end of the first charge oil passage 53 is opened at the first end face 172*a* of the charge pump case 172.

In this embodiment, the charge pump body 171 is inserted into the first charge oil passage 53.

Further, a charge pressure setting line 55 for connecting between a front stream side and a back stream side in a flow direction of the charge oil is formed in the charge pump case 172 with the charge pump body 171 interposed therebetween. A relief valve 56 is inserted into the charge pressure setting line 55.

The second charge oil passage 54 has a first end opening at the second end face 132 of the port block 130 so as to communicate to the second end of the first charge oil passage 53, and a second end communicating to each operating oil passage 31.

Specifically, the second charge oil passage 54 includes a common charge oil passage 40 communicated to the first charge oil passage 53, and a pair of branched oil passages 41 branched from the common charge oil passage 40 at a branch point C and each communicated to the corresponding operating oil passage 31 (see FIG. 3 and FIG. 6).

A check valve 42 is provided in each branched oil passage 41.

The check valve 42 is provided to allow the flow of the pressure oil from the charge line 50 to the pair of operating oil passages 31 and to prevent the pressure oil from flowing in a reverse direction.

In this embodiment, the check valve 42 has a throttle 43 (see FIG. 3); thus, a neutral state of the HST can be obtained without the need of strictly controlling the output adjusting member 150.

The drain line 60 includes a drain port 60P for communicating the pump body accommodating space S to the outside, and a drain conduit 62 having a first end communicated to the drain port 60P and a second end communicated to the oil tank 15.

Figure 8:
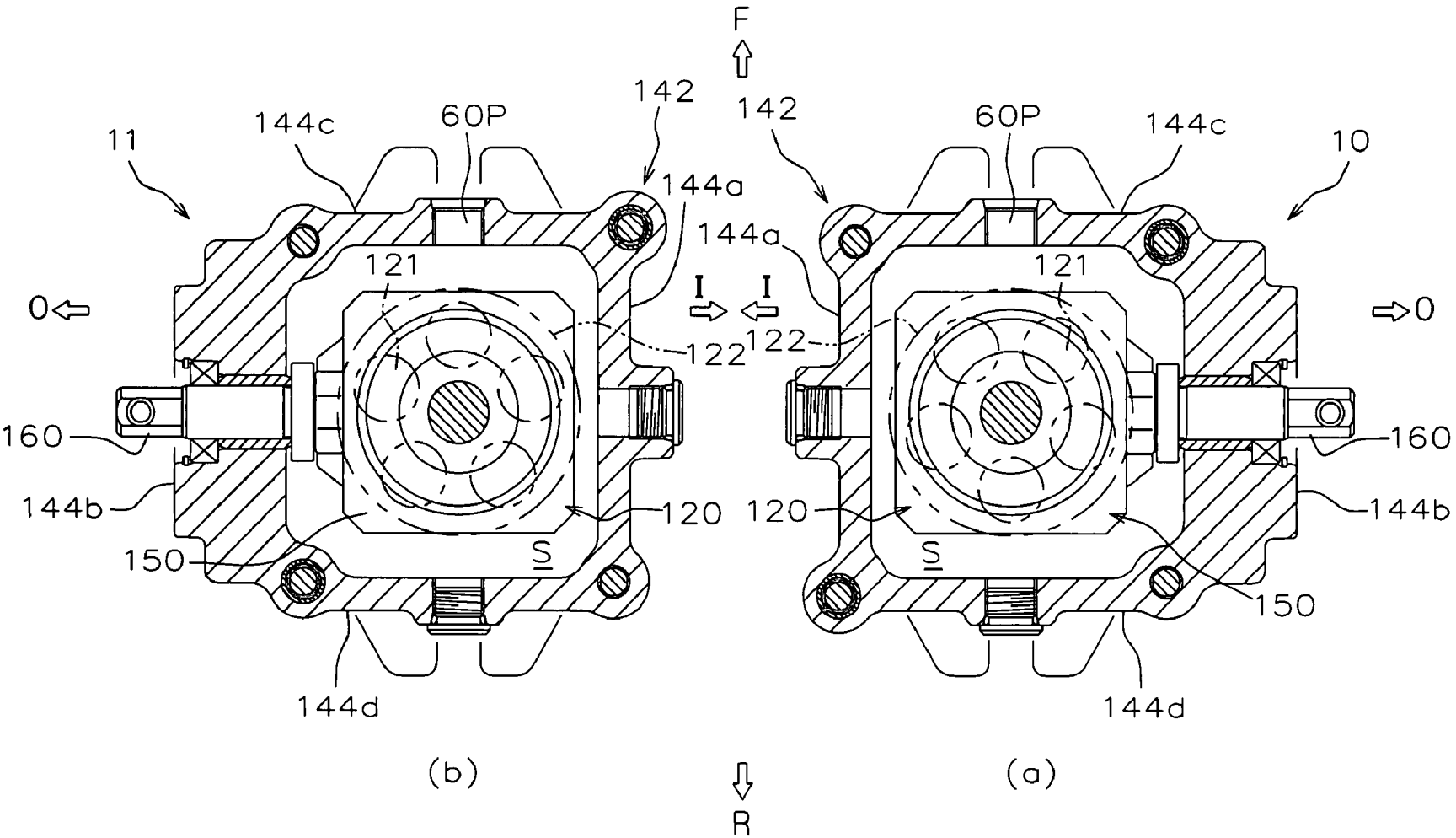
FIG. 8 is a transverse plan view of a pump case taken along line 8-8 of FIG. 4.

FIG. 8 shows a transverse plan view of the pump case 140 taken along line 8-8 of FIG. 4.

As shown in FIG. 3 and FIG. 8, the drain port 60P is formed in the pump case 140 in this embodiment.

Specifically, the drain port 60P is opened at a third side face 144*c* of the pump case 140.

That is, similar to the port block 130 and the charge pump case 172, the pump case 140 includes first to fourth side faces 144*a* to 144*d* extending along the axis line direction of the pump shaft 110.

The first side face 144*a* faces the inside in the width direction of the vehicle so as to face the other hydraulic pump unit, and the second side face 144*b* faces a direction opposite the first side face 144*a* (that is, outside in the width direction of the vehicle). Further, the third side face 144*c* faces one side (front in the longitudinal direction of the vehicle in this embodiment) in the longitudinal direction of the vehicle, and the fourth side face 144*d* faces a direction opposite the third side face 144*c* (that is, rear in the longitudinal direction of the vehicle in this embodiment).

Each of the first and second hydraulic pump units 10, 11 according to this embodiment further includes a bypass line 70 for communicating between the pair of hydraulic lines 30.

The bypass line 70 is provided to prevent a pressure difference from being occurred between the pair of hydraulic lines 30 when forcibly towing the vehicle at the time of a fault and the like.

In this embodiment, the bypass line 70 includes a first bypass oil passage 71 formed in the port block so as to communicate between the pair of operating oil passages 31, and a switching valve 72 for selectively communicating/blocking the first bypass oil passage 71.

The first bypass oil passage 71 is positioned on the opposite side of the branched oil passage 41 with the pump shaft 110 interposed therebetween.

The switching valve 72 is placed so as to be operated from the second side face 133*b* of the port block 130.

The following effects can be obtained in the working vehicle 1A of the above configuration.

The charge suction port 50P and the drain port 60P of the first hydraulic pump unit 10 are arranged on any one of the side faces 103*b* to 103*d* other than the first side face 103*a* of the first assembly 100 configuring the first hydraulic pump unit 10.

Similarly, the charge suction port 50P and the drain port 60P of the second hydraulic pump unit 11 are arranged on any one of the side faces 203*b* to 203*d* other than the first side face 203*a* of the second assembly 200 configuring the second hydraulic pump unit 11.

Specifically, the first assembly 100 comprising the pump case 140, the port block 130 and the charge pump case 172 includes a first end face 101 which is orthogonal to the pump shaft 110 and through which the input end of the pump shaft 110 passes, a second end face 102 positioned on the opposite side of the first end face 101, a first side face 103*a* which extends in the axis line direction of the pump shaft 110 and faces the second assembly 200, a second side face 103*b* positioned on the opposite side of the first side face 103*a*, a third side face 103*c* which extends in the axis line direction of the pump shaft 110 and faces one side in the longitudinal direction of the vehicle (front in this embodiment), and a fourth side face 103*d* positioned on the opposite side of the third side face 103*c*.

In this embodiment, the first end face 101 and the second end face 102 of the first assembly 100 are each defined by the end wall 141 of the pump case 140 and the second end face 172*b* of the charge pump case 172.

The first and second assemblies 100, 200 of the above configurations both have the charge suction port 50P and the drain port 60P arranged at the wall surface other than the opposing surfaces (first side face 103*a*).

Therefore, a space can be secured as much as possible between the first and second hydraulic pump units 10, 20.

Particularly, if the charge suction port 50P and the drain port 60P are arranged on the faces opposing each other when the oil tank 15 is arranged between the first and second hydraulic pump units 10, 11 as in this embodiment, a part of the free space between the first and second hydraulic pump units 10, 11 is occupied by the space for arranging the conduit. As a result, the space for accommodating vehicle mount parts decreases. Therefore, the oil tank 15 or a battery of a relatively large size that is satisfactory capacity-wise may not be arranged in the free space.

On the other hand, if the charge suction port 50P and the drain port 60P are arranged on the wall surface other than the opposing surfaces as in this embodiment, connection of the conduit between the oil tank 15 and the ports 50P, 60P is performed easily; thus, the oil tank 15 or a battery of a relatively large size that is satisfactory capacity-wise may be arranged between the pump units 10, 11.

Preferably, the charge suction port 50P and the drain port 60P may be arranged on the wall surface other than the wall surface (first end face 101 in this embodiment) where the input end 111 of the input shaft 110 is positioned.

Further, if each of the first and second hydraulic pump units 10, 11 is of a variable displacement type as in this embodiment, more preferably, the charge suction port 50P and the drain port 60P may be arranged on the wall surface other than the wall surface (second side face 103*b*, 203*b* in this embodiment) where the control shaft 160 is positioned.

With this configuration, the interference between the input shaft 110 and the control shaft 160 and various members connected to both shafts 110, 160, and the charge conduit 51 and the drain conduit 62 connected to the charge suction port 50P and the drain port 60P can be prevented.

More preferably, the charge suction port 50P and the drain port 60P may be arranged on the wall surface other than the wall surface (fourth wall surface 103*d*, 203*d* in this embodiment) where the operating oil port 30P is positioned.

With this configuration, the interference between the charge conduit 51 and the drain conduit 62, and the pair of operating oil conduits can be effectively prevented.

The charge suction port 50P and the drain port 60P are both connected to a single oil tank 15 by way of the corresponding conduits 51, 62.

Accordingly, by arranging these ports 50P, 60P on the same wall surface, optimization of the layout and efficiency of the installation task of the charge conduit 51 and the drain conduit 62 can be achieved.

Further, in this embodiment, the charge conduit 51 includes the common charge conduit communicated to the oil tank, and the first and second charge conduits branched from the common charge conduit and each communicated to the drain ports of the first and second hydraulic pump units 10,20 (see FIG. 2(*a*)).

Similarly, the drain conduit 62 includes the first and second drain conduits communicated to each drain port 60P of the first and second hydraulic pump units 10, 11, and a common drain conduit for converging drain oils of both conduits and returning the same to the oil tank 15 (see FIG. 2(*a*)).

The external conduits 51, 62 may of course take various forms.

For example, the external conduits 51, 62 may be configured so that the drain oils of the first and second hydraulic pump units 10, 11 return to the oil tank 15 by way of independent conduits as shown in FIG. 2(*b*), and/or so that the charge oils of the first and second hydraulic pump units 10, 11 are sucked through independent conduits.

Embodiment 2

Another embodiment of the working vehicle according to the first aspect of the present invention will now be described with reference to the accompanying drawings.

In this embodiment, the same reference numerals or the same reference numerals added with "B" are denoted for the members same as or corresponding to those in the first embodiment; therefore, the detailed description thereof will not be given herein.

Figure 9:
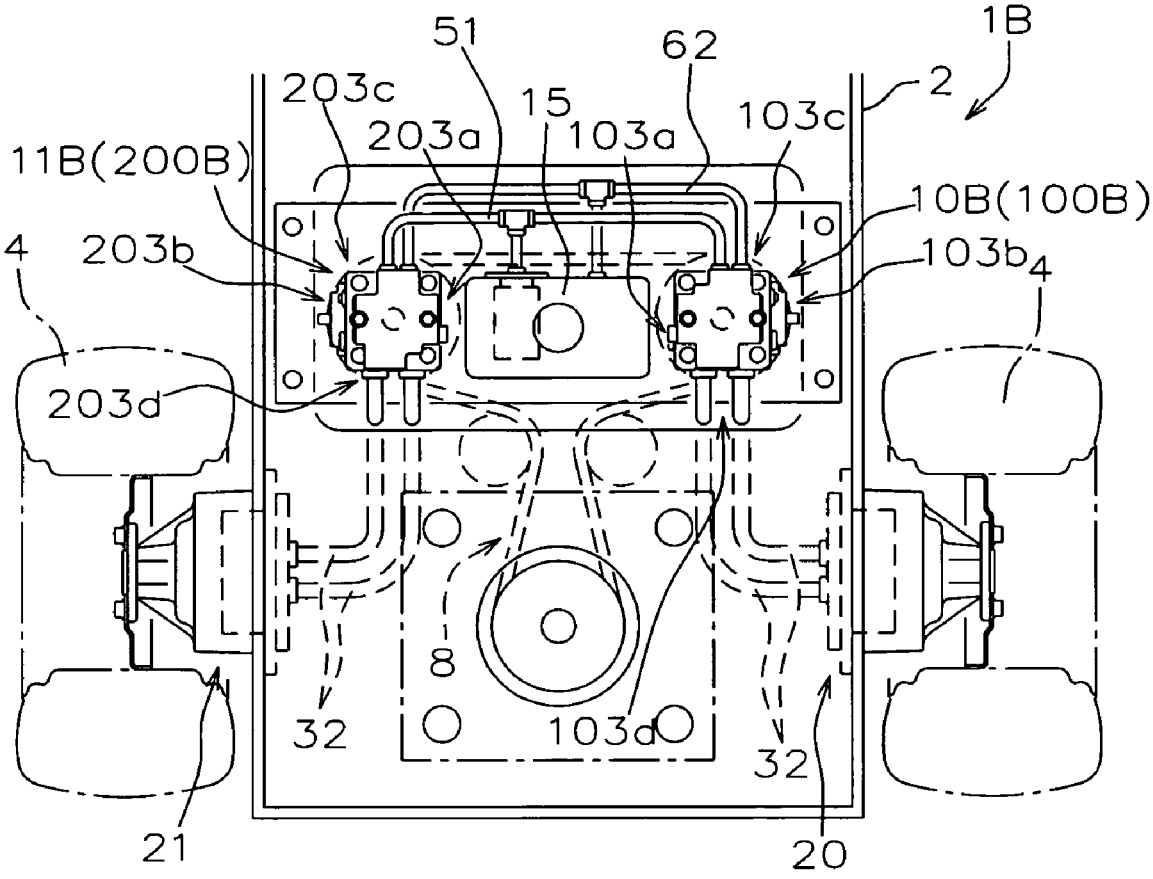
FIG. 9 is a partial plan view of a working vehicle according to a second embodiment of the present invention.

FIG. 9 shows a partial plan view of a working vehicle 1B according to this embodiment.

Figure 10:
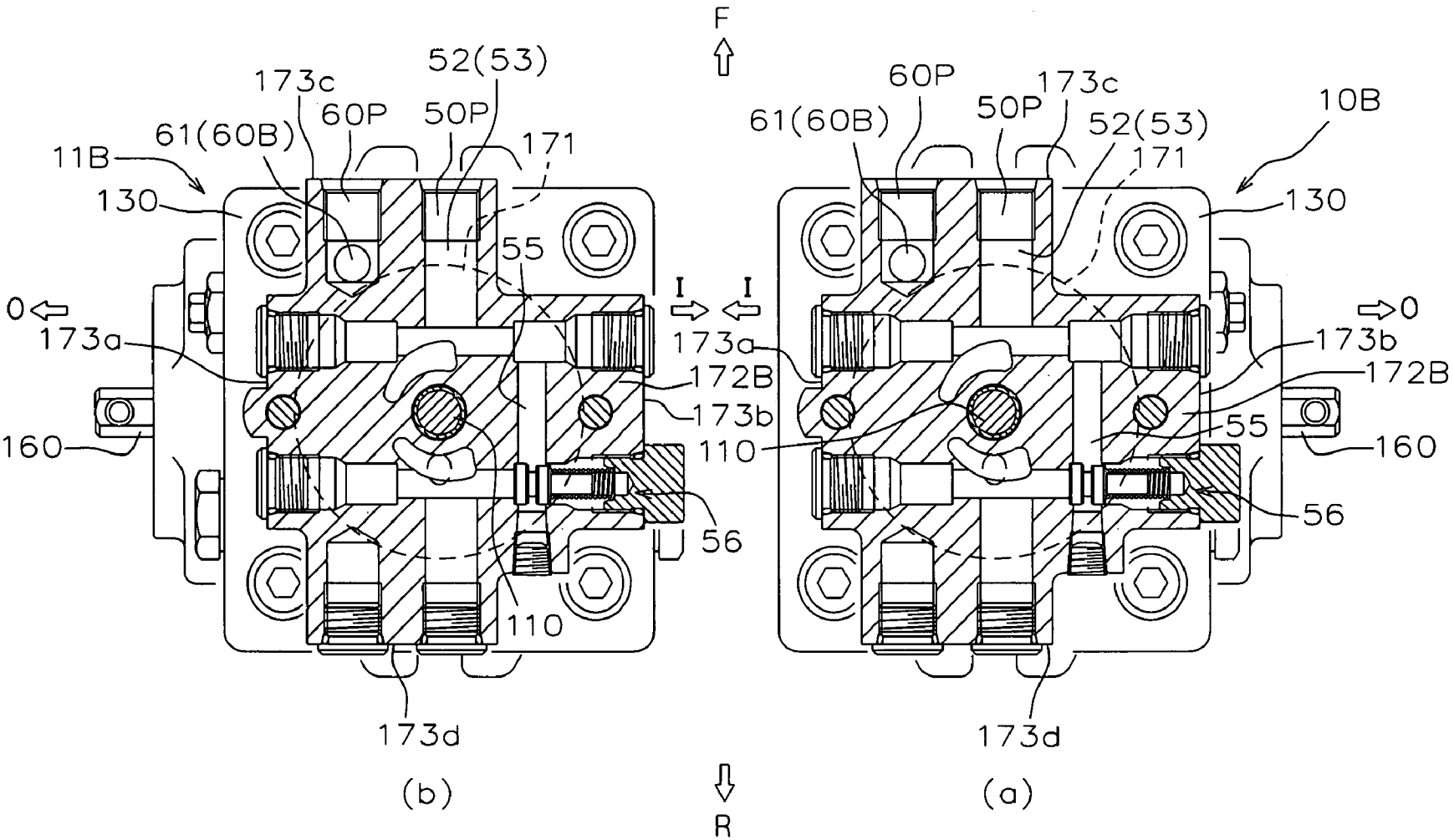
FIG. 10 is a transverse plan view of a charge pump case in the working vehicle according to the second embodiment of the present invention.

FIG. 10 shows a transverse plan view of a charge pump case 172B in the working vehicle 1B. Herein, FIG. 10 corresponds to FIG. 7 of the first embodiment.

As shown in FIG. 10, the drain port 60P is arranged in the charge pump case 172B in this embodiment.

That is, a drain line 60B in this embodiment includes a drain oil passage 61 formed in the port block and the charge pump case 172B so as to have a first end opening at the pump body accommodating space S and a second end opening at the third side face 173*c* of the charge pump case 172, and the drain conduit 62.

The second end of the drain oil passage 61 forms the drain port 60P.

Effects similar to the first embodiment can be also obtained in the working vehicle of the above configuration.

Embodiment 3

Still another embodiment of the working vehicle according to the first aspect of the present invention will now be described with reference to the accompanying drawings.

In this embodiment, the same reference numerals or the same reference numerals added with "C" are denoted for the members same as or corresponding to those in the first or second embodiment; therefore, the detailed description thereof will not be given herein.

Figure 11:
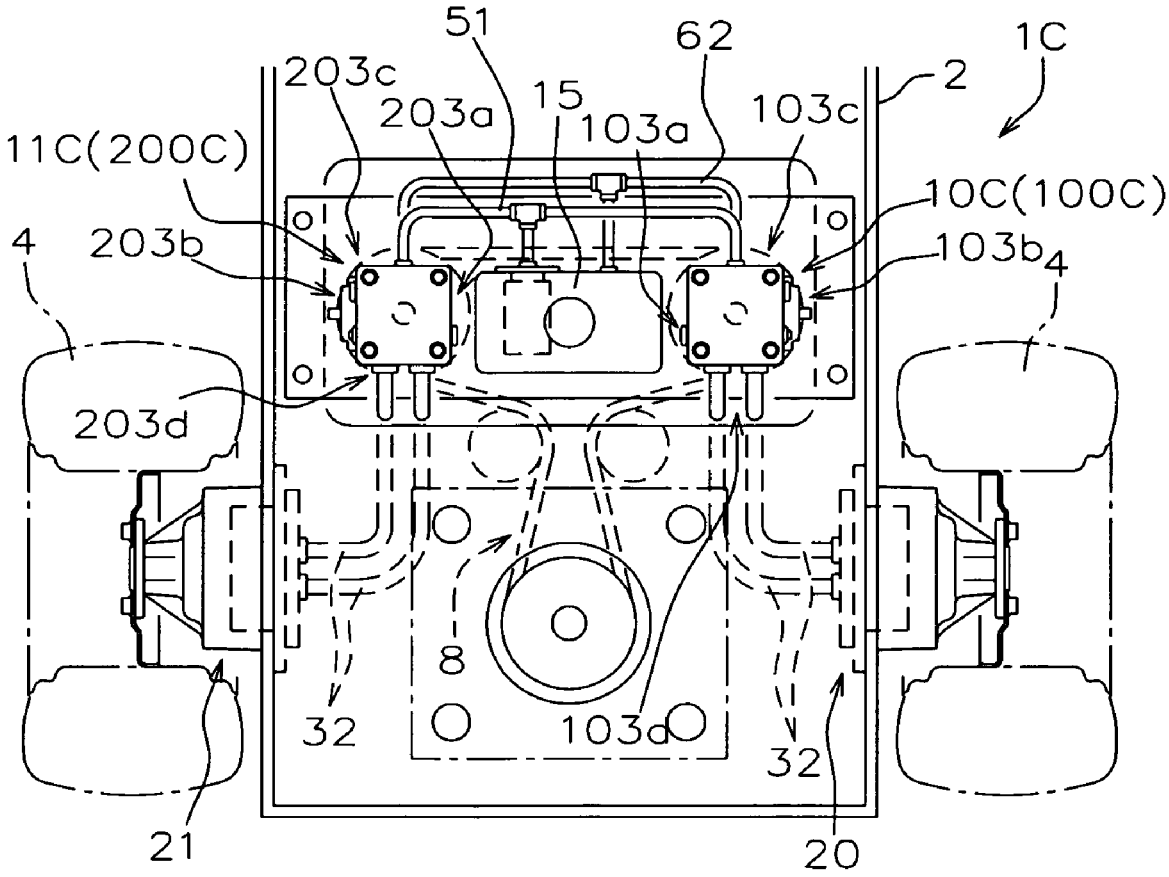
FIG. 11 is a partial plan view of a working vehicle according to a third embodiment of the present invention.

FIG. 11 shows a partial plan view of a working vehicle 1C according to this embodiment.

Figure 12:
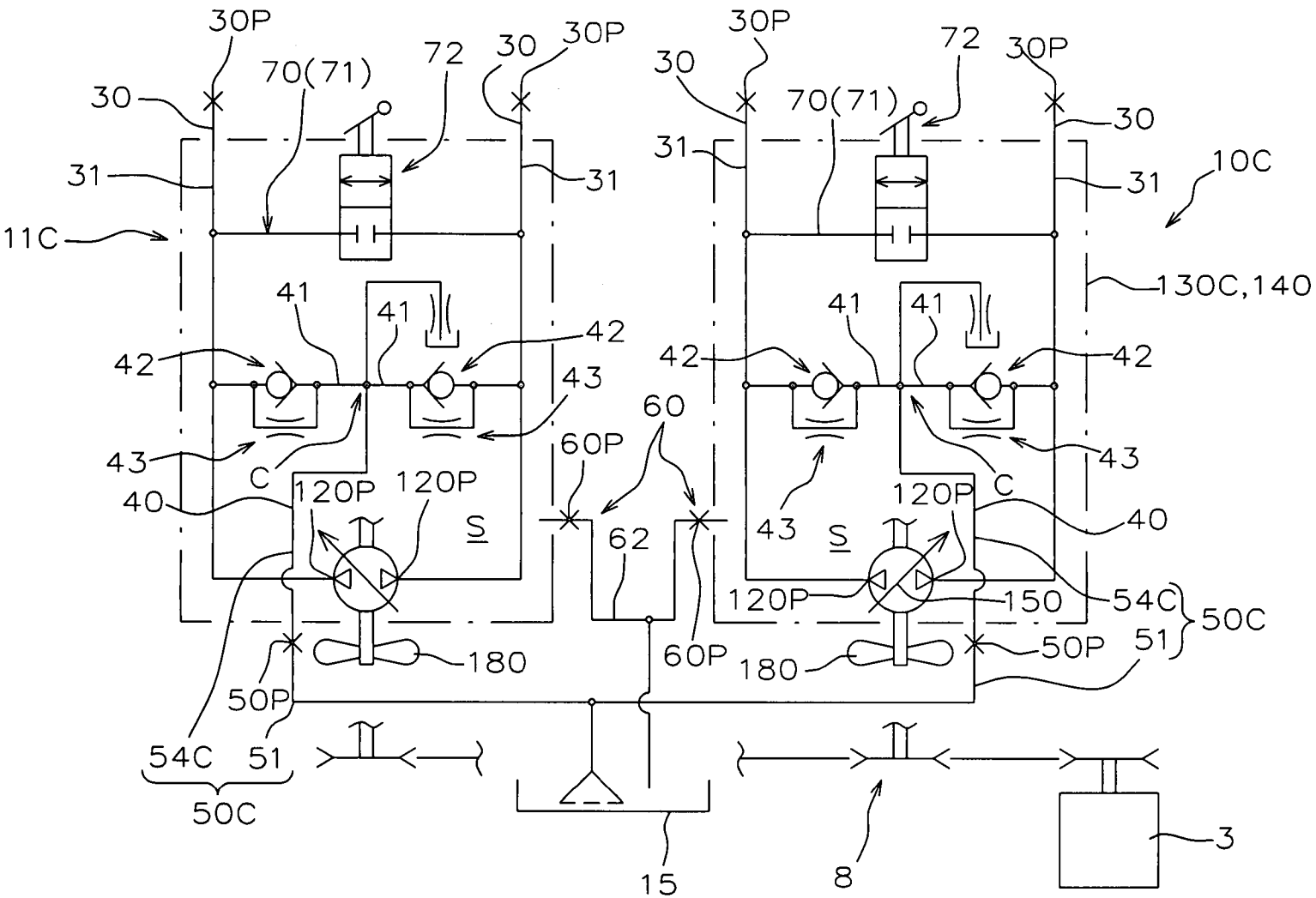
FIG. 12 is a hydraulic circuit diagram of first and second hydraulic pump units in the working vehicle according to the third embodiment of the present invention.
Figure 13:
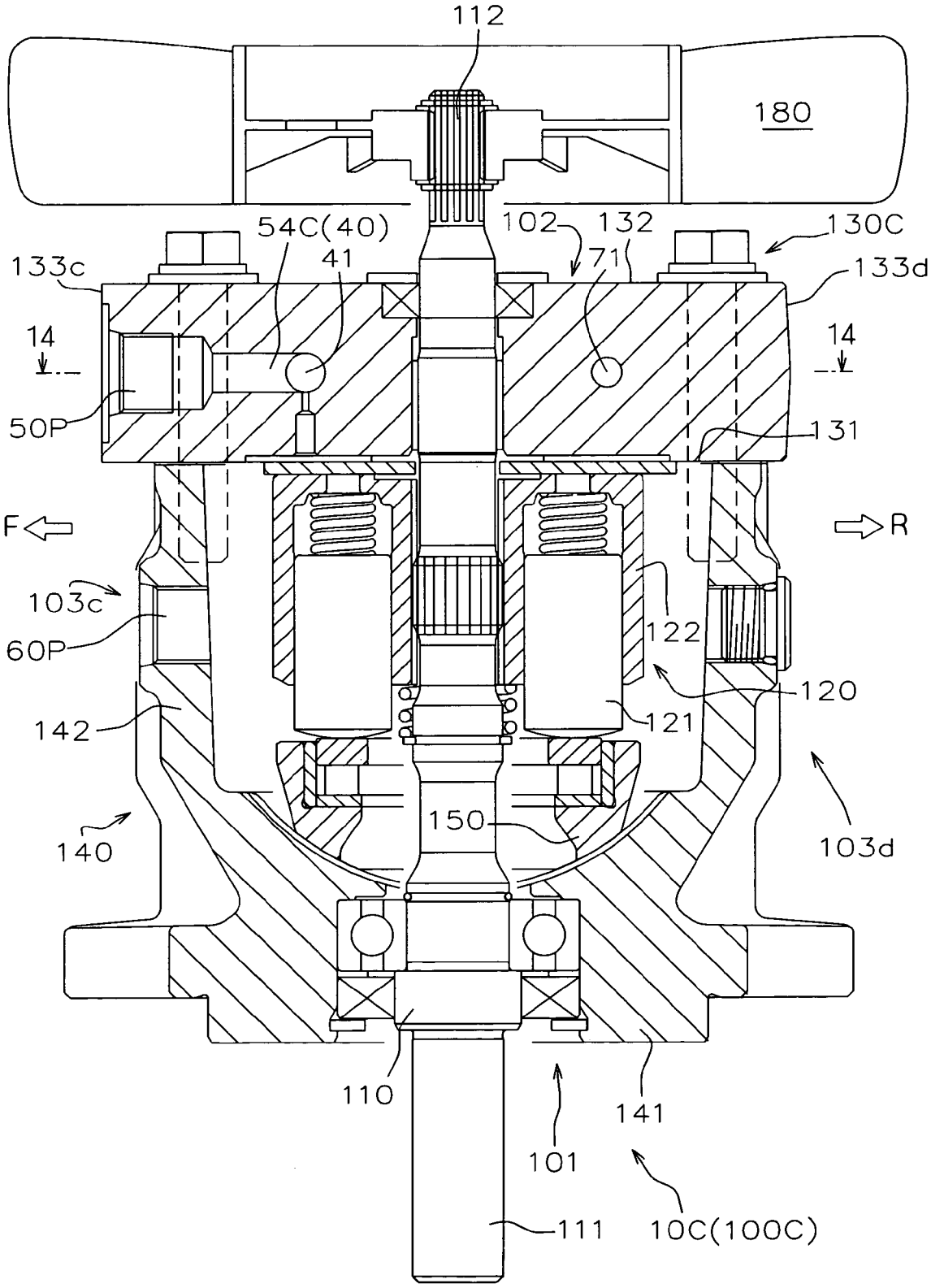
FIG. 13 is a longitudinal side view of the first hydraulic pump unit in the working vehicle according to the third embodiment of the present invention.
Figure 14:
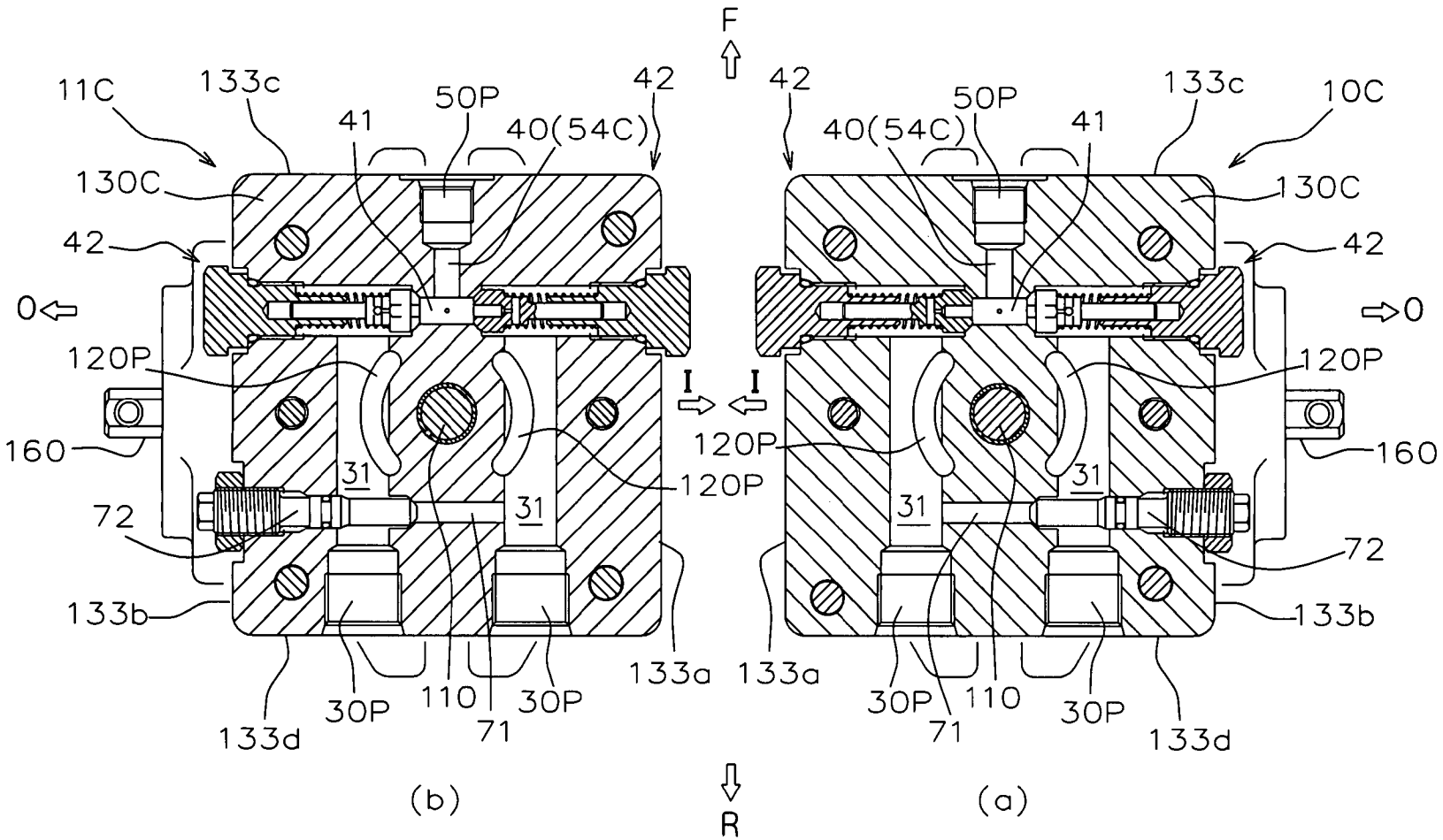
FIG. 14 is a transverse plan view of a port block taken along line 14-14 of FIG. 13.

FIG. 12 shows a hydraulic circuit diagram of first and second hydraulic pump units 10C, 11C in the working vehicle 1C. FIG. 13 shows a longitudinal side view of the first hydraulic pump unit 10C according to this embodiment. FIG. 14 shows a transverse plan view of a port block 130C taken along line 14-14 of FIG. 13.

Herein, FIG. 13 and FIG. 14 correspond to FIG. 4 and FIG. 6 of the first embodiment, respectively.

As shown in FIG. 12 and FIG. 13, in this embodiment, the first hydraulic pump unit 10C includes a cooling fan 180 in place of the charge pump unit 170. The air from the cooling fan 180 directly hits the port block 130C and efficiently cools the pressure oil flowing therein.

The second hydraulic pump unit 11C has substantially the same configuration as that of the first hydraulic pump unit 10C. Therefore, the detailed description of the second hydraulic pump unit 11C will not be given herein.

By arranging the cooling fan 180 in place of the charge pump unit 170 as mentioned above, the charge suction port 50P is arranged in the port block 130C in this embodiment.

That is, in the first and second embodiments, the charge oil is forcibly fed to the low-pressure side of the pair of hydraulic lines 30 by the charge pump unit 17. However, in this embodiment, the charge oil is naturally sucked when a negative pressure is generated in at least one of the pair of hydraulic lines 30.

More specifically, as shown in FIG. 13 and FIG. 14, a charge line 50C according to this embodiment includes the charge conduit 51 and a charge oil passage 54C formed in the port block 130C so as to have a first end forming the charge suction port 50P and opening at the third side face 133*c* of the port block 130C and a second end communicating to each operating oil passage 31.

Effects similar to those in the first and second embodiments can be also obtained in the working vehicle 1C of the above configuration.

In each embodiment, the first and second hydraulic pump units configured so that the pump shaft 110 is directed in the vertical direction are described by way of example, but the present invention is of course not limited to this form. That is, the hydraulic pump units configured so that the pump shaft 110 is directed in the front-to-rear direction of the vehicle or in the width direction of the vehicle may also be employed.

Figure 15:
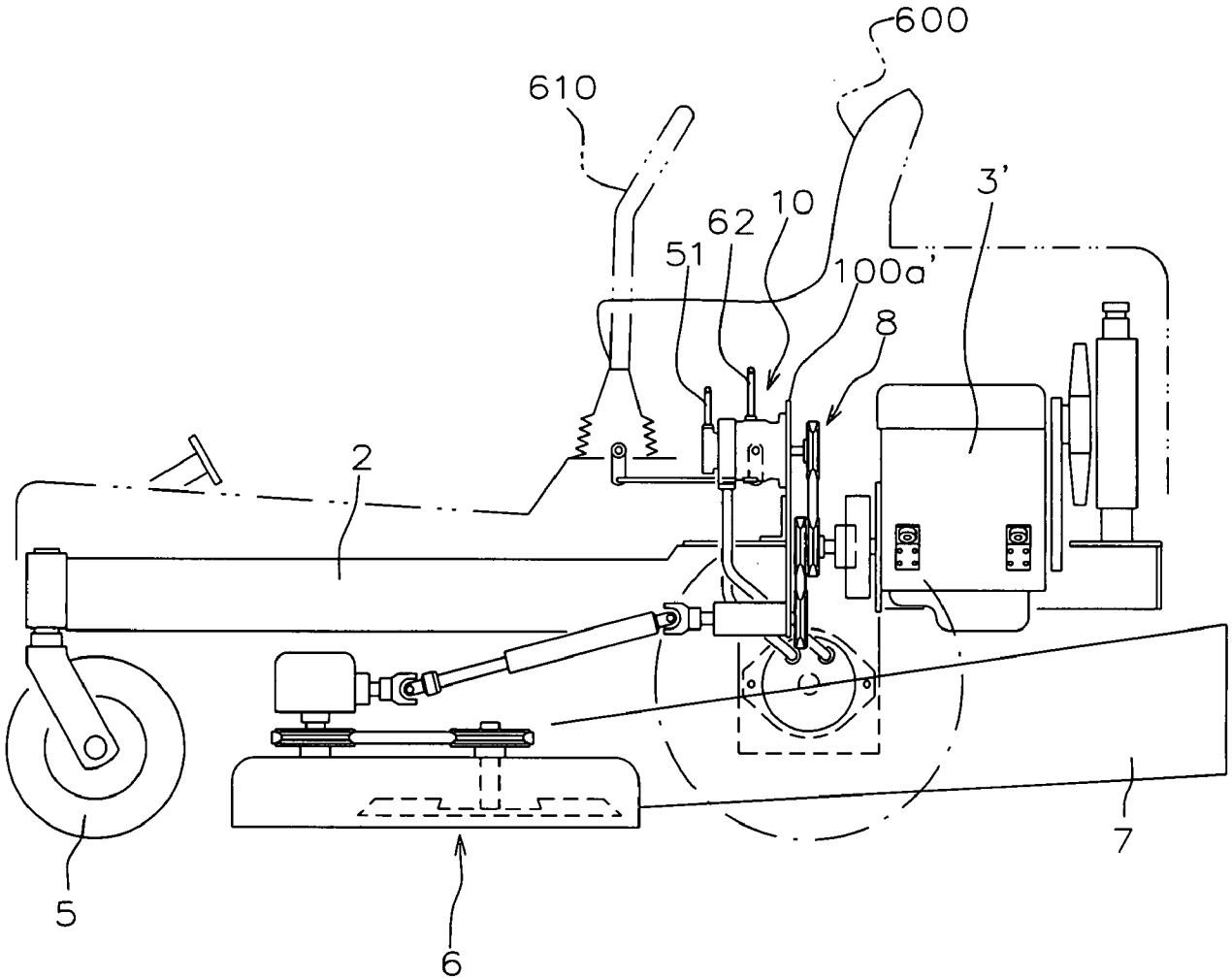
FIG. 15 is a side view of the modified working vehicle according to the present invention.
Figure 16:
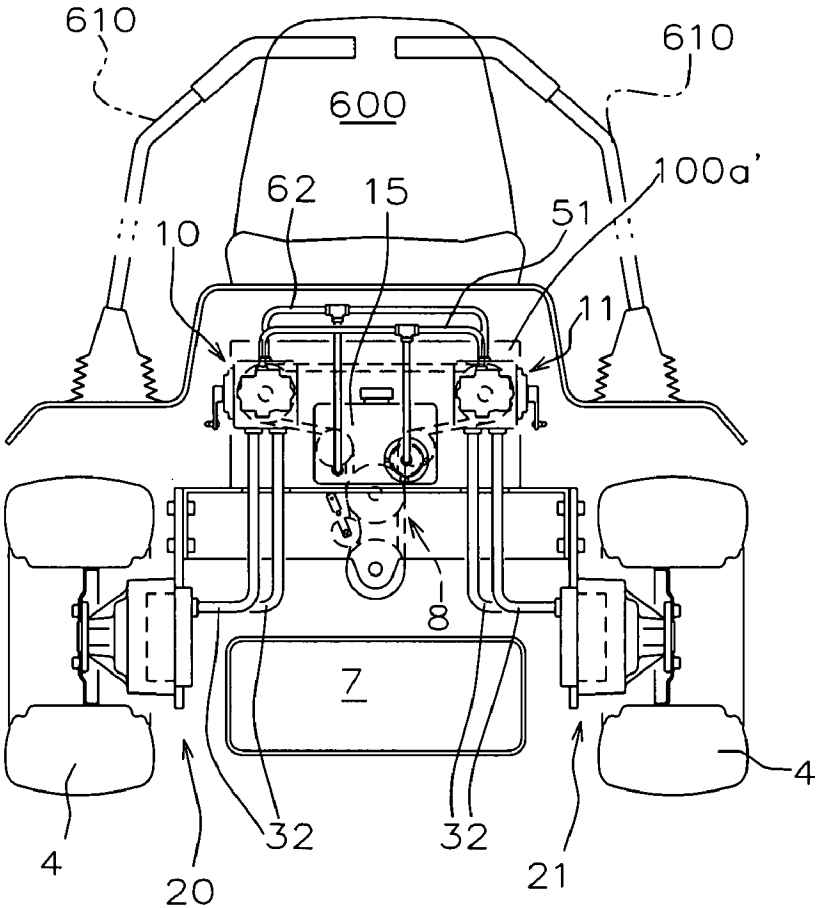
FIG. 16 is a front view of the modified working vehicle shown in FIG. 15.

FIG. 15 shows a side view of the modified working vehicle according to the present invention. FIG. 16 shows a front view of the modified working vehicle shown in FIG. 15.

The modified working vehicle shown in FIGS. 15 and 16 includes a driving source 3' of a horizontal crankshaft type, and a supporting plate 100*a*' connected to the frame 2 so as to extend in a vertical direction.

In the modified working vehicle, the hydraulic pump units 10, 11 are supported by the supporting plate 110*a*' so that the rotating axis line of each pump shaft 110 extends along a front-to-rear direction of the vehicle.

Embodiment 4

An embodiment of a hydraulic pump set according to the second aspect of the present invention will now be described with reference to the accompanying drawings.

Figure 17:
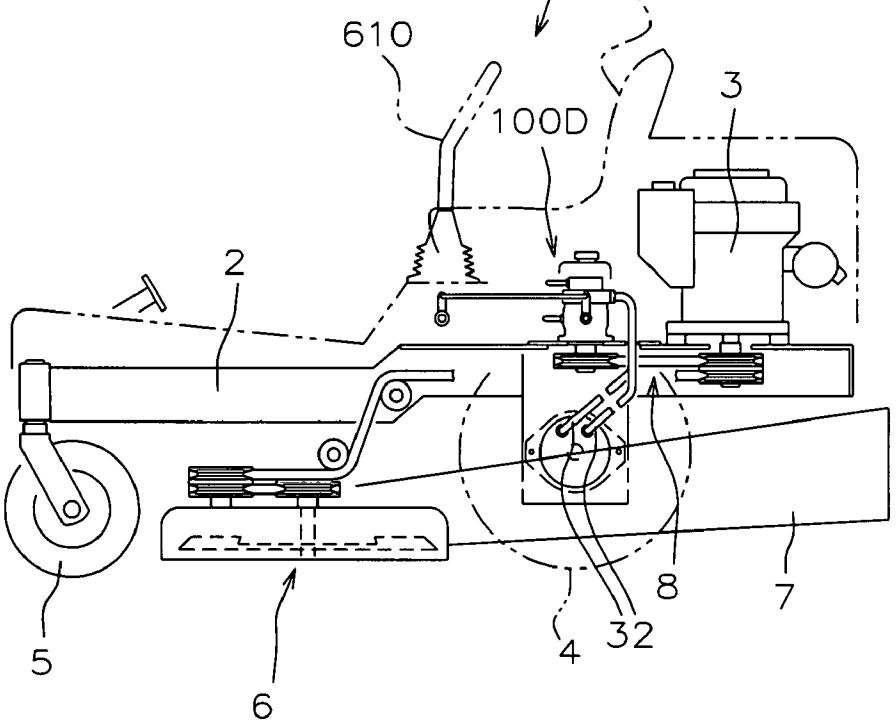
FIGS. 17(*a*) and (*b*) are a side view and a front view, respectively, of a working vehicle applied with a hydraulic pump set according to a fourth embodiment of the present invention.
Figure 17:
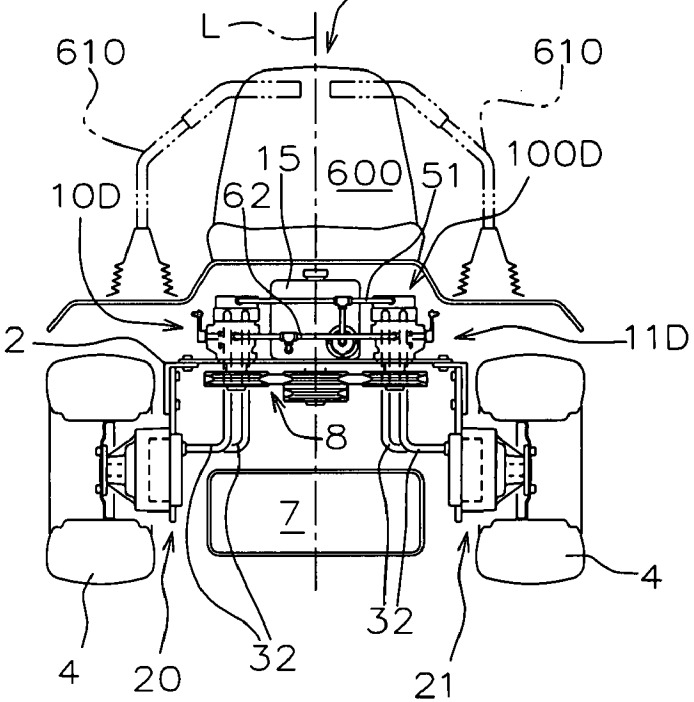
Figure 18:
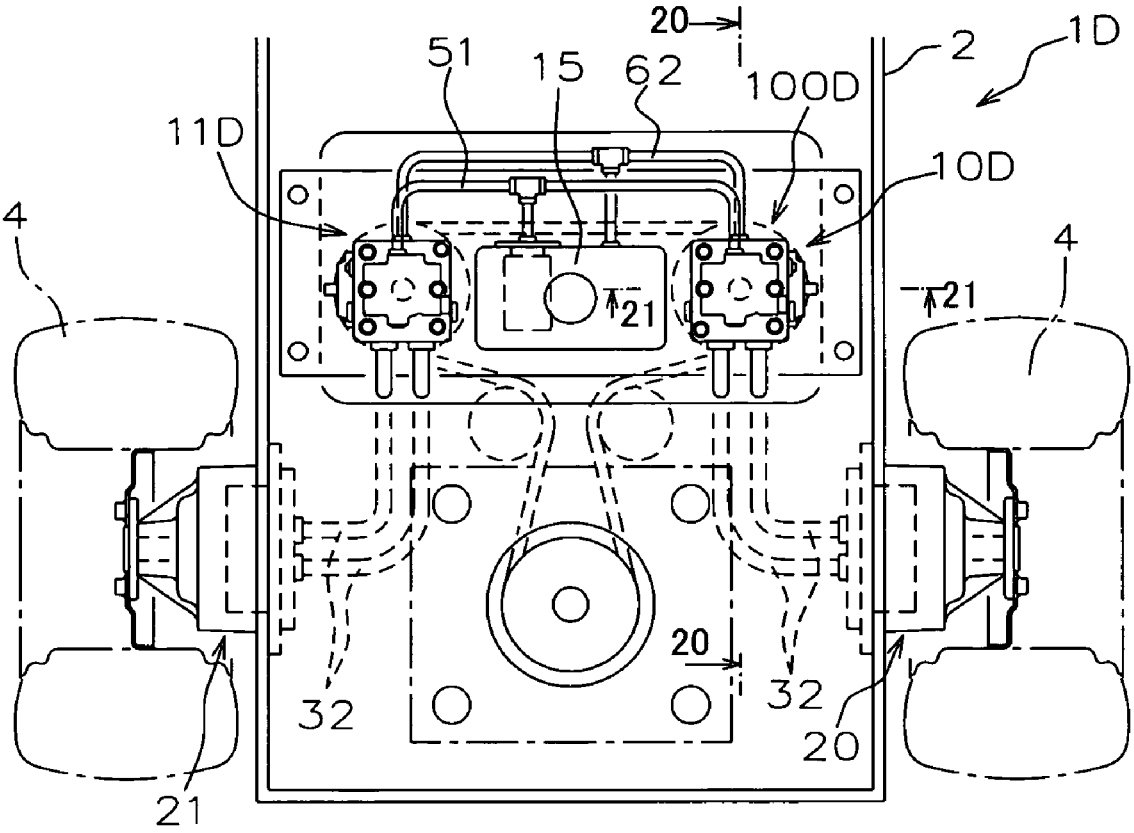
FIG. 18 is a partially developed plan view of the working vehicle shown in FIG. 17.

FIGS. 17(*a*) and 17(*b*) are a side view and a front view, respectively, of a working vehicle 1D applied with a hydraulic pump set 100D according to this embodiment. FIG. 18 is a partially developed plan view of the working vehicle 1D.

As shown in FIG. 17 and FIG. 18, the working vehicle 1D is a rear discharge-type riding mower capable of performing zero turn.

Specifically, the working vehicle 1D comprises a frame 2, a driving source 3 supported by the frame 2, the hydraulic pump set 100D arranged in the vicinity of the driving source 3 and operatively driven by the driving source 3 by way of a transmission mechanism 8, first and second hydraulic motor units 20, 21 fluidly connected with the hydraulic pump set 100D, a pair of driving wheels 4 (rear wheel in this embodiment) driven by the first and second hydraulic motor units 20, 21, and a caster wheel 5 (front wheel in this embodiment).

In this embodiment, as shown in FIG. 17, the driving source 3 is of a vertical crankshaft type; thus, first and second hydraulic pump units 10D, 11D are arranged so that a rotating axis line of each pump shaft 110 extends along a vertical direction. However, if the driving source 3 is of a horizontal crankshaft type, the hydraulic pump units 10D, 11D are arranged so that the rotating axis line of each pump shaft 110 extends along a front-to-rear direction.

As shown in FIG. 17(*b*) and FIG. 18, the first and second hydraulic motor units 20, 21 are distributed and arranged in a width direction of the vehicle so as to define a space therebetween.

The working vehicle 1D comprises, in addition to the above configuration, a mower device 6 suspended and supported in a freely rising/lowering manner between the front and rear wheels 4, 5, and a duct 7 arranged in the above space, the duct 7 which is arranged in the space and guides the mowed grass to a grass collecting bag (not shown) arranged at the rear of the vehicle body.

Further, in the working vehicle 1D, a driver's seat 600 is arranged above the center in the width direction of the frame 2 at the front of the driving source 3, and a pair of left and right steering handles 610 are arranged at the front of the driver's seat 600 in a freely forward/rearward tilting manner.

The pair of steering handles 610 are operatively connected with the first and second hydraulic pump units 10D, 11D so as to operate the first and second hydraulic pump units 10D, 11D, and the outputs of the first and second hydraulic motor units 20, 21 fluidly connected through a pair of operating oil conduits 32 are controlled by operating the pair of steering handles 610.

Moreover, in the working vehicle 1D according to this embodiment, the first and second hydraulic pump units 10D, 11D are also distributed and arranged in the width direction of the vehicle so as to define a space therebetween.

The working vehicle 1D comprises, in addition to the above configuration, an oil tank 15 arranged between the first hydraulic pump unit 10D and the second hydraulic pump unit 11D.

The oil tank 15 stores drain oils of the first and second hydraulic pump units 10D, 11D and, also, acts as a charge oil supply source for a pair of hydraulic lines 30, as will be described later.

Herein, a battery (not shown) for the driving source 3 is also arranged in the vicinity of the oil tank 15.

Figure 19:
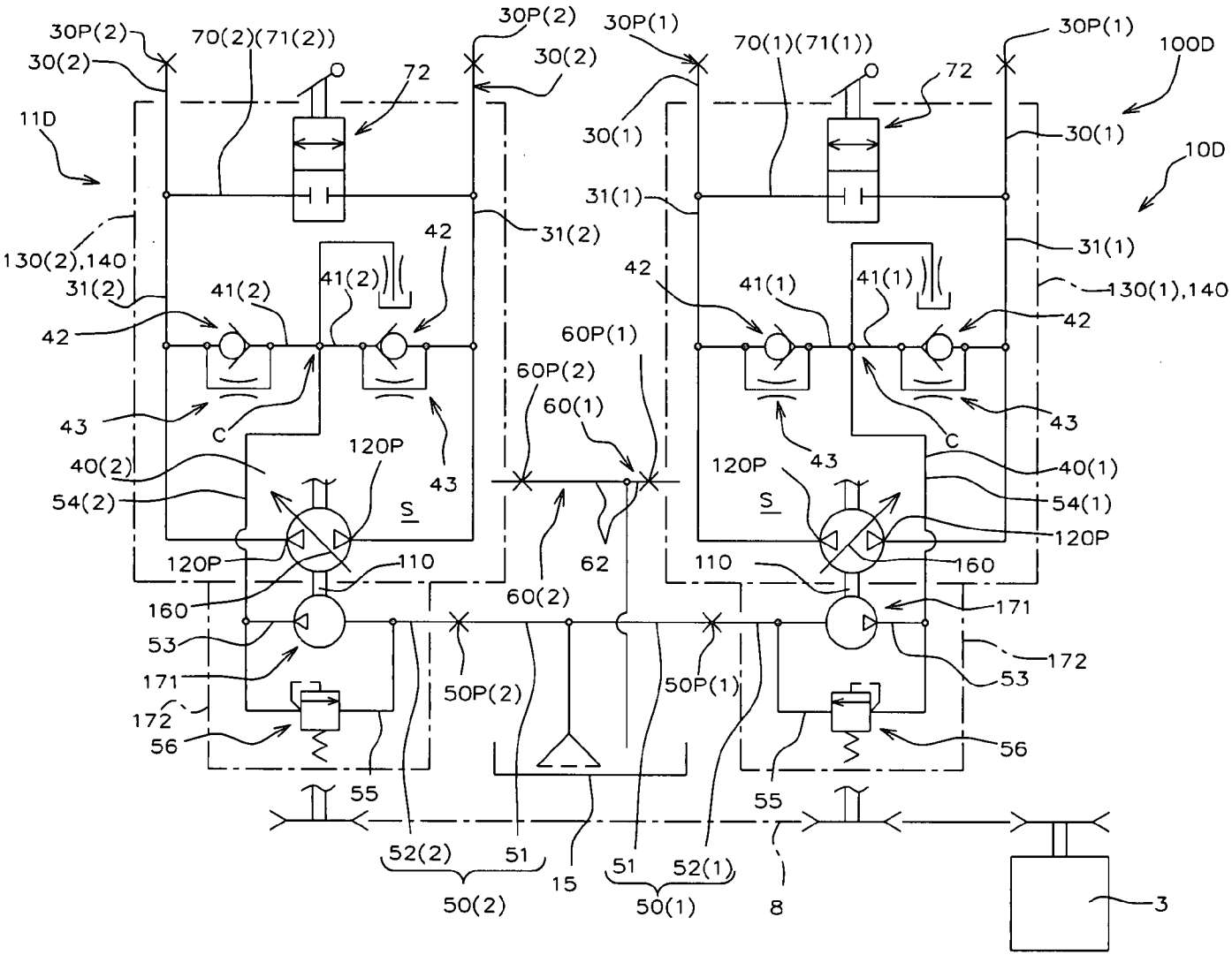
FIG. 19 is a hydraulic circuit diagram of first and second hydraulic pump units of the hydraulic pump set according to the fourth embodiment of the present invention.

FIG. 19 shows a hydraulic circuit diagram of the first and second hydraulic pump units 10D, 11D.

The first hydraulic pump unit 10D is fluidly connected to the first hydraulic motor unit 20 by way of a hydraulic circuit (the first hydraulic line 30(1) in this embodiment) so as to form a first HST in cooperation with the first hydraulic motor unit 20.

At least one of the first hydraulic pump unit 10D and the first hydraulic motor unit 20 is of a variable displacement type.

Similarly, the second hydraulic pump unit 11D is fluidly connected to the second hydraulic motor unit 21 by way of a hydraulic circuit (the second hydraulic line 30(2) in this embodiment) so as to form a second HST in cooperation with the second hydraulic motor unit 21.

At least one of the second hydraulic pump unit 11D and the second hydraulic motor unit 21 is of a variable displacement type.

In this embodiment, each of the first and second hydraulic pump units 10D, 11D is of a variable displacement type, and each of the first and second hydraulic motor units 20, 21 is of a fixed displacement type.

The configuration of the first hydraulic pump unit 10D will now be described in detail.

As shown in FIG. 17, the first hydraulic pump unit 10D is arranged on one side in the width direction of the vehicle (right side with respect to a forward movement direction of the vehicle in this embodiment) with a virtual central longitudinal plane L of the vehicle as a reference.

In this embodiment, the first hydraulic pump unit 10D is arranged so that the rotating axis line extends along an approximately vertical direction.

Figure 20:
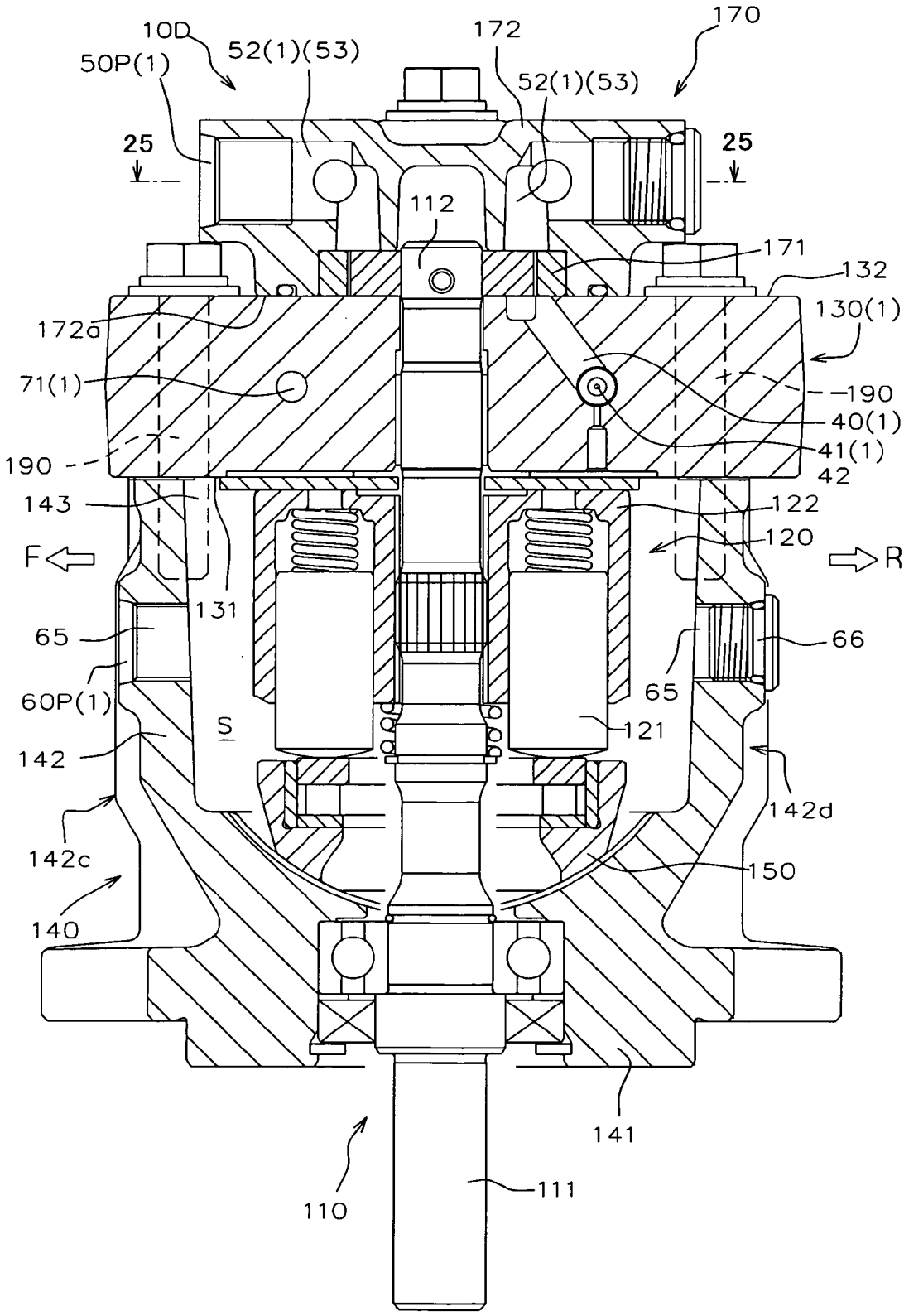
FIG. 20 is a longitudinal side view of the first hydraulic pump unit taken along line 20-20 in FIG. 18.
Figure 21:
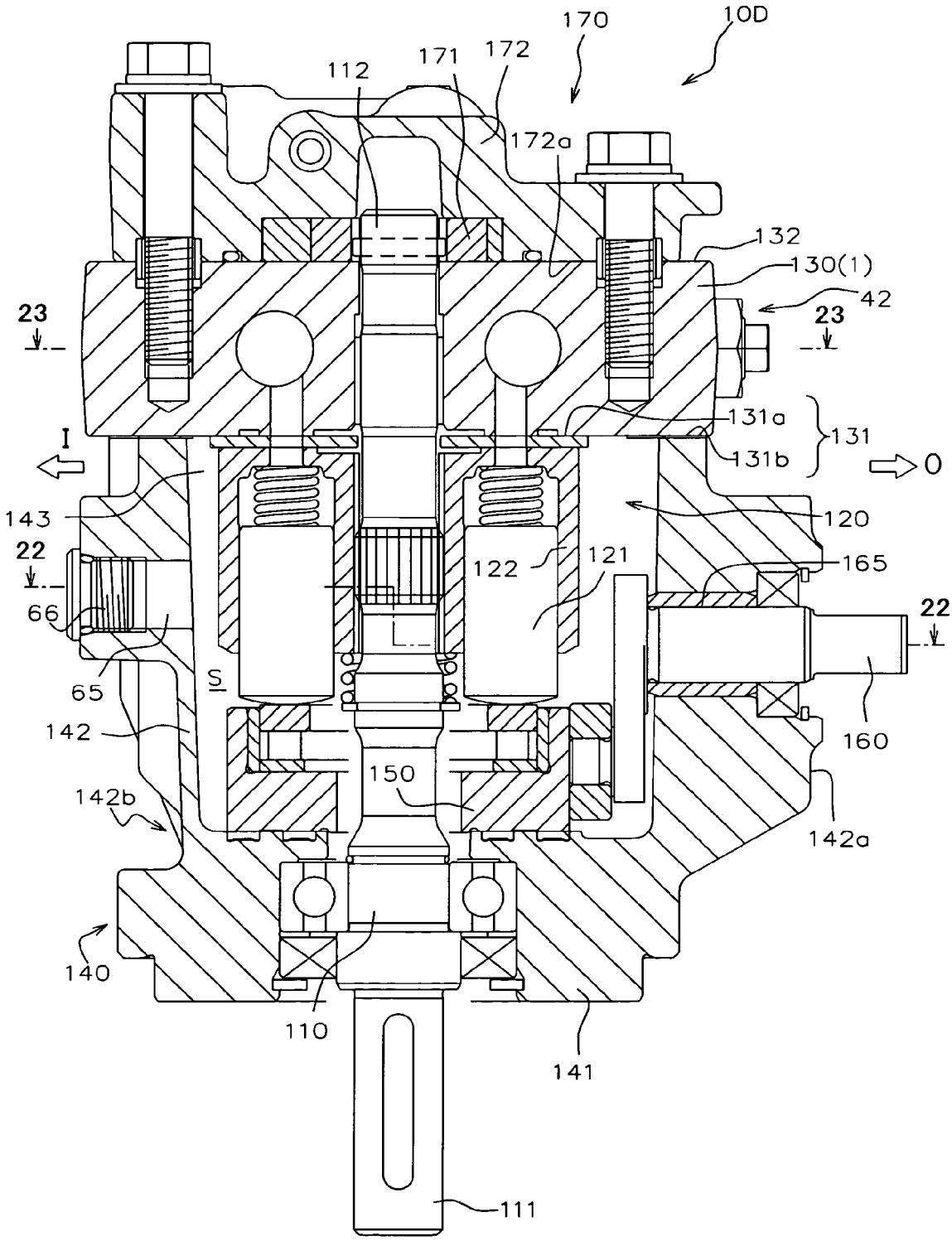
FIG. 21 is a longitudinal rear view of the first hydraulic pump unit taken along line 21-21 of FIG. 18.

FIG. 20 shows a longitudinal side view of the first hydraulic pump unit 10D taken along line 20-20 in FIG. 18. FIG. 21 shows a longitudinal rear view of the first hydraulic pump unit 10D taken along line 21-21 of FIG. 18. The symbols F and R of FIG. 20 each show the front and the rear in the longitudinal direction of the vehicle. Further, symbols O and I of FIG. 21 each show the outside and the inside in the width direction of the vehicle.

As shown in FIG. 20 and FIG. 21, the first hydraulic pump unit 10D comprises the pump shaft 110 operatively connected to the driving source 3, a pump body 120 driven by the pump shaft 110, a first port block 130(1) formed with a pair of first operating oil passages 31(1) for supplying/discharging an operating oil to/from the pump body 120, and a pump case 140 connected to the first port block 130(1) so as to accommodate the pump body 120.

As mentioned above, the first hydraulic pump unit 10D is of a variable displacement type in this embodiment.

Therefore, the first pump unit 10D comprises, in addition to the above configuration, an output adjusting member 150 for changing the suction/discharge rates of the pump body 120, and a control shaft 160 for slanting the output adjusting member 150.

In this embodiment, a movable swash plate is used for the output adjusting member 150, and a trunnion shaft is used for the control shaft 160.

In this embodiment, the control shaft 160 extends toward the outside in the width direction of the vehicle, in order to prevent interference with the oil tank 15.

The pump shaft 110 is supported by an assembly, configured by connecting the pump case 140 and the first port block 130(1), so that the input end 111 extends outward from the assembly.

In this embodiment, the input end 111 extends downward from the assembly.

The input end 111 is then operatively connected to the driving source 3 by way of an appropriate transmission mechanism 8 (pulley and belt in the embodiment) (see FIG. 17 and FIG. 18).

In this embodiment, the pump body 120 includes a piston unit 121 for performing a reciprocating movement by the rotation of the pump shaft 110, and a cylinder block 122 for supporting the piston unit 121 in a freely reciprocating manner.

The first port block 130(1) and the pump case 140 are connected to each other to configure a pump body accommodating space S for accommodating the pump body 120.

Figure 22:
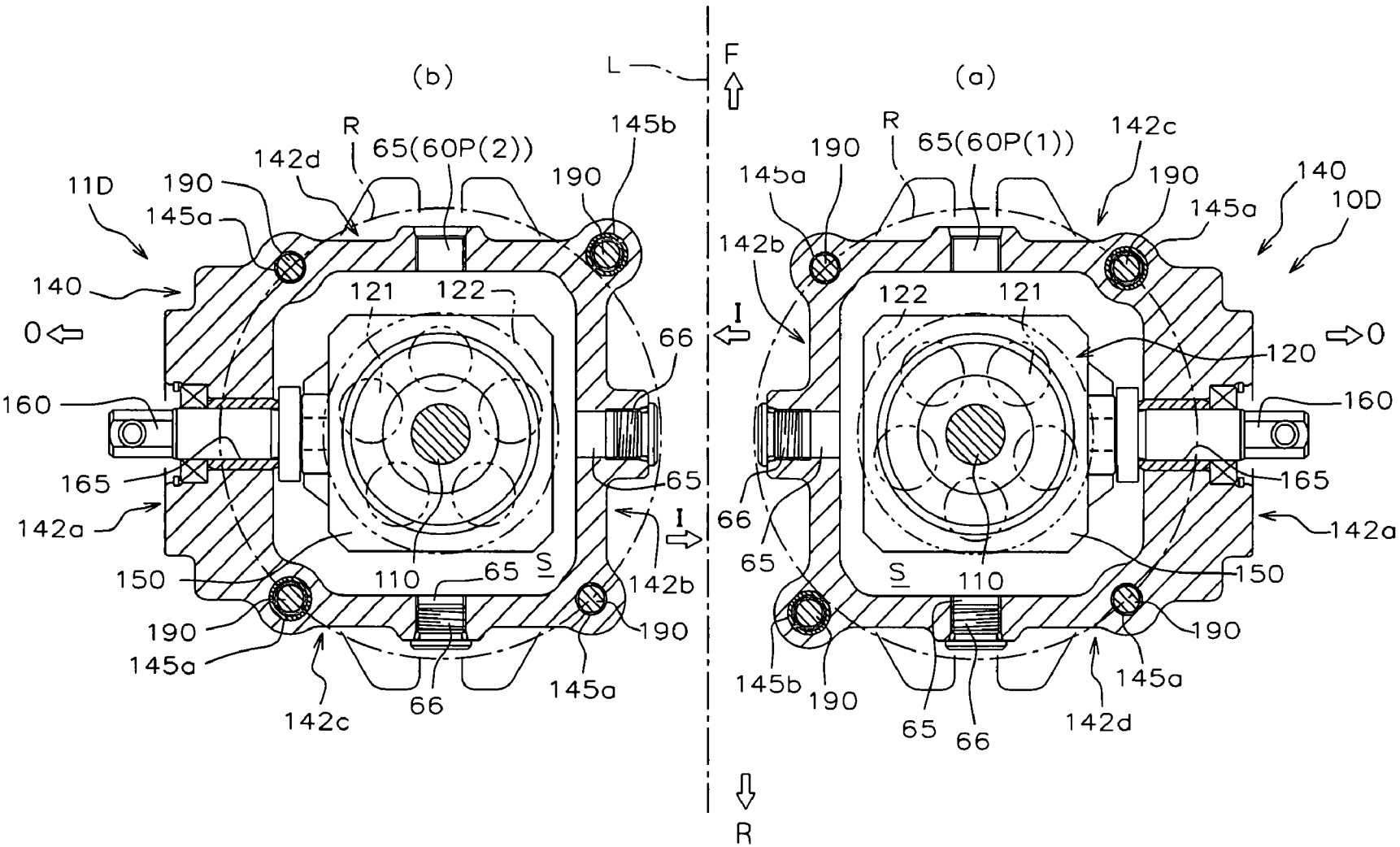
FIGS. 22(*a*) and (*b*) are a transverse plan view of a pump case of the first hydraulic pump unit taken along line 22-22 of FIG. 21 and a transverse plan view of a pump case of the second hydraulic pump unit, respectively.

FIG. 22(*a*) shows a transverse plan view of the pump case 140 taken along line 22-22 of FIG. 21. FIG. 22(*b*) shows a transverse plan view of the pump case 140 in the second hydraulic pump unit 11D.

The symbols F, R, O, and I of FIG. 22 show the front in the longitudinal direction of the vehicle, the rear in the longitudinal direction of the vehicle, the outside in the width direction of the vehicle, and the inside in the width direction of the vehicle, respectively.

As shown in FIG. 20 to FIG. 22, the pump case 140 has an end wall 141 positioned on a first end side in the direction of the pump shaft, and a peripheral wall 142 extending from the end wall 14 toward a second end side in the axis line direction of the pump shaft 110.

The peripheral wall 142 is formed so as to have an opening 143 at the second end side in the axis line direction of the pump shaft 110. The opening 143 is sized to allow the pump body 120 to be inserted thereinto.

As shown in FIG. 22, in this embodiment, the peripheral wall 142 has four peripheral surfaces 142*a* to 142*d* extending along the axis line direction of the pump shaft.

Specifically, the four peripheral surfaces include a first orthogonal plane 142*a* extending in a direction orthogonal to the axis line of the control shaft 160, and formed with a support hole 165 for supporting the control shaft 160 in a freely rotatable manner about the axis line, a second orthogonal plane 142*b* positioned on the opposite side of the first orthogonal plane 142*a* with the pump shaft 110 interposed therebetween, and first and the second parallel planes 142*c*, 142*d* extending parallel to the axis line direction of the control shaft 160.

The second orthogonal plane 142*b*, and the first and second parallel planes 142*c*, 142*d* are each formed with a through hole 65 for opening the pump body accommodating space S outward.

Figure 23:
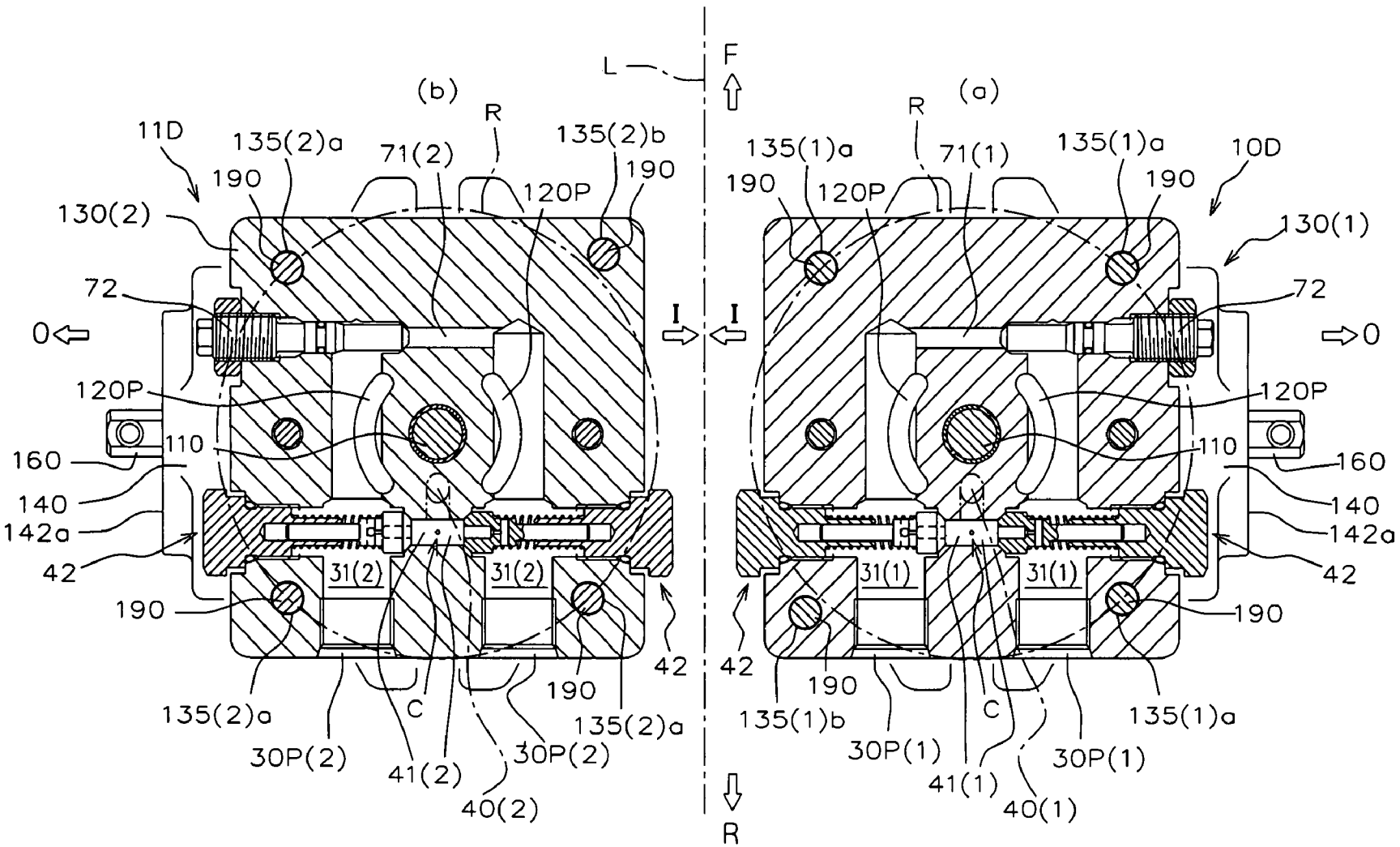
FIGS. 23(*a*) and (*b*) are a transverse plan view of a first port block of the first hydraulic pump unit taken along line 23-23 of FIG. 21, and a transverse plan view of a second port block of the second hydraulic pump unit, respectively.

FIG. 23(*a*) shows a transverse plan view of the first port block 130(1) taken along line 23-23 of FIG. 21. FIG. 23(*b*) shows a transverse plan view of a second port block 130(2) in the second hydraulic pump unit 11D.

The symbols F, R, O, and I of FIG. 23 show the front in the longitudinal direction of the vehicle, the rear in the longitudinal direction of the vehicle, the outside in the width direction of the vehicle, and the inside in the width direction of the vehicle, respectively.

The first port block 130(1) is connected to the pump case 140 so as to close the opening 143 while rotatably supporting the pump body 120 in cooperation with the pump case 140.

Specifically, the first port block 130(1) has a first end face 131 (lower surface in this embodiment) which is orthogonal to the pump shaft 110 and faces the pump case 140.

The first end face 131 includes a support region 131*a* for supporting the pump body 120 in a freely rotating manner, and a contact region 131*b* which is positioned outward in the radius direction of the support region 131*a* and is brought into contact with the pump case 140.

The pump body accommodating space S for accommodating the pump body 120 is defined when the first end face 131 of the first port block 130(1) is brought into contact with the end face of the peripheral wall 142 of the pump case 140.

The relative positional relationship about the pump shaft 110 of the first port block 130(1) and the pump case 140 will be described later.

As shown in FIG. 19 to FIG. 21, in this embodiment, the first hydraulic pump unit 10D further comprises a charge pump unit 170.

The charge pump unit 170 has a charge pump body 171 driven by the corresponding the pump shaft 110, and a charge pump case 172 surrounding the charge pump body 171.

In this embodiment, the charge pump unit 170 is connected to the second end face 132 (upper surface in this embodiment) on the opposite side of the first end face 131 of the first port block 130(1).

Specifically, the pump shaft 110 has a first end forming the input end 111, passing through the end wall 141 of the pump case 140 and extending outward, and a second end 112 passing through the first port block 130(1) and extending outward.

The charge pump body 171 is driven by the second end 112 of the pump shaft 110.

The charge pump case 172 is connected to the second end face 132 of the first port block 130(1) so as to surround the charge pump body 171.

The configuration of the second hydraulic pump unit 11D will now be described.

The second hydraulic pump unit 11D is arranged on the opposite side (left side with respect to the forward movement direction of the vehicle in this embodiment) in the width direction of the vehicle from the first hydraulic pump unit 10D with a virtual central longitudinal plane L as a reference.

In this embodiment, the second hydraulic pump unit 11D is also arranged so that the rotating axis line extends along an approximately vertical direction.

The second hydraulic pump unit 11D substantially has the same configuration as that of the first hydraulic pump unit 10D except for the first port block 130(1).

Accordingly, the same reference numerals are denoted for the members same as those in the first hydraulic pump unit 10D; therefore, the description thereof will not be given herein.

That is, the second hydraulic pump unit 11D comprises the pump shaft 110, the pump body 120, the second port block 130(2) (see FIG. 23(*b*)) formed with a pair of second operating oil passages 31(2) for supplying/discharging an operating oil to/from the pump body 120, the pump case 140 connected to the second port block 130(2) so as to surround the pump case 120, the output adjusting member 150, and the control shaft 160.

The second hydraulic pump unit 11D further comprises the charge pump unit 170, similar to the first hydraulic pump unit 10D.

The relative position of the first and second port blocks 130(1), 130(2) and the corresponding pump case 140 will now be described.

As shown in FIG. 20, FIG. 22 and FIG. 23, the first and second port blocks 130(1), 130(2) are each removably connected to the corresponding pump case 140 by way of a fastening member 190 such as a bolt.

Specifically, as shown in FIG. 22, the pump case 140 includes a connected part 145 arranged asymmetrically with the axis line of the corresponding pump shaft 110 as a reference.

In this embodiment, the connected part 145 includes, when seen along the axis line direction of the pump shaft 110, a reference connected part 145*a* arranged on a same predetermined radius R with the axis line of the pump shaft 110 as a reference, and a displacement connected part 145*b* arranged at a position different in the radius direction from the reference connected part 145*a*.

For instance, the reference connected part 145*a* and the displacement connected part 145*b* are holes with screw formed along the axis line direction of the pump shaft 110 on the peripheral wall 142 so as to open at the end faces facing the first or the second port block 130(1), 130(2) in the peripheral wall 142.

In this embodiment, the reference connected part 145*a* and the displacement connected part 145*b* are asymmetrical with the axis line of the pump shaft 110 as a reference by arranging the reference connected part 145*a* and the displacement connected part 145*b* at a different radius with the axis line of the pump shaft 110 as a reference. Alternatively, both connected parts may be arranged on the same radius and the spacing in the circumferential direction may be changed.

In the state where the first port block 130(1) is arranged on one side (right side with respect to the forward movement direction of the vehicle in this embodiment) in the width direction of the vehicle with the virtual central longitudinal plane L as a reference and the open end of each first operating oil passage 31(1) directed toward a specific direction, the first port block 130(1) is connectable to the pump case 140 only when the corresponding pump case 140 is positioned at a first relative position about the corresponding pump shaft 110.

Specifically, as shown in FIG. 23, the pair of first operating oil passages 31(1) configuring a part of the pair of first operating oil lines (1) are formed in the first port block 130(1) as mentioned above. Each pair of first operating oil passages 31(1) has a first end opening outward to form a pair of first operating oil ports 30P(1) and a second end communicating to each of a pair of kidney ports 120P in the pump body 120.

In the first port block 130(1) of the above configuration, a state where the open end of the first operating oil passage 31(1) is directed toward a specific direction is as follows:

a state where the pair of first operating oil ports 30P(1) are directed to one of the front of the vehicle, the rear of the vehicle, the inside in the width direction of the vehicle or the outside in the width direction of the vehicle in a vehicle mount state where the first hydraulic pump unit 10 has the rotating axis line thereof in an approximately vertical state as shown in the figures, and a state where the pair of first operating oil ports 30P(1) are directed to one of the upside of the vehicle, the downside of the vehicle, the inside in the width direction of the vehicle or the outside in the width direction of the vehicle in a vehicle mount state where the first hydraulic pump unit 10 has the rotating axis line thereof in an approximately horizontal state.

In this embodiment in which the first hydraulic pump unit 10D is mounted to the vehicle so that the rotating axis line is directed to an approximately vertical direction, the direction in which the pair of first operating oil ports 30P(1) face the rear in the front-to-rear direction of the vehicle is the specific direction (see FIG. 23).

Alternatively, the pair of first operating oil ports 30P(1) may face in the front in the front-to-rear direction of the vehicle or the inside or outside in the width direction of the vehicle.

Further, in the vehicle mount state where the rotating axis line of the first hydraulic pump unit 10D is in an approximately horizontal state, the direction in which the pair of first operating oil ports 30P(1) face one of the upside of the vehicle, the downside of the vehicle, the inside in the width direction of the vehicle or the outside in the width direction of the vehicle may be the specific direction.

The first port block 130(1) is so configured to be connectable to the pump case 140 only when the pump case 140 is positioned at the first relative position about the axis line of the pump shaft 110 in a state where the first port block 130(1) is directed toward the relevant specified direction.

More specifically, the first port block 130(1) includes a first connecting part 135(1) which is arranged asymmetrical with the axis line of the pump shaft 110 as a reference and corresponds to the connected part 145 formed in the pump case 140 when the pump case 140 is positioned at the first relative position.

Figure 24:
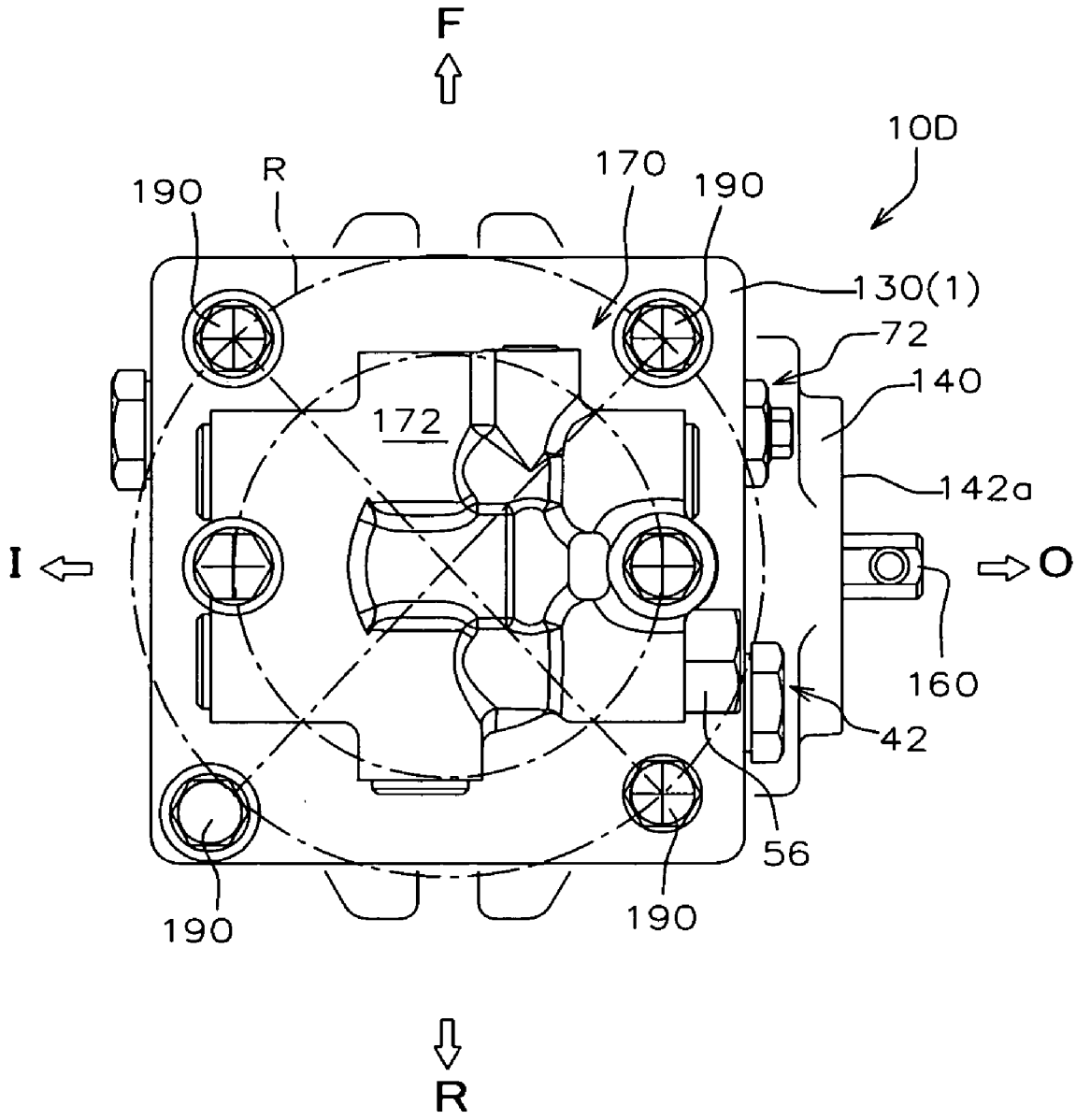
FIG. 24 is an end view of the first hydraulic pump unit seen from the side of the charge pump unit along the axis line of the pump shaft.

FIG. 24 shows an end view of the first hydraulic pump unit 10D seen from the side of the charge pump unit 170 along the axis line of the pump shaft 110.

As shown in FIG. 23 and FIG. 24, the first connecting part 135(1) is arranged to connect with the connected part 145(1) in the state where the first port block 130(1) is directed to the specific direction on one side in the width direction of the vehicle with respect to the center plane L, and the corresponding pump case 140 is positioned at the first relative position about the pump shaft.

In this embodiment, the first relative position of the pump case 140 refers to the position in which the first orthogonal plate 142*a* supporting the control shaft 160 is directed toward the outside in the width direction of the vehicle in the state where the first hydraulic pump unit 10 is arranged on one side in the width direction of the vehicle with the virtual central longitudinal plane L as a reference and the rotating axis line extends along an approximately vertical direction.

Specifically, the first connecting part 135(1) includes a first reference connecting part 135(1)a arranged at a position corresponding to the reference connected part 145*a*, and a first displacement connecting part 135(1)*b* arranged at a position corresponding to the displacement connecting part 145*b*, when the pump case 140 is positioned at the first relative position.

For example, the first reference connecting part 135(1)*a* and the first displacement connecting part 135(1)*b* are through holes without screw formed along the axis line direction of the pump shaft 110 so as to pass through the first end face 131 and the second end face 132.

In this embodiment, the state where the first orthogonal plane 142*a* faces the outside in the width direction of the vehicle is defined as the first relative position of the pump case 140. Alternatively, the first relative position may be the state where the first orthogonal plane 142*a* faces the inside in the width direction of the vehicle or one of the either direction in the front-to-rear direction of the vehicle.

In the case where the first hydraulic pump unit 10D is mounted to the vehicle so that the rotating axis line extends along an approximately horizontal direction, the state where the first orthogonal plane 142*a* faces one of the outside in the width direction of the vehicle, the inside in the width direction of the vehicle, or either the upside or downside of the vehicle may be the first relative position.

On the other hand, the second port block 130(2) is so configured to be connectable to the pump case 140 only when the corresponding pump case 140 is positioned at a second relative position, in the state where the second hydraulic pump unit 11D is arranged with the rotating axis line extending along an approximately vertical direction at the other side (left side with respect to the forward movement direction of the vehicle in this embodiment) in the width direction of the vehicle with the virtual central longitudinal plane L as a reference, and the open end (second hydraulic oil port 30P(2)) of the pair of second operating oil passage 31(2) facing the same direction as the first operating oil port 30P(1) with the virtual central longitudinal plane L as a reference.

That is, as shown in FIG. 23, similar to the first port block 130(1), a pair of second operating oil passages 31(2) each of which has a first end opening outward to form a pair of second operating oil ports 30P(2), and a second end communicated to each of a pair of kidney ports 120P in the pump body 120 are formed in the second port block 130(2).

In this embodiment, the second port block 130(2) of the above configuration is arranged so that the second operating oil port 30P(2) is directed in the same direction as the first operating oil port 30P(1) with the virtual central longitudinal plane L as a reference.

Herein, the same direction with the virtual central longitudinal plane L as a reference means that the second operating oil port 30P(2) is also directed to the rear in the front-to-rear direction of the vehicle in the case where the first operating oil port 30P(1) is directed to the rear in the front-to-rear direction of the vehicle, the second operating oil port 30P(2) is also directed to the inside in the width direction of the vehicle in the case where the first operating oil port 30P(1) is directed to the inside in the width direction of the vehicle, and the second operating oil port 30P(2) is also directed toward the outside in the width direction of the vehicle in the case where the first operating oil port 30P(1) is directed to the outside in the width direction of the vehicle.

As mentioned above, the second port block 130(2) is so configured to be connectable to the pump case 140 only when the corresponding pump case 140 is positioned at the second relative position about the axis line of the pump shaft 110 while facing the same direction as the first port block 130(1) with the virtual central longitudinal plane L as a reference.

More specifically, the second port block 130(2) includes a second connecting part 135(2).

The second connecting part 135(2) is arranged so as to be connectable to the connected part 145 of the corresponding pump case 140 only in the state where the second port block 130(2) is arranged in the same direction as the first port block 130(1) with the virtual central longitudinal plane L as a reference on the other side in the width direction of the vehicle and the corresponding pump case 140 is positioned at the second relative position about the axis line of the pump shaft 110.

The second relative position of the pump case 140 connected to the second port block 130(2) means a position in which the first orthogonal plane 142*a* of the pump case 140 faces the same direction as the first orthogonal plane 142*a* of the pump case 140 connected to the first port block 130(1) with the virtual central longitudinal plane L as a reference.

That is, in the case where the first hydraulic pump unit 10D is mounted to the vehicle so that the rotating axis line extends along an approximately vertical direction, assuming that the orientation in which the first orthogonal plane 142*a* of the pump case 140 connected to the first port block 130(1) faces each of the outside in the width direction of the vehicle, the inside in the width direction of the vehicle, the front of the vehicle or the rear of the vehicle is the first relative position of the pump case 140, the second relative position of the pump case 140 connected to the second port block 130(2) refers to the orientation in which the first orthogonal plane 142*a* of the pump case 140 faces each of the outside in the width direction of the vehicle, the inside in the width direction of the vehicle, the front of the vehicle or the rear of the vehicle.

Alternatively, if the first hydraulic pump unit 10D is mounted to the vehicle so that the rotating axis line extends along an approximately horizontal direction, assuming that the orientation in which the first orthogonal plane 142*a* of the pump case 140 connected to the first port block 130(1) faces each of the outside in the width direction of the vehicle, the inside in the width direction of the vehicle, the upside or downside of the vehicle is the first relative position of the pump case 140, the second relative position of the pump case 140 connected to the second port block 130(2) refers to the orientation in which the first orthogonal plane 142*a* of the pump case 140 faces each of the outside in the width direction of the vehicle, the inside in the width direction of the vehicle, the upside or downside of the vehicle.

In this embodiment, as mentioned above, the first relative position of the pump case 140 connected to the first port block 130(1) is the position in which the first orthogonal plane 142*a* faces the outside in the width direction of the vehicle while arranged on one side in the width direction of the vehicle with the virtual central longitudinal plane L as a reference.

Therefore, for the pump case 140 connected to the second port block 130(2), the second relative position is the position in which the first orthogonal plane 142*a* faces the outside in the width direction of the vehicle while arranged on the other side in the width direction of the vehicle with the virtual central longitudinal plane L as a reference.

In the hydraulic pump set 100D of the above configuration, the following effects can be obtained.

The components of the first and second hydraulic pump units 10D, 11D are common except for the port block, as mentioned above.

That is, the hydraulic pump set 100D according to this embodiment has the pump body 120, the pump case 140 and the pump shaft 110 as common components.

Therefore, the manufacturing cost and the managing cost of the common components can be reduced.

Further, in this embodiment, the first port block 130(1) is connectable to the pump case 140 only when the corresponding pump case 140 is positioned at the first relative position about the axis line of the pump shaft 110.

Similarly, the second port block 130(2) is connectable to the pump case 140 only when the corresponding pump case 140 is positioned at the second relative position about the axis line of the pump shaft 110.

In the above configuration, the relative position of the first orthogonal plane 142*a* in the pump case 140 and the operating oil ports 30P(1), 30P(2) in each port block 130(1), 130(2) is always fixed.

Therefore, at a hydraulic apparatus manufacturer, the disadvantage of erroneously connecting between the port block and the pump case with respect to the relative position therebetween can be effectively prevented.

Further, since the assembling work does not need to be carried out while paying attention to the relative position of the two, the assembling work efficiency of the port block and the pump case can be enhanced; thus, the precisely assembled hydraulic pump units 10, 11 for left and for right can be supplied to a vehicle manufacturer.

The hydraulic circuit of the first and second hydraulic pump units 10D, 11D will now be described focusing on the first hydraulic pump unit 10D.

The hydraulic circuit of the second hydraulic pump unit 11D is substantially the same as the hydraulic circuit of the first hydraulic pump unit 10D. Therefore, in the figures, the same reference numerals added with (2) are denoted for the same members or the corresponding members.

As shown in FIG. 19, the first hydraulic pump unit 10D includes the pair of operating oil lines 30(1) for fluidly connecting to the corresponding first hydraulic motor unit 20, a charge line 50(1) having a first end fluidly connected to the oil tank 15 and a second end fluidly connected to each operating oil line 30(1), and a drain line 60(1) having a first end communicated to the pump body accommodating space S and a second end communicated to the oil tank 15.

As shown in FIG. 19 and FIG. 23, the pair of operating oil lines 30(1) include the pair of first operating oil passages 31(1) perforated in the first port block 130(1), and a pair of operating oil conduits 32 (see FIG. 17 and FIG. 18) for communicating the pair of first operating oil passages 31(1) to the first hydraulic motor unit 20.

Figure 25:
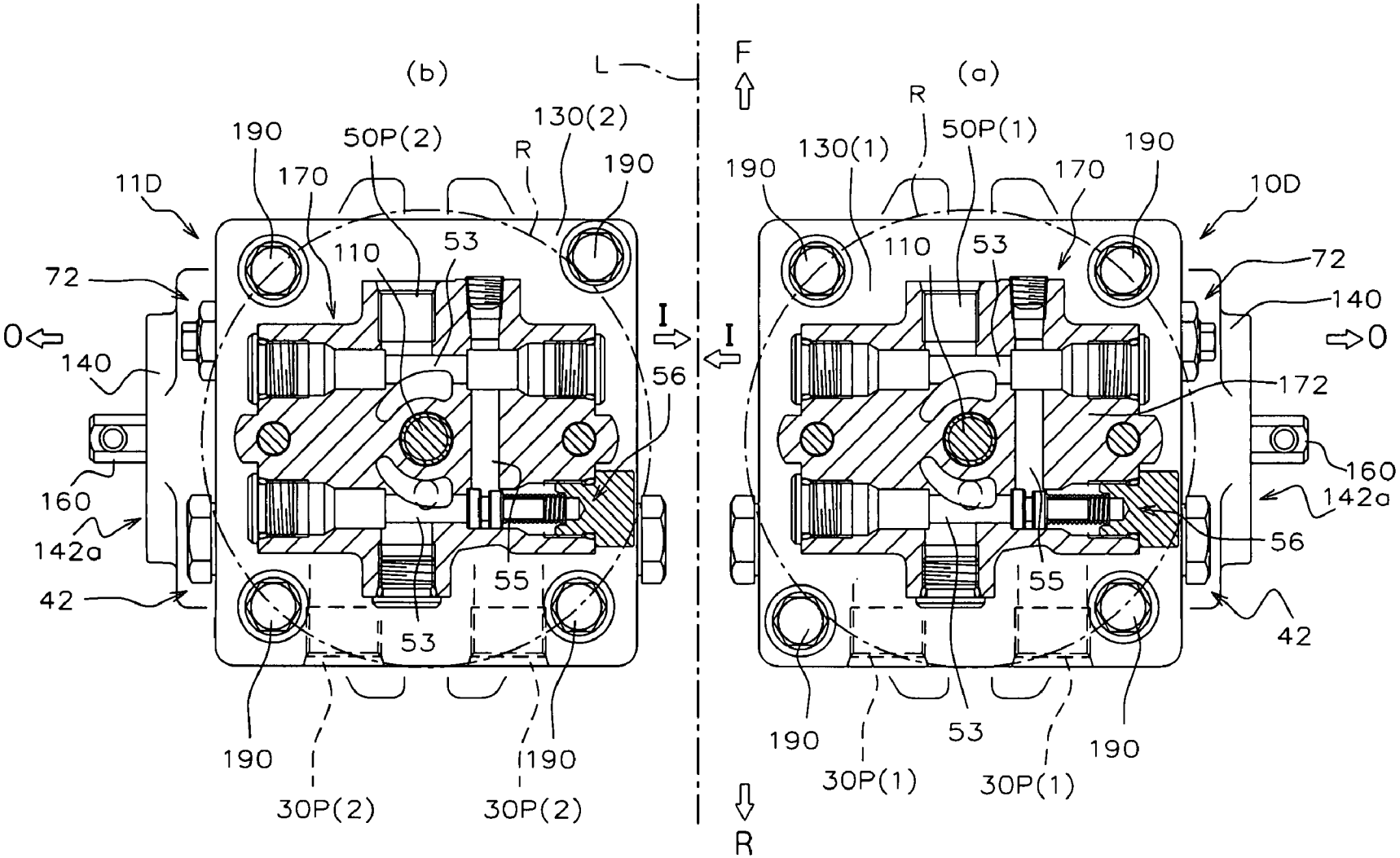
FIGS. 25(*a*) and (*b*) are a transverse plan view of a charge pump case of the first hydraulic pump unit taken along line 25-25 of FIG. 20, and a transverse cross sectional view of a charge pump case of the second hydraulic pump unit, respectively.

FIG. 25(*a*) shows a transverse plan view of the charge pump case 172 in the first hydraulic pump unit 10D taken along line 25-25 of FIG. 20. FIG. 25(*b*) shows a transverse cross sectional view of the charge pump case 172 in the second hydraulic pump unit 11D.

As shown in FIG. 19, the charge line 50(1) includes a charge conduit 51 having a first end communicated to the oil tank 15, and a charge oil passage 52(1) having a first end opened at the external surface of the assembly to form the charge suction port 50P(1) and a second end communicated to each operating oil line 30(1).

Similarly, the charge line 50(2) in the second hydraulic pump unit 11D includes a charge conduit 51 having a first end communicated to the oil tank 15, and a charge oil passage 52(2) having a first end opened at the external surface of the assembly to form the charge suction port 50P(2) and a second end communicated to the corresponding operating oil line 30(2).

In this embodiment, the charge oil passage 52(1) includes a first charge oil passage 53 formed in the charge pump case 172, and a second charge oil passage 54(1) formed in the first port block 130(1).

Similarly, the charge oil passage 52(2) includes a first charge oil passage 53 formed in the charge pump case 172, and a second charge oil passage 54(2) formed in the second port block 130(2).

That is, the first charge oil passage 53 has a first end opening at the external surface of the charge pump case 172 so as to form the charge suction port 50P(1), 50P(2), and a second end opening at the surface 172*a* which is brought into contact with the corresponding first or second port block 130(1), 130(2).

Both the first and second port blocks 130(1), 130(2) are so configured to support the corresponding charge pump case 172 in a state where the respective charge suction port 50P(1), 50P(2) face the same direction with the virtual central longitudinal plane L as a reference.

In this embodiment, the first port block 130(1) can support the corresponding charge pump case 172 so that the charge suction port 50P(1) is directed to the front of the vehicle with the first operating oil port 30P(1) arranged so as to be directed to the rear of the vehicle.

The second port block 130(2) can support the corresponding charge pump case 172 so that the charge suction port 50P(2) is directed to the front of the vehicle with the second operating oil port 30P(2) arranged so as to be directed in the same direction as the first operating oil port 30P(1) with the virtual central longitudinal plane L as a reference.

As mentioned above, by directing the operating oil port 30P and the charge suction port 50P in the opposite direction in each pump unit 10D, 11D, the interference between the operating oil conduit 32 and the charge conduit 51 can be effectively prevented.

In this embodiment, the charge pump body 171 is inserted into the first charge oil passage 53.

Further, a charge pressure setting line 55 for connecting a front stream side and a back stream side in a flow direction of the charge oil is formed in the charge pump case 172 with the charge pump body 171 interposed therebetween. A relief valve 56 is inserted into the charge pressure setting line 55.

The second charge oil passages 54(1), 54(2) are formed in the first and second port blocks 130(1), 130(2), respectively, so as to have a first end opening at the second end face 132 to communicate to the second end of the corresponding first charge oil passage 53 and a second end communicating to the corresponding operating oil passage 31(1), 31(2).

Specifically, the second charge oil passage 54(1) in the first hydraulic pump unit 10D includes a common charge oil passage 40(1) communicated to the first charge oil passage 53, and a pair of branched oil passages 41(1) branched from the common charge oil passage 40(1) at a branch point C and communicated to the pair of operating oil passages 31(1), respectively (see FIG. 19 and FIG. 22).

Similarly, the second charge oil passage 54(2) in the second hydraulic pump unit 11D includes a common charge oil passage 40(2) communicated to the first charge oil passage 53, and a pair of branched oil passages 41(2) branched from the common charge oil passage 40(2) at the branch point C and communicated to the pair of operating oil passages 31(2), respectively (see FIG. 19 and FIG. 22).

A check valve 42 is provided in each branched oil passage 41(1), 41(2).

The check valve 42 is provided to allow the flow of the pressure oil from the charge line 50 to the pair of operating oil lines 30(1), 30(2) and to prevent the pressure oil from flowing in a reverse direction.

In this embodiment, the check valve 42 includes a throttle 43 (see FIG. 19); thus, a neutral state of the HST can be obtained without the need of strictly controlling the output adjusting member 150.

As shown in FIG. 23, in this embodiment, the pair of branched oil passages 41(1) extend in the direction approximately orthogonal to the pair of operating oil passages 31(1) so as to communicate the corresponding pair of operating oil passages 31(1).

That is, the pair of branched oil passages 41(1) are formed as a single oil passage for communicating the pair of operating oil passages 31(1), and the common charge oil passage 40(1) is communicated to the single oil passage at the branch point C.

With the above configuration, the pair of branched oil passages 41(1) can be efficiently arranged.

The drain lines 60(1), 60(2) include drain ports 60P(1), 60P(2) for communicating the corresponding pump body accommodating space S outward, and a drain conduit 62 having a first end communicated to the drain ports 60P(1), 60P(2), and a second end communicated to the oil tank 15.

As shown in FIG. 20 and FIG. 22, in this embodiment, the drain ports 60P(1), 60P(2) are formed in the corresponding pump case 140.

As mentioned above, the through holes 65 are formed in the pump case 140 at the peripheral surfaces other than the first orthogonal plane 142*a* (see FIG. 22 and the like).

The pump case 140 in the first hydraulic pump unit 10D uses the through hole 65 formed in the peripheral surface facing the front of the vehicle (first parallel plane 142*c*) as the drain port 60P(1) while positioned in the first relative position (see FIG. 22(*a*)).

On the other hand, the pump case 140 in the second hydraulic pump unit 11D uses the through hole 65 formed in the peripheral surface facing the front of the vehicle (second parallel plane 142*d*) as the drain port 60P(2) while positioned in the second relative position (see FIG. 22(*b*)).

In the pump case 140, the through holes 65 not used are closed by plugs 66.

As mentioned above, in this embodiment, at least two opening 65 are provided in the each pump case 140 so that the drain ports 60P(1), 60P(2) are directed in the same direction when the pump case 140 is placed on the first relative position or on the second relative position.

Therefore, the drain lines 60(1), 60(2) in the first and second hydraulic pump units 10D, 11D can be efficiently connected to the oil tank 15.

In this embodiment, the drain ports 60P(1), 60P(2) of the first and second hydraulic pump units 10D, 11D are configured so as to be directed to the front in the front-to-rear direction of the vehicle; however, the present invention is of course not limited to this form.

That is, as long as the drain ports 60P(1), 60P(2) are directed in the same direction with the virtual central longitudinal plane L as a reference, various forms are applicable. For instance, the drain ports 60P(1), 60P(2) may be configured to be directed to the rear in the front-to-rear direction of the vehicle, or the drain ports 60P(1), 60P(2) may be configured to be directed to the inside in the width direction of the vehicle or to be directed to the outside in the width direction of the vehicle. Further, the drain ports 60P(1), 60P(2) may be configured so that when the first and second hydraulic pump units 10D, 11D are mounted with the rotating axis line thereof in an approximately horizontal state, the drain ports 60P(1), 60P(2) are directed upward or downward in the vertical direction of the vehicle.

Further, the first and second hydraulic pump units 10D, 11D include bypass lines 70(1), 70(2) for communicating between the pair of first and the second operating oil lines 30(1), 30(2).

The bypass line 70(1) is provided to prevent the pressure difference from being occurred between the pair of first operating oil lines 30(1) when forcibly towing the vehicle at the time of fault and the like.

The bypass line 70(2) has substantially the same configuration as that of the bypass line 70(1). Therefore, the description of the bypass line 70(2) will not be given herein.

In this embodiment, the bypass line 70(1) includes a bypass oil passage 71(1) formed in the first port block so as to communicate the pair of first operating oil passages 31(1), and a switching valve 72 for selectively communicating/blocking the bypass oil passage 71(1).

The bypass oil passage 71(1) is positioned on the opposite side of the single oil passage configuring the pair of branched oil passages 41(1) with the pump shaft 110 interposed therebetween.

That is, in this embodiment, as shown in FIG. 23, the first operating oil passage 31(1) has the internal end extending to a region on the opposite side of the operating oil port 31P(1) with the pump shaft 110 as a reference.

The single oil passage configuring the pair of branched oil passages 41(1), and the bypass oil passage 71(1) are distributed and arranged with the pump shaft 110 interposed therebetween (see FIG. 23), thereby achieving an efficient arrangement of the pair of operating oil passages 31(1), the pair of branched oil passages 41(1) and the bypass oil passage 71(1).

The bypass oil passages 71(1), 71(2) in the first and second port blocks 130(1), 130(2) both have a first end opening outward, and the switching valve 72 is operable from the open end. Preferably, each open end faces the same direction with the virtual central longitudinal plane L as a reference.

In this embodiment, the bypass oil passages 71(1), 71(2) in the first and second port block 130(1), 130(2) are formed so that each open end is directed toward the outside in the width direction of the vehicle.

Embodiment 5

Another embodiment of the hydraulic pump set according to the second aspect of the present invention will now be described with reference to the accompanying drawings.

In this embodiment, the same reference numerals or the same reference numerals added with "E" are denoted for the members same as or corresponding to those in the fourth embodiment 4; therefore, the detailed description thereof will not be given herein.

Figure 26:
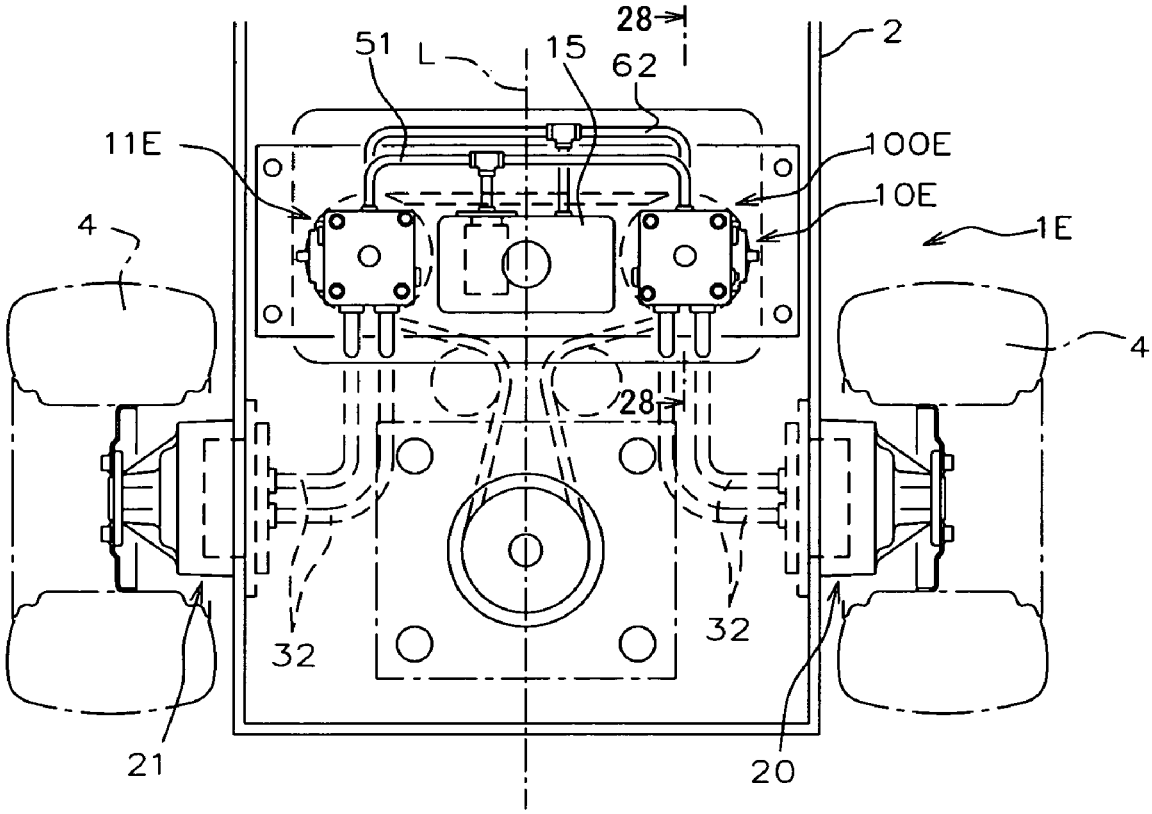
FIG. 26 is a partial plan view of a working vehicle applied with a hydraulic pump set according to a fifth embodiment of the present invention.
Figure 27:
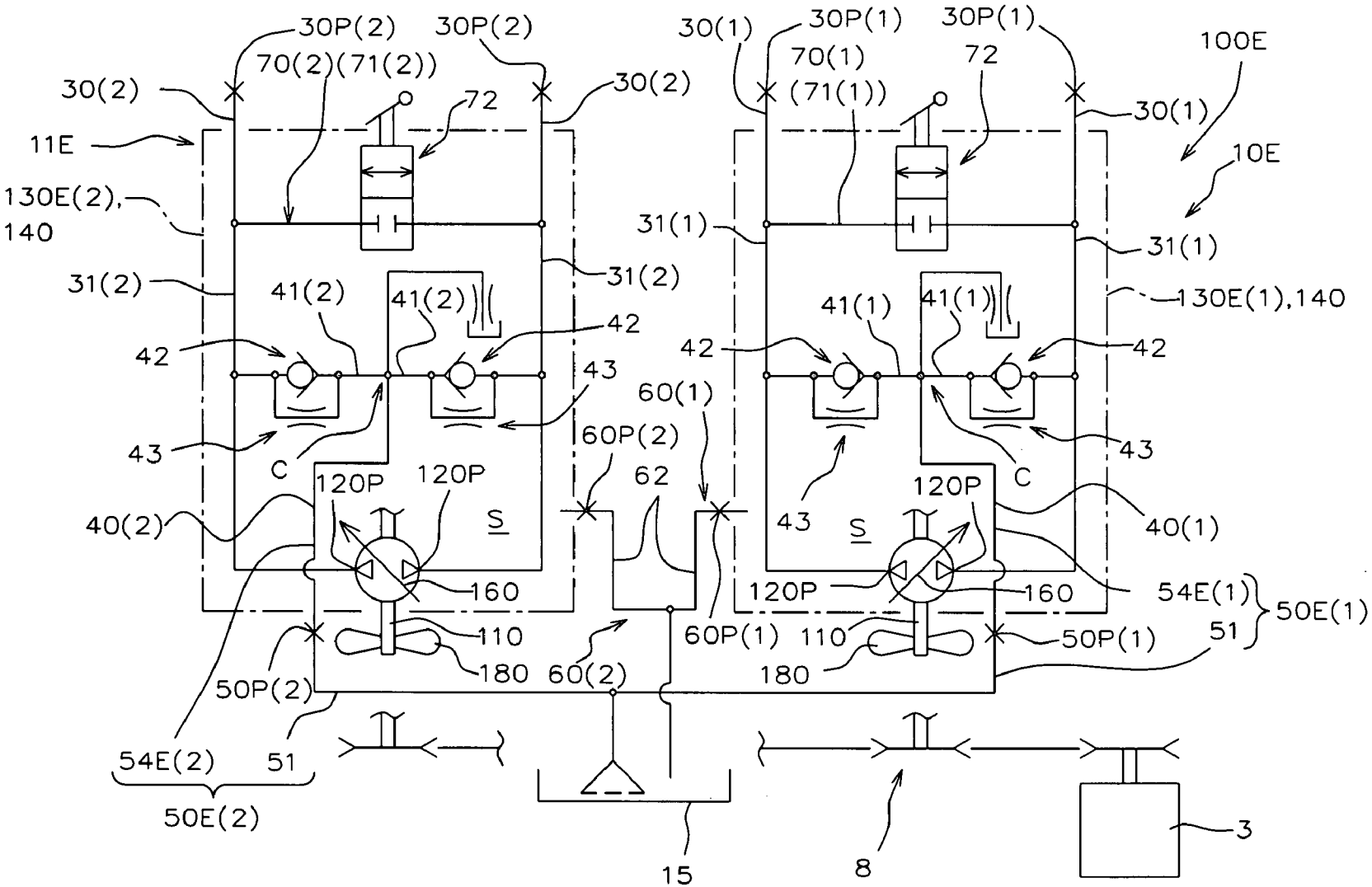
FIG. 27 is a hydraulic circuit diagram of the hydraulic pump set according to the fifth embodiment of the present invention.

FIG. 26 shows a partial plan view of a working vehicle 1E applied with a hydraulic pump set 100E according to this embodiment. FIG. 27 is a hydraulic circuit diagram of the hydraulic pump set 100E.

Figure 28:
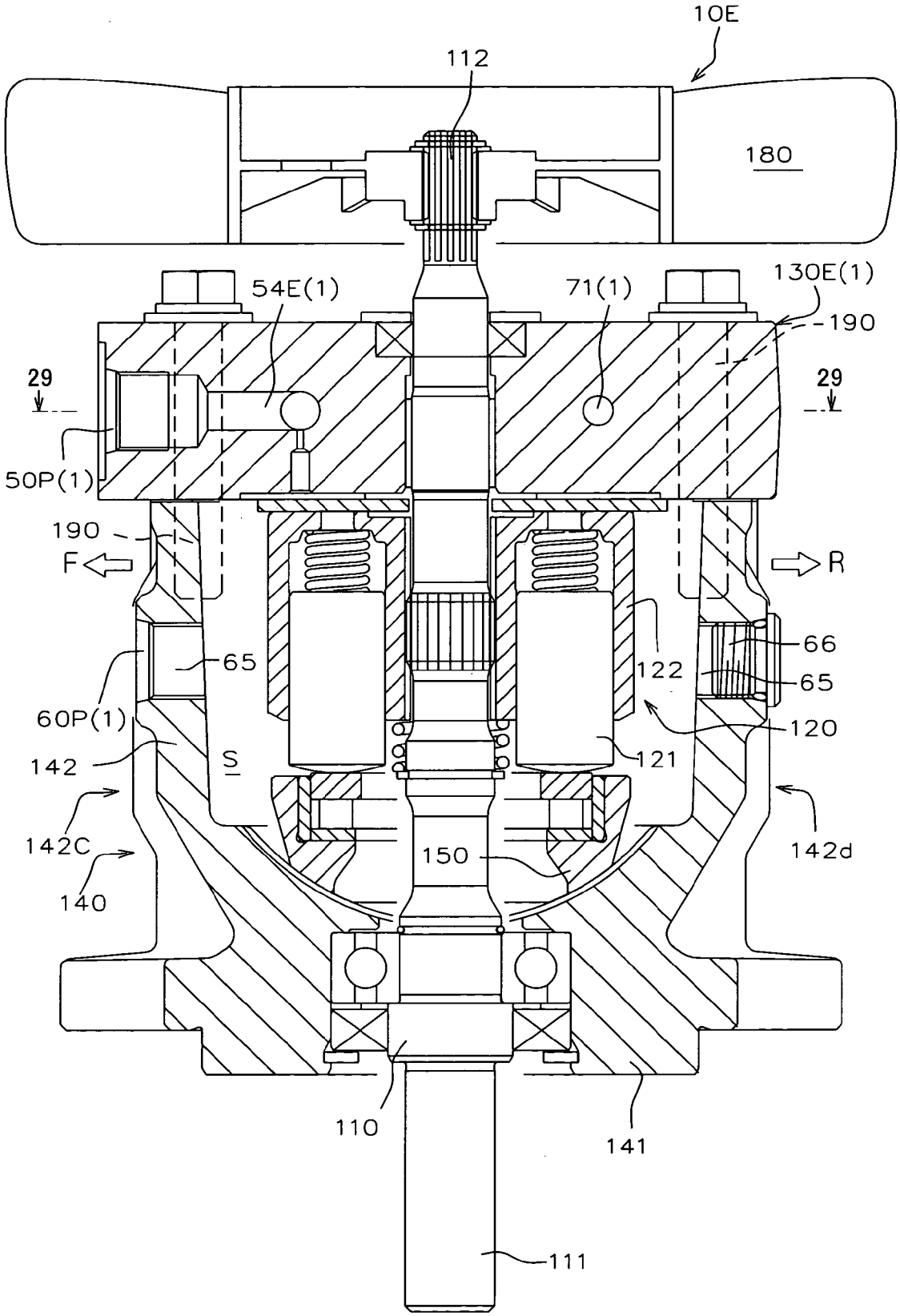
FIG. 28 is a cross sectional view taken along line 28-28 of FIG. 26.
Figure 29:
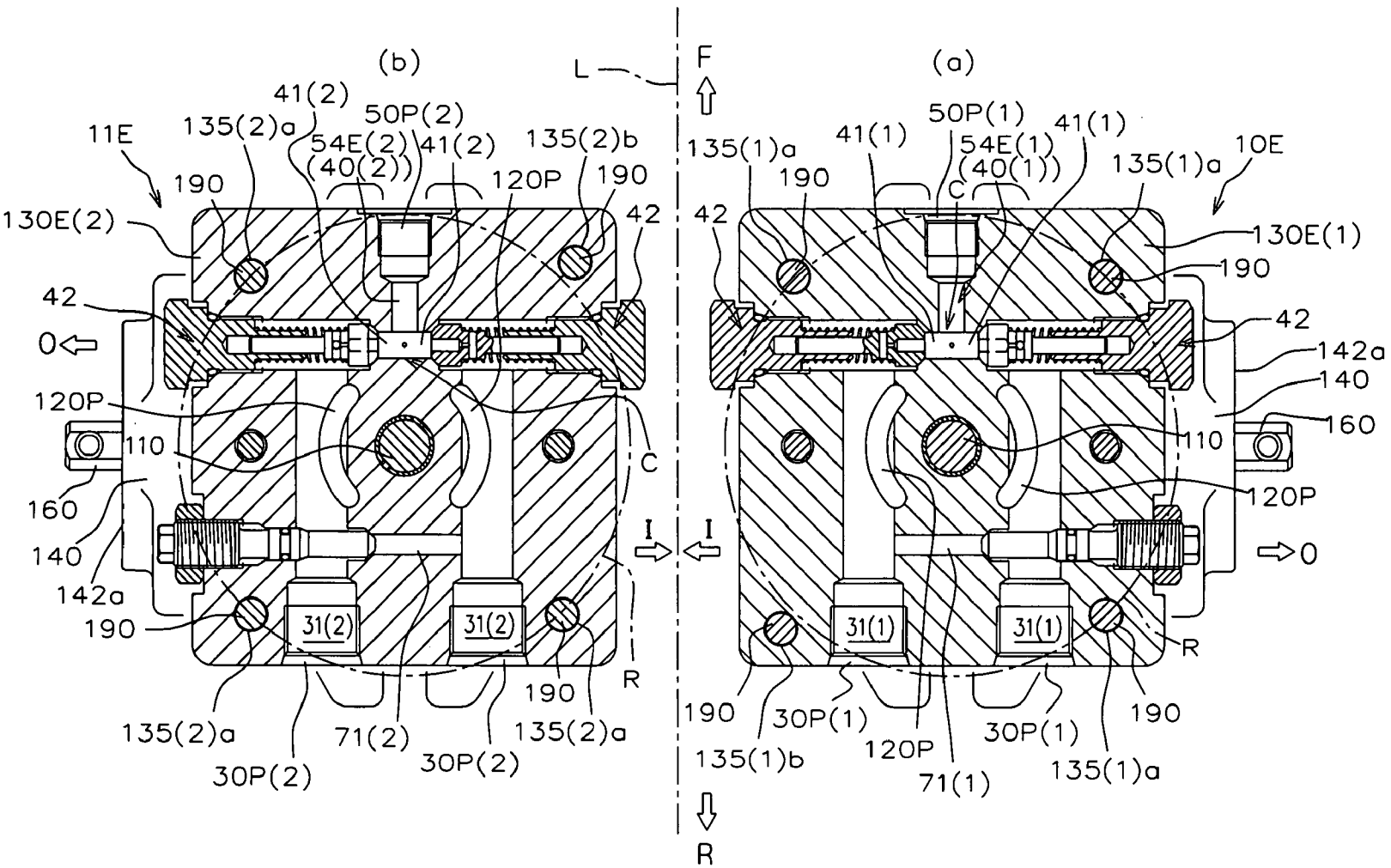
FIGS. 29(*a*) and (*b*) are a cross sectional plane view of the first port block of a first hydraulic pump unit taken along line 27-27 of FIG. 28, and a transverse plan view of a second port block of a second hydraulic pump unit, respectively.

Further, FIG. 28 shows a cross sectional view taken along line 28-28 of FIG. 26. FIG. 29(*a*) is a cross sectional view taken along line 29-29 of FIG. 28 and shows a transverse plan view of the first port block 130E(1). FIG. 29(*b*) shows a transverse plan view of the second port block 130E(2).

FIG. 28 and FIG. 29 correspond to FIG. 20 and FIG. 23, respectively, of the fourth embodiment.

As shown in FIG. 26 to FIG. 29, the hydraulic pump set 100E according to this embodiment comprises a first hydraulic pump unit 10E and a second hydraulic pump unit 11E, arranged approximately symmetrically with a reference plane (virtual central reference plan L in this embodiment) interposed therebetween.

The first and second hydraulic pump units 10E, 11E respectively include a cooling fan 180 in place of the charge pump unit 170 in the first and second hydraulic pump units 10D, 11D.

In this embodiment, the first and second hydraulic pump units 10E, 11E are also mounted to the vehicle so that the rotating axis line extends along an approximately vertical direction, similar to the fourth embodiment.

As mentioned above, by providing the cooling fan 180 in place of the charge pump unit 170, the charge suction ports 50P(1), 50P(2) are provided in the first and second port block 130E(1), 130E(2), respectively, in this embodiment (see FIG. 29).

That is, in the fourth embodiment, the charge oil is forcibly sucked by the charge pump unit 170. However, in this embodiment, the charge oil is naturally sucked.

More specifically, the charge line 50E(1) in the first hydraulic pump unit 10E includes the charge conduit 51 and a first charge oil passage 54E(1) formed in the first port block 130E(l), as shown in FIG. 27.

As shown in FIG. 29, the first charge oil passage 54E(1) is formed in the first port block 130E(1) so as to have a first end opening at the external surface of the first port block 130E(1) to form the charge suction port 50P(1), and a second end communicating to each operating oil passage 31(1).

More specifically, the first charge oil passage 54E(1) includes the common charge oil passage 40(1) forming the charge suction port 50P(1), and the pair of branched oil passages 41(1) which are branched from the common charge oil passage 40(1) at the branch point C and are communicated to the pair of operating oil passages 31(1).

In this embodiment, as shown in FIG. 29, the single oil passage communicating the pair of first operating oil passages 31(1) configures the pair of branched oil passages 41(1) at the region on the opposite side of the first operating oil port 30P(1) with the corresponding pump shaft 110 interposed therebetween.

With the above configuration, the charge suction port 50P(1) can be easily positioned on the opposite side of the first operating oil port 30P(1), and the interference between the operating oil conduit 32 and the charge conduit 51 can be prevented.

In this embodiment, the bypass oil passage 71(1) is arranged on the opposite side of the pair of branched oil passages 41(1) with the pump shaft 110 interposed therebetween (that is, side proximate the operating oil port 30P(1)).

Effects similar to those in the fourth embodiment can be also obtained in the working vehicle of the above configuration.

In the fourth and fifth embodiments, the drain ports 60P(1), 60P(2) are arranged in the pump case 140. Alternatively, the drain ports 60P(1), 60P(2) may be arranged in the port block 130, 130E or the charge pump case 172.

Embodiment 6

Still another embodiment of the hydraulic pump set according to the second aspect of the present invention will now be described with reference to the accompanying drawings.

Figure 30:
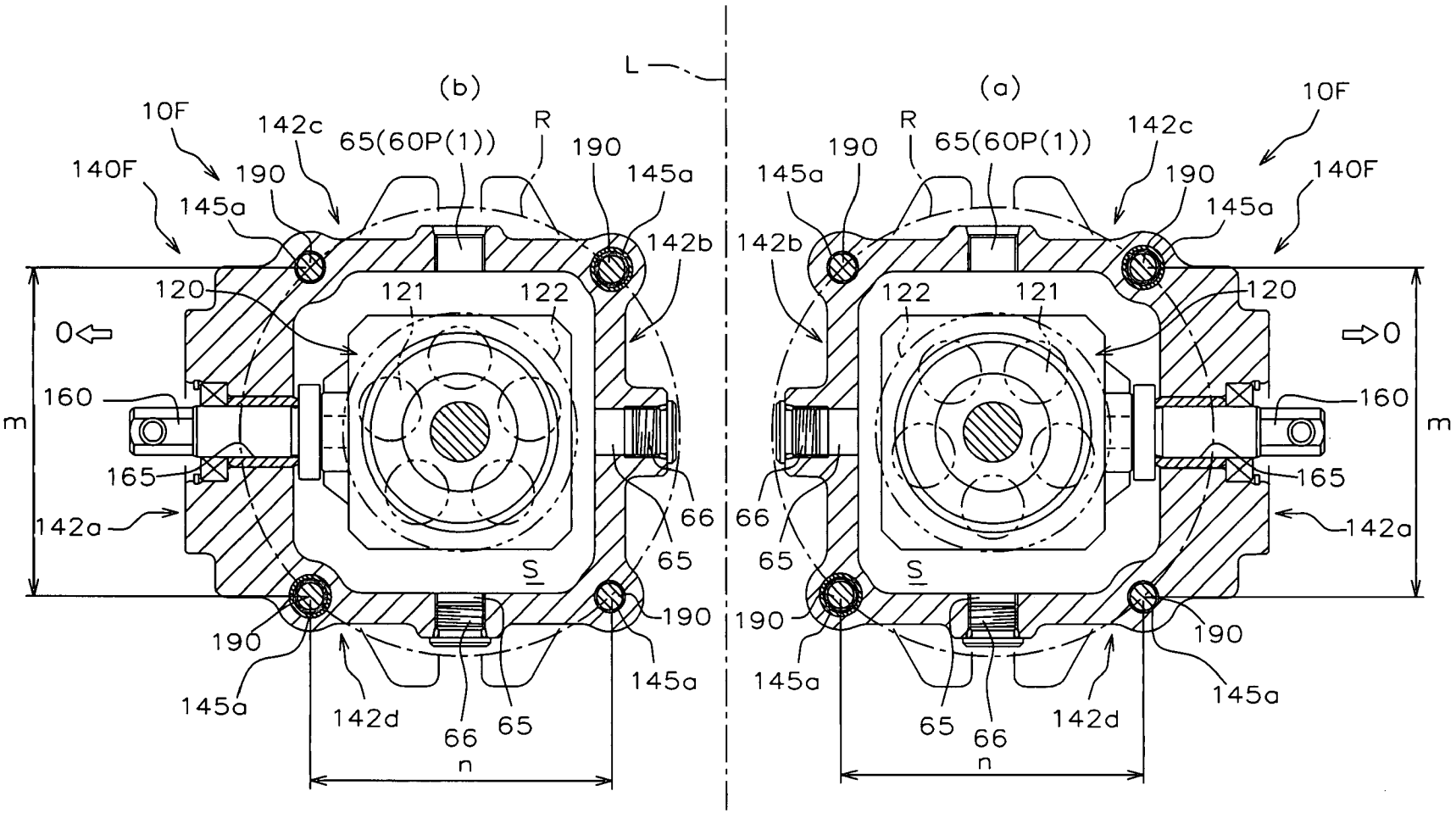
FIG. 30 is a transverse plan view of pump cases of a hydraulic pump set according to a sixth embodiment of the present invention.
Figure 31:
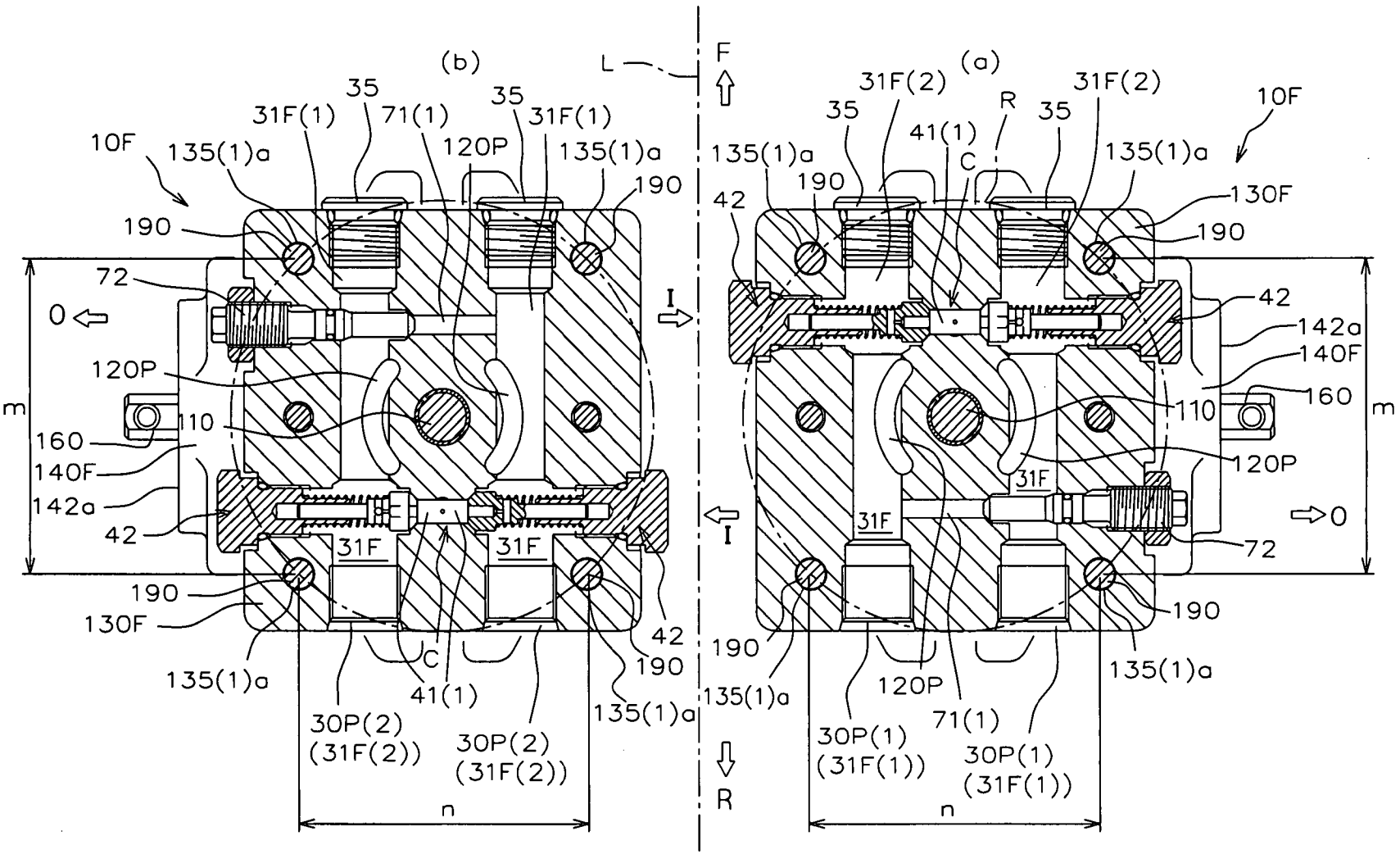
FIG. 31 is a transverse plan view of port blocks of the hydraulic pump set according to the sixth embodiment of the present invention.

FIG. 30 and FIG. 31 show transverse plan views of pump cases 140F and port blocks 130F, respectively, in the hydraulic pump set according to this embodiment. FIG. 30 and FIG. 31 correspond to FIG. 22 and FIG. 23, respectively, of the fourth embodiment.

Figure 32:
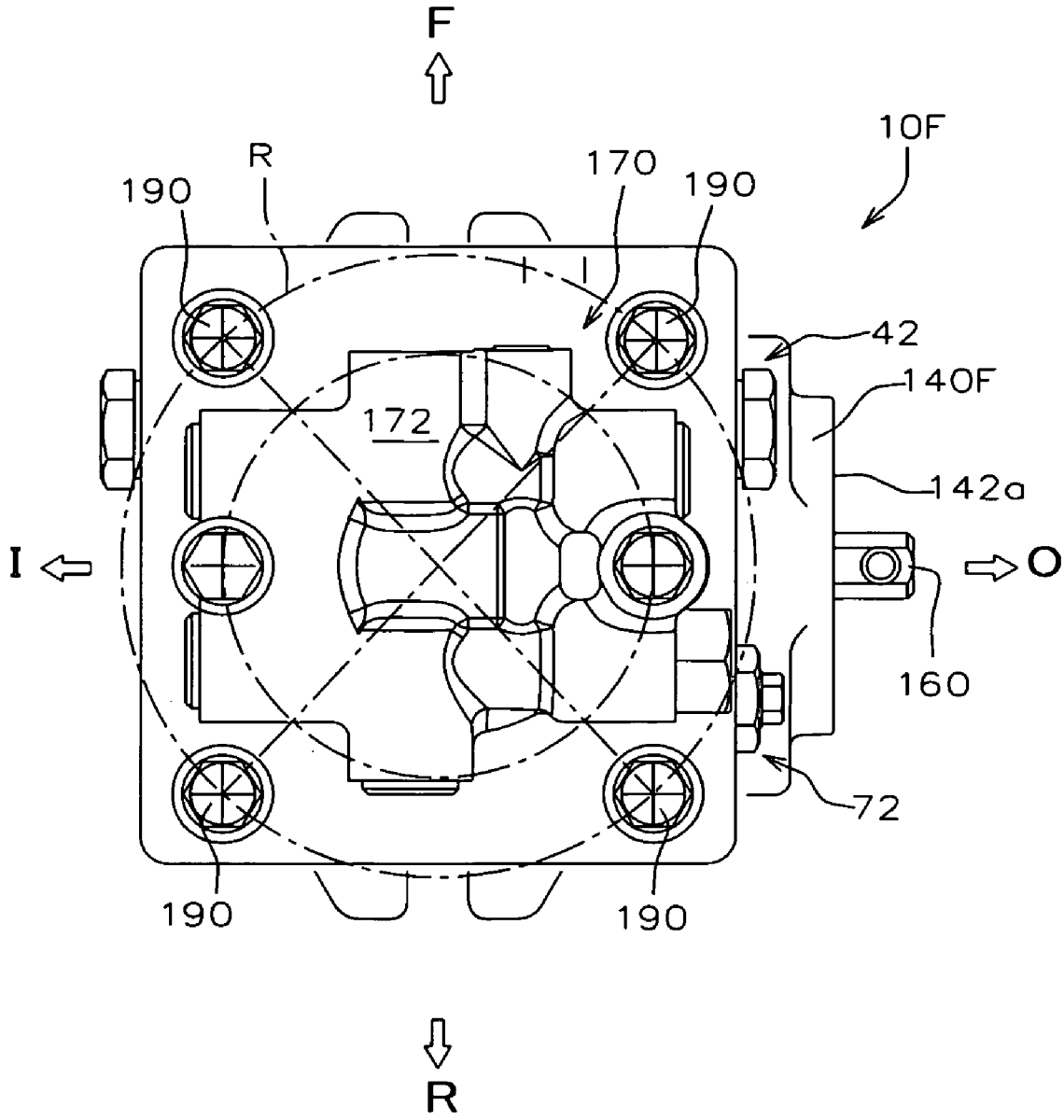
FIG. 32 is an end view of a hydraulic pump unit of the hydraulic pump set according to the sixth embodiment of the present invention.

FIG. 32 shows an end view of a hydraulic pump unit 10F in the hydraulic pump set. This end view is seen from the side of the charge pump unit 170 along the axis line of the pump shaft 110. FIG. 32 corresponds to FIG. 24 of the fourth embodiment.

The same reference numerals are denoted for the members same as or corresponding to those in the fourth and fifth embodiments; therefore, the detailed description thereof will not be given herein.

As shown in FIG. 30 to FIG. 32, the hydraulic pump set according to this embodiment comprises a pair of common hydraulic pump units 10F.

That is, in the fourth and fifth embodiments, the first and second hydraulic pump units include different port blocks to each other. However, in this embodiment, the first and second hydraulic pump units are entirely of the same configuration.

Specifically, the hydraulic pump unit 10F comprises the pump body 120, the port block 130F capable of supporting the pump body 120, the pump case 140F removably connected to the port block 130F so as to accommodate the pump body 120, the pump shaft 110, and the control shaft 160.

The port block 130F includes, as shown in FIG. 31, a pair of operating oil passages 31F extending in a direction orthogonal to the control shaft 160 with the pump case 140F connected thereto.

The pair of operating oil passages 31F are distributed and arranged with the pump shaft 110 interposed therebetween.

Further, the pair of operating oil passages 31F are configured so as to have a first end 31F(1) and a second end 31F(2) each of which opens outward to form the operating oil ports 30P(1), 30P(2).

That is, in this embodiment, the pair of operating oil passages 31F with both ends 31F(1), 31F(2) forming the open end are directed in the same direction, even if an assembly, configured by connecting the port block 130F and the pump case 140F, is rotated by 180 degrees about the pump shaft 110, as shown in FIG. 30 and FIG. 31.

According to the above configuration, the control shaft 160 and the operating oil passage 31F are directed in the same direction with the virtual central longitudinal plane L as a reference by arranging one assembly so that the control shaft 160 is directed to the outside in the width direction of the vehicle on one side in the width direction of the vehicle with the virtual central longitudinal plane L as a reference (right side with respect to the forward movement direction of the vehicle shown in the figures (see FIG. 31(*a*))) and, also, arranging the other assembly on the other side in the width direction of the vehicle with the virtual central longitudinal plane L as a reference (left side with respect to the forward movement direction of the vehicle shown in the figures) while rotated by 180 degrees about the pump shaft with respect to the one assembly.

Accordingly, the operating oil port 30P(1) of the one assembly and the operating oil port 30P(2) of the other assembly can be directed in the same direction by using a first end 31F(1) of the pair of operating oil passages 31F as the operating oil port 30P(1) in the one assembly and using a second end 31F(2) of the pair of operating oil passages 31F as the operating oil port 30P(2) in the other assembly.

Herein, the open ends not used for the operating oil ports 30P(1), 30P(2) are closed by the plugs 35.

In this embodiment of the above configuration, the port block 130F and the pump case 140F simply need to be connected so that the pair of operating oil passages 31F are orthogonal to the control shaft 160, and the arrangement to the vehicle frame 2 does not need to be taken into consideration in the hydraulic apparatus manufacturer.

Therefore, the assembling error of the hydraulic pump unit 10F is prevented, and the assembling work efficiency can be improved.

In this embodiment, the connected part 135(1)*a* of the port block 130F and the connecting part 145*a* of the pump case 140F have different pitch "m" in the direction parallel to the pair of operating oil passages 31F and a pitch "n" in the direction orthogonal to the pair of operating oil passages 31F, in order to connect the port block 130F and the pump case 140F without mistaking the direction of the pair of operating oil passages 31F and the direction of the control shaft 160.

Further, the port block 130F includes the pair of branched oil passages 41(1) forming a part of the charge oil passage, and the bypass oil passage 71(1), similar to the fourth embodiment.

As shown in FIG. 31, the pair of branched oil passages 41(1) and the bypass oil passage 71(1) are distributed and arranged with the pump shaft 110 interposed therebetween; thus, the port block 130F can be reduced in size.

In the hydraulic pump unit 10F (see FIG. 31(*a*)) arranged on one side and the hydraulic pump unit 10F (see FIG. 31(*b*)) arranged on the other side with the virtual central longitudinal plane L as a reference, the positions of the pair of branched oil passages 41(1) and the bypass oil pass 71(1) are reversed.

Moreover, in this embodiment, as shown in FIG. 30 to FIG. 32, the connected part 135(1)*a* of the port block 130F and the connecting part 145*a* of the pump case 140F are arranged on the same radius R about the pump shaft 110; however, the present invention is of course not limited to this form.

Further, in the fourth to sixth embodiments, the hydraulic pump unit configured so that the pump shaft 110 is directed in the vertical direction is described by way of example; however, the present invention is of course not limited to this form. That is, the hydraulic pump unit in which the pump shaft 110 is directed in the front-to-rear direction of the vehicle or in the width direction of the vehicle may also be employed.

Embodiment 7

An embodiment of a hydraulic pump unit according to the third aspect of the present invention will now be described with reference to the accompanying drawings.

The hydraulic pump unit according to the present invention is fluidly connected to a hydraulic actuator so as to variable-speed output a driving power input from a driving source in cooperation with the hydraulic actuator arranged spaced apart from the hydraulic pump unit.

In the following, the hydraulic pump unit according to the present invention will be described by way of example in application to a traveling system transmission mechanism for a working vehicle with the hydraulic motor unit acting as the hydraulic actuator.

Figure 33:
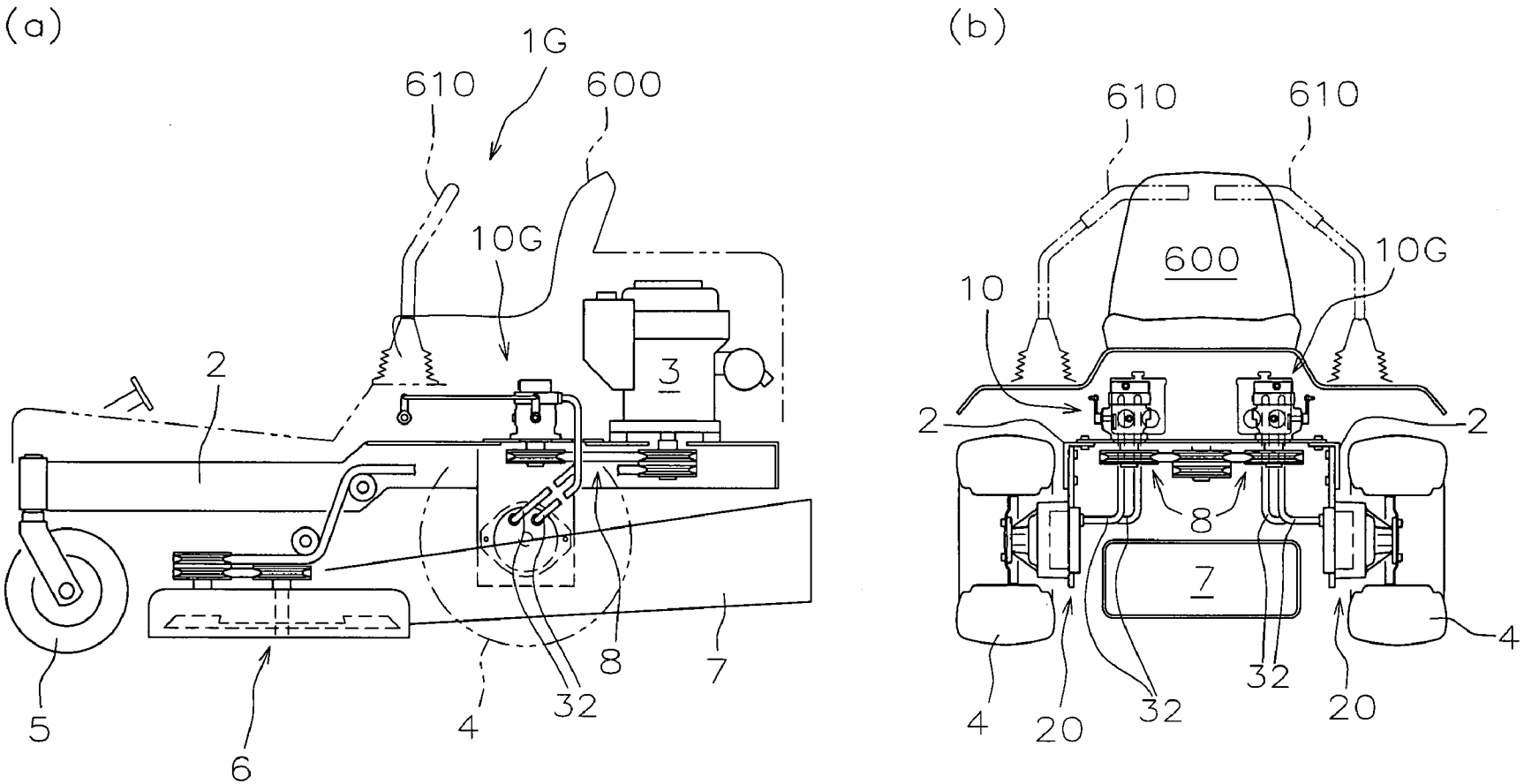
FIG. 33(*a*) and FIG. 33(*b*) are a side view and a front view, respectively, of a working vehicle applied with a hydraulic pump unit according to a seventh embodiment.
Figure 34:
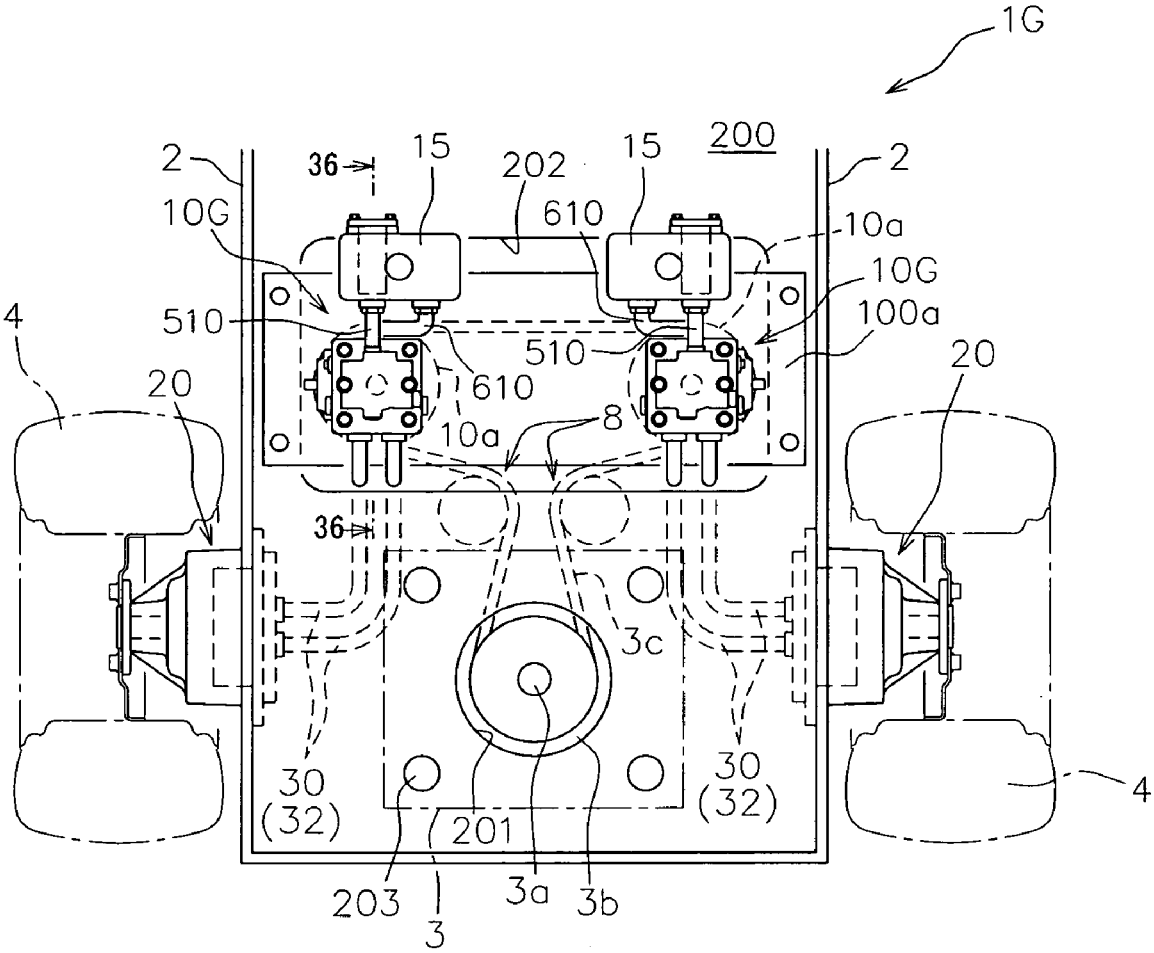
FIG. 34 is a partially developed plan view of the working vehicle applied with the hydraulic pump unit according to the seventh embodiment.

FIG. 33(*a*) and FIG. 33(*b*) show a side view and a front view, respectively, of a working vehicle 1G applied with the hydraulic pump unit 10G according to this embodiment. FIG. 34 shows a partially developed plan view of the working vehicle 1G.

As shown in FIG. 33 and FIG. 34, the working vehicle 1G is a rear discharge-type riding mower capable of performing zero turn.

Specifically, the working vehicle 1G comprises a frame 2, a driving source 3 supported by the frame 2, a pair of hydraulic pump units 10G according to this embodiment arranged in the vicinity of the driving source 3 and operatively driven by the driving source 3 by way of a transmission mechanism 8, a pair of hydraulic motor units 20 fluidly connected to the pair of hydraulic pump units 10G, respectively, a pair of driving wheels 4 (rear wheel in this embodiment) driven by the pair of hydraulic motor units 20, and a caster wheel 5 (front wheel in this embodiment).

In this embodiment, the driving source 3 is of a vertical crankshaft type, as shown in FIG. 33 and FIG. 34.

The driving source 3 is mounted on a flat plate 200 arranged on the rear side of the frame 2 by way of an elastic member 203 and, thus, is flexibly mounted to the frame 2.

Specifically, as shown in FIG. 34, a first opening 201 is formed at the center of the flat plate 200.

The driving source 3 is attached to the flat plate 200 by way of the elastic member 203 so that a driving pulley 3*b* attached to the shaft end of the driving shaft 3*a* is positioned below the flat plate 200 through the first opening 201.

A broad second opening 202 is formed in the flat plate 200 at the front of the first opening 201. The second opening 202 is provided to operatively connect between the driving source 3 and the hydraulic pump set 100.

Specifically, the pair of hydraulic pump units 10G are arranged on a common substrate 100*a* while spaced apart in the width direction of the vehicle.

The shaft end of the pump shaft 110 (which will be described later) passes through the substrate 100*a* and extends below the flat plate 200 by way of the second opening 202. Driven pulleys 10*a*, 10*b* are each arranged on the shaft end of the pump shaft 110 so as to be positioned below the flat plate 200.

The common substrate 100*a* has a left-to-right length (length along the width direction of the vehicle) thereof longer than a left-to-right length of the second opening 202, and a part overlapping the flat plate 200 is joined to the flat plate 200.

With the above configuration, a sub-assembly with the pair of hydraulic pump units 10G mounted on the common substrate 100*a* in advance is incorporated into the frame 2 (flat plate 200) all at once.

After incorporation into the sub-assembly, a transmission belt 3*c* is wound between the driven pulleys 10*a*, 10*b* and the driving pulley 3*b*, and by applying tension thereto, the pair of hydraulic pump units 10G are rotated in the same direction as the rotating direction of the driving source 3.

As mentioned above, the hydraulic motor unit 20 is arranged in pairs for every pair of driving wheels 4 in the working vehicle 1G, and the hydraulic pump unit 10G is also arranged in pairs so as to each fluidly connect with the pair of hydraulic motor units 20.

Alternatively, one hydraulic pump unit 10G and one hydraulic motor unit 20 may be arranged, and the output from the hydraulic motor unit 20 may be used for differentially driving the pair of driving wheels 4 by way of a differential gear device.

As shown in FIG. 33(*b*) and FIG. 34, in the working vehicle, the pair of hydraulic motor units 20 are distributed and arranged in the width direction of the vehicle so as to define a space therebetween.

The working vehicle 1G comprises, in addition to the above configuration, a mower device 6 suspended and supported in a freely rising/lowering manner between the front and rear wheels 4, 5, and a duct 7 which is arranged in the above space and guides the mowed grass to a grass collecting bag (not shown) arranged at the rear of the vehicle body.

Further, in the working vehicle 1G, a driver's seat 600 is arranged above the center in the width direction of the frame 2 at the front of the driving source 3, and a pair of left and right steering handles 610 are arranged at the front of the driver's seat 600 in a freely forward/rearward tilting manner.

The pair of steering handles 610 are operatively connected with the pair of hydraulic pump units 10G, respectively, so as to operate the pair of hydraulic pump units 10G, and the outputs of the pair of hydraulic motor units 20 fluidly connected through the pair of operating oil conduits 32 are controlled by operating the pair of steering handles 610.

Figure 35:
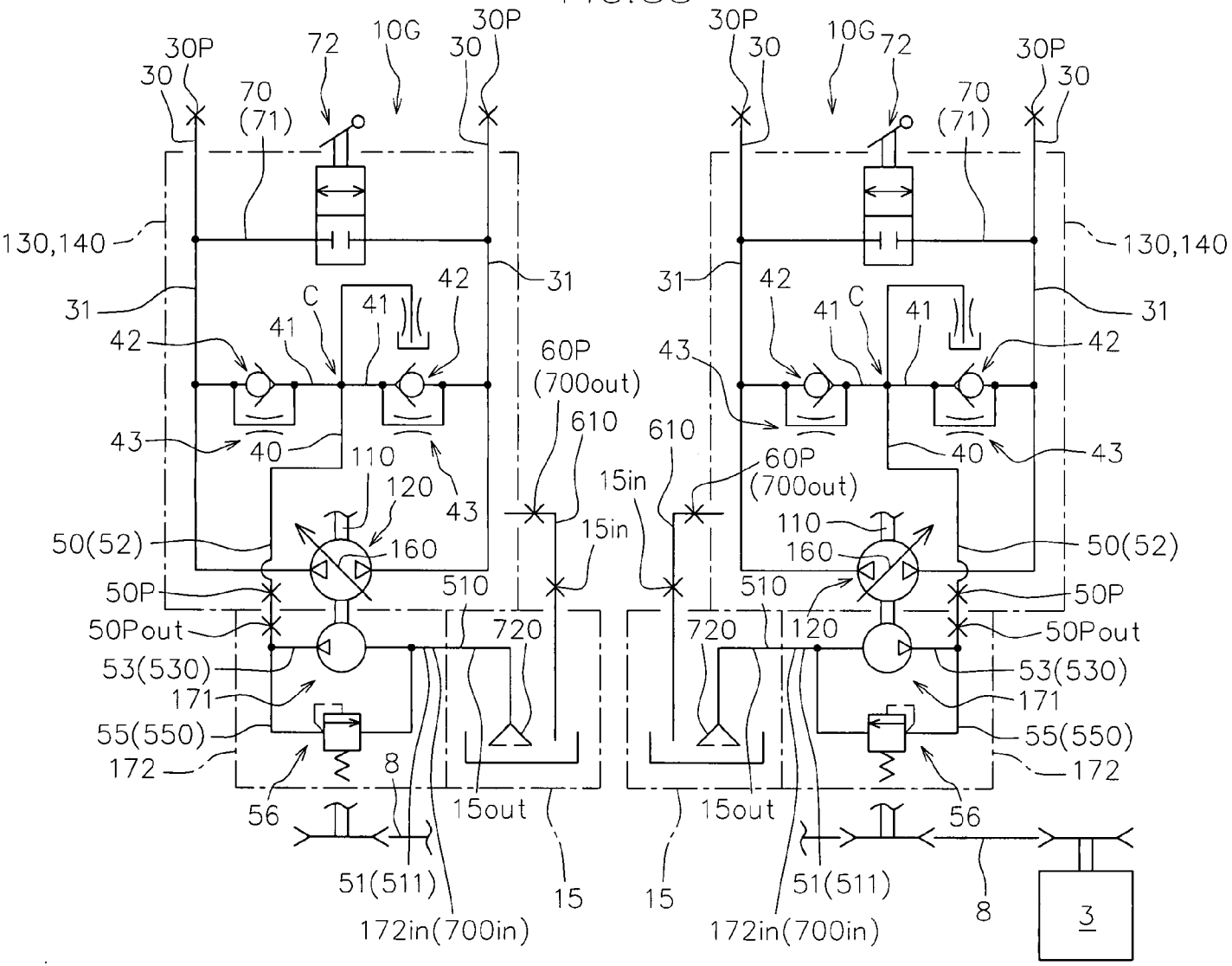
FIG. 35 is a hydraulic circuit diagram of the hydraulic pump unit according to the seventh embodiment.

FIG. 35 shows a hydraulic circuit diagram of the hydraulic pump unit 10G according to this embodiment.

In this embodiment, the pair of hydraulic pump units 10G are fluidly connected to the corresponding hydraulic motor unit 20 by way of the hydraulic circuit (a pair of hydraulic lines 30 in this embodiment) so as to form an HST in cooperation with the corresponding hydraulic motor unit.

At least one of the hydraulic pump unit 10G and the hydraulic motor unit 20 fluidly connected to each other is of a variable displacement type.

In this embodiment, the hydraulic pump unit 10G is of a variable displacement type, and the hydraulic motor unit 20 is of a fixed displacement type.

The configuration of the hydraulic pump unit 10G will now be described in detail.

Figure 36:
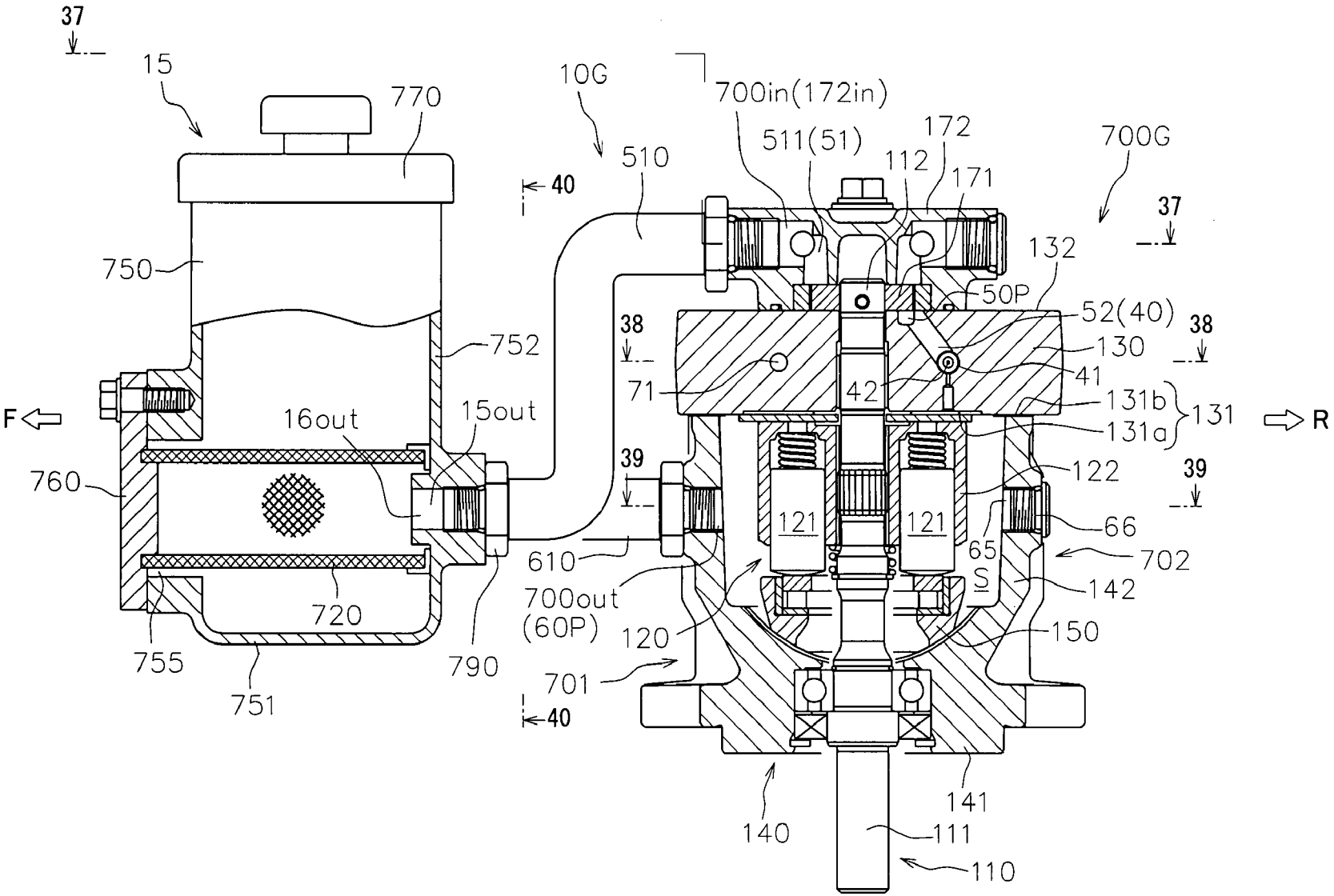
FIG. 36 is a longitudinal side view of the hydraulic pump unit taken along line 36-36 of FIG. 34.

FIG. 36 shows a longitudinal side view of the hydraulic pump unit 10G taken along line 36-36 of FIG. 34. The symbols F and R of FIG. 36 show the front and the rear in the longitudinal direction of the vehicle, respectively.

As shown in FIG. 36, the first hydraulic pump unit 10G comprises the pump shaft 110 operatively connected to the driving source 3, a pump body 120 driven by the pump shaft 110, a port block 130 formed with the operating oil passage for supplying/discharging an operating oil to/from the pump body 120, a pump case 140 connected to the port block 130 so as to define an internal space for accommodating the pump body 120, and an oil tank 15 for storing the drain oil from the pump body and acting as a charge oil source for the pump body.

The pump shaft 110 is supported by an assembly 700G, configured by connecting the pump case 140 and the port block 130, so that a first end 111 thereof extends outward from the assembly 700G so as to be operatively connected to the driving source 3.

In this embodiment, the first end 111 extends downward from the assembly 700G.

The first end 111 is operatively connected to the driving source 3 by way of an appropriate transmission mechanism 8 (pulley and belt shown in the figures) (see FIG. 33 and FIG. 34).

In this embodiment, the pump body 120 includes a piston unit 121 for performing a reciprocating movement by the rotation of the pump shaft 110, and a cylinder block 122 for supporting the piston unit 121 in a freely reciprocating manner.

As mentioned above, in this embodiment, the hydraulic pump unit 10G is of a variable displacement type.

Therefore, the hydraulic pump unit 10G comprises, in addition to the configuration, an output adjusting member 150 for changing the suction/discharge rate of the pump body 120, and a control shaft 160 for slanting the output adjusting member 150.

In this embodiment, a movable swash plate is used for the output adjusting member 150, and a trunnion shaft is used for the control shaft 160.

In this embodiment, the control shaft 160 extends outward in the width direction of the vehicle, in order to prevent interference with the oil tank 15.

The port block 130 and the pump case 140 are connected to each other to thereby configure the assembly 700G including an internal space for accommodating the pump body 120.

Specifically, the pump case 140 includes an end wall 141 positioned on a first end side in the direction of the pump shaft and a peripheral wall 142 extending from the end wall 141 to a second end side in the axis line direction of the pump shaft 110.

The peripheral wall 142 has an opening 143 at the second end side in the axis line direction of the pump shaft 110. The opening 143 is sized to allow the pump body 120 to be inserted thereinto.

The port block 130 is connected to the pump case 140 so as to close the opening 143 while rotatably supporting the pump body 120 in cooperation with the pump case 140.

Specifically, the port block 130 includes a first end face 131 (lower surface in this embodiment) which is orthogonal to the pump shaft 110 and faces the pump case 141.

The first end face 131 includes a support region 131*a* for supporting the pump body 120 in a freely rotating manner, and a contact region 131*b* which is positioned outward in the radius direction of the support region 131*a* and is brought into contact with the pump case 140.

The internal space S for accommodating the pump body 120 is defined when the first end face 131 of the port block 130 is brought into contact with the end face of the peripheral wall 142 of the pump case 140.

The oil passage and the port formed in the port block 130 will be described later.

As shown in FIG. 36, the hydraulic pump unit 10G according to this embodiment further comprises an auxiliary pump unit 170.

The auxiliary pump unit 170 includes an auxiliary pump body 171 driven by the pump shaft 110, and an auxiliary pump case 172 surrounding the auxiliary pump body 171.

In this embodiment, the auxiliary pump unit 170 is connected to a second end face 132 (upper surface in this embodiment) on the opposite side of the first end face 131 of the port block 130.

Specifically, the pump shaft 110 has the first end 111 configuring the input end, passing through the end wall 141 of the pump case 140 and extending outward, and a second end 112 passing through the port block 130 and extending outward.

The auxiliary pump body 171 is driven by the second end 112 of the pump shaft 110.

Further, the auxiliary pump case 172 is connected to the second end face 132 of the port block 130 so as to surround the auxiliary pump body 171, and forms the assembly 700G with the pump case and the port block.

The oil tank 15 is configured so as to be supported by the assembly 700G.

In this embodiment, the oil tank 15 is supported by the assembly 700G by way of conduits 510, 610 for fluidly connecting with the assembly 700G.

FIG. 37 to FIG. 40 show cross sectional views taken along line 37-37, line 38-38, line 39-39, and line 40-40, respectively, of FIG. 36.

The symbols F, R, O, and I of FIG. 37 to FIG. 40 show the front of the vehicle, the rear of the vehicle, the outside in the width direction of the vehicle, and the inside in the width direction of the vehicle, respectively.

Specifically, the assembly 700G includes a draw-in port 700in for drawing in the charge oil for the pump body 120, and a draw-out port 700out for drawing out the drain oil within the internal space.

Figure 40:
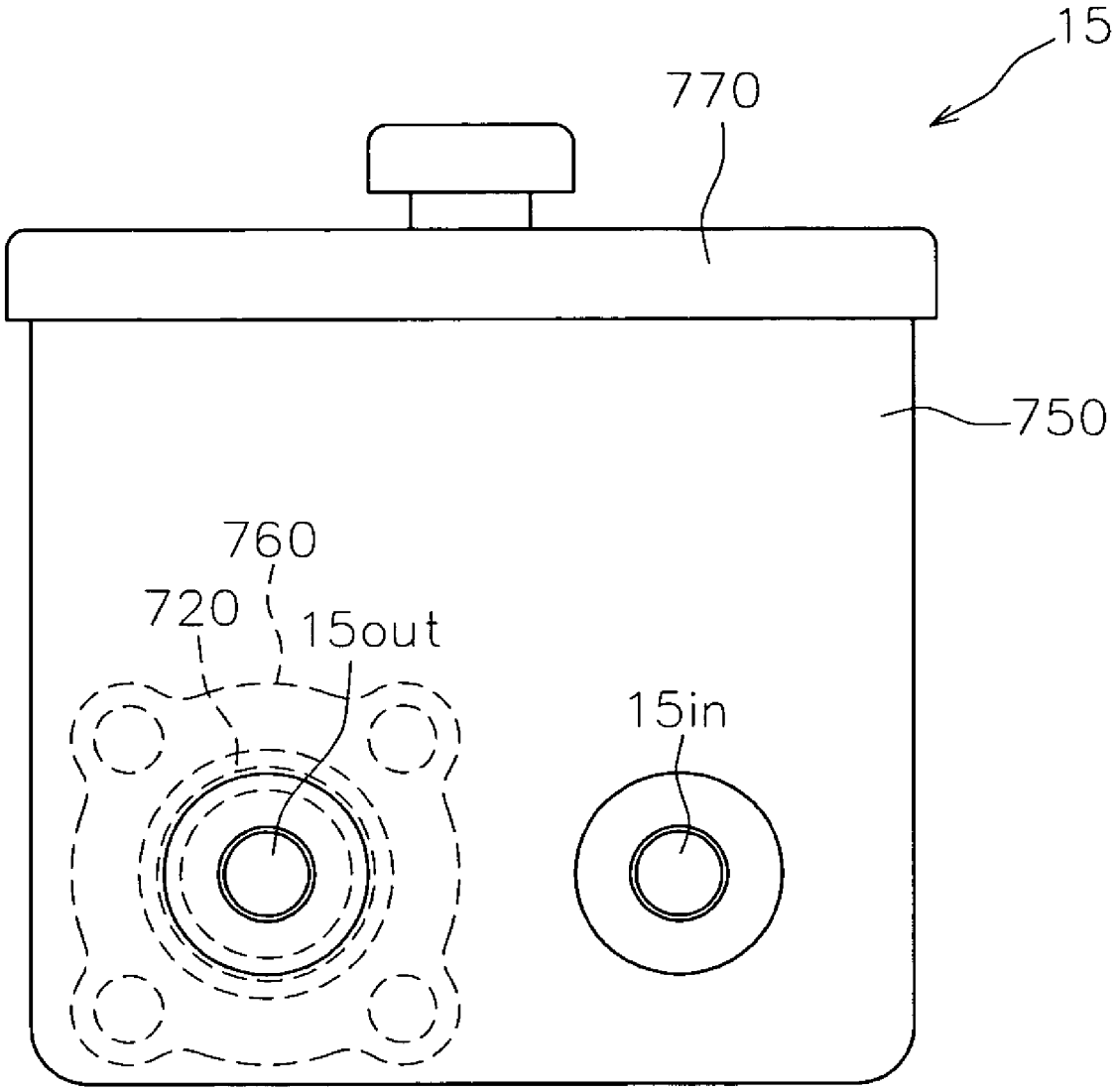
FIG. 40 is a cross sectional view taken along line 40-40 of FIG. 36.

On the other hand, the oil tank 15 includes an inlet port 15in and an outlet port 15out for opening the internal space of the oil tank 15 outward, as shown in FIG. 36 and FIG. 40.

The inlet port 15in and the outlet port 15out are fluidly connected to the draw-out port 700out and the draw-in port 700in, respectively, by way of the drain conduit 610 and the suction conduit 510.

The drain conduit 610 and the suction conduit 510 act as a flow passage for fluidly connecting the oil tank 15 and the assembly 700G and, also, act as a supporting member for supporting the oil tank 15.

Preferably, a heat releasing fin (not shown) may be arranged in the drain conduit 610 and/or the suction conduit 510, thereby efficiently cooling the oil flowing through the conduit.

In addition to or instead of annexing the heat releasing fin to the conduit, the heat releasing fin may be arranged on the outer wall of the pump case 140.

The inlet port 15in and the outlet port 15out are arranged at the lower portion of the oil tank 15 (see FIG. 40).

With the above configuration, the air mixing with the charge oil for the pair of hydraulic lines 30 can be effectively prevented.

In this embodiment, the oil tank 15 is supported at the assembly 700G by the conduits 510, 610 fluidly connecting the assembly 700G and the oil tank 15. Instead of or in addition to this supporting structure by the conduit, however, an attachment member connected to the assembly 700G may be included, which attachment member (not shown) supporting the oil tank 15.

As mentioned above, the working vehicle 1G has the driving source 3 of a vertical crankshaft type, and the hydraulic pump unit 10G is longitudinally arranged on the vehicle frame so that the rotating axis line extends along the vertical direction.

As shown in FIG. 36, in the hydraulic pump unit 10G arranged longitudinally, the oil tank 15 can be supported by the assembly 700G so that the assembly 700G and the oil tank 15 overlap when seen in the horizontal direction; thus, the entire space of the hydraulic pump unit 10G including the oil tank 15 can be saved.

Specifically, the hydraulic pump unit 10G according to this embodiment is mounted to the vehicle frame 2 in a longitudinally placed state, as mentioned above. Therefore, the assembly 700G includes first to fourth side faces 701 to 704 each facing the front of the vehicle, the rear of the vehicle, the inside in the width direction of the vehicle, and the outside in the width direction of the vehicle in the vehicle mount state.

The oil tank 15 is supported by the assembly so as to face any one of the side faces other than the side face where the control shaft 160 is supported of the first to the fourth side faces 701 to 704.

Figure 37:
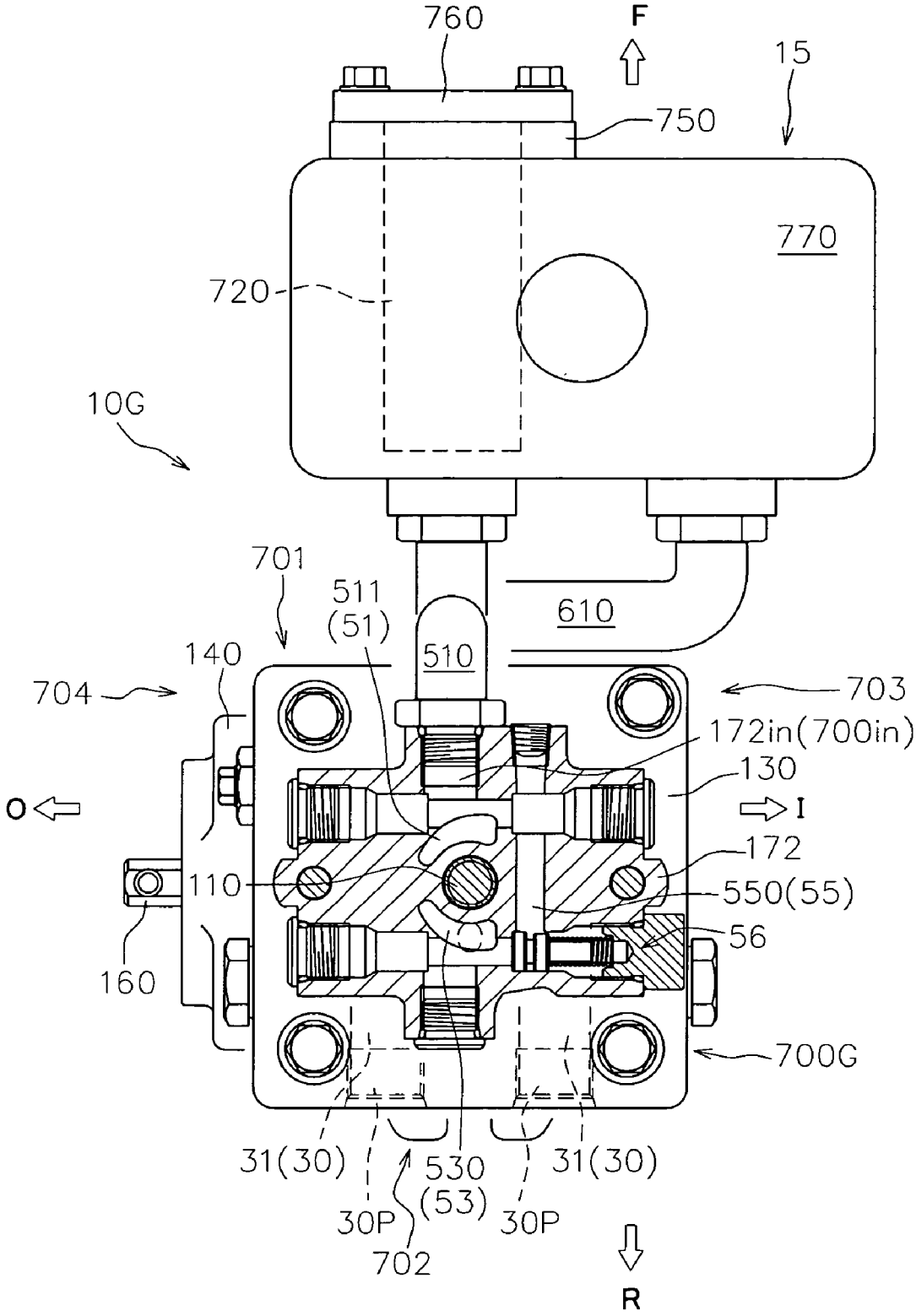
FIG. 37 is a cross sectional view taken along line 37-37 of FIG. 36.

In the embodiment shown in the figures, the control shaft 160 is supported by the fourth side face 704, as shown in FIG. 36 and FIG. 37. Therefore, the oil tank 15 is supported by the assembly 700G so as to face the side face (first side face 701 in the embodiment shown in the figures) other than the fourth side face 704.

More preferably, the outlet port 15out and the inlet port 15in are arranged on the proximate wall surface facing the assembly 700G of the wall surfaces of the oil tank 15.

With the above configuration, the entire hydraulic pump unit 10G including the drain conduit 610 and the suction conduit 510 can be made small.

The hydraulic circuit of the hydraulic pump unit 10G will now be described.

As shown in FIG. 35, the first hydraulic pump unit 10G includes the pair of hydraulic lines 30 fluidly connecting to the corresponding hydraulic motor unit 20, a suction line 51 extending between the oil tank 15 and the auxiliary pump body 171, a discharge line 53 for flowing the discharge oil from the auxiliary pump body 171, a charge line 50 having a first end fluidly connected to the discharge line 53 and a second end fluidly connected to each first hydraulic line 30, and a drain line 60 for returning the drain oil within the internal space S in the hydraulic pump unit 10 back to the oil tank 15.

Figure 38:
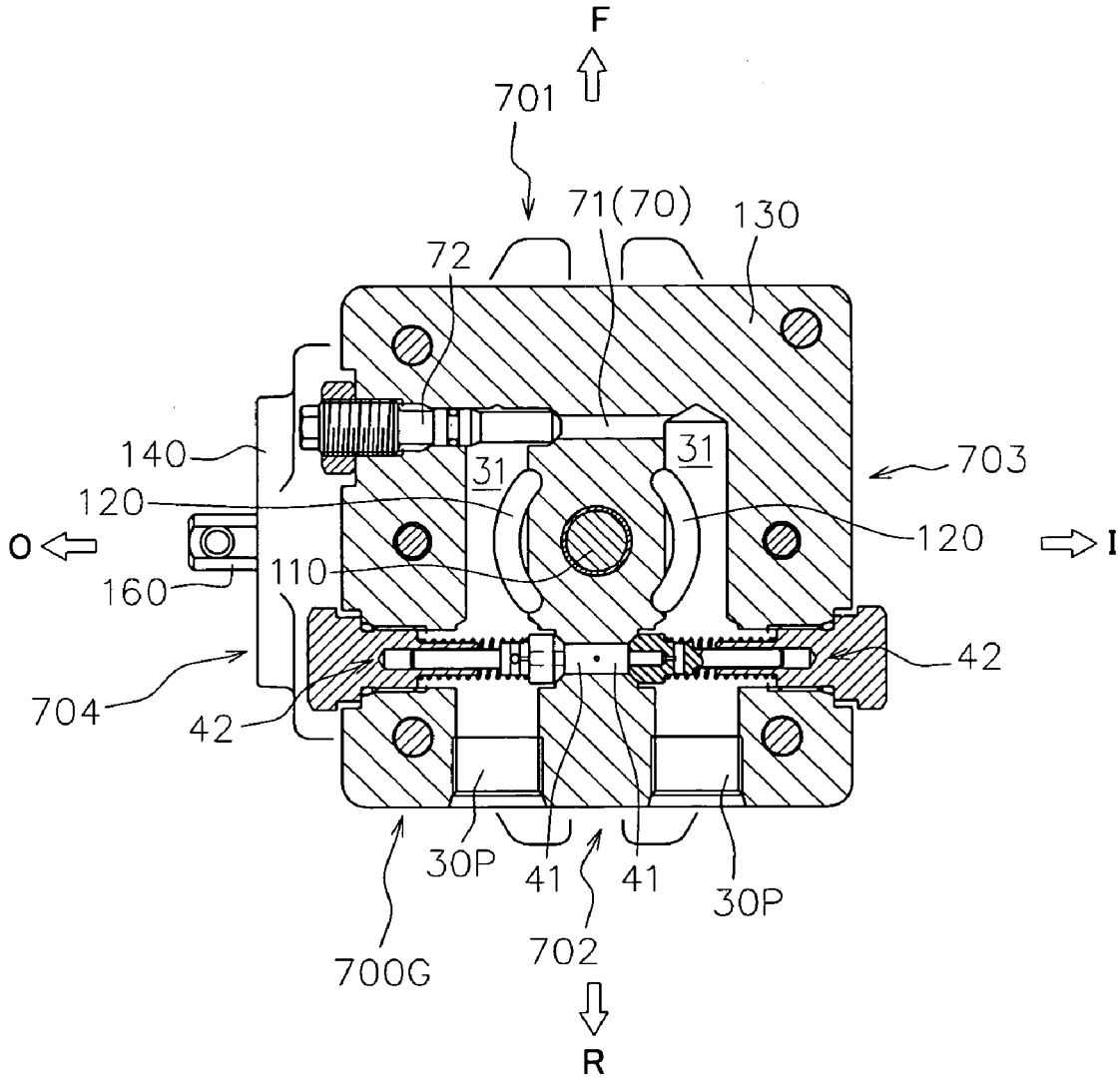
FIG. 38 is a cross sectional view taken along line 38-38 of FIG. 36.

As shown in FIG. 35 and FIG. 38, the pair of hydraulic lines 30 include a pair of operating oil passages 31 perforated in the port block 130, and a pair of operating oil conduits 32 for communicating the pair of operating oil passages 31 to the corresponding hydraulic motor unit 20 (see FIG. 33 and FIG. 34).

Each of the pair of operating oil passages 31 has a first end opening outward to form an operating oil port 30P and a second end communicating to a pair of kidney ports 120P in the pump body 120.

In this embodiment, the pair of operating oil passages 31 are formed in the port block 130 so that the operating oil port 30P is positioned on the side face (second side face 702 in the embodiment shown in the figure) other than the first side face 701 and the fourth side face 704 of the assembly 700G (see FIG. 38).

The suction line 51 includes, as shown in FIG. 35 and FIG. 36, the suction conduit 510 having a first end communicated to the oil tank 15, and a suction oil passage 511 having a first end opened at the external surface of the assembly to form a suction port 172in and a second end communicated to the suction part of the auxiliary pump body 171.

In this embodiment, the suction oil passage 511 is formed in the auxiliary pump case 172 so that the suction port 172in is positioned on, of the side faces in the assembly 700G, the side face (first side face 701 in the embodiment shown in the figure) facing the oil tank 15.

In this embodiment, the suction port 172in acts as the draw-in port 700in, in order to draw in the charge oil for the pump body 120.

The discharge line 53 includes a discharge oil passage 530 formed in the auxiliary pump case 172.

The discharge oil passage 530 has a first end communicating to the discharge part of the auxiliary pump body 171 and a second end opening at the external surface of the auxiliary pump case to form the discharge port 50Pout.

In this embodiment, the first discharge port 50Pout is arranged at the surface which is brought into contact with the port block 130.

The hydraulic pump unit 10G according to this embodiment further includes a charge pressure setting line 55 for setting the oil pressure of the discharge line 53.

In this embodiment, the charge pressure setting line 55 includes a charge pressure setting oil passage 550 formed in the auxiliary pump case 172 so as to communicate the suction line 51 and the discharge line 53, and a relief valve 56 inserted into the charge pressure setting oil passage 550.

As shown in FIG. 34, FIG. 35 and FIG. 38, the charge line 50 includes a charge oil passage 52 formed in the port block 130 so as to have a first end forming a charge suction port 50P communicated to the discharge oil passage 530 and a second end communicating to each operating oil passage 31.

In this embodiment, the charge suction port 50P is formed at the surface which is brought into contact with the auxiliary pump case 172, so as to be fluidly connected with the discharge port 50Pout.

Specifically, the charge oil passage 52 includes a common charge oil passage 40 having a first end forming the charge suction port 50P, and a pair of branched oil passages 41 branched from the common charge oil passage 40 at the branch point C and communicated to the pair of operating oil passages 31 (see FIG. 35 and FIG. 38).

A check valve 42 is provided in each branched oil passage 41.

The check valve 42 is provided to allow the flow of the pressure oil from the charge line 50 to the pair of hydraulic lines 30 and to prevent the pressure oil from flowing in a reverse direction.

In this embodiment, the check valve 42 includes a throttle 43 (see FIG. 35); thus, a neutral state of the HST can be obtained without the need of strictly controlling the output adjusting member 150.

In this embodiment, as shown in FIG. 38, a single oil passage perforated in a direction approximately orthogonal to the pair of operating oil passages 31 is formed in the port block 30 so as to communicate the pair of operating oil passages 31, and the single oil passage forms the pair of branched oil passages 41.

According to the above configuration, the pair of branched oil passages 41 can be efficiently provided.

In this embodiment, the drain line 60 is configured so as to have a first end communicating to the internal space S in the hydraulic pump unit 10G and a second end communicating to the oil tank 15.

Specifically, as shown in FIG. 35 and FIG. 36, the hydraulic pump unit 10G includes a drain port 60P in which the internal space S thereof is opened outward, and the drain conduit 610 for fluidly connecting the drain port 60P and the inlet port 15in of the oil tank 15.

In this embodiment, the drain port 60P forms the draw-out port 700out.

Figure 39:
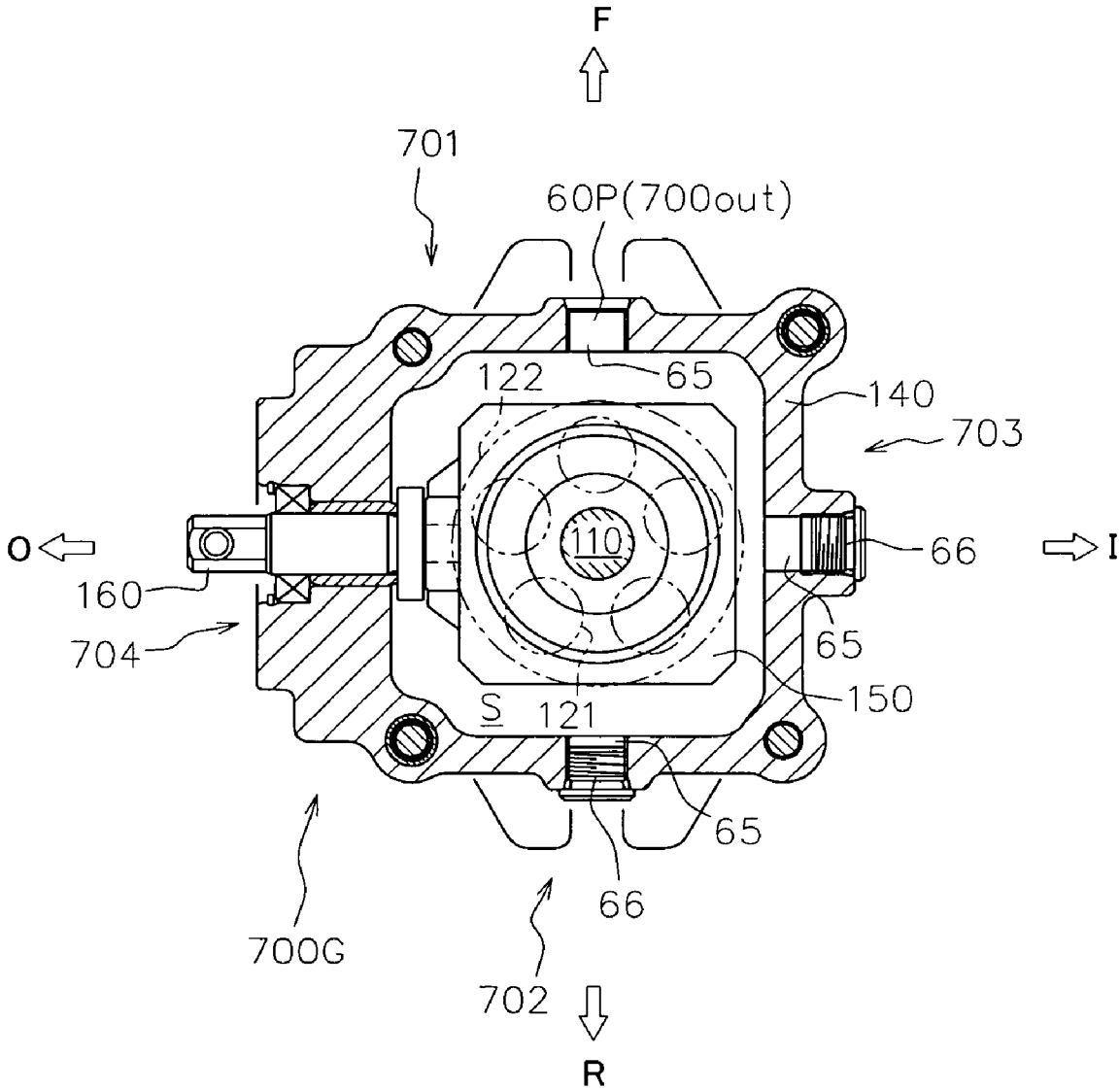
FIG. 39 is a cross sectional view taken along line 39-39 of FIG. 36.

In this embodiment, the drain port 60P is positioned on, of the side faces in the assembly 700G, the side face (first side face 701 in the embodiment shown in the figure) facing the oil tank 15 (see FIG. 39).

As shown in FIG. 39, in this embodiment, openings 65 for opening the internal space S outward are arranged on the side faces 701, 702, 703 other than the fourth side face 704 supporting the control shaft 160 in the pump case 40. The openings 65 other than the opening 65 used as the drain port 60*p* are closed by plugs 66.

The hydraulic pump unit 10G according to this embodiment further includes a bypass line 70 for communicating between the pair of hydraulic lines 30 (see FIG. 35).

The bypass line 70 is provided to prevent a pressure difference from being occurred between the pair of hydraulic lines 30 when forcibly towing the vehicle at the time of fault and the like.

As shown in FIG. 35 and FIG. 38, in this embodiment, the bypass line 70 includes a bypass oil passage 71 formed in the port block 130 so as to communicate between the pair of operating oil passages 31, and a switching valve 72 for selectively communicating/blocking the bypass oil passage 71.

Preferably, as shown in FIG. 38, the bypass oil passage 71 is positioned on the opposite side of the single oil passage forming the pair of branched oil passages 41 with the pump shaft 110 interposed therebetween.

That is, the first operating oil passage 31 has the first end opening at the external surface of the port block 130 to form the operating oil port 30P, and a second end extending beyond the corresponding pump shaft 110 to a region on the opposite side of the operating oil port 30P.

The pair of branched oil passages 41 are arranged to communicate between the pair of operating oil passages 31 in the region (region on the side proximate the first operating oil port 30P in the embodiment shown in the figure) on one side with the pump shaft 110 as a reference.

On the other hand, the bypass oil passage 71 are arranged to communicate between the pair of operating oil passages 31 in the region (region on the side away from the operating oil port 30P in the embodiment shown in the figure) on the other side with the pump shaft 110 as a reference.

According to the above configuration, the efficient arrangement of the pair of operating oil passages 31, the pair of branched oil passages 41 and the bypass oil passage 71 can be achieved.

The switching valve 72 is inserted into the bypass oil passage 71 so as to be externally operated from the corresponding port block 130.

In the hydraulic pump unit 10G of the above configuration, the oil tank 15 is integrated with the assembly 700G in advance; thus, by simply mounting the assembly 700G to the vehicle frame 2, the hydraulic pump unit 10G including the oil tank 15 can be considerably easily attached to the vehicle.

In the conventional configuration in which the hydraulic pump unit and the oil tank are independently arranged on the vehicle frame, the hydraulic pump unit and the oil tank must be fluidly connected by a conduit after being independently arranged on the vehicle frame 2. In the hydraulic pump unit 10G according to this embodiment, however, the installation work can be eliminated.

Further, since the assembly 700G comprising the pump case 140 and the port block 130, and the oil tank 15 are fluidly connected in advance, various adjusting tasks may be performed on the hydraulic pump unit 10G in the vehicle mount state with the oil tank 15 connected on the manufacturer side of the hydraulic pump unit 10G.

Therefore, in the vehicle manufacturer, the hydraulic pump unit 10G simply needs to be attached to the vehicle frame 2; thus, the load on the vehicle manufacturer side can be reduced as much as possible.

The hydraulic pump unit 10G according to this embodiment further includes a filter 720 inserted into the suction line 51, as shown in FIG. 35.

In this embodiment, as shown in FIG. 36, the filter 720 is arranged in the oil tank 15 so as to surround an inner end opening 16out of the outlet port 15out, thereby making the entire hydraulic pump unit 10G including the filter 720 small.

Specifically, the oil tank 15 includes a tank body 750, and a lid 760 removably connected to the tank body 750.

The tank body 750 includes a bottom wall 751, and a peripheral wall 752 extending upward from the peripheral edge of the bottom wall 751.

In this embodiment, the peripheral wall 752 is formed so as to be opened at the top, and this upper opening is closed by a cap 770.

An access opening 755 of a size allowing the filter 720 to be inserted thereinto, the outlet port 15out and the inlet port 15in are arranged in the peripheral wall 752.

The access opening 755 is liquid-tightly closed by the lid 760.

Specifically, the access opening 755 is arranged at, of the peripheral wall 752 of the oil tank 15, locations other than a location where the outlet port 15out and the inlet port 15in are formed.

With the above configuration, the lid 760 is removed from the tank body 750 to insert/withdraw the filter 720 with the tank body 750 connected to the assembly 700G by way of the drain conduit 610 and the suction conduit 510, thereby improving the efficiency of the maintenance task of the filter 720.

More specifically, the following configuration may be employed that the access opening 755 is formed so as to face the inward opening 16out leading to the outlet port 15out, a hollow filter configured to surround the inward opening 16out is used as the filter 720, and the filter 720 is held by the wall surface (proximate wall surface close to the assembly 700G in this embodiment) where the inward opening 16out is formed and the lid 760 connected to the tank body 750.

With the above configuration, the holding structure of the filter 720 can be simplified, and the filtered oil can be reliably output from the outlet port 15out.

Embodiment 8

Another embodiment of the hydraulic pump unit according to the third aspect of the present invention will now be described with reference to the accompanying drawings.

In this embodiment, the same reference numerals are denoted for the members same as or corresponding to those in the seventh embodiment; therefore, the detailed description thereof will not be given herein.

Figure 41:
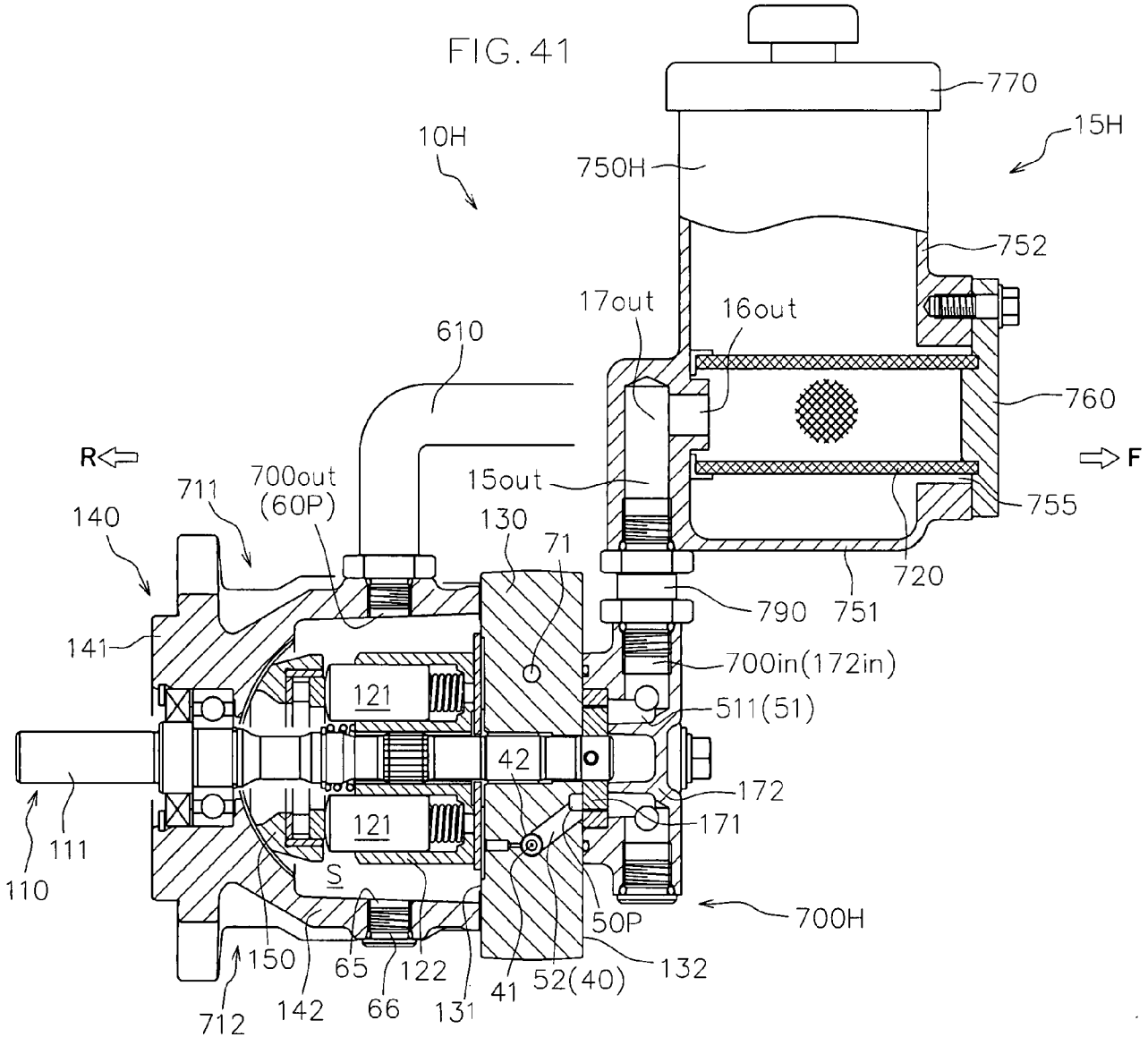
FIG. 41 is a longitudinal side view of a hydraulic pump unit according to an eighth embodiment of the present invention.

FIG. 41 shows a longitudinal side view of a hydraulic pump unit 10H according to this embodiment. The symbols F and R of FIG. 41 show the front of the vehicle and the rear of the vehicle.

As shown in FIG. 41, the hydraulic pump unit 10H according to this embodiment is arranged transversally on the vehicle frame 2 so that the rotating axis line extends along the horizontal direction (see FIG. 33 and FIG. 34).

The hydraulic pump unit 10H comprises an assembly 700H arranged so that the rotating axis line extends along the horizontal direction, and an oil tank 15H mounted on the assembly 700H.

Specifically, the hydraulic pump unit 10H comprises the pump shaft 110, the pump body 120, the port block 130, the pump case 140, the auxiliary pump unit 170, and the oil tank 15H mounted on the assembly 700H comprising the port block 130, the pump case 140 and the auxiliary pump case 172.

In the hydraulic pump unit 10H arranged transversally, the assembly 700H includes first to fourth side faces 711 to 714 facing the upside, the downside, the inside in the width direction of the vehicle, and the outside in the width direction of the vehicle, respectively, in the vehicle mount state.

The control shaft 160 is supported by the fourth side face 714 of the assembly 700H.

The suction port 172in configuring the draw-in port 700in and the drain port 60P configuring the draw-out port 700out are each positioned on the first side face 711.

The oil tank 15H includes a tank body 750H, the lid 760 removably attached to the tank body 750, the filter 720 arranged in the tank body 750, and the cap 770 for closing the upper opening of the tank body 750H.

That is, the oil tank 15H includes the tank body 750H in place of the tank body 750 of the oil tank 15 in the seventh embodiment.

The tank body 750H is the same as the tank body 750 in terms of including the outlet port 15out and the inlet port 15in fluidly connectable to the draw-in port 700in and the draw-out port 700out, respectively, but is different the tank body 750 in that at least one of the outlet port 15out or the inlet port 15in is opened downward.

In this embodiment, as shown in FIG. 41, the outlet port 15out is opened downward.

Specifically, the outlet port 15out opened downward, the inner end opening 16out leading to the outlet port 15out, and an oil passage 17out for communicating the outlet port 15out and the inner end opening 16out in an oil freely flowing manner are formed in the tank body 750H.

In this embodiment, the inner end opening 16out is opened horizontally.

The tank body 750H has the port opening downward (outlet port 15out in this embodiment) directly connected to the corresponding port (draw-in port 700in in this embodiment) in the assembly 700H by way of a joint member 790, thereby substantially mounting the oil tank 15H on the first side face 711 of the assembly 700H.

Effects similar to those in the seventh embodiment can be also obtained in the hydraulic pump unit 10H of the above configuration.

In this embodiment, the joint member 790 is a separate body separable from the tank body 750H and the assembly 700H. However, the joint member 790 may of course be integrally formed with either the tank body 750H or the assembly 700H.

Embodiment 9

Still another embodiment of the hydraulic pump unit according to the third aspect of the present invention will now be described with reference to the accompanying drawings.

In this embodiment, the same reference numerals are denoted for the members same as or corresponding to those in the seventh or eighth embodiments; therefore, the description thereof will not be given herein.

Figure 42:
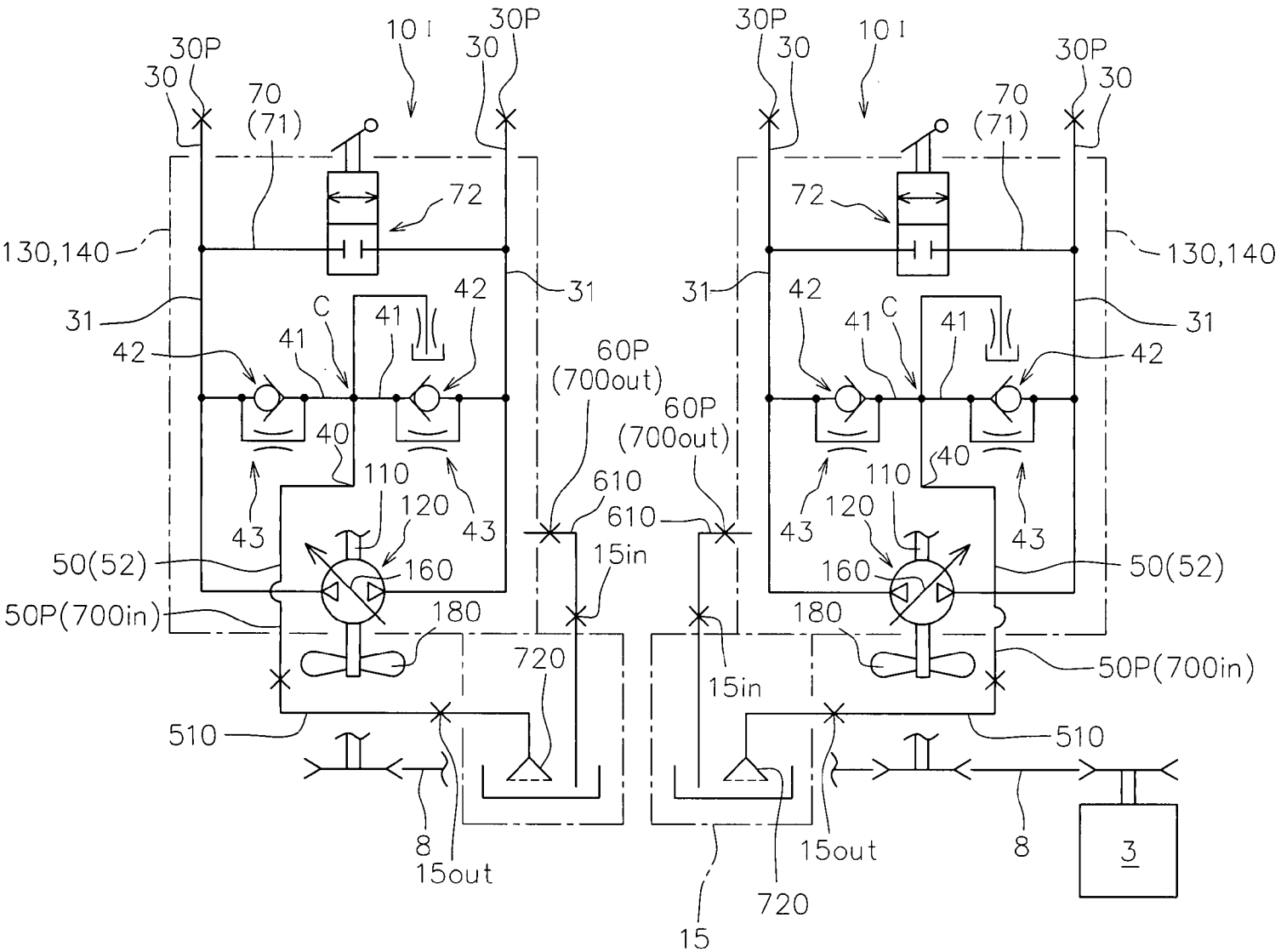
FIG. 42 is a hydraulic circuit diagram of a hydraulic pump unit according to a ninth embodiment of the present invention.
Figure 43:
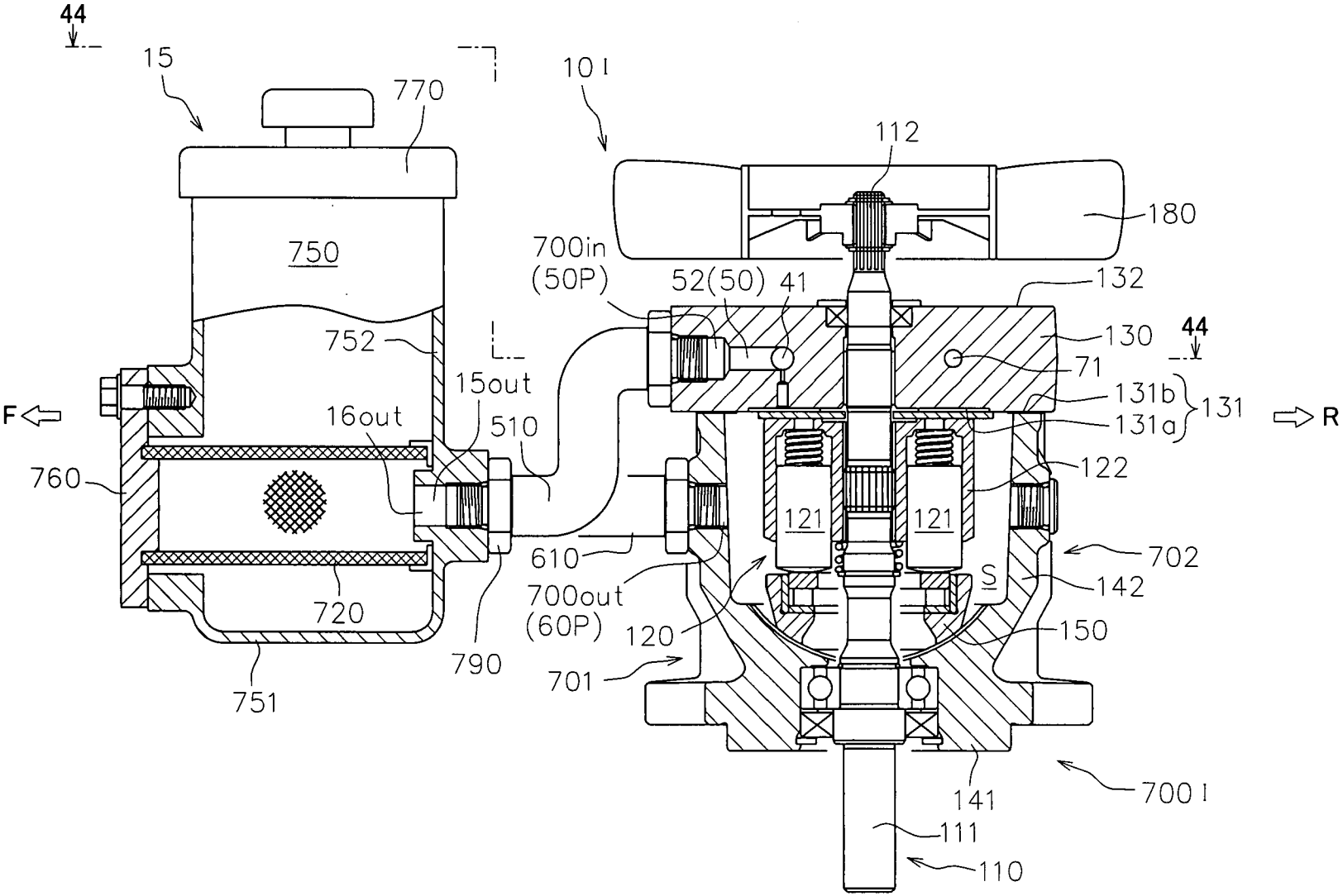
FIG. 43 is a longitudinal side view of the hydraulic pump unit shown in FIG. 42.
Figure 44:
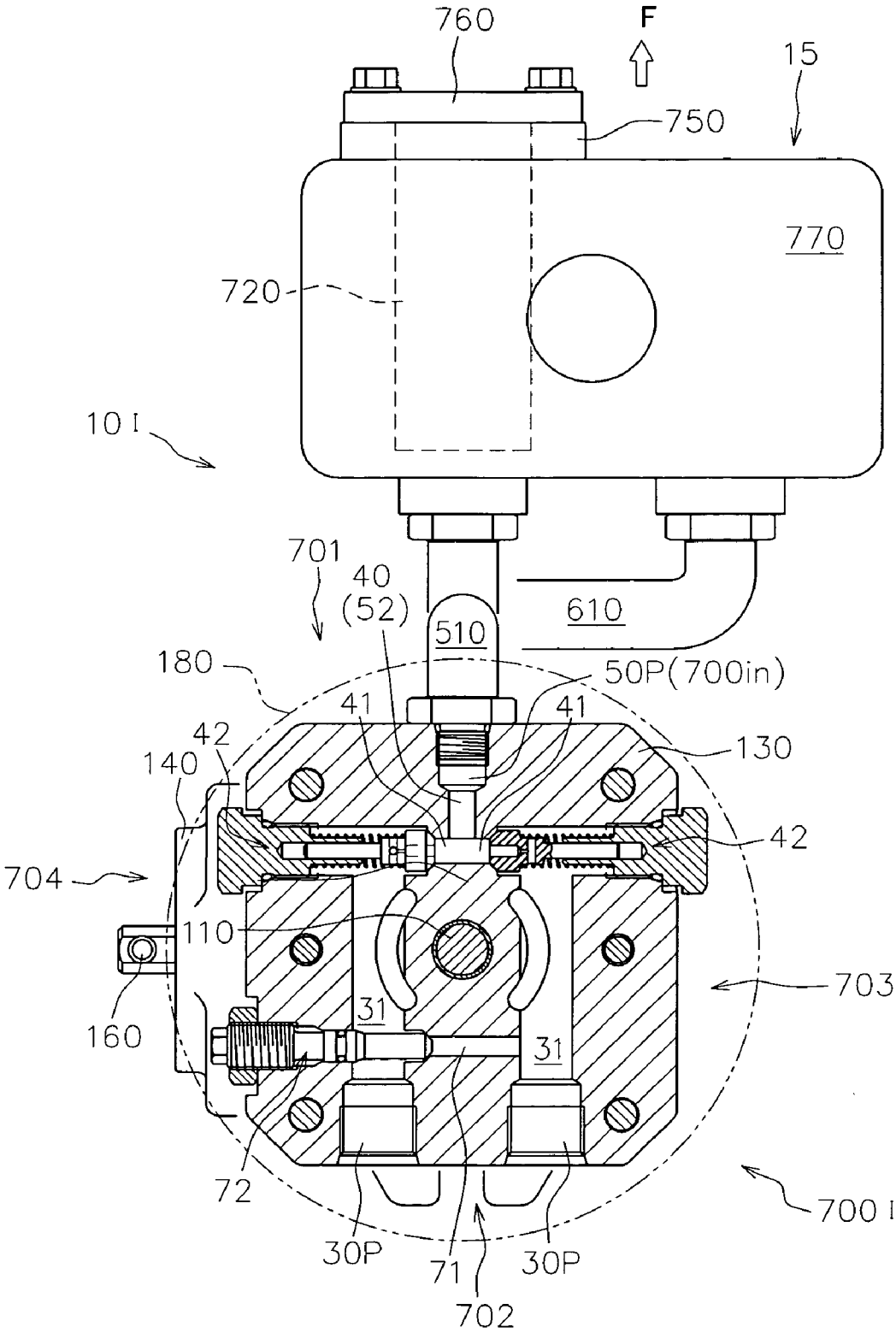
FIG. 44 is a transverse plan view of the hydraulic pump unit taken along line 44-44 of FIG. 43.

FIG. 42 and FIG. 43 are a hydraulic circuit diagram and a longitudinal side view, respectively, of a hydraulic pump unit 101 according to this embodiment. Further, FIG. 44 is a transverse plan view of the hydraulic pump unit 101 taken along line 44-44 of FIG. 43. The symbols F, R, O, and I of FIG. 43 and FIG. 44 show the front of the vehicle, the rear of the vehicle, the outside in the width direction of the vehicle, and the inside in the width direction of the vehicle, respectively.

As shown in FIG. 42 to FIG. 44, in the hydraulic pump unit 101, the auxiliary pump unit 170 is not provided, in comparison with the hydraulic pump unit 10G according to the seventh embodiment.

That is, in the hydraulic pump unit 10G according to the seventh embodiment, the charge oil is forcibly sucked by the auxiliary pump unit 170. However, in the hydraulic pump unit 101 according to this embodiment, when one of the pair of hydraulic lines 30 is in a negative pressure, the charge oil is naturally sucked to the one of the hydraulic lines 30.

More specifically, the hydraulic pump unit 101 comprises the pump shaft 110, the pump body 120, the port block 130, the pump case 140 and the oil tank 15.

The pump case 140 and the port block 130 are connected to each other to thereby configure an assembly 700I including an internal space S.

The charge suction port 50P of the port block 130 is fluidly connected to the outlet port 15out of the oil tank 15.

That is, in this embodiment, the charge suction port 50P acts as the draw-in port 700in.

Figure 46:
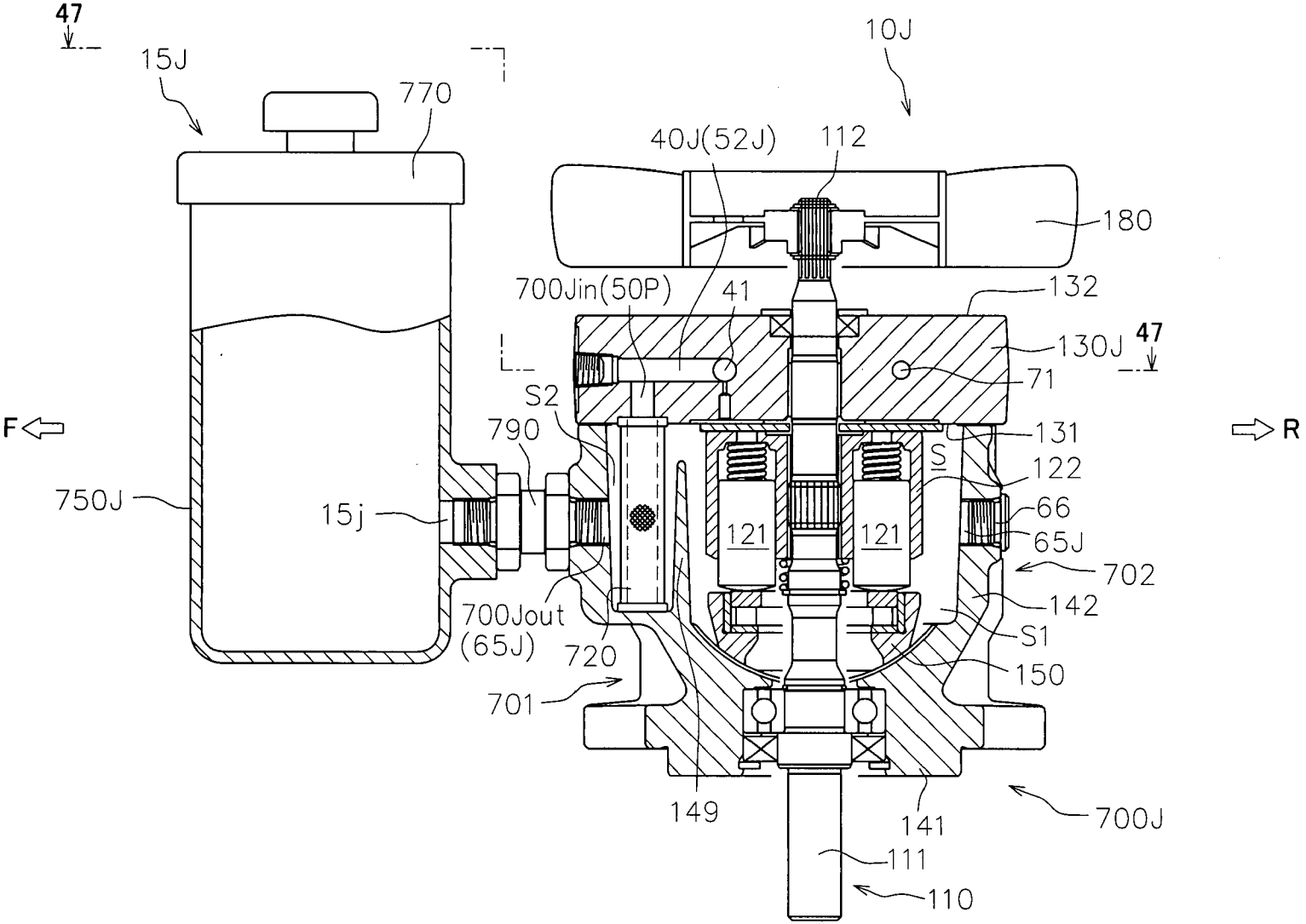
FIG. 46 is a longitudinal side view of the hydraulic pump unit shown in FIG. 45.

Preferably, a cooling fan 180 driven by the second end 112 of the pump shaft 110 may be provided in the hydraulic pump unit 101 in stead of the auxiliary pump unit 170 (see FIG. 46 and the like).

Effects similar to those in the seventh and eighth embodiments can be also obtained in the hydraulic pump unit 101 of the above configuration.

In this embodiment, a case of arranging the hydraulic pump unit longitudinally so that the rotating axis line extends along the vertical direction is described by way of example. However, the hydraulic pump unit 101 may of course be arranged transversally on the vehicle frame so that the rotating axis line extends along the horizontal direction.

Embodiment 10

Yet another embodiment of the hydraulic pump unit according to the third aspect of the present invention will now be described with reference to the accompanying drawings.

In this embodiment, the same reference numerals are denoted for the members same as or corresponding to those in the seventh to ninth embodiments; therefore, the description thereof will not be given herein.

Figure 45:
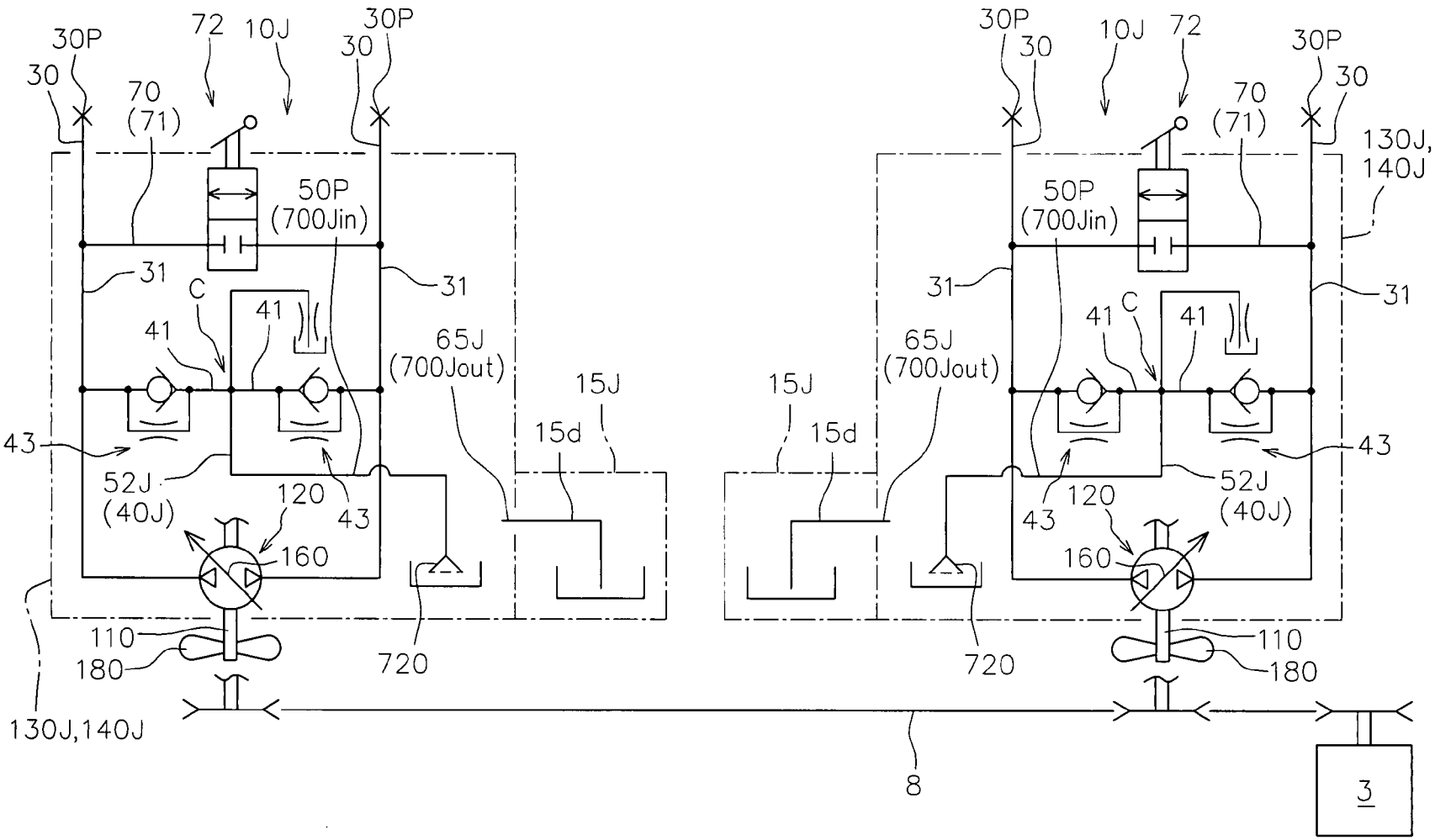
FIG. 45 is a hydraulic circuit diagram of a hydraulic pump unit according to a tenth embodiment of the present invention.
Figure 47:
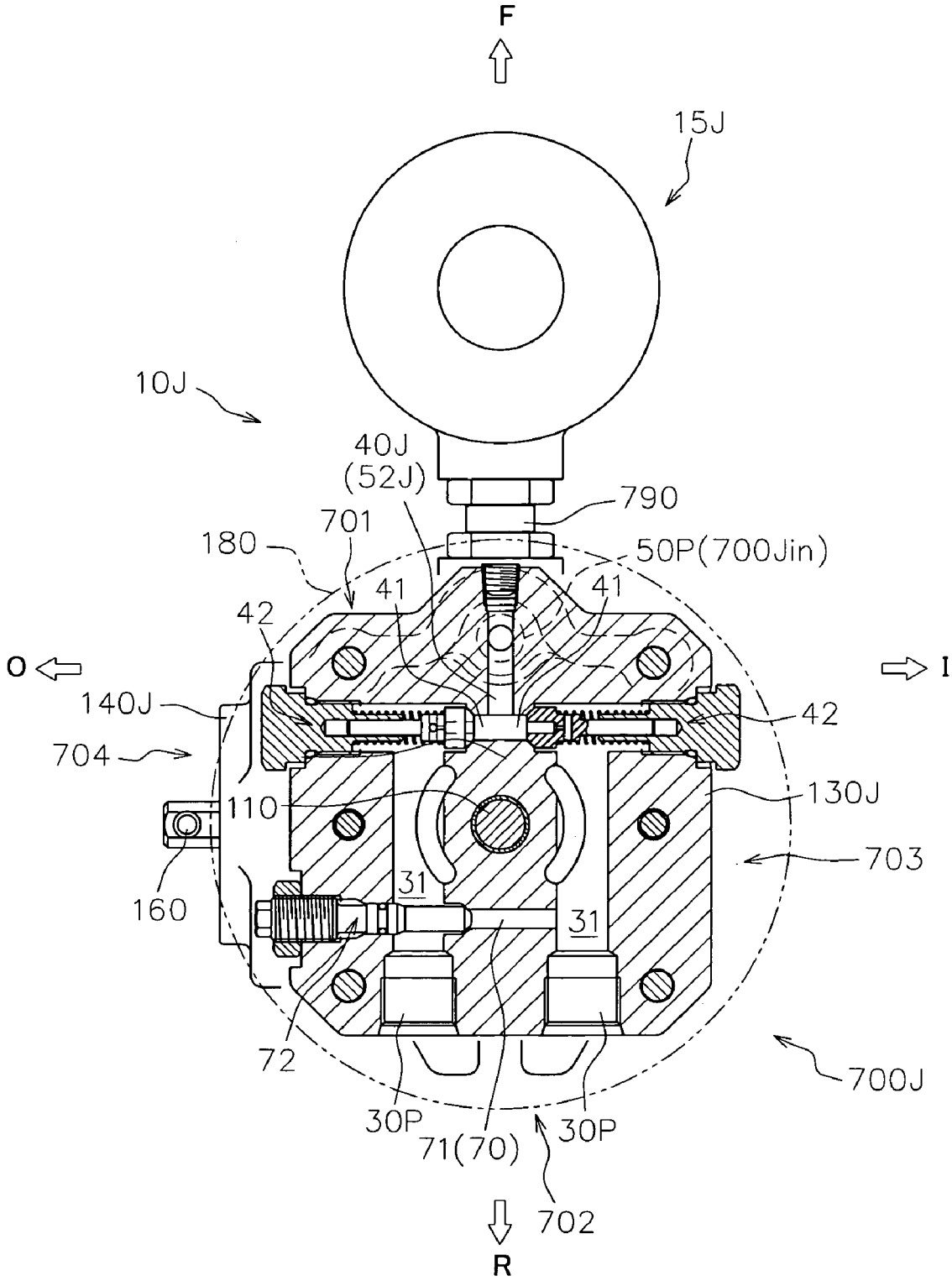
FIG. 47 is a transverse plan view of the hydraulic pump unit taken along line 47-47 of FIG. 46.

FIG. 45 and FIG. 46 are a hydraulic circuit diagram and a longitudinal side view, respectively, of a hydraulic pump unit 10J according to this embodiment. Further, FIG. 47 is a transverse plan view of the hydraulic pump unit 10J taken along line 47-47 of FIG. 46. The symbols F, R, O, and I of FIG. 46 and FIG. 47 show the front of the vehicle, the rear of the vehicle, the outside in the width direction of the vehicle, and the inside in the width direction of the vehicle, respectively.

As shown in FIG. 45 to FIG. 47, the hydraulic pump unit 10J is different from the hydraulic pump unit 101 according to the ninth embodiment mainly in that the filter 720 is arranged in the internal space S and an oil tank 15J is directly supported by an assembly 700J.

More specifically, the hydraulic pump unit 10J comprises the pump shaft 110, the pump body 120, a port block 130J, a pump case 140J, and the oil tank 15J.

The port block 130J and the pump case 140J are connected to each other to configure the assembly 700J including the internal space S for accommodating the pump body 120, similar to the seventh to ninth embodiments.

The assembly 700J comprising the port block 130J and the pump case 140J includes an external port 700Jout for opening the internal space S outward, and an internal port 700Jin for communicating the internal space S to the operating oil passage 31 formed in the port block 130J.

The internal port 700Jin is formed in the port block 130J.

Specifically, the port block 130J includes a pair of operating oil passages 31, and a charge oil passage 52J for supplying a charge oil to the pair of operating oil passages 31.

The charge oil passage 52J has a first end opening at the internal space S to form the charge suction port 50P and a second end fluidly connected to each operating oil passage 31.

The charge suction port 50P acts as the internal port 700Jin.

More specifically, the charge oil passage 52J includes a common charge oil passage 40J having a first end for forming the charge suction port 50P, and the pair of branched oil passages 41 branched from the common charge oil passage 40J at the branch point C and communicated to the pair of operating oil passages 31.

Similar to each of the above embodiments, the check valve 42 and the throttle valve 43 are inserted into the each branched oil passage 31.

Similar to each of the above embodiments, the bypass oil passage 71 and the switching valve 72 inserted into the bypass oil passage 71 are provided in the port block 130J.

The filter 720 is arranged in the internal space S so as to surround the internal port 700Jin (charge suction port 50P).

Specifically, the pump case 140J includes a pump body accommodating region S1 for accommodating the pump body 120 and a filter accommodating region S2 for accommodating the filter 720 in the internal space S.

Preferably, the pump case 140J may include a partition wall 149 for dividing the internal space S into the pump body accommodating region S1 and the filter accommodating region S2.

The filter 149 can be stably held by arranging the partition wall.

The pump case 140J further includes an opening 65J for opening the internal space S outward.

The opening 65J acts as the external port 700Jout.

In this embodiment, the openings 65J are formed at the side faces 701, 702, 703 other than the side face 704 supporting the control shaft 160 in the pump case 140J.

Among these openings 65J, the opening 65J formed in the first side wall 701 facing the oil tank 15J is used as the external port 700Jout and the remaining openings 65J are closed by plugs 66.

The oil tank 15J includes a single port 15*j* for opening the internal space thereof outward.

That is, two ports, the outlet port 15out and the inlet port 15in, are provided in the oil tanks 15, 15H in the seventh to ninth embodiments. However, only a single port 15*j* is provided in the oil tank 15J in this embodiment.

More specifically, the oil tank 15J includes a tank body 750J in which the single port 15*j* is formed, and a cap 770 for closing the upper opening of the tank body 750.

The oil tank 15J is supported by the assembly 700J by way of the joint member 790 for fluidly connecting between the external port 700Jout and the single port 15*j*.

That is, in this embodiment, the assembly 700J and the oil tank 15J are fluidly connected only by the single flow passage, as mentioned above.

Therefore, the assembly 700J and the oil tank 15J can be easily connected to each other by simply connecting between the external port 700Jout and the single port 15*j*.

The joint member 790 may of course be integrally provided in the oil tank 15J or the assembly 700J, or may be separately provided therefrom.

In place of the joint member 790, the external port 700Jout and the single port 15*j* may be connected by a conduit. In this conduit connection, the oil tank 15J may be supported only by the conduit, or the oil tank 15J may be supported by an attachment member (not shown) connected to the assembly 700J.

Effects similar to those in the seventh to ninth embodiments can be also obtained in the hydraulic pump unit 10J of the above configuration.

In this embodiment, a case of arranging the hydraulic pump unit longitudinally so that the rotating axis line extends along the vertical direction is described by way of example. However, the hydraulic pump unit may of course be arranged transversally on the vehicle frame so that the rotating axis line extends along the horizontal direction (see FIG. 48).

Figure 48:
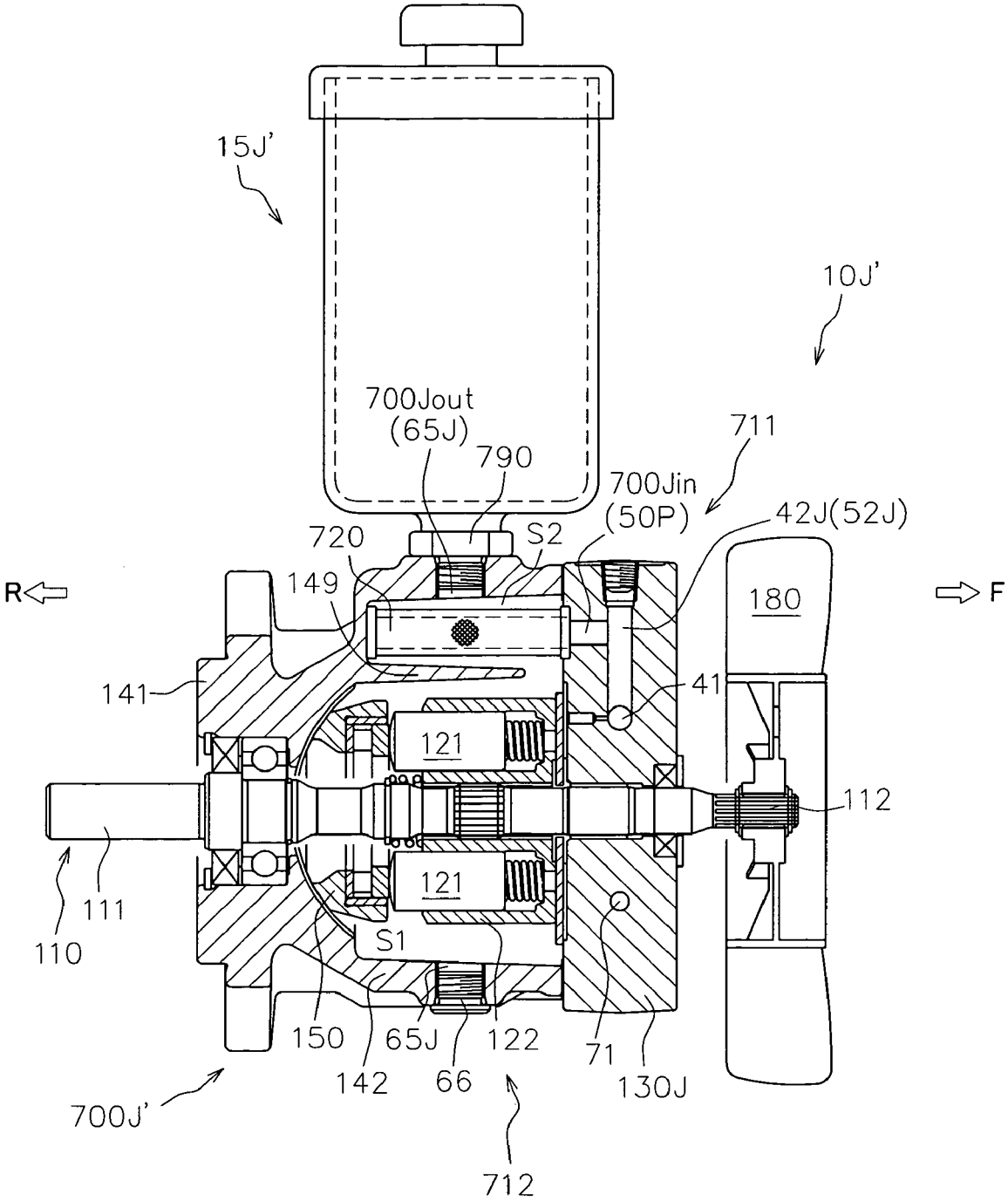
FIG. 48 is a longitudinal side view of a modified hydraulic pump unit of the present invention.

As shown in FIG. 48, in a hydraulic pump unit 10J' which is arranged transversally, an oil tank 15J' is preferably changed so that the single port 15*j* opens downward (see FIG. 48). With the above configuration, the oil tank 15J' can be substantially mounted on the first side face 711 of the assembly 700J', thereby more stably supporting the oil tank 15J'.

Embodiment 11

An embodiment of a hydraulic pump set according to the fourth aspect of the present invention will now be described with reference to the accompanying drawings.

Figure 49:
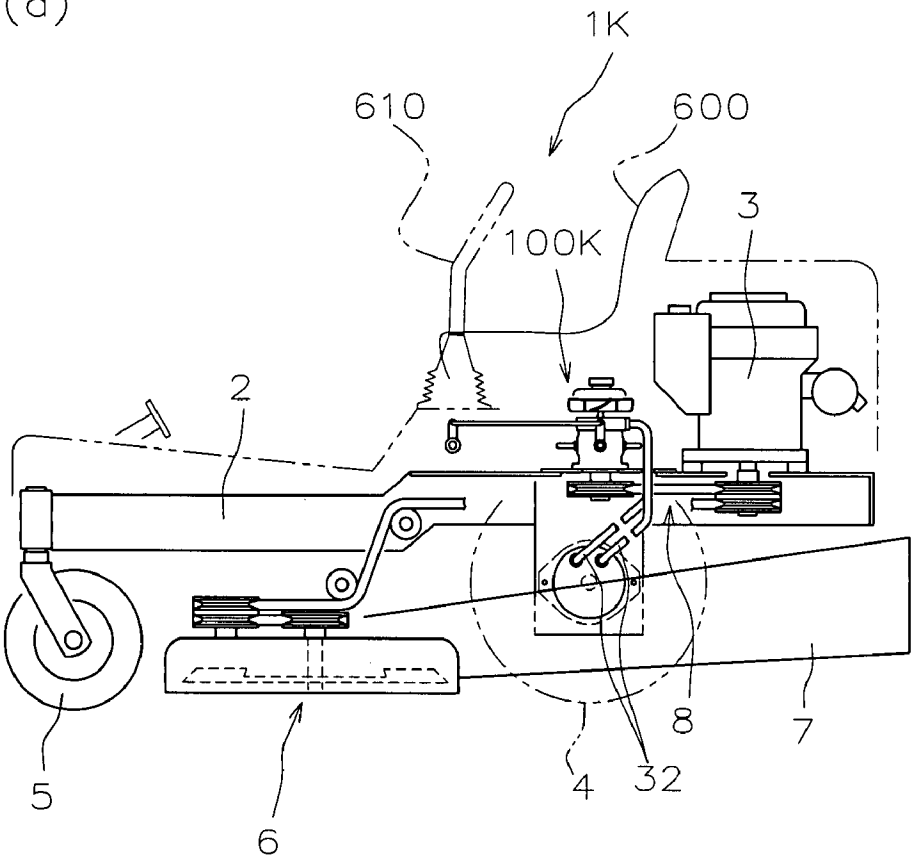
FIGS. 49(*a*) and 49(*b*) are a side view and a front view, respectively, of a working vehicle applied with a hydraulic pump set according to a eleventh embodiment of the present invention.
Figure 49:
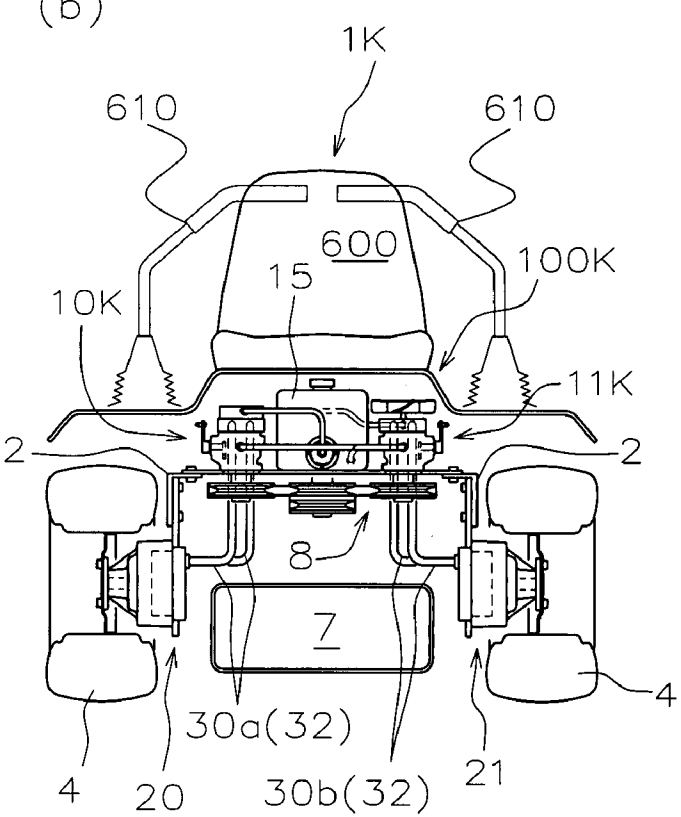
Figure 50:
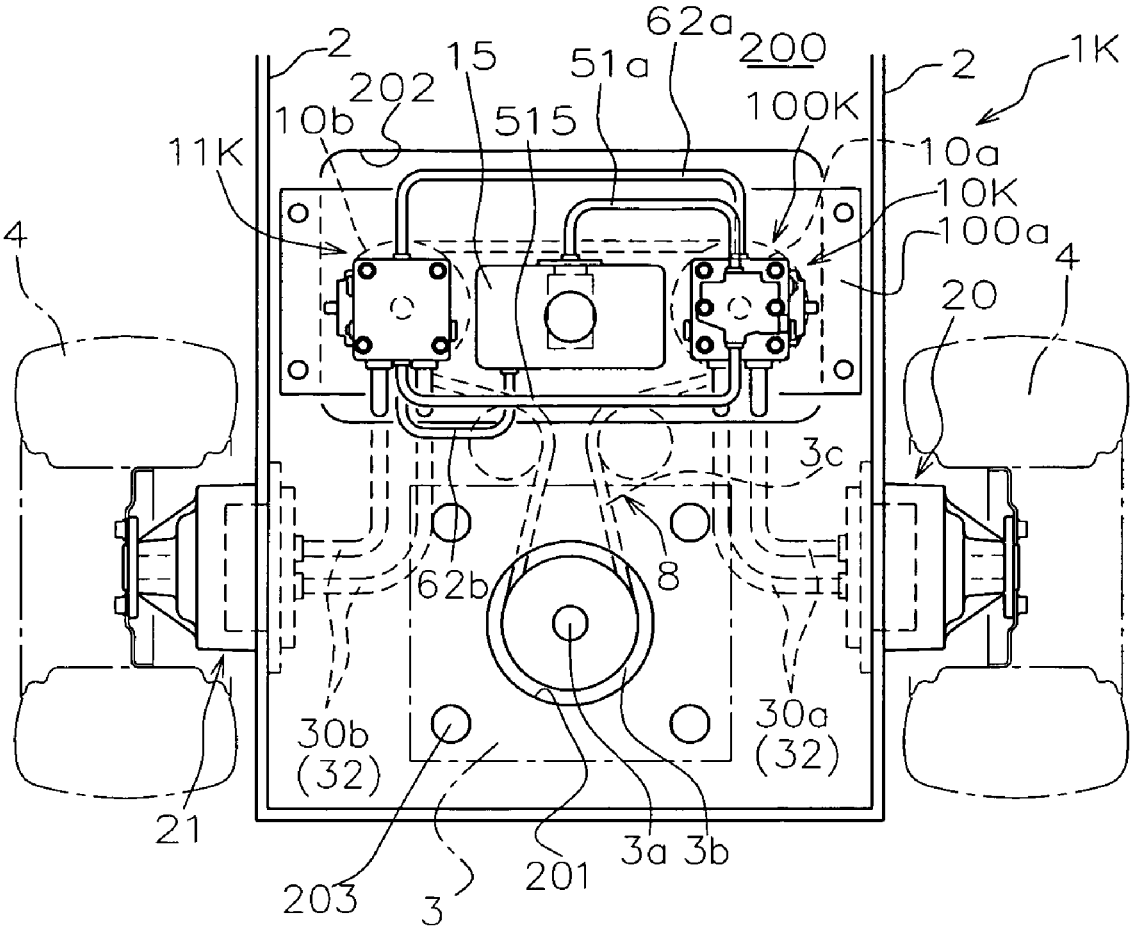
FIG. 50 is a partially developed plan view of the working vehicle shown in FIG. 49.

FIGS. 49(*a*) and 49(*b*) are a side view and a front view, respectively, of a working vehicle 1K applied with a hydraulic pump set 100K according to this embodiment. FIG. 50 is a partially developed plan view of the working vehicle 1K.

As shown in FIG. 49 and FIG. 50, the hydraulic pump set 100K comprises first and second hydraulic pump units 10K, 11K arranged apart from each other.

In this embodiment, the first and second hydraulic pump units 10K, 11K are arranged apart from each other along the width direction of the vehicle so as to define a space at the center in the width direction of the vehicle.

The configuration of the working vehicle 1K will now be described.

As shown in FIG. 49 and FIG. 50, the working vehicle 1K is a rear discharge-type riding mower capable of performing zero turn.

Specifically, the working vehicle 1K comprises a frame 2, a driving source 3 supported by the frame 2, the hydraulic pump set 100K arranged in the vicinity of the driving source 3 and operatively driven by the driving source 3 by way of a transmission mechanism 8, first and second hydraulic motor units 20, 21 fluidly connected to the hydraulic pump set 100K, a pair of driving wheels 4 (rear wheel in this embodiment) driven by the first and second hydraulic motor units 20, 21, and caster wheels 5 (front wheel in this embodiment).

In this embodiment, the driving source 3 is of a vertical crankshaft type, as shown in FIG. 49 and FIG. 50.

The driving source 3 is mounted to a flat plate 200 arranged on the rear side of the frame 2 by way of an elastic member 203 and, thus, is flexibly supported by the frame 2.

Specifically, as shown in FIG. 50, a first opening 201 is formed at the center of the flat plate 200.

The driving source 3 is attached to the flat plate 200 by way of the elastic member 203 in a state where a driving pulley 3*b* attached to the shaft end of the driving shaft 3*a* is positioned below the flat plate 200 through the first opening 201.

A broad second opening 202 is formed in the flat plate 200 at the front of the first opening 201. The second opening 202 is provided to operatively connect between the driving source 3 and the hydraulic pump set 100K.

Specifically, the first and second hydraulic pump units 10K, 11K are arranged on a common substrate 100*a* in a state spaced apart from each other in the width direction of the vehicle.

Herein, the shaft end of the pump shaft 110 (which will be described later) passes through the substrate 100*a* and, then, extends below the flat plate 200 by way of the second opening 202. Driven pulleys 10*a*, 10*b* are each arranged on the shaft end of the pump shaft 110 so as to be positioned below the flat plate 200.

The common substrate 100*a* has a left-to-right length (length along the width direction of the vehicle) longer than a left-to-right length of the second opening, and a portion overlapping the flat plate 200 is joined to the flat plate 200.

With the above configuration, a sub-assembly with the first and second hydraulic pump units 10K, 11K arranged on the common substrate 100*a* in advance is incorporated into the frame 2 (flat plate 200) all at one.

After incorporation in the sub-assembly, a transmission belt 3*c* is wound between the driven pulleys 10*a*, 10*b* and the driving pulley 3*b*, and by applying tension thereto, the first and second hydraulic pump units 10K, 11K are rotated in the same direction as the rotating direction of the driving source 3.

In this embodiment, as shown in FIG. 49, the driving source 3 is of a vertical crankshaft type; thus, the first and second hydraulic pump units 10K, 11K are arranged so that the rotating axis line of each pump shaft 110 extends along the vertical direction. However, if the driving source 3 is of a horizontal crankshaft type, the hydraulic pump units may be arranged so that the rotating axis line of each pump shaft 110 extends along the front-to-rear direction.

As shown in FIG. 49(*b*) and FIG. 50, the first and second hydraulic motor units 20, 21 are also distributed and arranged in the width direction of the vehicle so as to define a space therebetween.

The working vehicle 1K comprises, in addition to the above configuration, a mower device 6 suspended and supported in a freely rising/lowering manner between the front and rear wheels 4, 5, and a duct 7 which is arranged in the space and guides the mowed grass to a grass collecting bag (not shown) arranged at the rear of the vehicle body.

Further, in the working vehicle 1K, a driver's seat 600 is arranged above the center in the width direction of the frame 2 at the front of the driving source 3, and a pair of left and right steering handles 610 are arranged at the front of the driver's seat 600 in a freely forward/rearward tilting manner.

The pair of steering handles 610 are operatively connected with the first and second hydraulic pump units 10K, 11K so as to operate the first and second hydraulic pump units 10K, 11K, respectively, and the outputs of the first and second hydraulic motor units 20, 21 fluidly connected through a pair of operating oil conduits 32 are controlled by operating the pair of steering handles 610.

The working vehicle 1K comprises, in addition to the above configuration, an oil tank 15 arranged between the first hydraulic pump unit 10K and the second hydraulic pump unit 11K.

The oil tank 15 stores drain oils of the first and second hydraulic pump units 10K, 11K and, also, acts as a charge oil supply source for pairs of hydraulic lines 30*a*, 30*b*, as will be described later.

Figure 51:
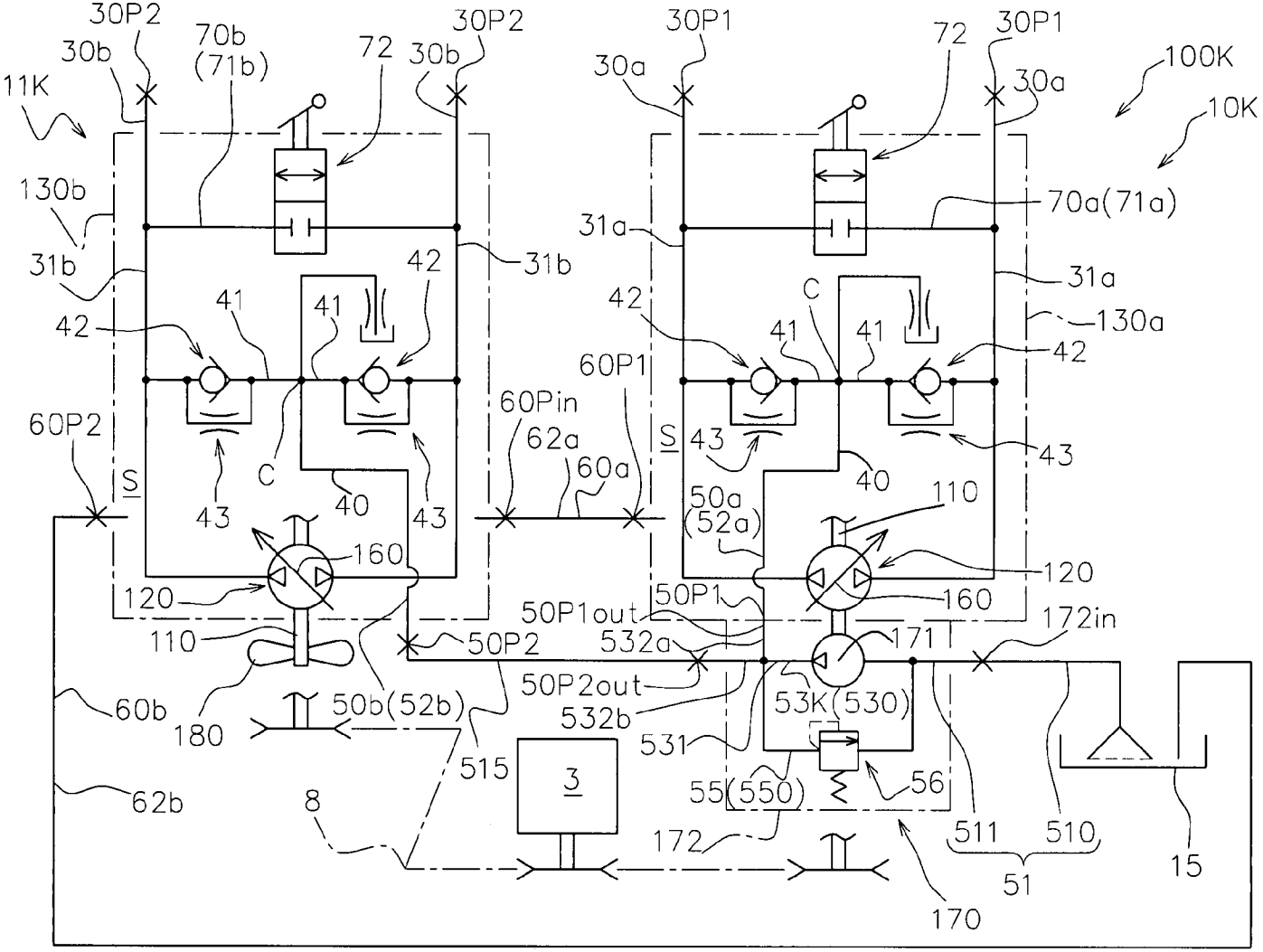
FIG. 51 is a hydraulic circuit diagram of the hydraulic pump set according to the eleventh embodiment.

FIG. 51 shows a hydraulic circuit diagram of the hydraulic pump set 100K according to this embodiment.

The first hydraulic pump unit 10K is fluidly connected to the first hydraulic motor unit 20 by way of a hydraulic circuit (pair of first hydraulic lines 30*a* in this embodiment) so as to form a first HST in cooperation with the first hydraulic motor unit 20 (see FIG. 50).

At least one of the first hydraulic pump unit 10K and the first hydraulic motor unit 20 is of a variable displacement type.

Similarly, the second hydraulic pump unit 11K is fluidly connected to the second hydraulic motor unit 21 by way of a hydraulic circuit (pair of second hydraulic lines 30*b* in this embodiment) so as to form a second HST in cooperation with the second hydraulic motor unit 21 (see FIG. 50).

At least one of the second hydraulic pump unit 11K and the second hydraulic motor unit 21 is of a variable displacement type.

In this embodiment, each of the first and second hydraulic pump units 10K, 11K is of a variable displacement type, and each of the first and second hydraulic motor units 20, 21 is of a fixed displacement type.

The configurations of the first hydraulic pump unit 10K and the second hydraulic pump unit 11K will now be described in detail.

Figure 52:
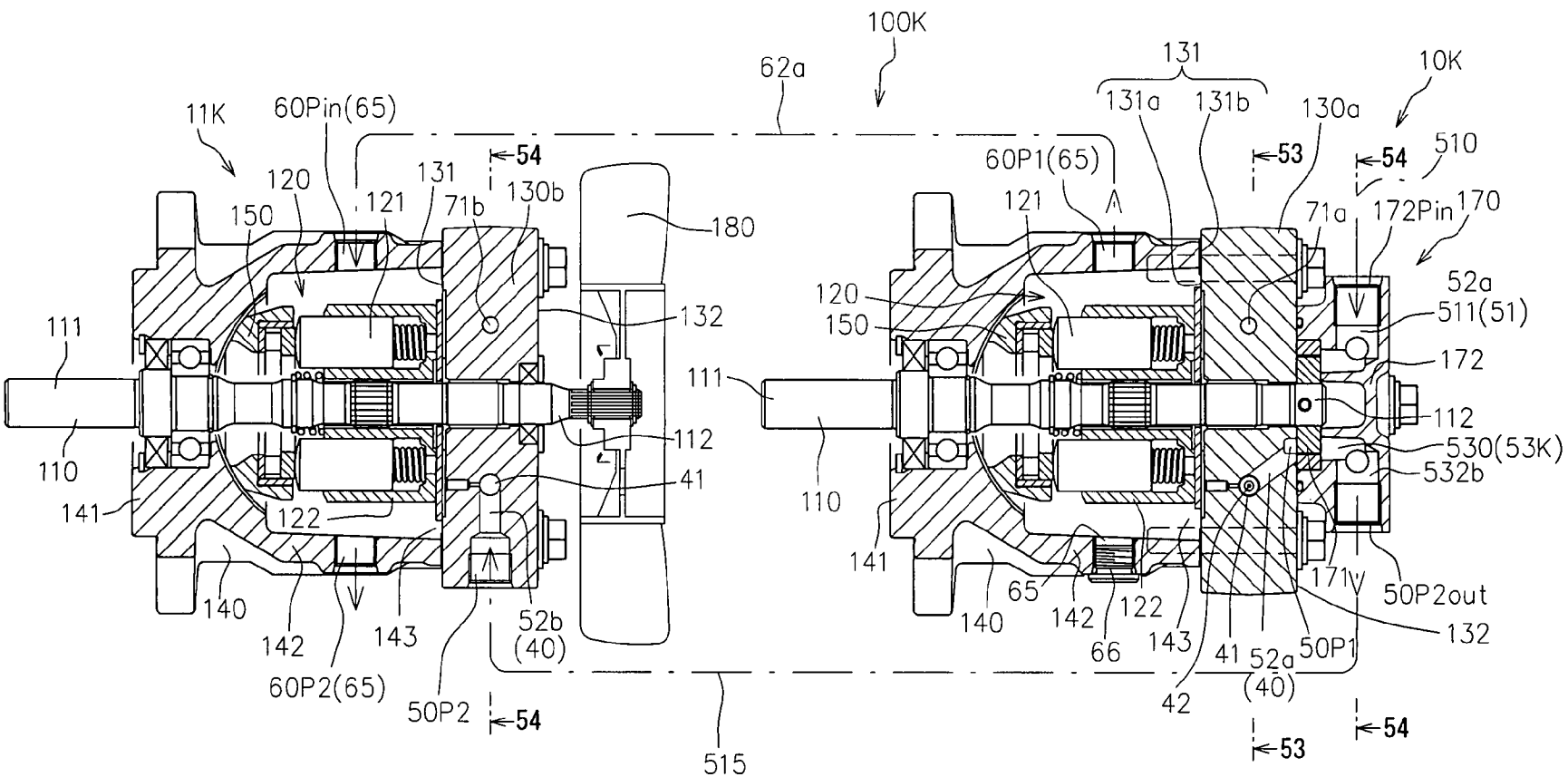
FIG. 52 is a schematic longitudinal side view of the first and second hydraulic pump units in the hydraulic pump set according to the eleventh embodiment.

FIG. 52 shows a schematic longitudinal side view of the first and second hydraulic pump units 10K, 11K.

Figure 53:
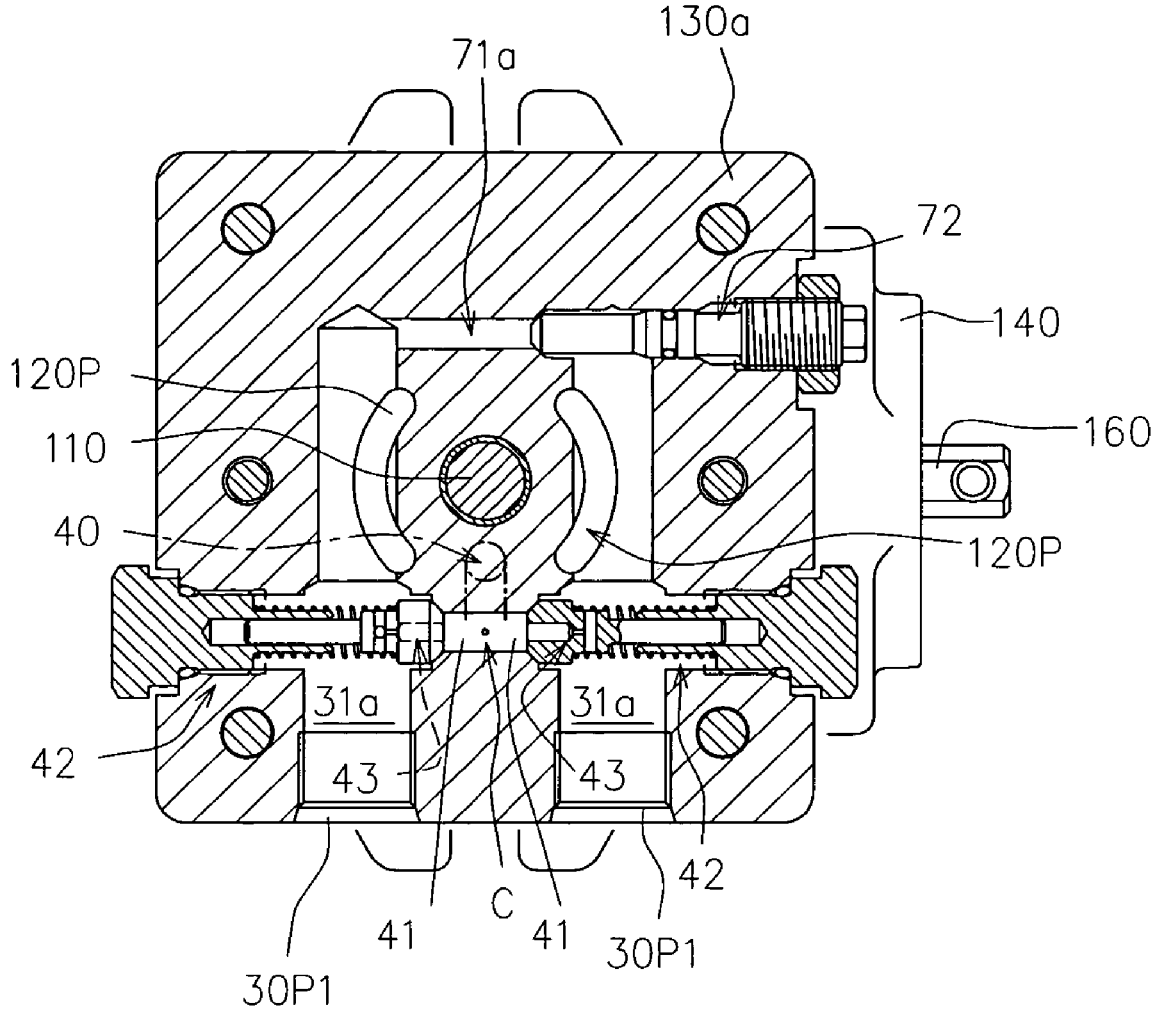
FIG. 53 is a cross sectional view taken along line 53-53 of FIG. 52.
Figure 54:
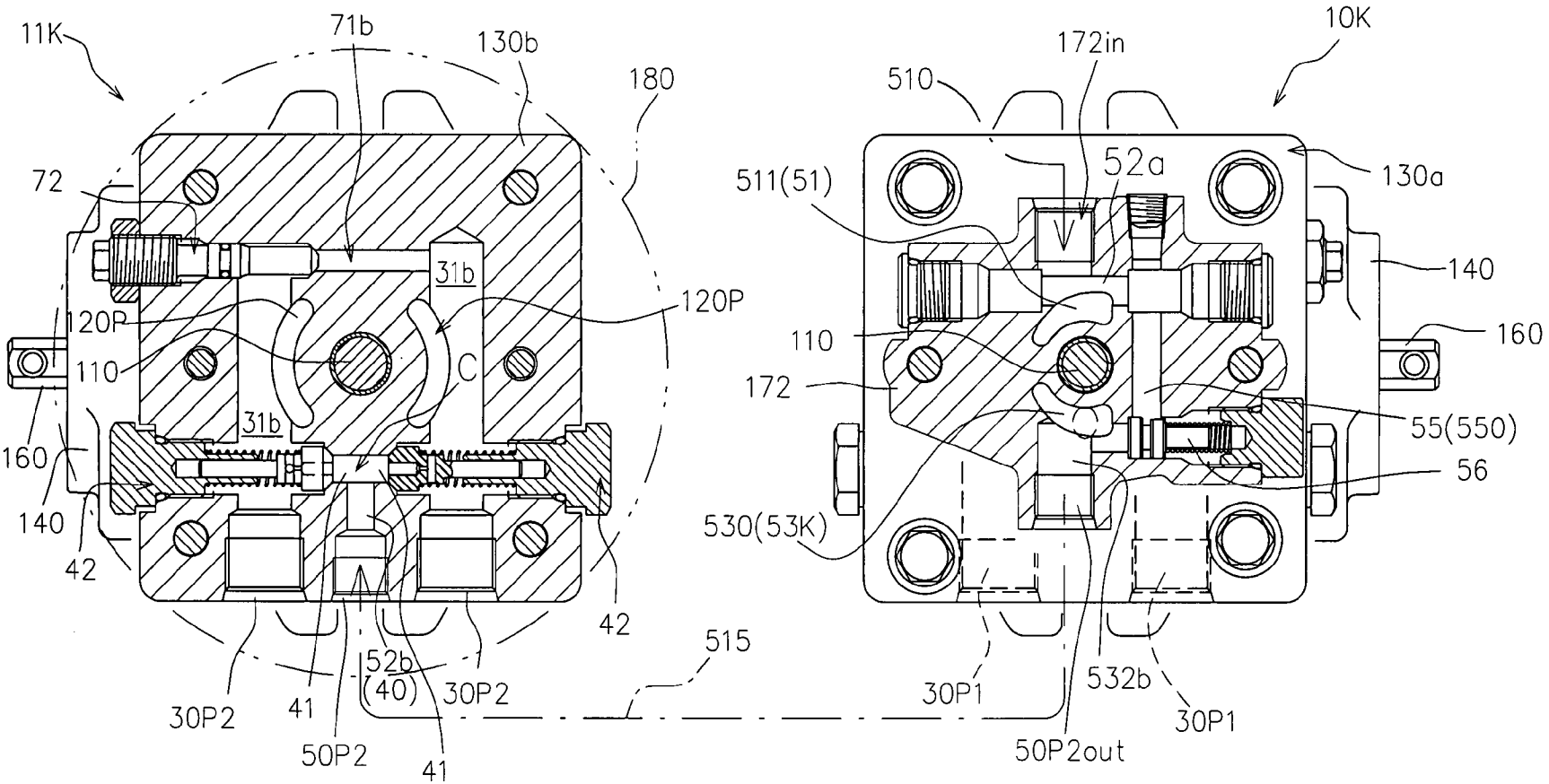
FIG. 54 is a cross sectional view taken along line 54-54 of FIG. 52.

FIG. 53 and FIG. 54 show cross sectional views taken along line 53-53 and line 54-54 of FIG. 52, respectively.

As shown in FIG. 52 and FIG. 53, the first hydraulic pump unit 10K comprises the pump shaft 110 operatively connected to the driving source 3, a pump body 120 driven by the pump shaft 110, a first port block 130*a* formed with an oil passage for supplying/discharging an operating oil to/from the pump body 120, and a pump case 140 connected to the first port block 130*a* so as to surround the pump body 120.

The second hydraulic pump unit 11K comprises the pump shaft 110, the pump body 120, a second port block 130*b* formed with an oil passage different from that of the first port block 130*a*, and the pump case 140.

That is, the first and second hydraulic pump units 10K, 11K have substantially the same configuration except for the port block.

The pump shaft 110 is supported by an assembly, configured by connecting the pump case 140 and the corresponding port block 130*a*, 130*b*, so that a first end 111 extends outward from the assembly.

In this embodiment, the first end 111 extends downward from the assembly (see FIG. 49(*a*)).

The first end 111 is operatively connected to the driving source 3 by way of an appropriate transmission mechanism 8 (pulley and belt in the embodiment shown in the figure) (see FIG. 49 and FIG. 50).

In this embodiment, the pump body 120 includes a piston unit 121 for performing a reciprocating movement by the rotation of the pump shaft 110, and a cylinder block 122 for supporting the piston unit 121 in a freely reciprocating manner.

As mentioned above, each of the first and second hydraulic pump units 10K, 11K are of a variable displacement type in this embodiment.

Therefore, each of the first and second pump units 10K, 11K comprises, in addition to the above configuration, an output adjusting member 150 for changing the suction/discharge rates of the pump body 120, and a control shaft 160 for slanting the output adjusting member 150.

In this embodiment, a movable swash plate is used for the output adjusting member 150, and a trunnion shaft is used for the control shaft 160.

In this embodiment, the control shaft 160 extends toward the outside in the width direction of the vehicle, in order to prevent interference with the oil tank 15.

The pump case 140 is connected to the corresponding port block 130 to configure the assembly for accommodating the corresponding pump body 120.

Specifically, the pump case 140 has an end wall 141 positioned on a first end side in the direction of the pump shaft 110, and a peripheral wall 142 extending from the end wall 141 toward a second end side in the axis line direction of the pump shaft 110.

The peripheral wall 142 has an opening 143 at the second end side in the axis line direction of the pump shaft 110. The opening 143 is sized to allow the pump body 120 to be inserted thereinto.

The first and second port blocks 130*a*, 130*b* are connected to the corresponding pump case 140 so as to close the opening 143 while rotatably supporting the corresponding pump body 120 in cooperation with the corresponding pump case 140.

Specifically, the first and second port blocks 130*a*, 130*b* include a first end face 131 (lower surface in this embodiment) which is orthogonal to the pump shaft 110 and faces the pump case 140.

The first end face 131 includes a support region 131*a* for supporting the pump body 120 in a freely rotating manner, and a contact region 131*b* which is positioned outward in the radius direction of the support region 131*a* and is brought into contact with the pump case 140.

A pump body accommodating space S for accommodating the pump body 120 is defined when the first end faces 131 of the first and second port blocks 130*a*, 130*b* are brought into contact with the end face of the peripheral wall 142 of the corresponding pump case 140.

The oil passages formed in the first and second port blocks 130*a*, 130*b* will be described later.

In the hydraulic pump set 100K, an auxiliary pump unit 170 driven by the corresponding pump shaft 110 is arranged only in one of the first and second pump units 10K, 11K.

As shown in FIG. 51, FIG. 52, and FIG. 54, the auxiliary pump unit 170 is arranged in the first hydraulic pump unit 10K in this embodiment.

The auxiliary pump unit 170 includes an auxiliary pump body 171 driven by the corresponding pump shaft 110, and an auxiliary pump case 172 surrounding the auxiliary pump body 171.

In this embodiment, the auxiliary pump unit 170 is connected to a second end face 132 (upper surface in this embodiment) on the opposite side of the first end face 131 of the first port block 130*a*.

Specifically, the pump shaft 110 has the first end 111 forming the input end, passing through the end wall 141 of the pump case 140 and extending outward, and a second end 112 passing through the first port block 130*a* and extending outward.

The auxiliary pump body 171 is driven by the second end 112 of the pump shaft 110.

Further, the auxiliary pump case 172 is connected to the second end face 132 of the first port block 130*a* so as to surround the auxiliary pump body 171.

The hydraulic pump unit (second hydraulic pump unit 11K in this embodiment) not equipped with the auxiliary pump unit 170 comprises, in addition to the above configuration, a cooling fan 180 driven by the corresponding pump shaft 110.

Specifically, also in the second hydraulic pump unit 11K, the pump shaft 110 has the second end 112 passing through the second port block 130*b* and extending outward.

The cooling fan 180 is driven by the second end 112 of the pump shaft 110.

The hydraulic pump unit of the hydraulic pump set 100K according to this embodiment will now be described.

As shown in FIG. 51, the first hydraulic pump unit 10K includes the pair of first hydraulic lines 30*a* fluidly connecting with the corresponding first hydraulic motor unit 20, a suction line 51 extending between the oil tank 15 and the auxiliary pump body 171, a discharge line 53K for flowing a discharge oil from the auxiliary pump body 171, a first charge line 50*a* having a first end fluidly connected to the discharge line 53K and a second end fluidly connected to each first hydraulic line 30*a*, and a first drain line 60*a* for returning a drain oil in the pump body accommodating space S in the first hydraulic pump unit 10K back to the oil tank 15.

On the other hand, the second hydraulic pump unit 11K includes the pair of second hydraulic lines 30*b* for fluidly connecting with the corresponding second hydraulic motor unit 21, a second charge line 50*b* having a first end fluidly connected to the discharge line 53K and a second end fluidly connected to each second hydraulic line 30*b*, and a second drain line 60*b* for returning the drain oil in the pump body accommodating space S in the second hydraulic pump unit 11K back to the oil tank 15.

As shown in FIG. 51 and FIG. 53, the pair of hydraulic lines 30*a* include a pair of first operating oil passages 31*a* perforated in the first port block 130*a*, and a pair of operating oil conduits 32 (see FIG. 49 and FIG. 50) for communicating the pair of first operating oil passages 31*a* to the first hydraulic motor unit 20.

Each of the pair of first operating oil passages 31*a* has a first end opening outward to form a first operating oil port 30P1 and a second end communicating to a pair of kidney ports 120P in the corresponding pump body 120 (see FIG. 53).

The pair of second hydraulic lines 30*b* include a pair of second operating oil passages 31*b* perforated in the second port block 130*b*, and a pair of operating oil conduits 32 (see FIG. 49 and FIG. 50) for communicating the pair of second operating oil passages 31*b* to the second hydraulic motor unit 21.

Each of the pair of second operating oil passages 31*b* also has a first end opening outward to form a second operating oil port 30P2 and a second end communicating to the pair of kidney ports 120P in the corresponding pump body 120 (see FIG. 54).

The suction line 51 includes, as shown in FIG. 50, FIG. 51, FIG. 52 and FIG. 54, a suction conduit 510 having a first end communicated to the oil tank 15, and a suction oil passage 511 having a first end opened at the external surface of the assembly to form a suction port 172in and a second end communicated to the suction part of the auxiliary pump body 171.

In this embodiment, the suction port 172in is provided in the auxiliary pump case 172.

The discharge line 53K includes a discharge oil passage 530 formed in the auxiliary pump case 172 so as to have a first end communicated to the discharge part of the auxiliary pump body 171 and a second end opened at the external surface of the auxiliary pump case 172.

More specifically, as shown in FIG. 51, the discharge oil passage 530 includes a common discharge oil passage 531 communicated to the discharge part of the auxiliary pump body 171, and a first discharge oil passage 532*a* and a second discharge oil passage 532*b* branched from the common discharge oil passage 531.

Each of the first and second discharge oil passages 532*a*, 532*b* has a first end communicated to the common discharge oil passage 531, and a second end opened at the external surface of the auxiliary pump case 172 to form first and second discharge ports 50P1out, 50P2out for charging.

In this embodiment, the first discharge port 50P1out is opened at the surface which is brought into contact with the first port block 130*a*.

On the other hand, the second discharge port 50P2out is opened at one side face (rear side face in this embodiment) of the auxiliary pump case 172 so as to supply the pressure oil to the outside of the first hydraulic pump unit 10K (see FIG. 54).

The hydraulic pump unit 10K according to this embodiment further includes a charge pressure setting line 55 for setting the oil pressure of the discharge line 53K.

In this embodiment, the charge pressure setting line 55 includes a charge pressure setting oil passage 550 formed in the auxiliary pump case 172 so as to communicate the suction line 51 and the discharge line 53K, and a relief valve 56 inserted into the charge pressure setting oil passage 550.

As shown in FIG. 50, FIG. 51, FIG. 52 and FIG. 54, the first charge line 50*a* includes a charge oil passage 52*a* formed in the first port block 130*a* so as to have a first end forming the charge suction port 50P1 communicating to the first discharge oil passage 532*a* and a second end communicating to each first operating oil passage 31*a*.

In this embodiment, the first charge suction port 50P1 is formed in the surface, which is brought into contact with the auxiliary pump case 172, so as to be fluidly connected with the first discharge port 50P1out.

Specifically, the charge oil passage 52*a* includes a common charge oil passage 40 forming the first charge suction port 50P1, and a pair of branched oil passages 41 branched from the common charge oil passage 40 at the branch point C and communicated to the pair of first operating oil passages 31*a* (see FIG. 51 and FIG. 53).

A check valve 42 is arranged in each branched oil passage 41.

The check valve 42 is provided to allow the flow of the pressure oil from the first charge line 50*a* to the pair of first hydraulic lines 30*a* and to prevent the pressure oil from flowing in the opposite direction.

In this embodiment, the check valve 42 includes a throttle 43 (see FIG. 51); thus, a neutral state of the HST is obtained without the need of strictly controlling the output adjusting member 150.

In this embodiment, as shown in FIG. 53, a single oil passage perforated in a direction approximately orthogonal to the pair of first operating oil passages 31*a* is formed in the first port block 130*a* so as to communicate between the pair of first operating oil passages 31*a*. The single oil passage forms the pair of branched oil passages 41.

With the above configuration, the pair of branched oil passages 41 can be efficiently arranged.

The second charge line 50*b*, as shown in FIG. 51, has a first end fluidly connected to the discharge line 53K and a second end fluidly connected to the pair of second hydraulic lines 30*b*.

In this embodiment, the second charge line 50*b* includes a second charge oil passage 52*b* formed in the second port block 130*b* so as to be fluidly connected to the second discharge port 50P2out by way of an appropriate conduit (charge conduit 515 in this embodiment).

Specifically, the second charge oil passage 52*b* is formed in the second port block 130*b* so as to have a first end forms the second charge suction port 50P2 connectable to the charge conduit 515 and a second end communicating to each second operating oil passage 31*b*.

More specifically, the second charge oil passage 52*b* includes the common charge oil passage 40 forming the second charge suction port 50P2, and the pair of branched charge oil passages 41 branched from the common charge oil passage 40 at the branch point C and communicated to the pair of second operating oil passages 31*b* (see FIG. 51 and FIG. 53).

Similar to the first hydraulic pump unit 10K, the check valve 42 and the throttle valve 43 are inserted to each branched charge oil passage 41.

In this embodiment, the first drain line 60*a* is configured so as to have a first end communicated to the pump body accommodating space S in the first hydraulic pump unit 10K and a second end communicated to the pump body accommodating space S in the second hydraulic pump unit 11K.

On the other hand, the second drain line 60*b* is configured so as to have a first end communicated to the pump body accommodating space S in the second hydraulic pump unit 11K and a second end communicated to the oil tank 15.

Specifically, as shown in FIG. 51 and FIG. 52, the hydraulic pump unit 10K includes a first drain port 60P for opening the pump body accommodating space S thereof outward, and a first drain conduit 62*a* having a first end communicated to the first drain port 60P1.

The second hydraulic pump unit 11K includes a drain input port 60Pin to which the second end of the first drain conduit 62*a* is communicated, a second drain port 60P2 for opening the pump body accommodating space S thereof outward, and a second drain conduit 62*b* having a first end communicated to the second drain port 60P2 and a second end communicated to the oil tank 15.

In this embodiment, the first drain port 60P1, the drain input port 60Pin and the second drain port 60P2 are provided in the pump case 140.

Specifically, in this embodiment, the first and second hydraulic pump units 10K, 11K include a common pump case 140, as mentioned above.

The common pump case 140, as shown in FIG. 52, includes at least two or more openings 65 for opening the corresponding pump body accommodating space S outward.

The unnecessary opening 65 of the pump case 140 in the first hydraulic pump unit 10K is closed by a plug 66.

On the other hand, in the pump case 140 in the second hydraulic pump unit 11K, one opening 65 is used for the drain input port 60Pin, and the other opening 65 is used for the second drain port 60P2 (see FIG. 52).

In the hydraulic pump set 100K according to this embodiment, the first hydraulic pump unit 10K further includes a bypass line 70*a* for communicating between the pair of first hydraulic lines 30*a* (see FIG. 51).

The bypass line 70*a* is provided to prevent a pressure difference from being occurred between the pair of first hydraulic lines 30*a* when forcibly towing the vehicle at the time of fault and the like.

Similarly, the second hydraulic pump unit 11K also includes a bypass line 70*b* for communicating between the pair of second hydraulic lines 30*b*.

The bypass line 70*b* has substantially the same configuration as the bypass line 70*a*. Therefore, the same reference numerals or the same reference numerals added with "b" are denoted in the figures for the bypass line 70*b* for those similar to the bypass line 70*a*, and the detailed description thereof will not be given herein.

As shown in FIG. 51 and FIG. 53, in this embodiment, the bypass line 70*a* includes a bypass oil passage 71*a* formed in the first port block 130*a* so as to communicate between the pair of first operating oil passages 31*a*, and a switching valve 72 for selectively communicating/blocking the bypass oil passage 71*a*.

Preferably, as shown in FIG. 53, the bypass oil passage 71*a* is positioned on the opposite side of the single oil passage configuring the pair of branched oil passages 41 with the pump shaft 110 interposed therebetween.

That is, the first operating oil passage 31*a* has a first end opening at the external surface of the first port block 130*a* so as to form the first operating oil port 30P1, and a second end extending beyond the corresponding pump shaft 110 to a region on the opposite side of the first operating oil port 30P1.

The pair of branched oil passages 41 are arranged so as to communicate between the pair of first operating oil passages 31*a* in the region (region on the side proximate the first operating oil port 30P1 in the embodiment shown in the figure) on one side with the pump shaft 110 as a reference.

On the other hand, the bypass oil passage 71*a* is arranged so as to communicate between the pair of first operating oil passages 31*a* in the region (region on the side away from the first operating oil port 30P1 in the embodiment shown in the figure) on the other side with the pump shaft 110 as a reference.

With the above configuration, the efficient arrangement of the pair of first operating oil passages 31*a*, the pair of branched oil passages 41 and the bypass oil passage 71*a* can be achieved.

The switching valve 72 is inserted into the bypass oil passage 71*a*, 71*b* so as to be externally operated from the first and second port blocks 130*a*, 130*b*.

The following effects can be obtained in the hydraulic pump set 100K of the above configuration.

That is, in this embodiment, the auxiliary pump unit 170 is provided in only one of the first and second hydraulic pump unit 10K, 11K, as mentioned above. The charge oil is supplied to both the first and second hydraulic pump units 10K, 11K by the auxiliary pump unit 170.

Therefore, in comparison with the conventional configuration in which the charge pump unit is provided in each of the first and second hydraulic pump units, the number of auxiliary pump units to be annexed can be decreased; thus, the manufacturing cost and the assembling cost can be reduced.

Further, only one hydraulic circuit such as the relief valve 56 for setting the oil pressure of the charge oil needs to be provided; thus, the cost can be further reduced.

In this embodiment, the auxiliary pump unit 170 is configured so as to be driven by the second end of the pump shaft 110 in the corresponding hydraulic pump unit (first hydraulic pump unit 10K in this embodiment).

Therefore, the transmission path from the driving source 3 to the auxiliary pump unit 170 does not need to be separately provided; thus, the cost can be further reduced.

Embodiment 12

Another embodiment of the hydraulic pump set according to the fourth aspect of the present invention will now be described with reference to the accompanying drawings.

Figure 55:
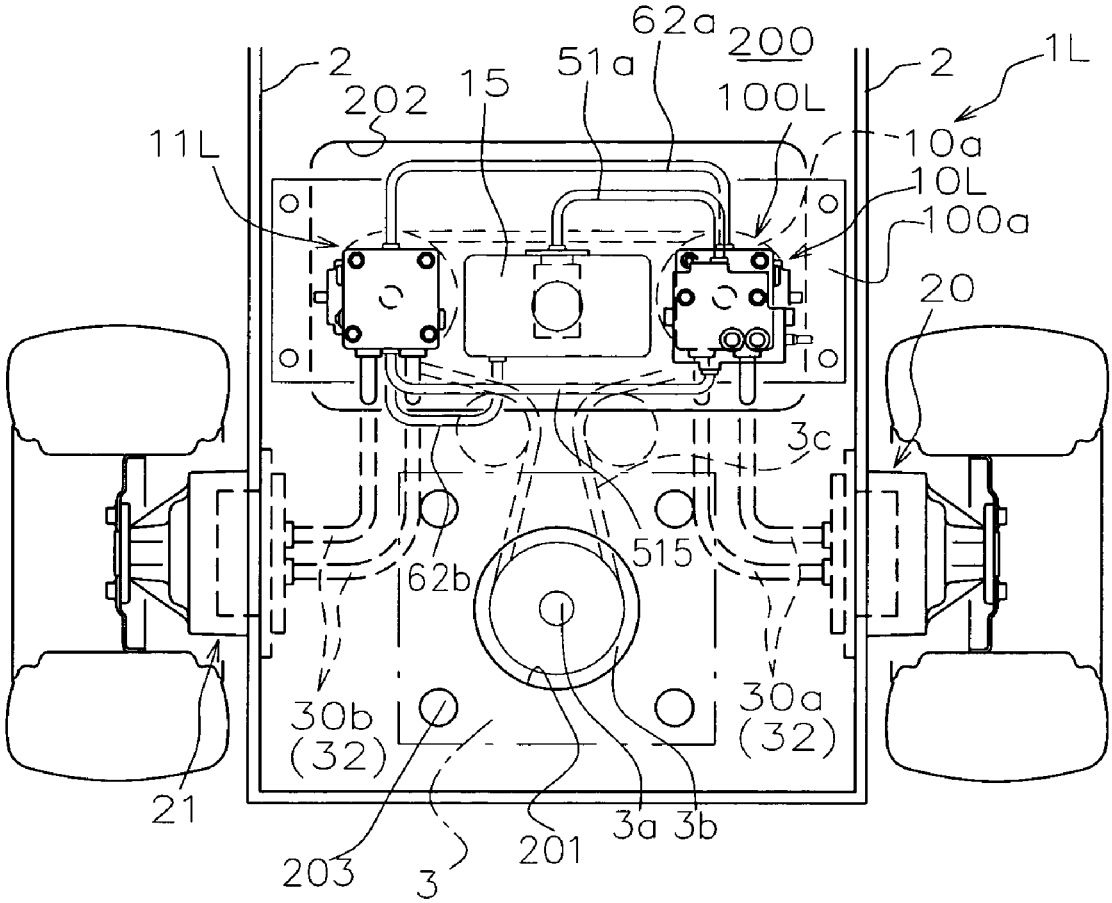
FIG. 55 is a partial plan view of a working vehicle applied with a hydraulic pump set according to a twelfth embodiment of the present invention.
Figure 56:
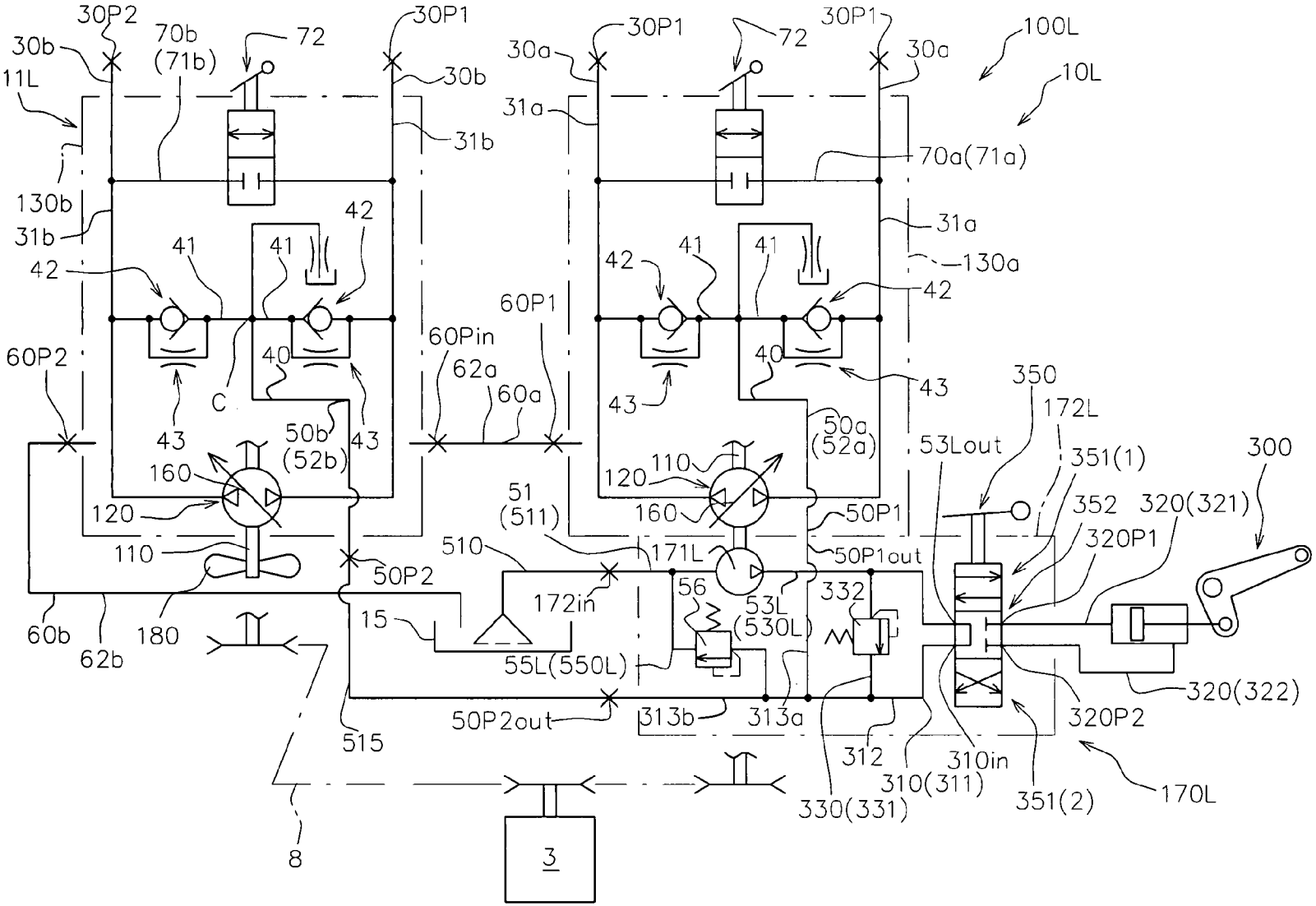
FIG. 56 is a hydraulic circuit diagram of the hydraulic pump set according to the twelfth embodiment of the present invention.

FIG. 55 shows a partial plan view of a working vehicle 1L applied with a hydraulic pump set 100L according to this embodiment. Further, FIG. 56 shows a hydraulic circuit diagram of the hydraulic pump set 100L.

In this embodiment, the same reference numerals or the same reference numerals added with "L" are denoted for the members same as or corresponding to those in the eleventh embodiment; therefore, the description thereof will not be given herein.

The hydraulic pump set 100L according to this embodiment comprises an auxiliary pump unit 170L in place of the auxiliary pump unit 170 in the hydraulic pump set 100K according to the eleventh embodiment.

That is, the auxiliary pump unit 170 according to the eleventh embodiment is of a charge dedicated low-pressure type that supplies only the charge oil to the first and second hydraulic pump units 10K, 11K, whereas the auxiliary pump unit 170L according to this embodiment is of a high-pressure type capable of supplying the operating oil to an external hydraulic device 300 (see FIG. 56) such as a hydraulic lift device and, also, supplying the return oil from the external hydraulic device 300 to first and second hydraulic pump units 10L, 11L as the charge oil.

The hydraulic pump set 100L comprises the first hydraulic pump unit 10L including the auxiliary pump unit 170L and the second hydraulic pump unit 11L arranged apart from the first hydraulic pump unit 10L.

The second hydraulic pump unit 11L is the same as the second hydraulic pump unit 11K in the eleventh embodiment.

Therefore, the same reference numerals are denoted for the same members as those in the eleventh embodiment; therefore, and the description of the second hydraulic pump unit 11L will not be given herein.

The first hydraulic pump unit 10L of the hydraulic pump set 100L according to this embodiment is substantially the same as the first hydraulic pump unit 10K in the eleventh embodiment except for the fact that the auxiliary pump unit 170L is arranged in place of the auxiliary pump unit 170.

Therefore, the same reference numerals are denoted for the same members as those in the eleventh embodiment, and only the auxiliary pump unit 170L will be described in detail below.

Figure 57:
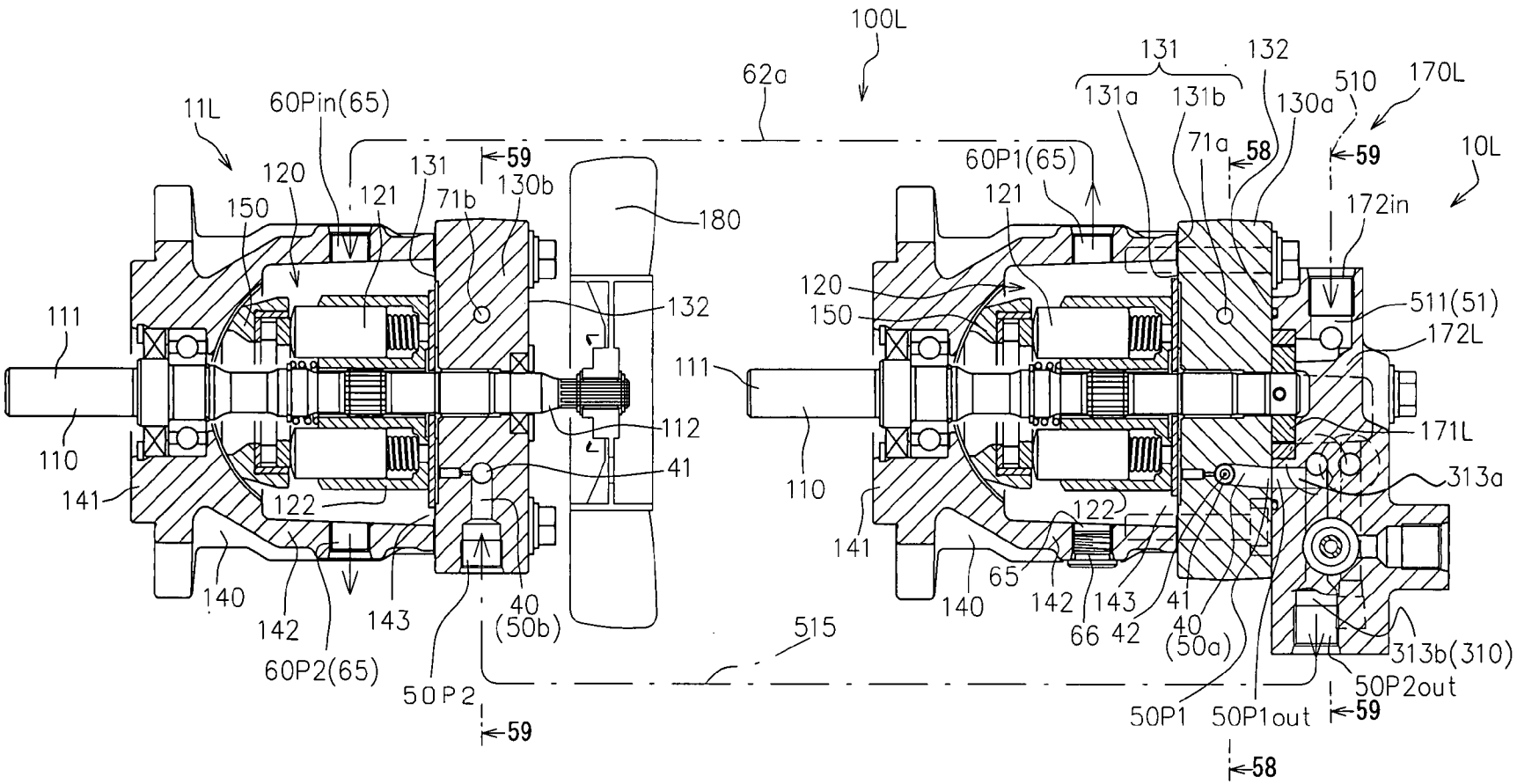
FIG. 57 is a schematic longitudinal side view of the first and second hydraulic pump units in the hydraulic pump set according to the twelfth embodiment of the present invention.

FIG. 57 shows a schematic longitudinal side view of the first and second hydraulic pump units 10L, 11L.

Figure 58:
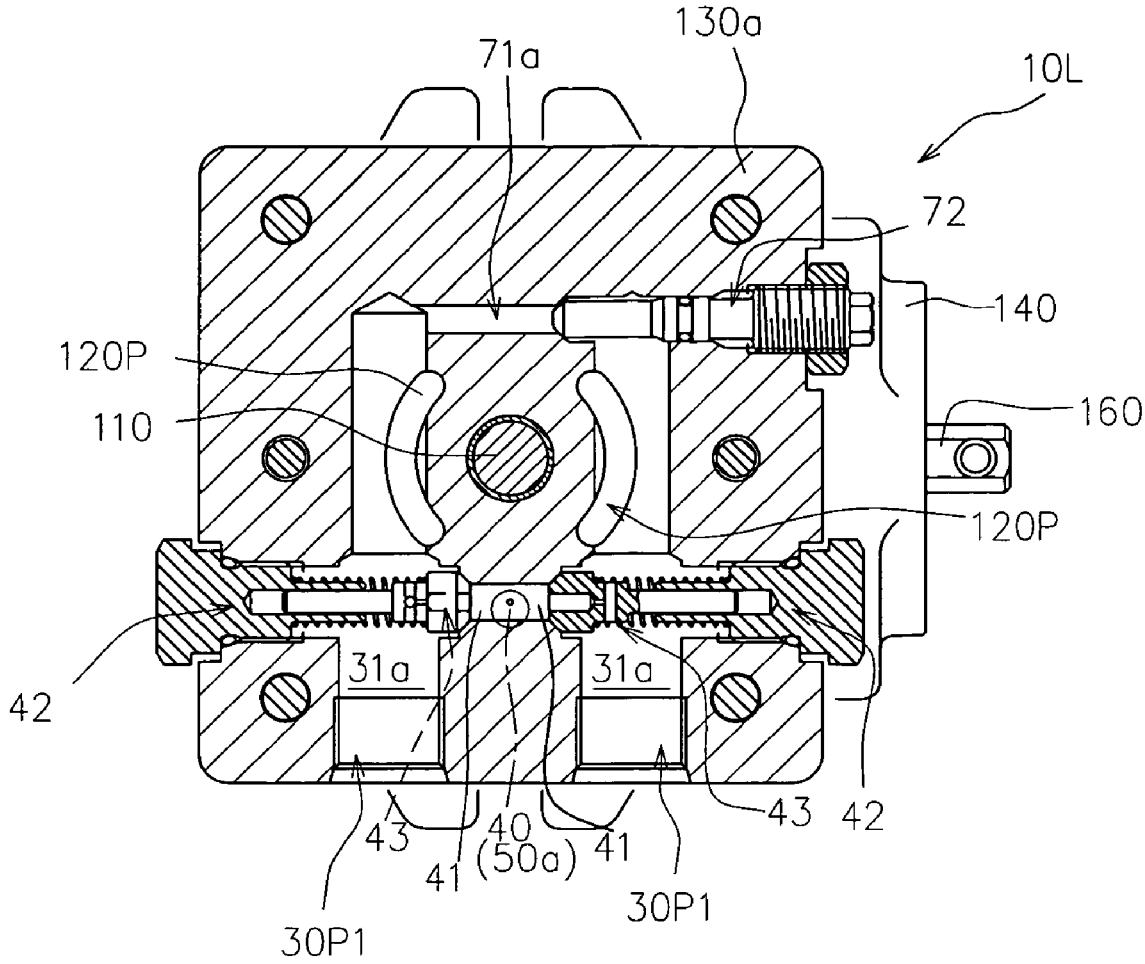
FIG. 58 is a cross sectional view taken along line 58-58 of FIG. 57.
Figure 59:
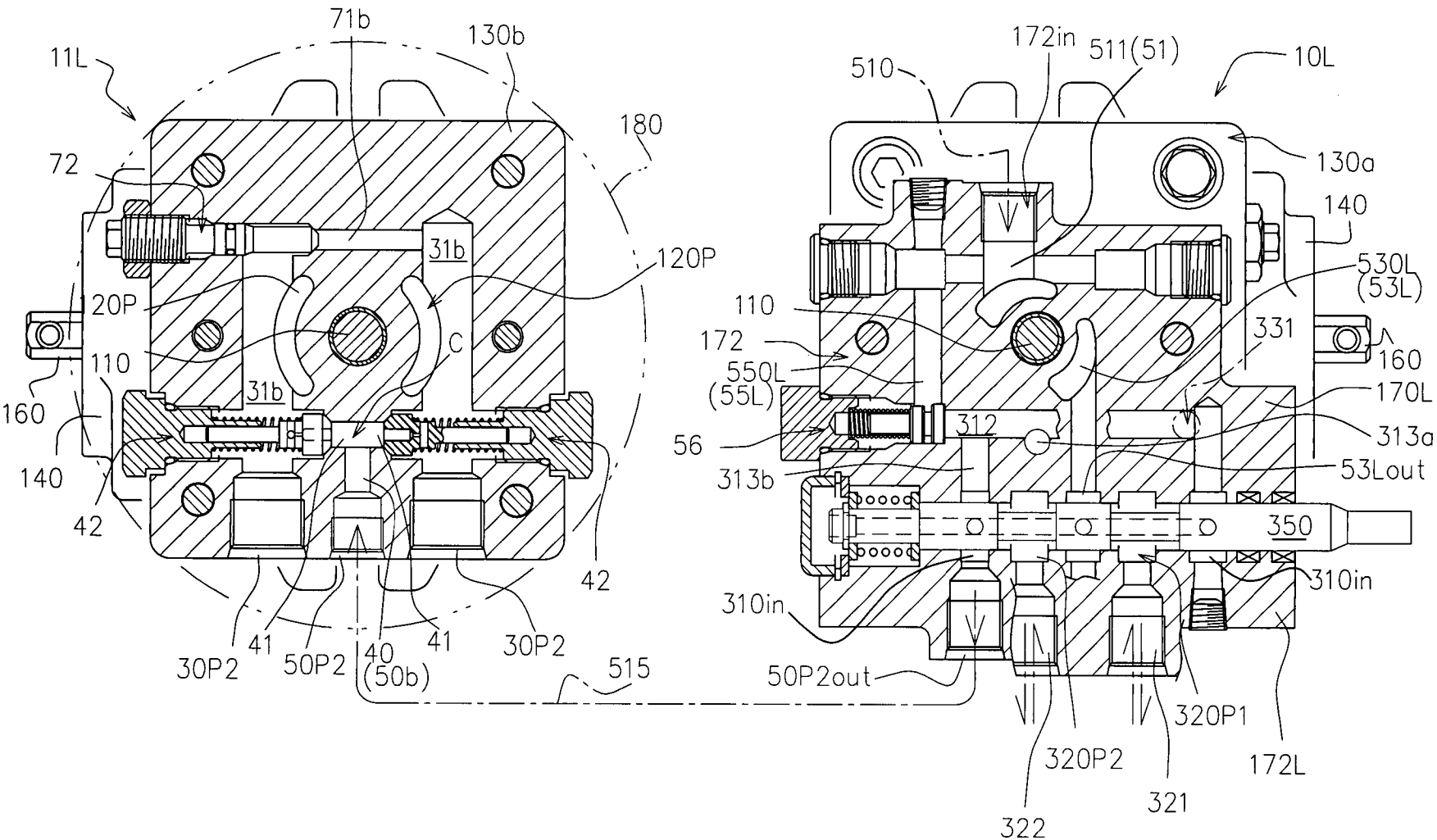
FIG. 59 is a cross sectional view taken along line 59-59 of FIG. 57.

FIG. 58 and FIG. 59 show cross sectional views taken along line 58-58 and line 59-59 of FIG. 57, respectively. Herein, FIG. 57 to FIG. 59 correspond to FIG. 52 to FIG. 54, respectively, of the eleventh embodiment.

Figure 60:
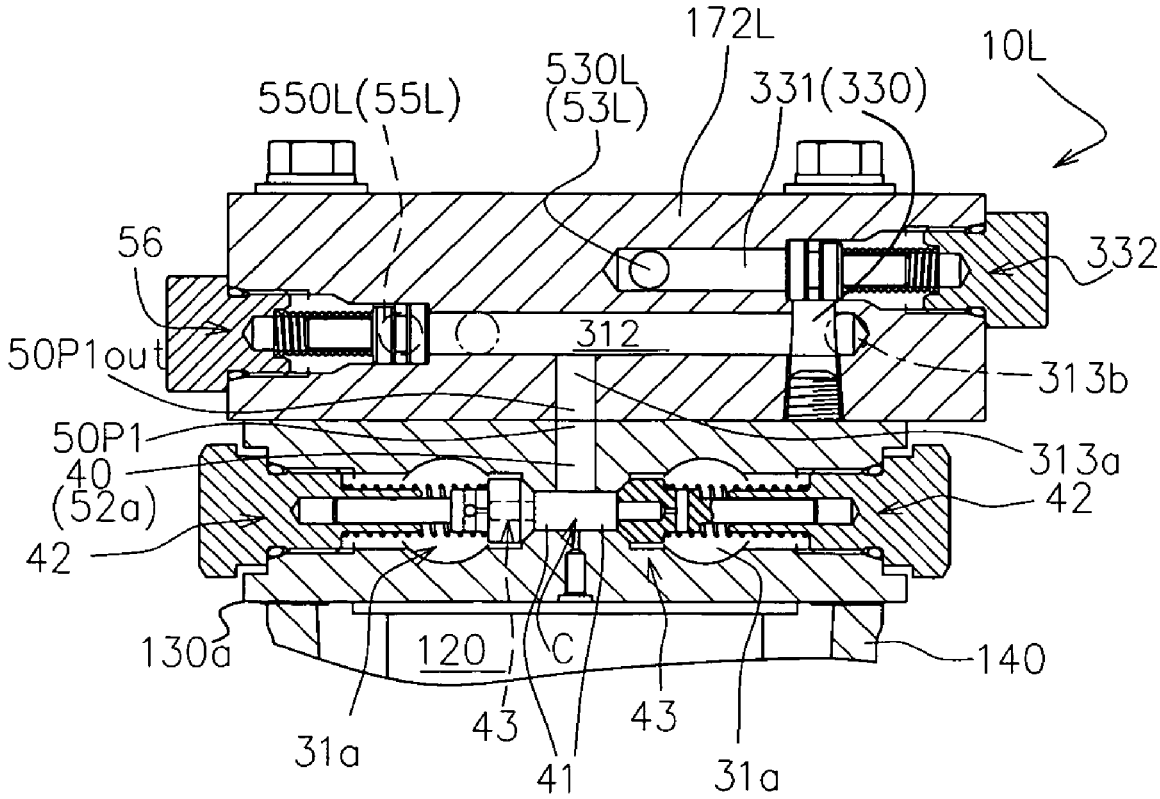
FIG. 60 is a partial longitudinal side view of the first hydraulic pump unit in the hydraulic pump set according to the twelfth embodiment of the present invention.

Further, FIG. 60 shows a partial longitudinal side view of the first hydraulic pump unit 10L.

As shown in FIG. 56, 57, and FIG. 59, the auxiliary pump unit 170L according to this embodiment includes an auxiliary pump body 171L driven by the corresponding pump shaft 110 and an auxiliary pump case 172L surrounding the auxiliary pump body 171L.

The first hydraulic pump unit 10L having the auxiliary pump unit 170L includes the pair of first hydraulic lines 30*a*, the suction line 51, a discharge line 53L for flowing the discharge oil from the auxiliary pump body 171L, an external oil pressure draw-out line 320 for supplying the pressure oil supplied from the discharge line 53L to an external hydraulic device 300 and, also, flowing the return oil from the external hydraulic device 300, a return line 310 fluidly connectable to the external oil pressure draw-out line 320, a first charge line 50*a* having a first end fluidly connected to the return line 310 and a second end fluidly connected to each first hydraulic line 30*a*, and the first drain line 60*a*.

The suction line 51 includes the suction conduit 510 and the suction oil passage 511, as shown in FIG. 56, FIG. 59 and the like.

The suction oil passage 511 is formed in the auxiliary pump case 172L so as to have a first end opening at the external surface to form an input port 172in connectable to the suction conduit 510, and a second end communicating to a suction part of the auxiliary pump unit 171L.

The discharge line 53L includes a discharge oil passage 530L formed in the auxiliary pump case 172L, as shown in FIG. 56, FIG. 59 and the like.

The discharge oil passage 530L has a first end communicated to the discharge part of the auxiliary pump body 171L and a second end forming the output port 53Lout.

The return line 310 includes a return oil passage 311 formed in the auxiliary pump case 172L.

The return oil passage 311 includes, as shown in FIG. 56, a common return oil passage 312 fluidly connectable to the external oil pressure draw-out line 320, and a first return oil passage 313*a* and a second return oil passage 313*b* branched from the common return oil passage 312.

The common return oil passage 312 has a first end forming an input port 310in fluidly connectable to the external oil pressure draw-out line 320.

Each of the first and second return oil passages 313*a*, 313*b* has a first end communicated to the common return oil passage 312, and a second end opening at the external surface of the auxiliary pump case 172L to form first and second discharge ports 50P1out, 50P2out for charging.

The first and second discharge ports 50P1out, 50P2out are fluidly connectable to the first charge line 50*a* and the second charge line 50*b*, respectively.

In this embodiment, the first discharge port 50P1out is opened at the surface which is brought into contact with the first port block 130*a*.

On the other hand, the second discharge port 50P2out is opened at one side face (rear side face in this embodiment) of the auxiliary pump case 172L so as to supply the pressure oil to the outside of the first hydraulic pump unit 10L.

In this embodiment, the first hydraulic pump unit 10L further includes a switching member 350 for selectively communicating the discharge line 53L to the external oil pressure draw-out line 320 or the return line 310.

That is, in the first hydraulic pump unit 10L, operation of the switching member 350 allows switching between a state where the pressure oil flowing through the discharge line 53L returns to the return line 310 by way of the external oil pressure draw-out line 320 after being sent to the external hydraulic device 300, and a state where the pressure oil flowing through the discharge line 53L bypasses the external hydraulic device 300 and directly flows into the return line 310.

Specifically, in this embodiment, the external hydraulic device 300 is of a double acting type. Therefore, the first hydraulic pump unit 10L includes two hydraulic lines of a first supply/discharge line 321 and a second supply/discharge line 322 as the external oil pressure draw-out line 320.

The switching member 350 includes first and second supply/discharge ports 320P1, 320P2 leading to the first supply/discharge line 321 and the second supply/discharge line 322, respectively.

The switching member 350, as shown in FIG. 56, is configured to selectively take a first external hydraulic device operating position 351(1) at which the output port 53Lout of the discharge oil passage 530L is connected to the first supply/discharge port 320P1 and the second supply/discharge port 320P2 is connected to the input port 310in of the return oil passage 311, a second external hydraulic device operating position 351(2) at which the output port 53Lout is connected to the second supply/discharge port 320P2 and the first supply/discharge port 320P1 is connected to the input port 310in, and an external hydraulic device stop position 352 at which the output port 53Lout is connected to the input port 310in and the first supply/discharge port 320P1 and the second supply/discharge port 320P2 are blocked. In FIG. 56, the switching member 350 is positioned at the external hydraulic device stop position 352.

In this embodiment, the switching member 350 is configured in a spool valve type and is provided inside the auxiliary pump case 172L. However, the switching member 350 may of course be arranged apart from the first hydraulic pump unit 10L, or configured in a rotary valve type.

The external hydraulic device 300 may of course be a single acting type. In this case, the external oil pressure draw-out line 320 is a single hydraulic line fluidly connecting between the discharge line 53L and the external hydraulic device 300.

The first hydraulic pump unit 10L comprises, in addition to various hydraulic lines, an operating pressure setting line 330 for setting the operating oil pressure of the external hydraulic device 300, and a charge pressure setting line 55L for setting the charge oil pressure of the return line 310.

In this embodiment, the operating pressure setting line 330 includes an operating pressure setting oil passage 331 formed in the auxiliary pump case 172L so as to have a first end communicated to the discharge line 53L and a second end communicated to the return line 310, and an operating oil regulating valve 332 inserted into the operating pressure setting oil passage 331.

Further, the charge pressure setting line 55L includes a charge pressure setting oil passage 550L formed in the auxiliary pump case 172L so as to have a first end communicated to the return line 310 and a second end communicated to the suction line 51, and a charge relief valve 56 inserted into the charge pressure setting oil passage 550L.

In the hydraulic pump set 100L of the above configuration, the charge oil is replenished to both the first and second hydraulic pump units 10L, 11L by the single auxiliary pump unit 170L and, further, the operating oil is supplied to the external hydraulic device 300.

Therefore, in comparison with the conventional configuration, the manufacturing cost and the assembling cost can be reduced.

In the configuration as in this embodiment in which the return oil from the external hydraulic device 300 is used as the charge oil, a diverting line 370 for bypassing a part of pressure oil in the discharge line 53L to the return line 310 can be provided, thereby stably and reliably performing the charge oil supply.

Figure 61:
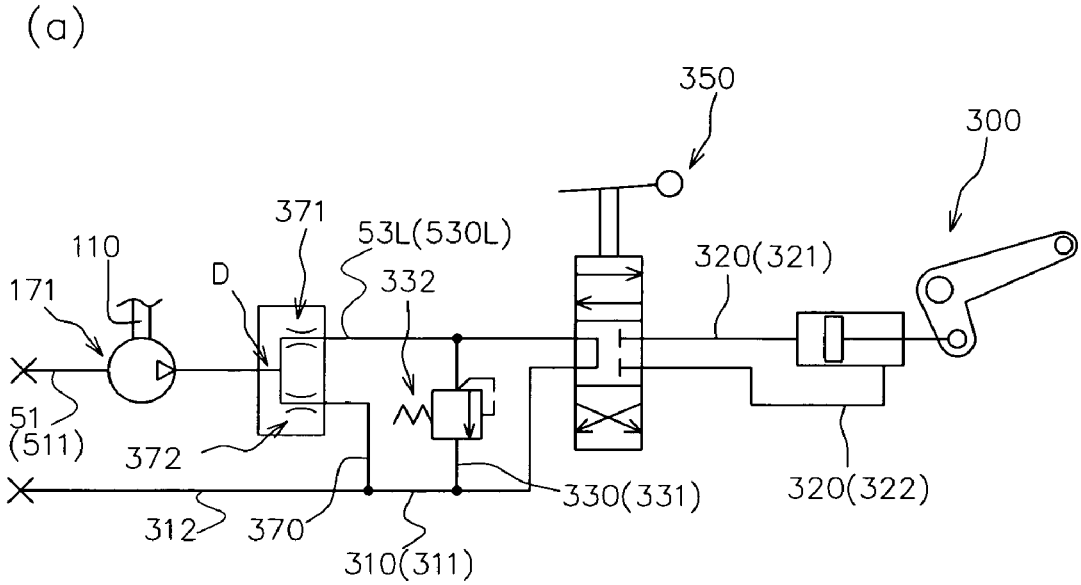
FIGS. 61(*a*) and (*b*) are part of hydraulic circuit diagrams of a modified hydraulic pump set of the present invention.
Figure 61:
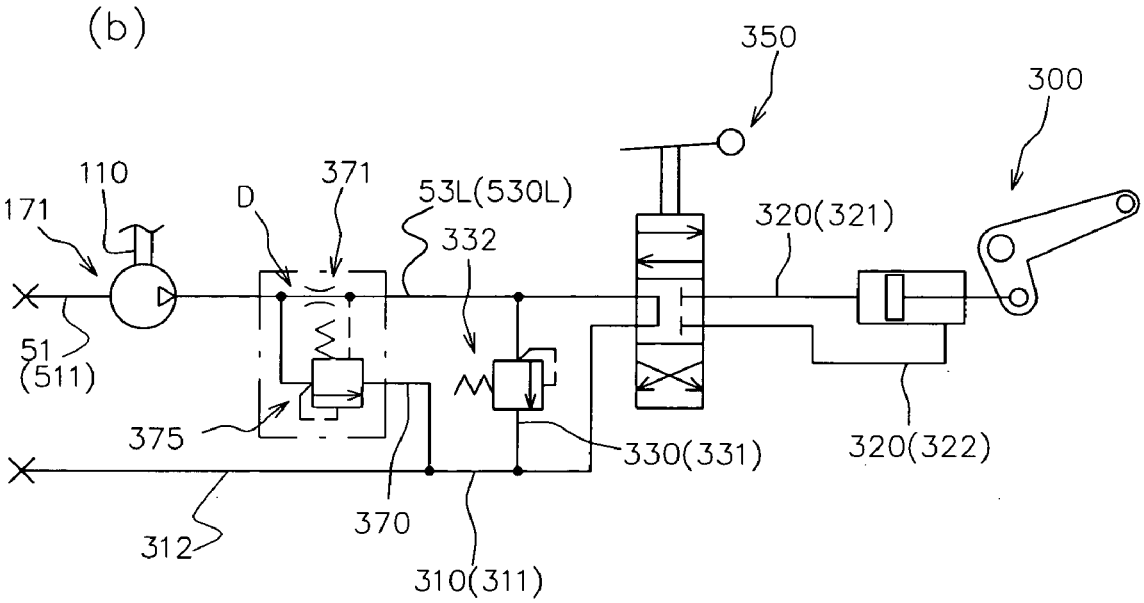

More specifically, the hydraulic pump unit 10L according to this embodiment may comprise the diverting line 370 having a first end communicated to the discharge line 53L and a second end communicated to the return line 310, a first throttle valve 371 inserted into the discharge line 53L at the downstream side in the flow direction of the pressure oil rather than a communicating point D of the discharge line 53L and the diverting line 370, and a second throttle valve 372 inserted into the diverting line 370 (see FIG. 61(*a*)).

By adopting the proportional diverting valve method, in addition to the return pressure oil from the external oil pressure draw-out line 320, the pressure oil of the oil amount corresponding to the drawing ratio defined by the first throttle valve 371 and the second throttle valve 372 also flows into the return line 310 from the discharge line 53L.

Therefore, the charge oil supply can be performed stably and reliably.

A control valve 375 in which the oil pressure on the downstream side in the flow direction of the pressure oil of the first throttle valve 371 serves as the pilot pressure may be provided in place of the second throttle valve 372 (see FIG. 61(*b*)).

By adopting the constant flow rate-type flow rate control valve method, an approximately constant oil amount defined by the first throttle valve 371 flows to the external hydraulic device 300 and the excess oil amount flows to the diverting line 370 regardless of the rotating speed of the auxiliary pump body 171.

Therefore, the charge oil supply can be performed stably and reliably.

In each embodiment, the auxiliary pump unit 170, 170L are configured so as to be driven by the corresponding pump shaft 110; however, the present invention is of course not limited to this form.

That is, as long as the auxiliary pump units 170, 170L are operatively driven by the driving source 3, various forms are applicable. For instance, in a form in which the auxiliary pump units 170, 170L are arranged apart from the corresponding hydraulic pump unit, the auxiliary pump units 170, 170L may be driven by a path different from the transmission path 8 for the first and second hydraulic pump units, or may be directly driven by the driving source 3.

In the eleventh and twelfth embodiments, the check valve 42 with a throttle is inserted into each branched charge oil passage 41 in each hydraulic pump unit. Alternatively, a check composite valve 390 with a relief function can be used for one of the pair of branched charge oil passages 41.

Figure 62:
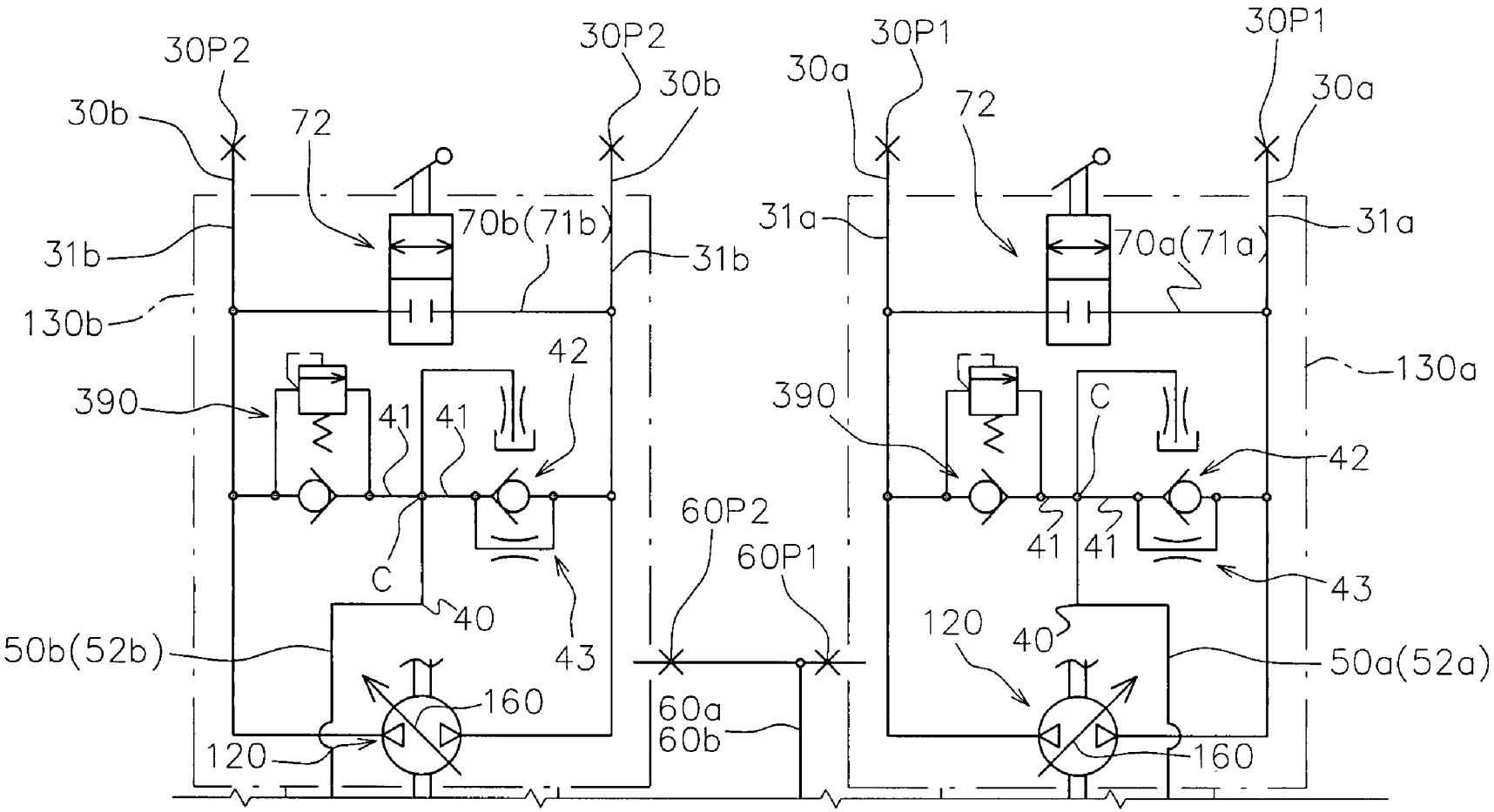
FIG. 62 is a hydraulic circuit diagram of port blocks according to a modified embodiment of the present invention.

FIG. 62 shows a hydraulic circuit diagram of the port blocks 130*a*, 130*b* according to a modification including the composite valve 390.

Figure 63:
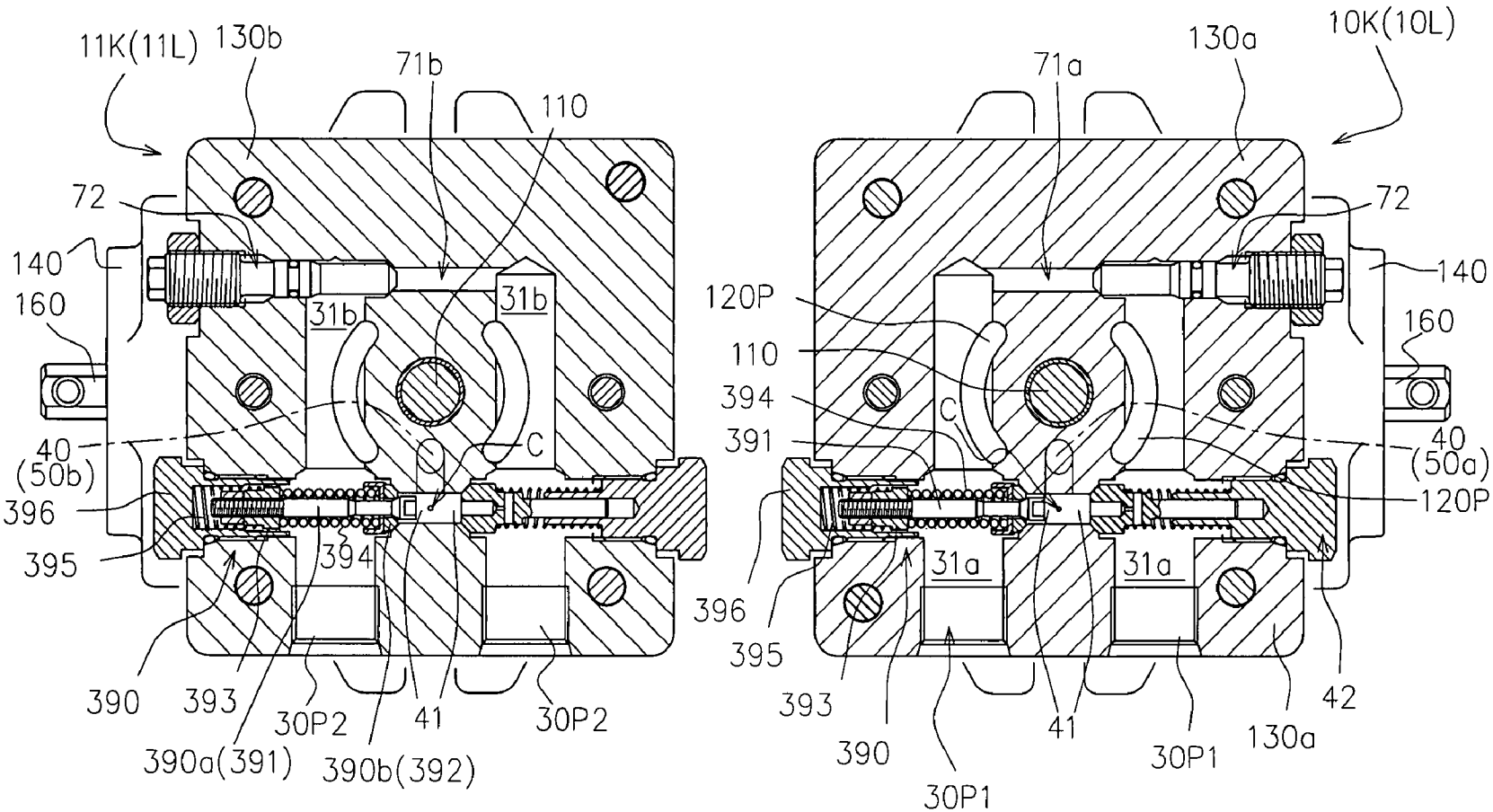
FIG. 63 is a transverse plan view of the port blocks of the modified embodiment shown in FIG. 62.

FIG. 63 shows a transverse plan view of the port blocks 130*a*, 130*b*.

As shown in FIG. 63, the composite valve 390 includes an inner valve body 390*a* acting as a relief valve body, and an outer valve body 390*b* acting as a check valve body.

In the embodiment shown in the figure, the composite valve 390 includes a shaft body 391 having a first end provided with the inner valve body 390*a*, and a ring body 392 which has a central hole through which the shaft body 391 is inserted, and has the outer valve body 390*b* on the outer peripheral surface.

The inner valve body 390*a* is seated on the inner seat ring provided at the central hole of the ring body 392.

The outer valve body 390*b* is seated on the outer seat ring provided on the inner peripheral surface of the communicating hole between one of the branched charge oil passage 41 and the corresponding operating oil passages 31*a*, 31*b*.

The composite valve 390 further includes a spring engaging body 393 arranged fixable at a position in the axis line direction at the second end of the shaft body 391, a relief spring 394 which biases the ring body 392 so that the outer valve body 392 seats on the outer seat ring, and is arranged between the spring engaging body 393 and the ring body 392, and a check spring 395 arranged between the spring engaging body 393 and a fixed member (plug 396 in the embodiment shown in the figure) on the opposite side of the relief spring 394 with the spring engaging body 393 interposed therebetween.

The composite valve 390 of the relevant configuration operates as follows.

That is, in a normal state where the oil pressure of the corresponding one of the hydraulic lines 30*a*, 30*b* is a predetermined value or less, the shaft body 391 and the ring body 392 are integrally pushed toward a direction compressing the check spring 395 by the charge oil from the charge lines 50*a*, 50*b*. This operation allows the charge oil to flow from the charge lines 50*a*, 50*b* to one of the hydraulic lines 30*a*, 30*b*.

On the other hand, in an overpressure state where the oil pressure of one of the hydraulic lines 30*a*, 30*b* exceeds a predetermined value, only the shaft body 391 (and the spring engaging body 393) is pushed toward the direction compressing the relief spring 394 by the oil pressure of one of the hydraulic lines 30*a*, 30*b*. This operation causes the pressure oil of one of the hydraulic lines 30*a*, 30*b* to flow out through the central hole of the ring body 392, thereby returning the oil pressure of one of the hydraulic lines 30*a*, 30*b* back to the predetermined value.

The composite valve 390 may be arranged in a hydraulic line on the side that becomes high-pressure in the forward movement of the vehicle, and/or arranged in a hydraulic line on the side that becomes high-pressure in the rearward movement of the vehicle.

In each embodiment, the first and second hydraulic pump units configured so that the pump shaft 110 is directed in the vertical direction is described by way of an example; however, the present invention is of course not limited to this form. That is, the hydraulic pump unit configured so that the pump shaft 110 is directed in the front-to-rear direction of the vehicle or in the width direction of the vehicle may also be used.

Further, in the working vehicle including a single hydraulic motor unit and configured so as to transmit the output from the single hydraulic motor unit to the left and right driving wheels by way of a differential gear device, for example, only the first hydraulic pump unit 10K, 10L including the auxiliary pump unit 170, 170L capable of driving the external hydraulic device 300 may be solely provided. In this usage, the second discharge port 50P2out is closed.

Embodiment 13

An embodiment of a hydraulic pump set according to the fifth aspect of the present invention will now be described with reference to the accompanying drawings.

Figure 64:
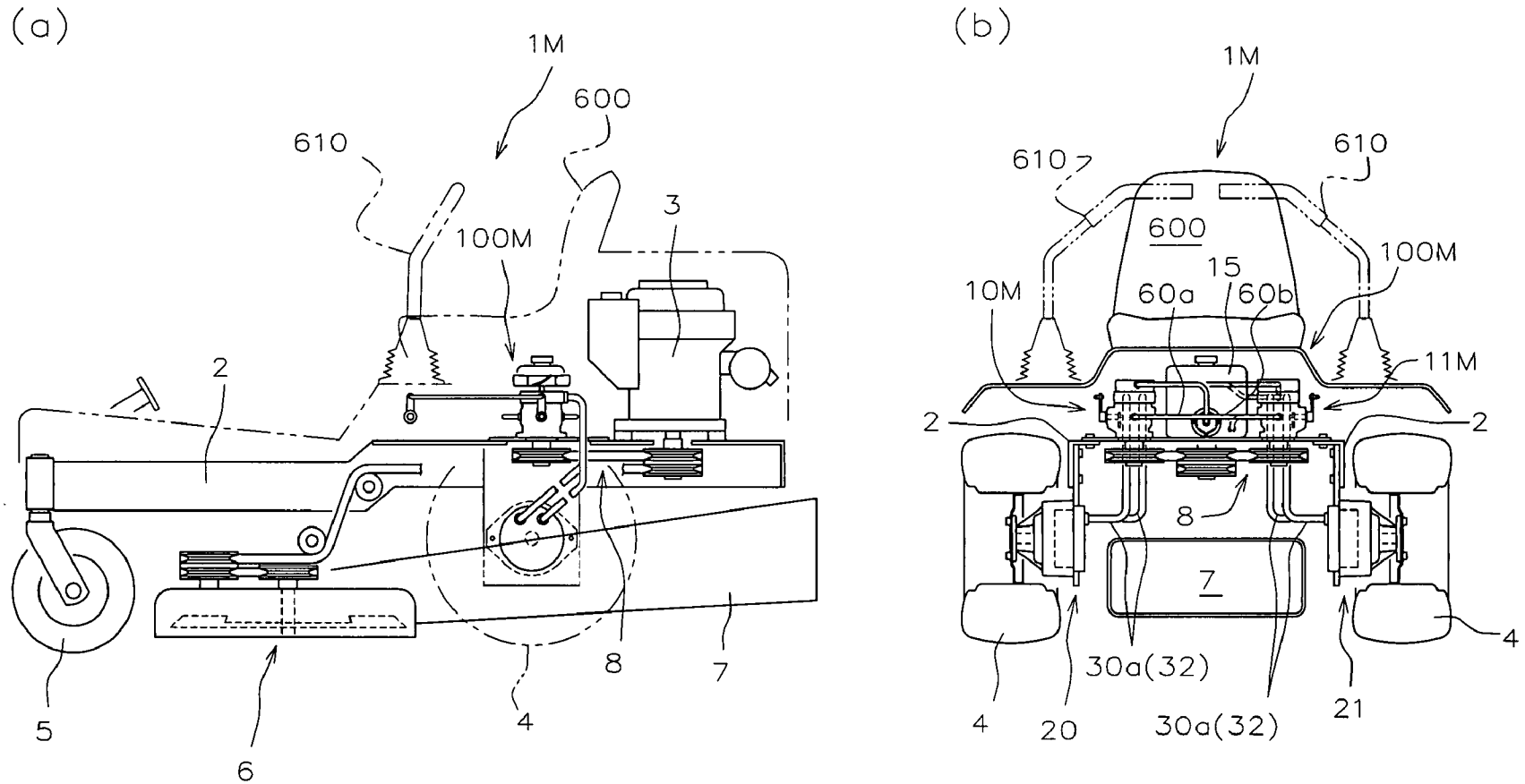
FIGS. 64(*a*) and 64(*b*) are a side view and a front view, respectively, of a working vehicle applied with a hydraulic pump set according to a thirteenth embodiment of the present invention.
Figure 65:
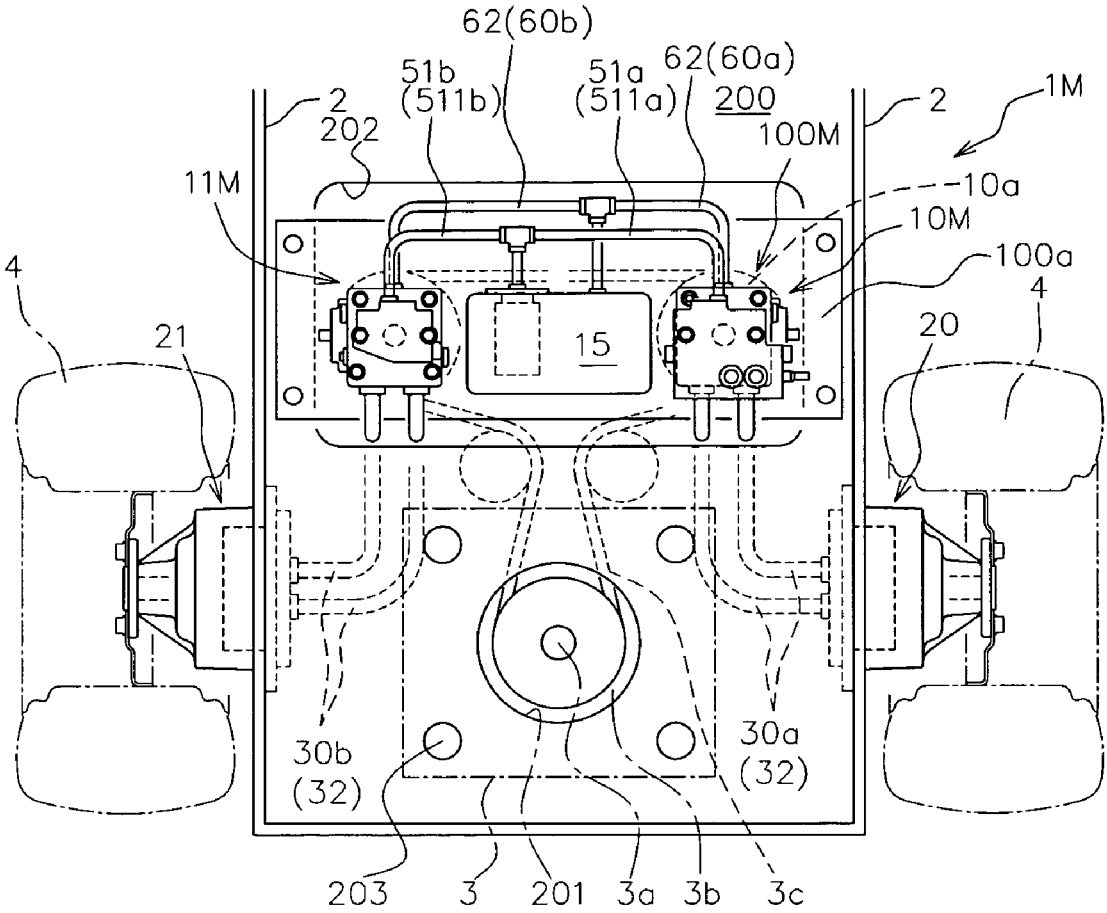
FIG. 65 is a partially developed plan view of the working vehicle shown in FIG. 64.

FIGS. 64(*a*) and 64(*b*) are a side view and a front view, respectively, of a working vehicle 1M applied with a hydraulic pump set 100M according to this embodiment. FIG. 65 is a partially developed plan view of the working vehicle 1M.

As shown in FIG. 64 and FIG. 65, the hydraulic pump set 100M comprises first and second pump units 10M, 11M arranged apart from each other.

In this embodiment, the first and second pump units 10M, 11M are arranged apart along the width direction of the vehicle so as to define a space at the center in the width direction of the vehicle.

The configuration of the working vehicle 1M will now be described.

As shown in FIG. 64 and FIG. 65, the working vehicle 1M is a rear discharge-type riding mower capable of performing zero turn.

Specifically, the working vehicle 1M includes a frame 2, a driving source 3 supported by the frame 2, a hydraulic pump set 100M including the pair of first and second hydraulic pump units 10M, 11M arranged in the vicinity of the driving source 3 and operatively driven by the driving source 3 by way of a transmission mechanism 8, first and second hydraulic motor units 20, 21 fluidly connected to the first and second hydraulic pump units 10M, 11M, a pair of driving wheels 4 (rear wheel in this embodiment) driven by the first and second hydraulic motor units 20, 21, and caster wheels 5 (front wheel in this embodiment).

As shown in FIG. 64 and FIG. 65, the driving source 3 is of a virtual crankshaft type in this embodiment.

The driving source 3 is mounted to a flat plate 200 arranged on the rear side of the frame 2 by way of an elastic member 203 and, thus, is supported by the frame 2 in a vibrating manner.

Specifically, as shown in FIG. 65, a first opening 201 is formed at the center of the flat plate 200.

The driving source 3 is attached to the flat plate 200 by way of the elastic member 203 so that a driving pulley 3*b* attached to the shaft end of the driving shaft 3*a* is positioned below the flat plate 200 through the first opening 201.

A broad second opening 202 is formed in the flat plate 200 at the front of the first opening 201. The second opening 202 is provided to operatively connect the driving source 3 and the hydraulic pump set 100M.

Specifically, the first and second hydraulic pump units 10M, 11M are arranged on a common substrate 100*a* in a state spaced apart in the width direction of the vehicle.

Herein, the shaft end of the pump shaft 110 (which will be described later) passes through the substrate 100*a* and extends below the flat plate 200 by way of the second opening 202. Driven pulleys 10*a*, 10*b* are each arranged on the shaft end of the pump shaft 110 so as to be positioned below the flat plate 200.

The common substrate 100*a* has a left-to-right length (length along the width direction of the vehicle) longer than a left-to right length of the second opening, and a part overlapping the flat plate 200 is joined to the flat plate 200.

With the above configuration, a sub-assembly with the first and second hydraulic pump units 10M, 11M arranged on the common substrate 100*a* in advance is incorporated into the frame 2 (flat plate 200) all at once.

After incorporation in the sub-assembly, a transmission belt 3*c* is wound between the driven pulleys 10*a*, 10*b* and the driving pulley 3*b*, and by applying tension thereto, the first and second hydraulic pump units 10M, 11M are rotated in the same direction as the rotating direction of the driving source 3.

In this embodiment, the driving source 3 is of a vertical crankshaft type; thus, the first and second hydraulic pump units 10M, 11M are arranged so that the rotating axis line of each pump shaft 110 extends along the vertical direction. However, if the driving source 3 is of a horizontal crankshaft type, the hydraulic pump units may be arranged so that the rotating axis line of each pump shaft 110 extends along the front-to-rear direction, as mentioned above.

As shown in FIG. 64(*b*) and FIG. 65, the first and second hydraulic motor units 20, 21 are also distributed and arranged in the width direction of the vehicle so as to define a space therebetween.

The working vehicle 1M comprises, in addition to the above configuration, a mower device 6 suspended and supported in a freely rising/lowering manner between the front and rear wheels 4, 5, and a duct 7 which is arranged in the above space and guides the mowed grass to a grass collecting bag (not shown) arranged at the rear of the vehicle body.

Further, in the working vehicle 1M, a driver's seat 600 is arranged above the center in the width direction of the frame 2 at the front of the driving source 3, and a pair of left and right steering handles 610 are arranged at the front of the driver's seat 600 in a freely forward/rearward tilting manner.

The pair of steering handles 610 are operatively connected with the first and second hydraulic pump units 10M, 11M so as to operate the first and second hydraulic pump units 10M, 11M, respectively, and the outputs of the first and second hydraulic motor units 20, 21 fluidly connected through a pair of operating oil conduits 32 are controlled by operating the pair of steering handles 610.

Further, the working vehicle 1M comprises, in addition to the above configuration, an oil tank 15 arranged between the first hydraulic pump unit 10M and the second hydraulic pump unit 11M.

The oil tank 15 stores drain oils of the first and second hydraulic pump units 10M, 11M and acts as a charge oil supply source for pairs of hydraulic lines 30*a*, 30*b*, as will be described later.

Figure 66:
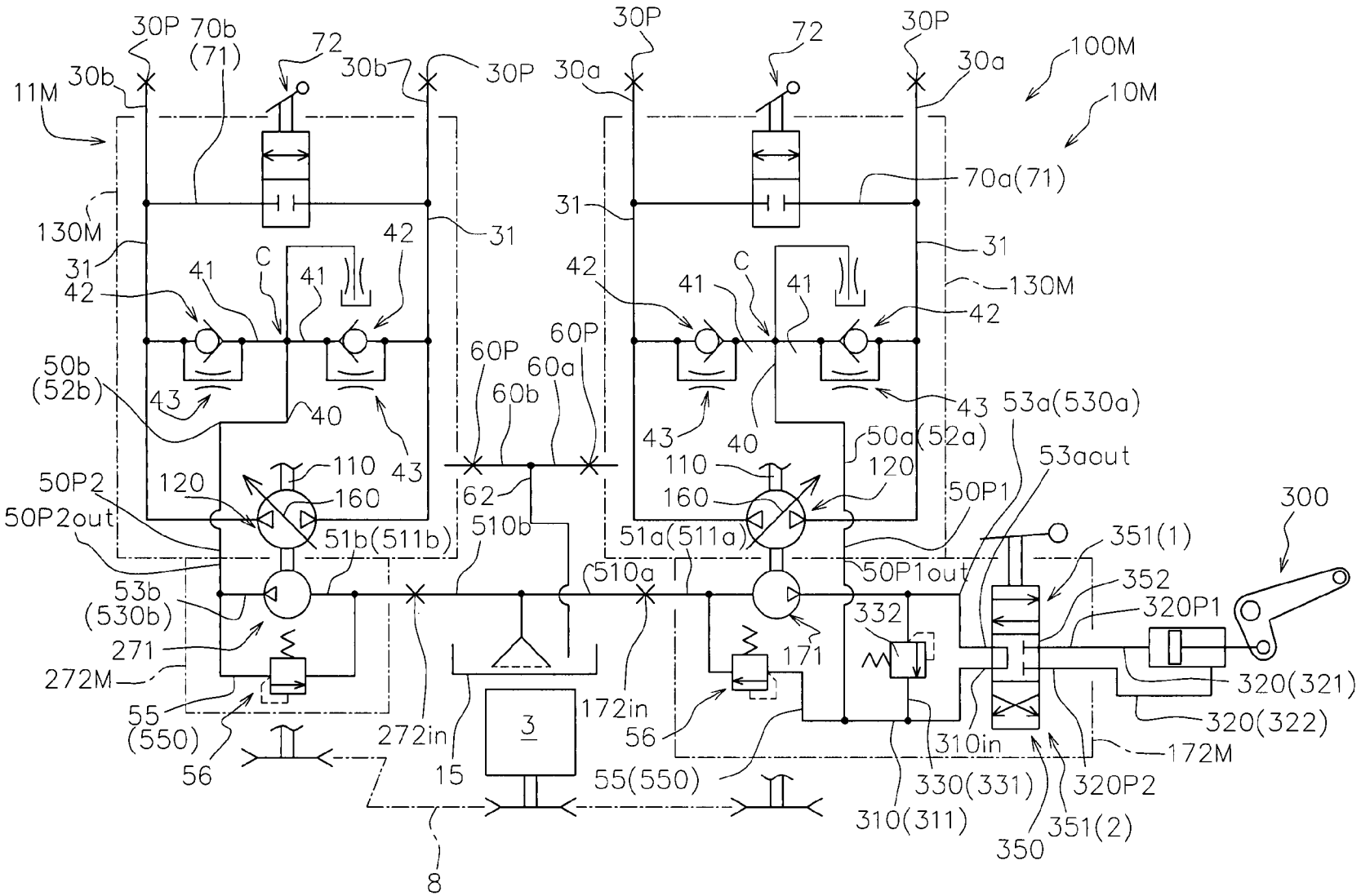
FIG. 66 is a hydraulic circuit diagram of the hydraulic pump set according to the thirteenth embodiment.

FIG. 66 shows a hydraulic circuit diagram of the hydraulic pump set 100M according to this embodiment.

The first hydraulic pump unit 10M is fluidly connected to the first hydraulic motor unit 20 by way of a hydraulic circuit (pair of first hydraulic lines 30*a* in this embodiment) so as to form a first HST in cooperation with the first hydraulic motor unit 20 (see FIG. 65).

At least one of the first hydraulic pump unit 10M and the first hydraulic motor unit 20 is of a variable displacement type.

Similarly, the second hydraulic pump unit 11M is fluidly connected to the second hydraulic motor unit 21 by way of a hydraulic circuit (pair of second hydraulic lines 30*b* in this embodiment) so as to form a second HST in cooperation with the second hydraulic motor unit 21 (see FIG. 65).

At least one of the second hydraulic pump unit 11M and the second hydraulic motor unit 21 is of a variable displacement type.

In this embodiment, each of the first and second hydraulic pump units 10M, 11M is of a variable displacement type, and each of the first and second hydraulic motor units 20, 21 is of a fixed displacement type.

The configuration of the first hydraulic pump unit 10M and the second hydraulic pump unit 11M will now be described in detail.

Figure 67:
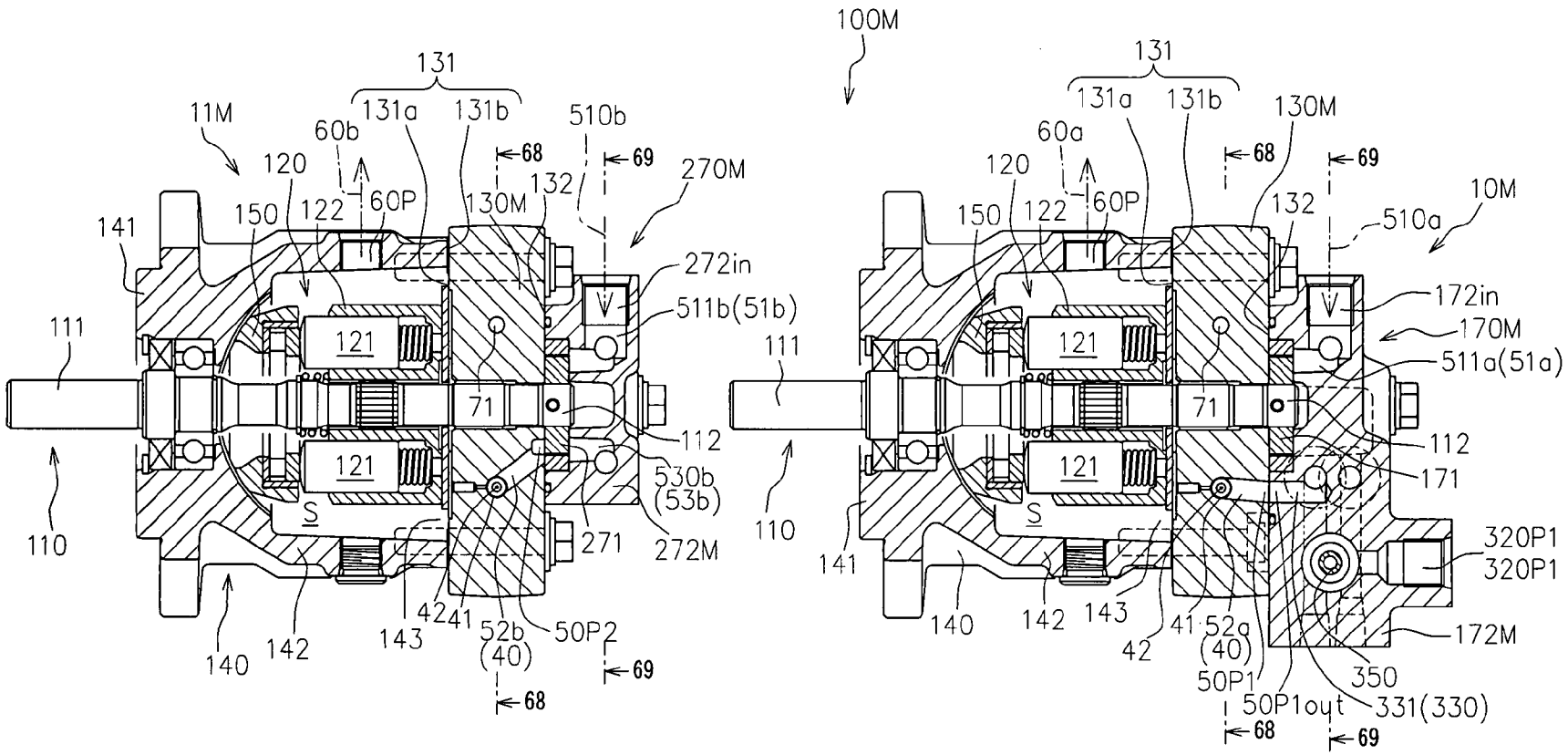
FIG. 67 is a schematic longitudinal side view of first and second hydraulic pump units of the hydraulic pump set according to the thirteenth embodiment.

FIG. 67 shows a schematic longitudinal side view of the first and second hydraulic pump units 10M, 11M.

Figure 68:
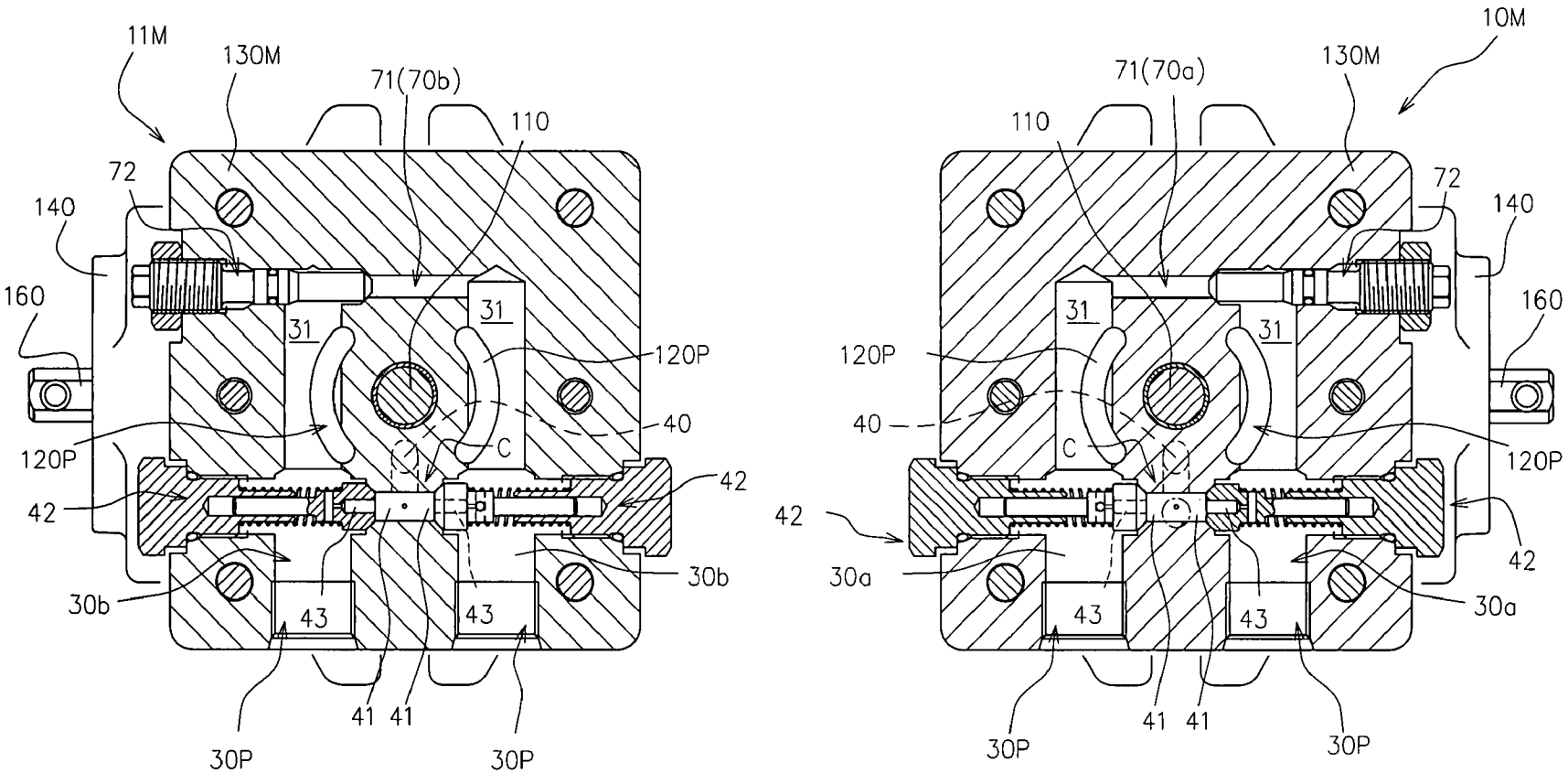
FIG. 68 is a cross sectional view taken along line 68-68 of FIG. 67.
Figure 69:
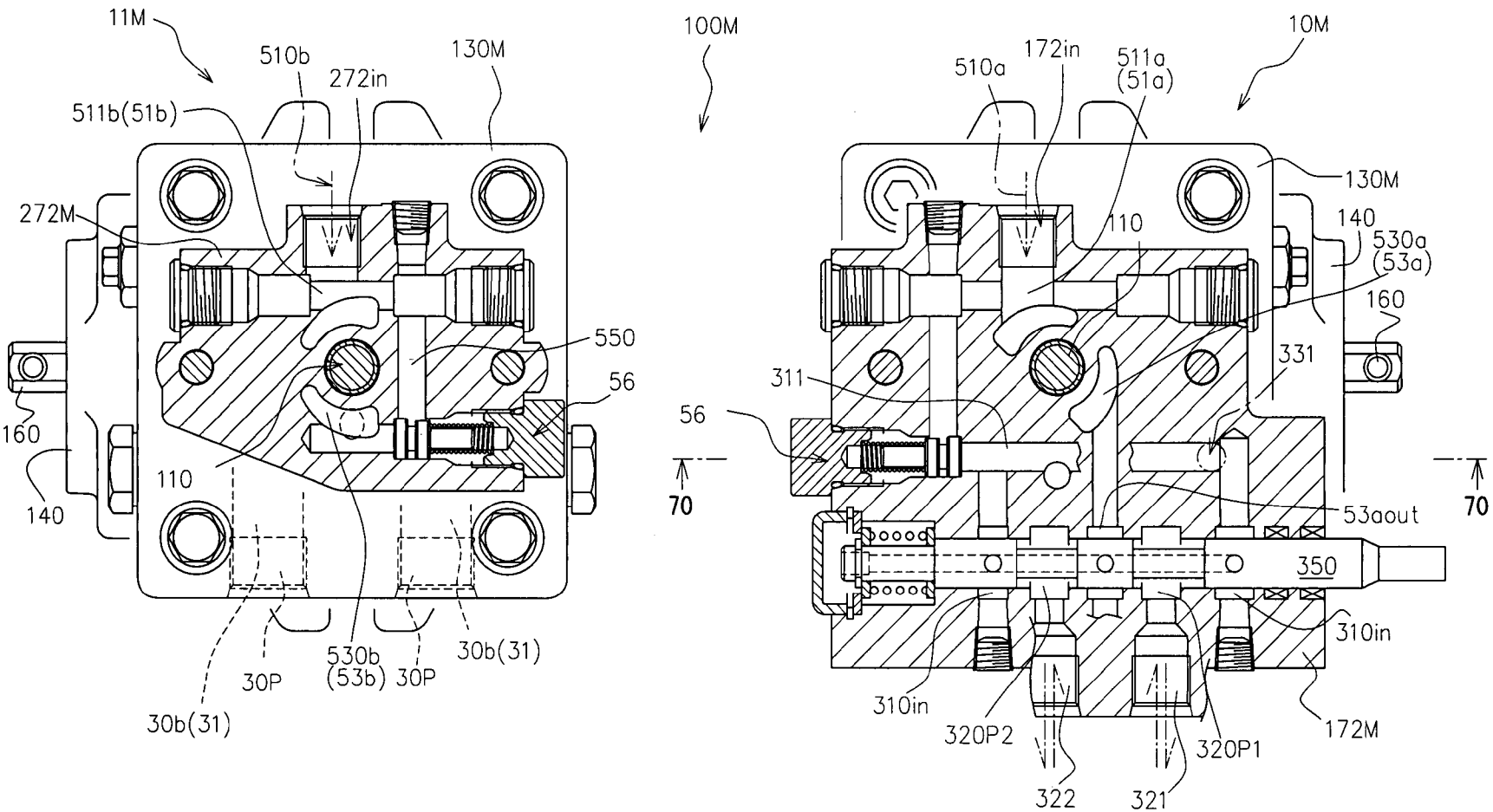
FIG. 69 is a cross sectional view taken along line 69-69 of FIG. 67.

FIG. 68 and FIG. 69 show cross sectional views taken along line 68-68 and line 69-69, respectively, of FIG. 67.

Figure 70:
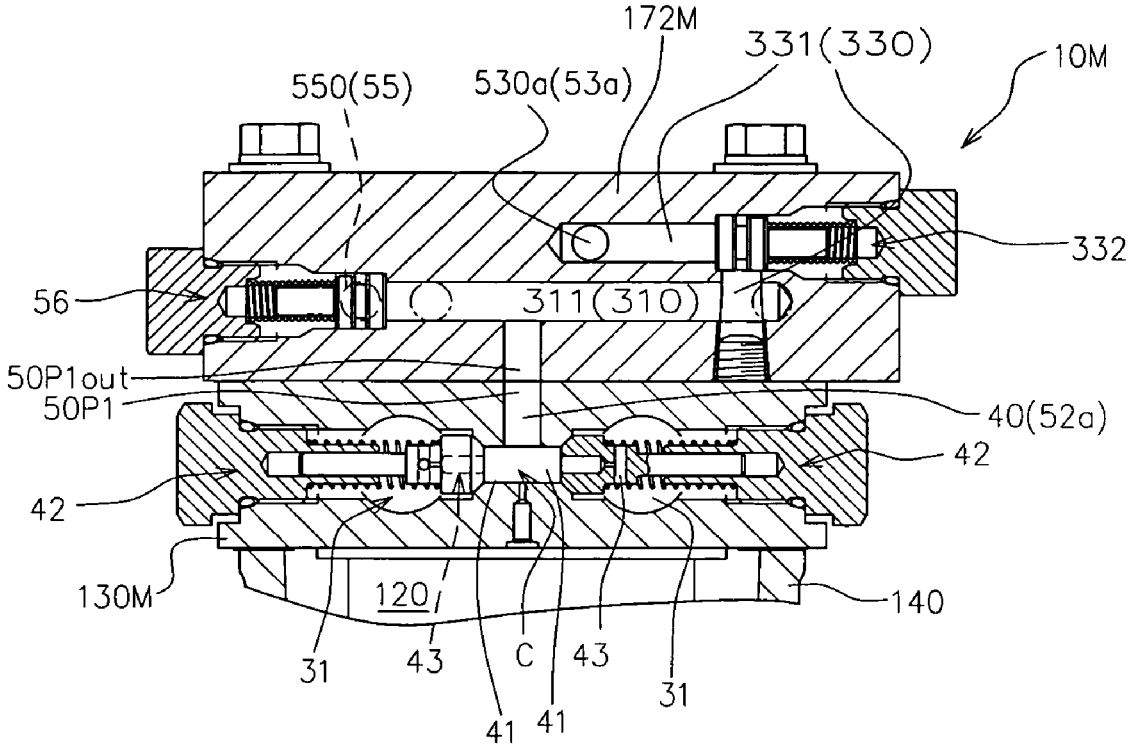
FIG. 70 is a cross sectional view taken along line 70-70 of FIG. 69.

Further, FIG. 70 shows a cross sectional view taken along line 70-70 of FIG. 69.

As shown in FIG. 67 and FIG. 68, the first hydraulic pump unit 10M comprises a pump shaft 110 operatively connected to the driving source 3, a pump body 120 driven by the pump shaft 110, a port block 130M formed with an operating oil passage for supplying/discharging an operating oil to/from the pump body 120, a pump case 140 connected to the port block 130M so as to surround the pump body 120, and an auxiliary pump body 171 which is driven by the pump shaft 110 and supplies the operating oil to an external hydraulic device 300 (see FIG. 66).

The second hydraulic pump unit 11M comprises the pump shaft 110, the pump body 120, the port block 130M, the pump case 140, and a charge pump body 271 driven by the corresponding pump shaft 110.

That is, the second hydraulic pump unit 11M has substantially the same configuration as the first hydraulic pump unit 10M except for the fact that the charge pump body 271 is provided in place of the auxiliary pump body 171.

The pump shaft 110 is supported by an assembly, configured by connecting the pump case 140 and the port block 130M, so that a first end 111 extends outward from the assembly.

In this embodiment, the first end 111 extends downward from the assembly (see FIG. 64(*a*)).

The first end 111 is operatively connected to the driving source 3 by way of an appropriate transmission mechanism 8 (pulley and belt in the embodiment shown in the figure) (see FIG. 64 and FIG. 65).

As shown in FIG. 67, in this embodiment, the pump body 120 includes a piston unit 121 for performing a reciprocating movement by the rotation of the pump shaft 110, and a cylinder block 122 for supporting the piston unit 121 in a freely reciprocating manner.

As mentioned above, each of the first and second hydraulic pump units 10M, 11M is of a variable displacement type in this embodiment.

Therefore, each of the first and second hydraulic pump units 10M, 11M comprises, in addition to the configuration, an output adjusting member 150 for changing the suction/discharge rates of the pump body 120, and a control shaft 160 for slanting the output adjusting member 150 (see FIG. 66 to FIG. 68 and the like).

In this embodiment, a movable swash plate is used for the output adjusting member 150, and a trunnion shaft is used for the control shaft 160.

In this embodiment, the control shaft 160 extends toward the outside in the width direction of the vehicle, in order to prevent interference with the oil tank 15.

The pump case 140 is connected to the corresponding port block 130 to configure the assembly for accommodating the corresponding pump body 120.

Specifically, as shown in FIG. 67, the pump case 140 includes an end wall 141 positioned on a first end side in the direction of the pump shaft 110, and a peripheral wall 142 extending from the end wall 141 toward a second end side in the axis line direction of the pump shaft 110.

The peripheral wall 142 has an opening 143 at the second end side in the axis line direction of the pump shaft 110. The opening 143 is sized to allow the pump body 120 to be inserted thereinto.

The port block 130M is connected to the corresponding pump case 140 so as to close the opening 143 while rotatably supporting the corresponding pump body 120 in cooperation with the corresponding pump case 140.

Specifically, the port block 130M includes a first end face 131 (lower surface in this embodiment) which is orthogonal to the pump shaft 110 and faces the pump case 141.

The first end face 131 includes a support region 131*a* for supporting the pump body 120 in a freely rotating manner, and a contact region 131*b* which is positioned outward in the radius direction of the support region 131*a* and is brought into contact with the pump case 140.

A pump body accommodating space S for accommodating the corresponding pump body 120 is defined when the first end face 131 of the port block 130 is brought into contact with the end face of the peripheral wall 142 of the corresponding pump case 140.

The oil passage formed in the port block 130M will be described later.

The auxiliary pump body 171 and the charge pump body 271 are configured so as to be driven by the second end of the corresponding pump shaft 110, as shown in FIG. 67.

Specifically, the pump shaft 110 has the first end 111 forming the input end, passing through the end wall 141 of the pump case 140 and extending outward, and a second end 112 passing through the port block 130 and extending outward.

The auxiliary pump body 171 and the charge pump body 271 are driven by the second end 112 of the corresponding pump shaft 110.

As shown in FIG. 67 and FIG. 69, the first hydraulic pump unit 10M comprises, in addition to the above configuration, an auxiliary pump case 172M surrounding the auxiliary pump body 171.

The auxiliary pump case 172M forms an auxiliary pump unit 170M with the auxiliary pump body 171.

On the other hand, the second hydraulic pump unit 11M comprises, in addition to the above configuration, a charge pump case 272 surrounding the charge pump body 271.

The charge pump case 272 forms a charge pump unit 270M with the charge pump body 271.

In this embodiment, the auxiliary pump unit 170M and the charge pump unit 270M are each connected to the second end face 132 (upper surface in this embodiment) on the opposite side of the first end face 131 in the corresponding port block 130.

The oil passages formed in the auxiliary pump case 172M and the charge pump case 272M will be described later.

Herein, the hydraulic circuit of the hydraulic pump set 100M according to this embodiment will be described.

The hydraulic circuit of the first hydraulic pump unit 10M will now be described.

As shown in FIG. 66, the first hydraulic pump unit 10M includes the pair of first hydraulic lines 30*a* fluidly connecting with the corresponding first hydraulic motor unit 20, a first suction line 51*a* extending between the oil tank 15 and the auxiliary pump body 171, a first discharge line 53*a* for flowing a discharge oil from the auxiliary pump body 171, an external oil pressure draw-out line 320 for supplying a pressure oil supplied from the first discharge line 53*a* to the external hydraulic device 300 and, also, flowing a return oil from the external hydraulic device 300, a return line 310 fluidly connectable to the external oil pressure draw-out line 320, a first charge line 50*a* having a first end fluidly connected to the return line 310 and a second end fluidly connected to each first hydraulic lines 30*a*, and a first drain line 60*a* for returning the drain oil in the pump body accommodating space S of the first hydraulic pump unit 10M back to the oil tank 15.

As shown in FIG. 66 and FIG. 68, the pair of first hydraulic lines 30*a* include a pair of operating oil passages 31 perforated in the corresponding port block 130, and a pair of operating oil conduits 32 (see FIG. 64) for communicating the pair of first operating oil passages 31 to the first hydraulic motor unit 20.

Each of the pair of operating oil passages 31 has a first end opening outward to form an operating oil port 30P and a second end communicating to a pair of kidney ports 120P in the corresponding pump body 120 (see FIG. 68).

The first suction line 51*a* includes, as shown in FIG. 65, FIG. 66, FIG. 67 and FIG. 69, a suction conduit 510*a* having a first end communicated to the oil tank 15, and a suction oil passage 511*a* having a first end opened to the external surface of the assembly to form a suction port 172in and a second end communicated to the suction part of the auxiliary pump body 171.

In this embodiment, the suction port 172in is provided in the auxiliary pump case 172M.

The first discharge line 53*a* includes a discharge oil passage 530*a* formed in the auxiliary pump case 172M, as shown in FIG. 66, FIG. 69 and the like.

The discharge oil passage 530*a* has a first end communicated to the discharge part of the auxiliary pump body 171 and a second end forming the output port 53*a*out.

The return line 310 includes a return oil passage 311 formed in the auxiliary pump case 172M.

As shown in FIG. 66 and FIG. 70, the return oil passage 311 has a first end forming an input port 310in fluidly connectable to the external oil pressure draw-out line 320, and a second end opening at the surface opposing the port block 130 and forming a first discharge port 50P1out.

In this embodiment, the first hydraulic pump unit 10M further comprises a switching member 350 for selectively communicating the first discharge line 53*a* or the external oil pressure draw-out line 320 to the return line 310.

That is, in the first hydraulic pump unit 10M, operation of the switching member 350 allows switching between a state where the pressure oil flowing through the first discharge line 53*a* returns to the return line 310 by way of the external oil pressure draw-out line 320 after being sent to the external hydraulic device 300, and a state where the pressure oil flowing through the discharge line 53*a* bypasses through the external hydraulic device 300 and directly flows into the return line 310.

Specifically, in this embodiment, the external hydraulic device 300 is of a double acting type. Therefore, the first hydraulic pump unit 10M includes two hydraulic lines of a first supply/discharge line 321 and a second supply/discharge line 322 as the external oil pressure draw-out line 320.

The switching member 350 includes first and second supply/discharge ports 320P1, 320P2 leading to the first supply/discharge line 321 and the second supply/discharge line 322, respectively.

The switching member 350, as shown in FIGS. 66 and 69, is configured to selectively take a first external hydraulic device operating position 351(1) at which the output port 53*a*out of the discharge oil passage 530*a* is connected to the first supply/discharge port 320P1 and the second supply/discharge port 320P2 is connected to the input port 310in of the return oil passage 311, a second external hydraulic device operating position 351(2) at which the output port 53*a*out is connected to the second supply/discharge port 320P2 and the first supply/discharge port 320P1 is connected to the input port 310in, and an external hydraulic device stop position 352 at which the output port 53*a*out is connected to the input port 310in and the first supply/discharge port 320P1 and the second supply/discharge port 320P2 are blocked. In FIG. 69, the switching member 350 is positioned at the external hydraulic device stop position 352.

In this embodiment, the switching member 350 is configured in a spool valve type and is provided inside the auxiliary pump case 172M. However, the switching member 350 may of course be arranged apart from the first hydraulic pump unit 10M, or configured in a rotary valve type.

The external hydraulic device 300 may of course be a single acting type. In this case, the external oil pressure draw-out line 320 is a single hydraulic line fluidly connecting between the discharge line 53*a* and the external hydraulic device 300.

The first hydraulic pump unit 10M comprises, in addition to various hydraulic lines, an operating pressure setting line 330 for setting the operating oil pressure of the external hydraulic device 300, and a charge pressure setting line 55 for setting the charge oil pressure of the return line 310.

In this embodiment, the operating pressure setting line 330 includes an operating pressure setting oil passage 331 formed in the auxiliary pump case 172M so as to have a first end communicated to the discharge line 53*a* and a second end communicated to the return line 310, and an operating oil regulating valve 332 inserted into the operating pressure setting oil passage 331.

Further, the charge pressure setting line 55 includes a charge pressure setting oil passage 550 formed in the auxiliary pump case 172M so as to have a first end communicated to the return line 310 and a second end communicated to the first suction line 51*a*, and a charge relief valve 56 inserted into the charge pressure setting oil passage 550.

The first charge line 50*a* includes, as shown in FIG. 66 and FIG. 68, a charge oil passage 52*a* formed in the corresponding port block 130.

The charge oil passage 52*a* is configured so as to have a first end forming the first charge suction port 50P1 and a second end communicated to each operating oil passage 31.

In this embodiment, the first charge suction port 50P1 is provided at the surface, which is brought into contact with the auxiliary pump case 172M, so as to be fluidly connected with the first discharge port 50P1out.

Specifically, the charge oil passage 52*a* includes a common charge oil passage 40 forming the first charge suction port 50P1, and a pair of branched oil passages 41 branched from the common charge oil passage 40 at the branch point C and communicated to the pair of operating oil passages 31*a* (see FIG. 66 an FIG. 68).

A check valve 42 is provided in each branched oil passage 41.

The check valve 42 is provided to allow the flow of pressure oil from the first charge line 50*a* to the pair of first hydraulic lines 30*a* and to prevent the flow of pressure oil in a reverse direction.

In this embodiment, the check valve 42 includes a throttle 43 (see FIG. 66); thus, a neutral state of the HST is obtained without the need of strictly controlling the output adjusting member 150.

In this embodiment, as shown in FIG. 68, a single oil passage perforated in the direction approximately orthogonal to the pair of operating oil passages 31*a* is provided in the port block 130 so as to communicate between the pair of operating oil passage 31*a*.

The single oil passage forms the pair of branched oil passages 41.

With the above configuration, the pair of branched oil passages 41 can be efficiently provided.

The first drain line 60*a* includes a drain port 60P for opening the corresponding pump body accommodating space S outward, and a drain conduit 62 for fluidly connecting the drain port 60P to the oil tank 15.

In this embodiment, the drain port 60P is formed in the respective pump cases 140 (see FIG. 67).

The first hydraulic pump unit 10M further includes a bypass line 70*a* for communicating between the pair of first hydraulic lines 30*a* (see FIG. 66).

The bypass line 70*a* is provided to prevent a pressure difference from being occurred between the pair of first hydraulic lines 30*a* when forcibly towing the vehicle at the time of fault and the like.

As shown in FIG. 66 and FIG. 68, in this embodiment, the bypass line 70*a* includes a bypass oil passage 71 formed in the first port block 130*a* so as to communicate between the pair of first operating oil passages 31, and a switching valve 72 for selectively communicating/blocking the bypass oil passage 71.

Preferably, as shown in FIG. 68, the bypass oil passage 71 is positioned on the opposite side of the single oil passage forming the pair of branched oil passages 41 with the pump shaft 110 interposed therebetween.

That is, the operating oil passage 31 has a first end opening at the external surface of the port block 130 so as to form the operating oil port 30P, and a second end extending beyond the corresponding pump shaft 110 to a region on the opposite side of the first operating oil port 30P.

The pair of branched oil passages 41 are arranged to communicate between the pair of first operating oil passages 31 in the region (region on the side proximate the operating oil port 30P in the embodiment shown in the figures) on a first side with the pump shaft 110 as a reference.

On the other hand, the bypass oil passage 71 is arranged so as to communicate between the pair of first operating oil passages 31 a in the region (region on the side away from the first operating oil port 30P1 in the embodiment shown in the figures) on a second side with the pump shaft 110 as a reference.

With the above configuration, the efficient arrangement of the pair of first operating oil passages 31*a*, the pair of branched oil passages 41 and the bypass oil passage 71 can be achieved.

The switching valve 72 is inserted into the bypass oil passage 71 so as to be externally operated from the port block 130M.

The hydraulic circuit of the second hydraulic pump unit 11M will now be described.

The second hydraulic pump unit 11M includes the pair of second hydraulic lines 30*b* fluidly connecting with the corresponding second hydraulic motor unit 21, a second suction line 51*b* extending between the oil tank 15 and the charge pump body 271, a second discharge line 53*b* for flowing the discharge oil from the charge pump body 271, a second charge line 50*b* having a first end fluidly connected to the second discharge line 53*b* and a second end fluidly connected to each second hydraulic line 30*b*, and a second drain line 60*b* for returning the drain oil in the pump body accommodating space S of the second hydraulic pump unit 11M back to the oil tank 15.

The pair of second hydraulic lines 30*b*, the second charge line 50*b* and the second drain line 60*b* each have substantially the same configurations as the pair of first hydraulic lines 30*a*, the first charge line 50*a*, and the first drain line 60*a*, respectively.

Therefore, of the hydraulic circuits of the second hydraulic pump unit 11M, the same reference numerals or the same reference numerals added with "b" in place of "a" are denoted for the members substantially the same as or corresponding to those of the hydraulic circuit of the first hydraulic pump unit 10M; therefore, the detailed description thereof will not be given herein.

The second suction line 51*b* includes, as shown in FIG. 65, FIG. 66, FIG. 67 and FIG. 69, a suction conduit 510*b* having a first end communicated to the oil tank 15, and a suction oil passage 511*b* having a first end opened at the external surface of the assembly to form a suction port 272in and a second end communicated to the suction part of the charge pump body 271.

In this embodiment, the suction port 272in is provided in the charge pump case 272M.

The second discharge line 53*b* includes a discharge oil passage 530*b* formed in the auxiliary pump case 272M, as shown in FIG. 66, FIG. 69 and the like.

The discharge oil passage 530*b* has a first end communicated to the discharge part of the charge pump body 271 and a second end forming a second discharge port 50P2out.

The second discharge port 50P2 is opened at the surface opposing the corresponding port block 130M and is fluidly connected to the second charge suction port 50P2 of the second charge line 50*b*.

The second hydraulic pump unit 11M also includes a charge pressure setting line 55, similar to the first hydraulic pump unit 10M.

The second charge line 50*b* has substantially the same configuration as that of the first charge line 50*a*.

That is, the second charge line 50*b* includes a charge oil passage 52*b* formed in the corresponding port block 130 so as to have a first end opened at the surface opposing the charge pump case 272M to form the second charge suction port 50P2 and a second end communicating with each operating oil passage 31.

The charge oil passage 52*b* includes the common charge oil passage 40 and the pair of branched charge oil passages 41, similar to the charge oil passage 52*a*.

The second drain line 60*b* also has substantially the same configuration as that of the first drain line 60*a*.

In this embodiment, drain conduits 62 of the first and second drain lines 60*a*, 60*b* are fluidly connected to the oil tank 15 while being merged with each other (see FIG. 66). However, each drain conduit may of course be fluidly connected to the oil tank independently.

Further, the bypass line 70*b* for communicating between the pair of hydraulic lines 30*b* is also arranged in the second hydraulic pump unit 11M.

The bypass line 70*b* has substantially the same configuration as that of the bypass line 70*a*.

The following effects can be obtained in the hydraulic pump set 100M of the above configuration.

That is, in this embodiment, the auxiliary pump body 171 and the charge pump body 271 driven by the corresponding pump shaft 110 are each provided on one or the other of the first and second hydraulic pump units 10M, 11M. The pressure oil from the auxiliary pump body 171 is used as the operating oil for the external hydraulic device 300 and the charge oil of one of the hydraulic pump unit 10M, and the pressure oil from the charge pump body 271 is used as the charge oil for the other hydraulic pump unit 11M.

Therefore, by simply operatively connecting the driving source 3 and each pump shaft 110 of the first and second hydraulic pump units 10M, 11M, the operating oil of the external device 300 can be efficiently obtained in addition to the charge oil of the first and second hydraulic pump units 10M, 11M.

Embodiment 14

Another embodiment of the hydraulic pump set according to the fifth aspect of the present invention will now be described with reference to the accompanying drawings.

The same reference numerals are denoted for the members same as or corresponding to those in the thirteenth embodiment; therefore, the detailed description thereof will not be given herein.

Figure 71:
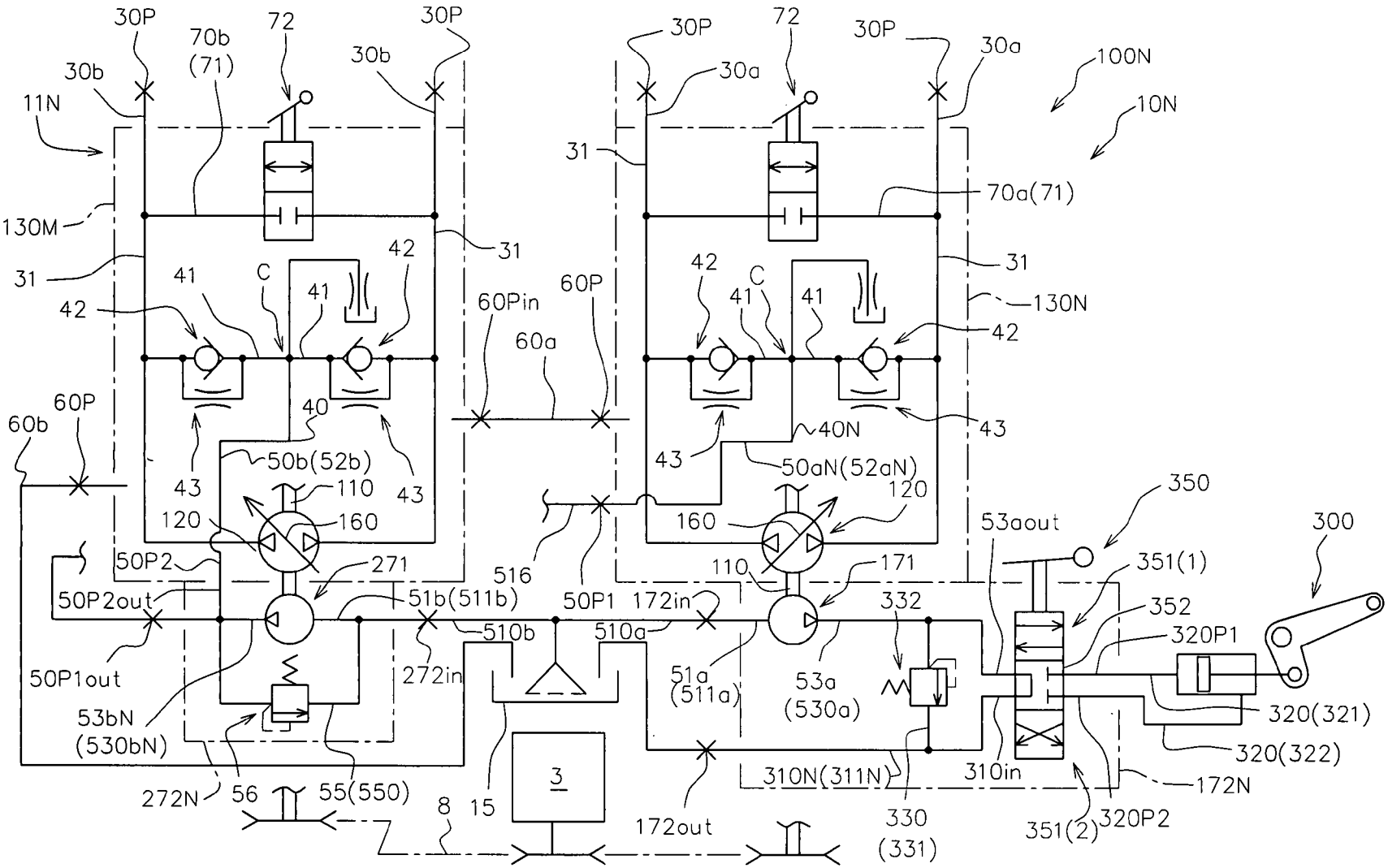
FIG. 71 is a hydraulic circuit diagram of a hydraulic pump set according to a fourteenth embodiment of the present invention.

FIG. 71 shows a hydraulic circuit diagram of a hydraulic pump set 100N according to this embodiment.

Figure 72:
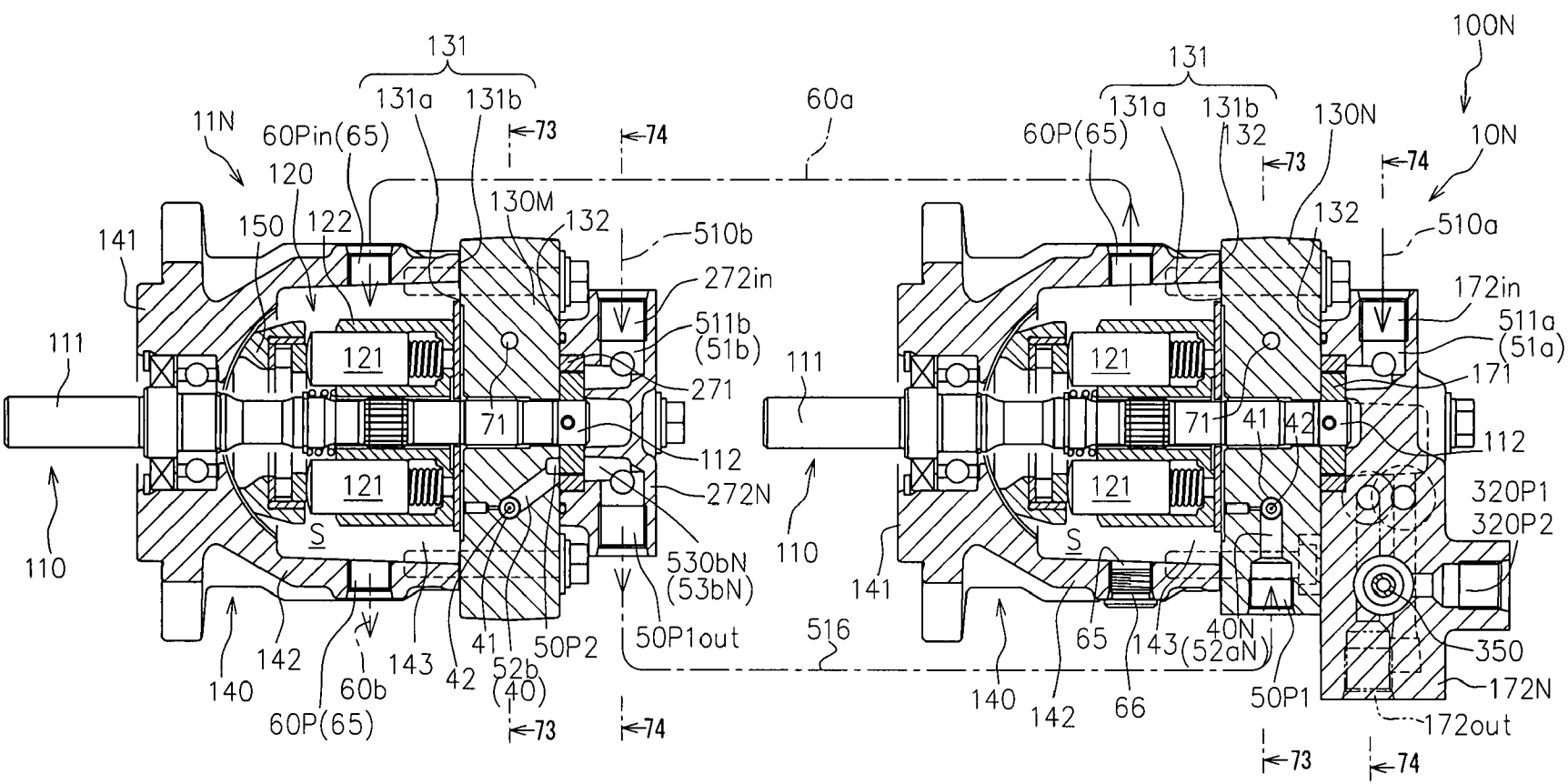
FIG. 72 is a schematic longitudinal side view of first and second hydraulic pump units of the hydraulic pump set according to the fourteenth embodiment of the present invention.

FIG. 72 shows a schematic longitudinal side view of first and second hydraulic pump units 10N, 11N of the hydraulic pump set 100N.

Figure 73:
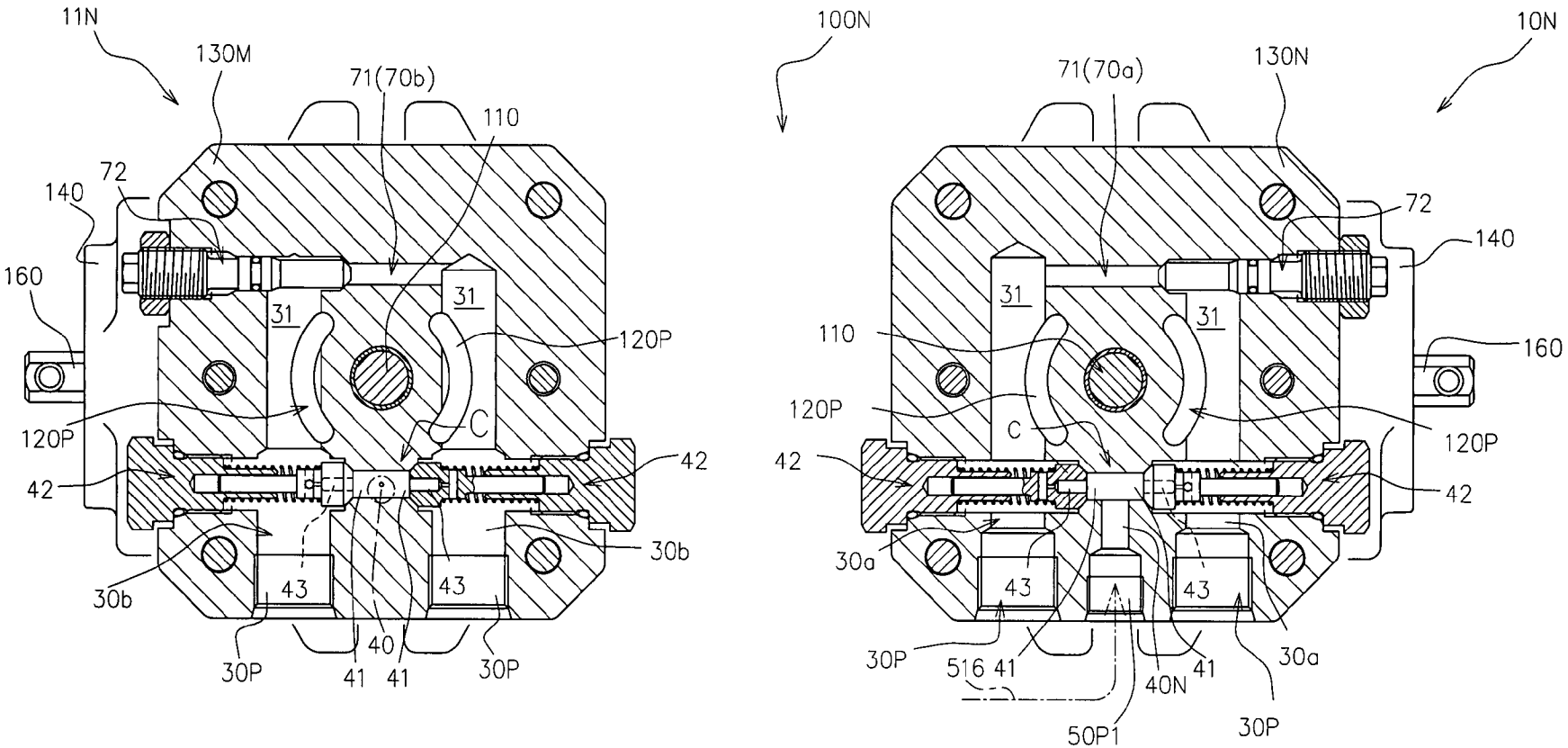
FIG. 73 is a cross sectional view taken along line 73-73 of FIG. 72.
Figure 74:
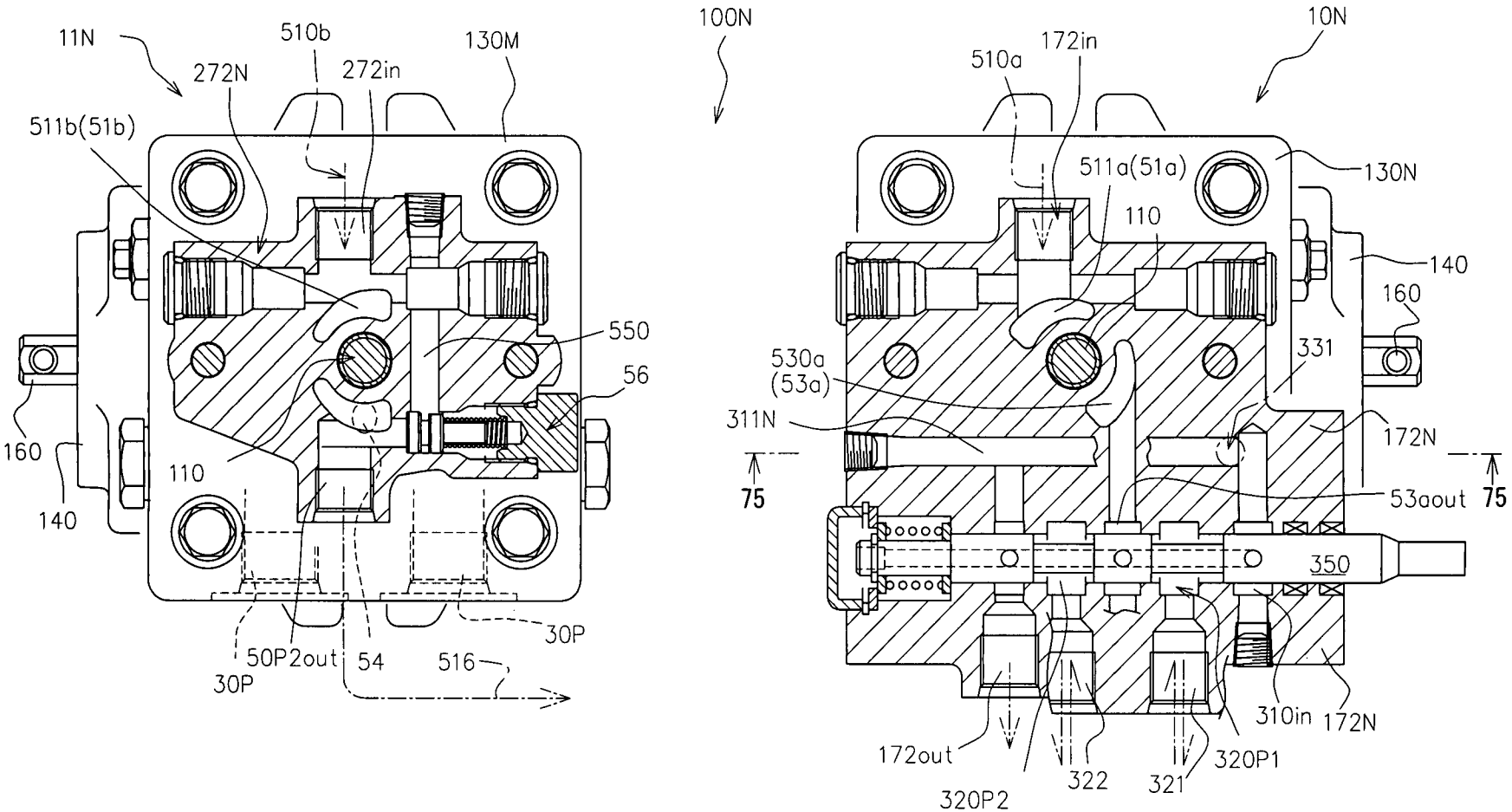
FIG. 74 is a cross sectional view taken along line 74-74 of FIG. 72.
Figure 75:
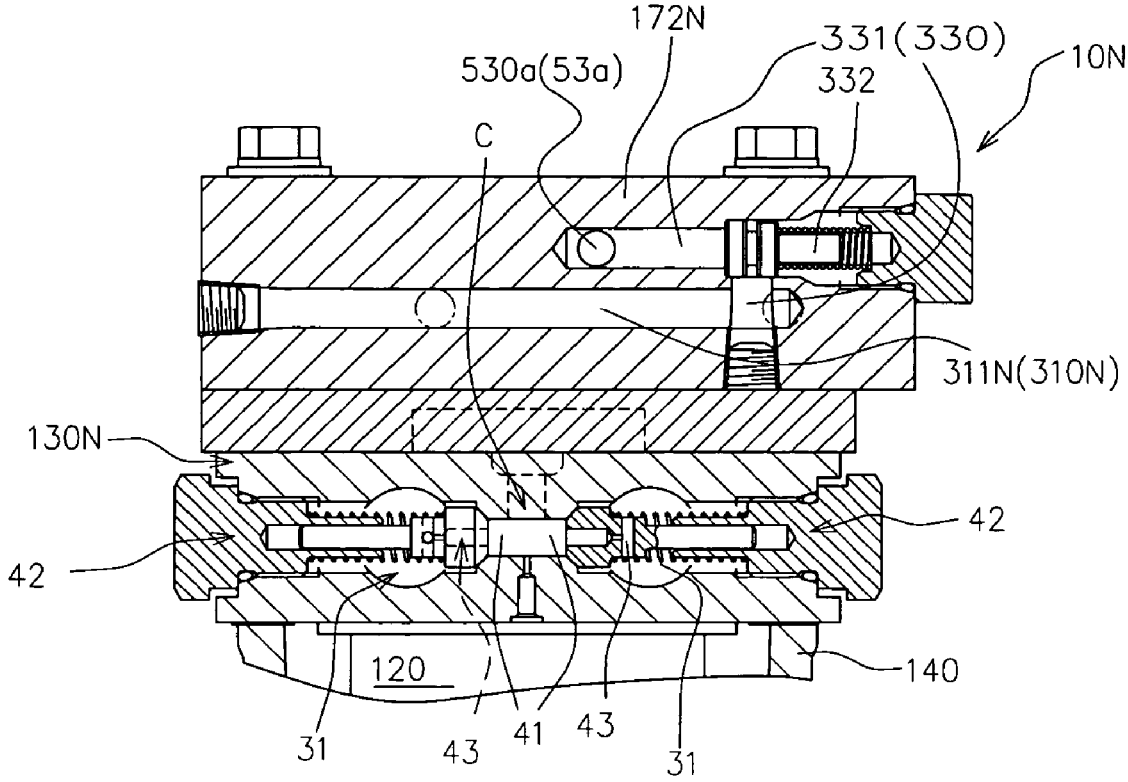
FIG. 75 is a cross sectional view taken along line 75-75 of FIG. 74.

FIG. 73 and FIG. 74 show cross sectional views taken along line 73-73 and line 74-74, respectively, of FIG. 72. Further, FIG. 75 shows a cross sectional view taken along line 75-75 of FIG. 74.

FIG. 72 to FIG. 75 correspond to FIG. 67 to FIG. 70, respectively, of the thirteenth embodiment.

As mentioned above, in the hydraulic pump set 100M according to the thirteenth embodiment, the return oil of the pressure oil supplied from the auxiliary pump body 171 to the external hydraulic device 300 is supplied to one of the hydraulic pump unit (first hydraulic pump unit 10M in the embodiment shown in the figure) including the auxiliary pump body 171 as the charge oil. However, in the hydraulic pump set 100N according to this embodiment, the pressure oil from the charge pump body 271 included in the other hydraulic pump unit (second hydraulic pump unit 11N in the embodiment shown in the figure) is supplied to both hydraulic pump units 10N, 11N as the charge oil.

Specifically, as shown in FIG. 71, the hydraulic pump set 100N comprises the first hydraulic pump unit 10N and the second hydraulic pump unit 11N.

The first hydraulic pump unit 10N includes a return line 310N in place of the return line 310, and a first charge line 50*a*N in place of the first charge line 50*a* of the first hydraulic pump unit 10M in the thirteenth embodiment.

On the other hand, the second hydraulic pump unit 11N further includes a second discharge line 53*b*N in place of the second discharge line 53*b* of the second hydraulic pump unit 11M in the thirteenth embodiment.

The second discharge line 53*b*N is configured so as to supply the pressure oil from the charge pump body 271 to the pair of second hydraulic lines 30*b* and, also, to supply the charge oil to the pair of first hydraulic lines 30*a*.

Specifically, as shown in FIG. 72, the second hydraulic pump unit 11N includes a charge pump case 272N in place of the charge pump case 272M of the second hydraulic pump unit 11M.

The second discharge line 53*b*N includes a discharge oil passage 530*b*N formed in the charge pump case 272N, as shown in FIG. 72, FIG. 74 and the like.

The discharge oil passage 530*b*N has a first end communicated to the discharge part of the charge pump body 271, and a second end forming the first discharge port 50P1out and the second discharge port 50P2out.

The second discharge port 50P2out is opened at the surface opposing the corresponding port block 130M and is fluidly connected to the second charge suction port 50P2 of the second charge line 50*b*.

The first discharge port 50P1out, on the other hand, is opened at one side face (rear side face in this embodiment) of the charge pump case 272N so as to supply the pressure oil to the outside of the second hydraulic pump unit 11N (see FIG. 72).

The return line 310N is configured to return the pressure oil from the external oil pressure draw-out line 320 and/or the first discharge line 53*a* back to the oil tank.

Specifically, the first hydraulic pump unit 10N includes an auxiliary pump case 172N in place of the auxiliary pump case 172M.

The return line 310N includes a return oil passage 311N formed in the auxiliary pump case 172N.

The return oil passage 311N has, as shown in FIG. 71 and FIG. 74, a first end forming an input port 310in fluidly connectable to the external oil pressure draw-out line 320 and a second end forming the externally connectable output port 172out.

In this embodiment, the output port 172out is fluidly connected to the oil tank 15 by way of a conduit.

The first charge line 50*a*N has a first end fluidly connectable to the first discharge port 50P1out and a second end fluidly connected to the pair of first hydraulic lines 30*a*.

More specifically, the first hydraulic pump unit 10N includes a port block 130N in place of the port block 130.

The first charge line 50*a*N includes a charge oil passage 52*a*N formed in the port block 130N.

The charge oil passage 52*a*N has a first end opening at the external surface to form a first charge suction port 50P1 fluidly connectable to the first discharge port 50P1out and a second end fluidly connected to each operating oil passage 31.

The first charge suction port 50P1 is provided on one side face (rear side face in this embodiment) of the port block 130N. In this embodiment, the first charge suction port 50P1 is fluidly connected to the first discharge port 50P1out by way of the conduit 516 (see FIG.71).

Specifically, the charge oil passage 52*a*N includes a common charge oil passage 40N having a first end forming the first charge suction port 50P1 and a pair of branched charge oil passages 41 branched from the common charge oil passage 40N.

As shown in FIG. 71, in this embodiment, the first drain line 60*a* is configured so as to communicate the pump body accommodating space S of the first hydraulic pump unit 10N to a pump body accommodating space S of the second hydraulic pump unit 11N.

The second drain line 60*b* is configured so as to communicate the pump body accommodating space S of the second hydraulic pump unit 11N to the oil tank 15.

Specifically, in this embodiment, the first and second hydraulic pump units 10N, 11N include a common pump case 140 of the same configuration.

The common pump case 140 includes, as shown in FIG. 72, at least two or more openings 65 for opening the corresponding pump body accommodating space S outward.

In the pump case 140 of the first hydraulic pump unit 10N, the unnecessary opening 65 is closed by the plug 66.

On the other hand, in the pump case 140 of the second hydraulic pump unit 11N, one opening 65 is used as the drain input port 60Pin and another opening 65 is used as the drain port 60P.

In the hydraulic pump set 100N of the above configuration as well, the operating oil of the external hydraulic device 300 can be efficiently obtained in addition to the charge oil of the first and second hydraulic pump units 10N, 11N, similar to the thirteenth embodiment.

Further, in this embodiment, the first charge pressure setting line 55*a* may be eliminated, thereby reducing the cost.

Embodiment 15

Still another embodiment of the hydraulic pump set according to the fifth aspect of the present invention will now be described with reference to the accompanying drawings.

The same reference numerals are denoted for the members same as or corresponding to those in the thirteenth and fourteenth embodiments; therefore, the detailed description thereof will not be given herein.

Figure 76:
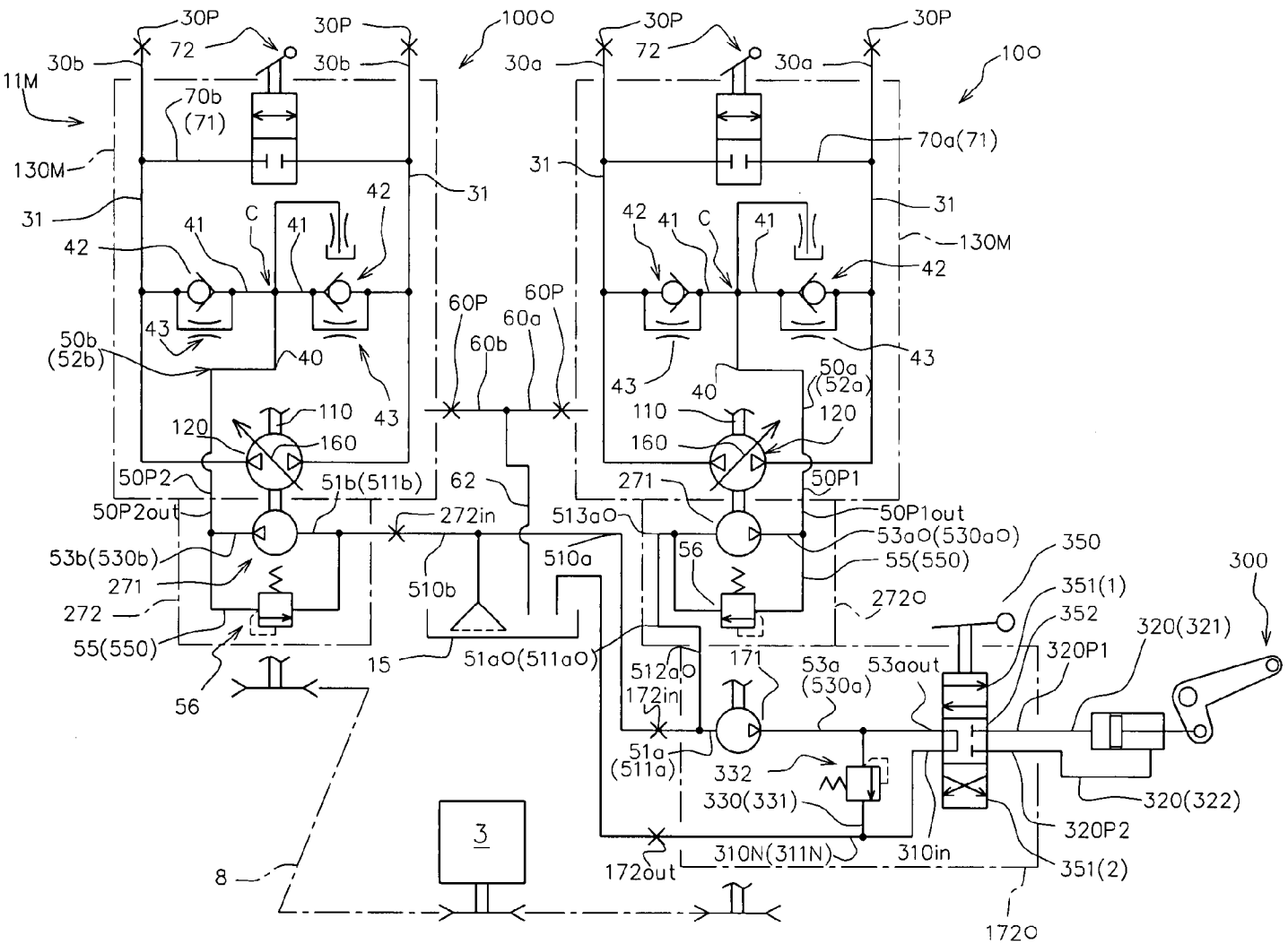
FIG. 76 is a hydraulic circuit diagram of a hydraulic pump set according to a fifteenth embodiment of the present invention.

FIG. 76 shows a hydraulic circuit diagram of a hydraulic pump set 100O according to this embodiment.

Figure 77:
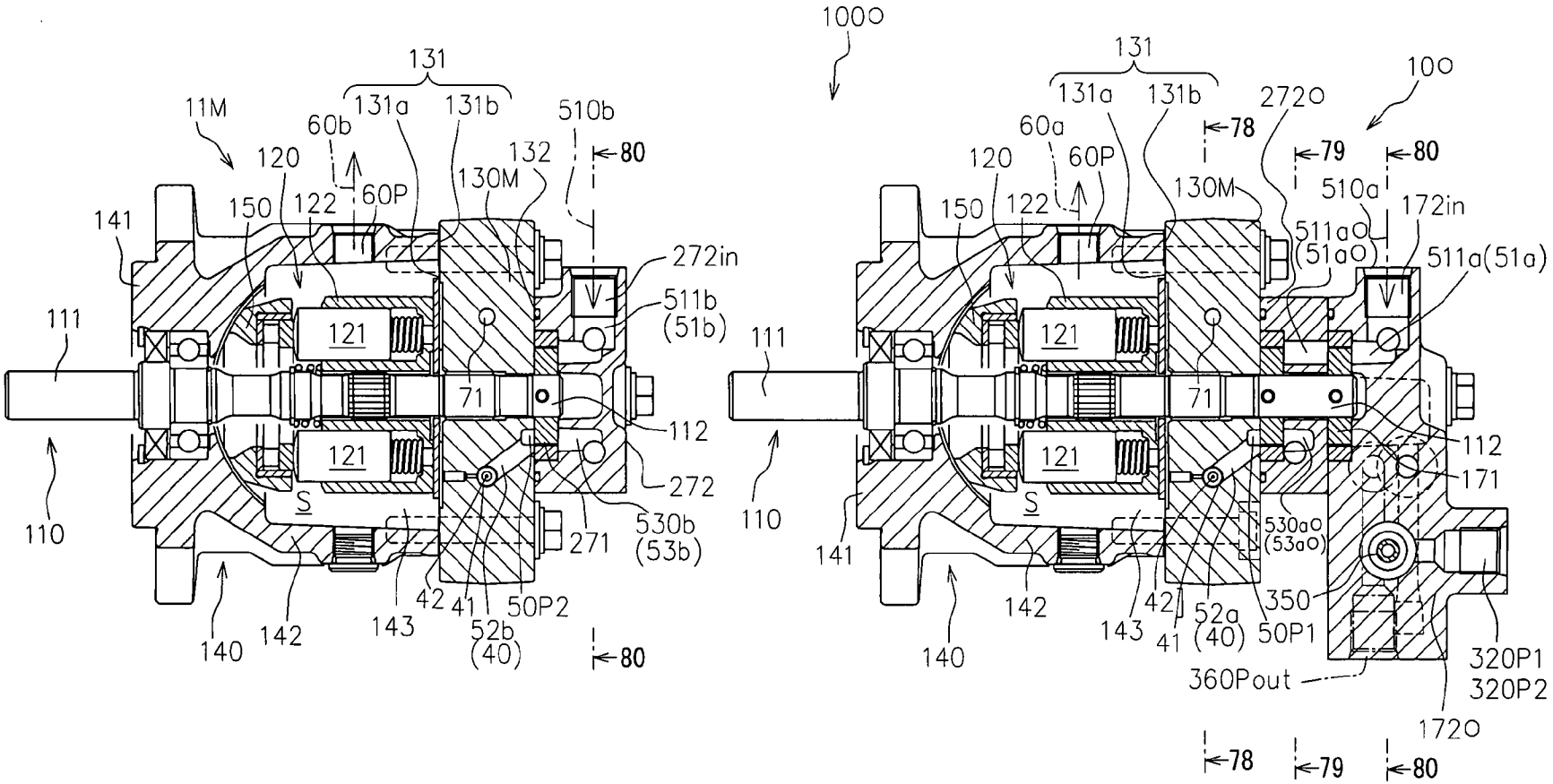
FIG. 77 is a schematic longitudinal side view of first and second hydraulic pump units of the hydraulic pump set according to the fifteenth embodiment of the present invention.

FIG. 77 shows a schematic longitudinal side view of first and second hydraulic pump units of the hydraulic pump set 100O.

Figure 78:
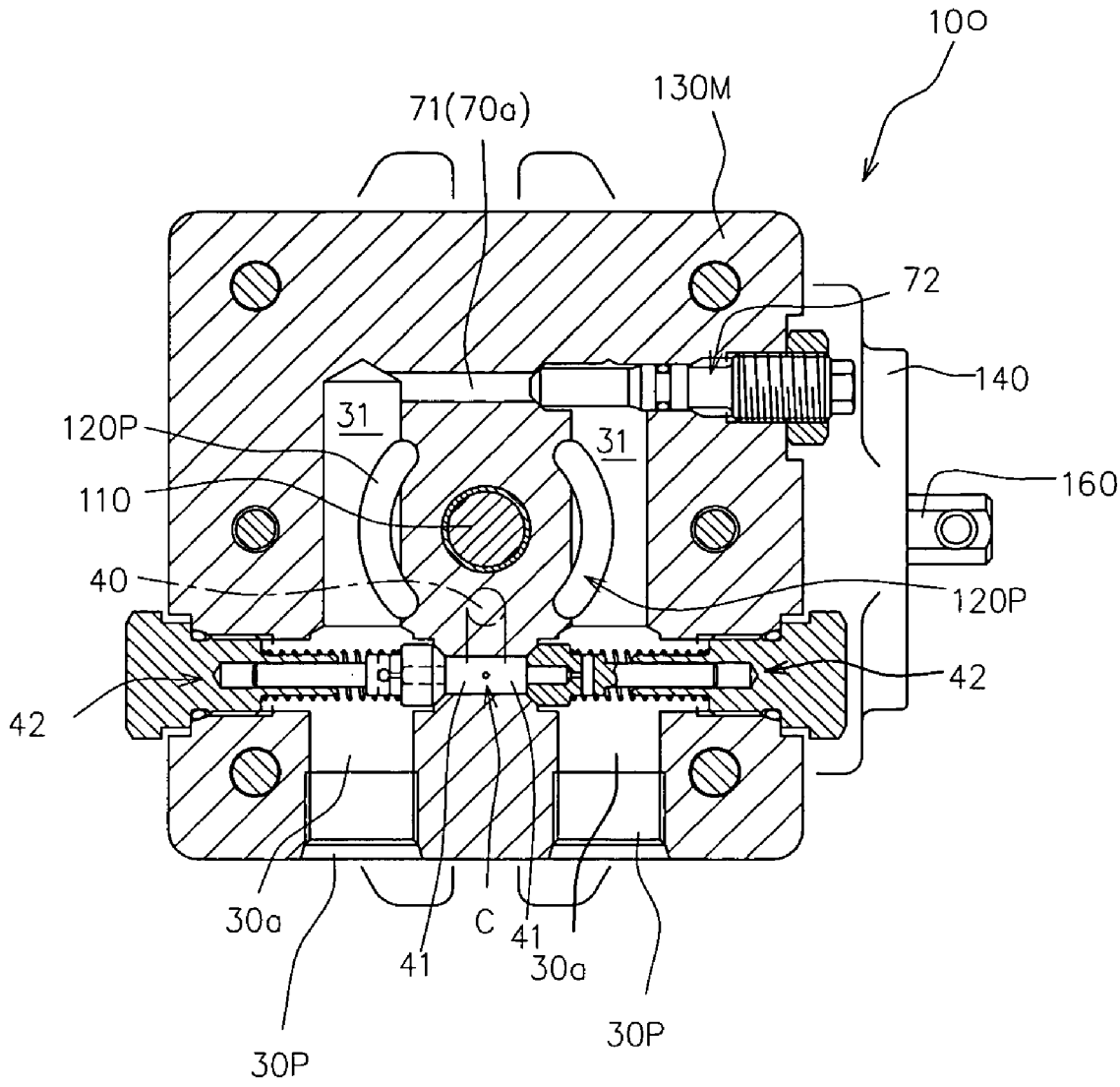
FIG. 78 is a cross sectional view taken along line 78-78 of FIG. 77.
Figure 79:
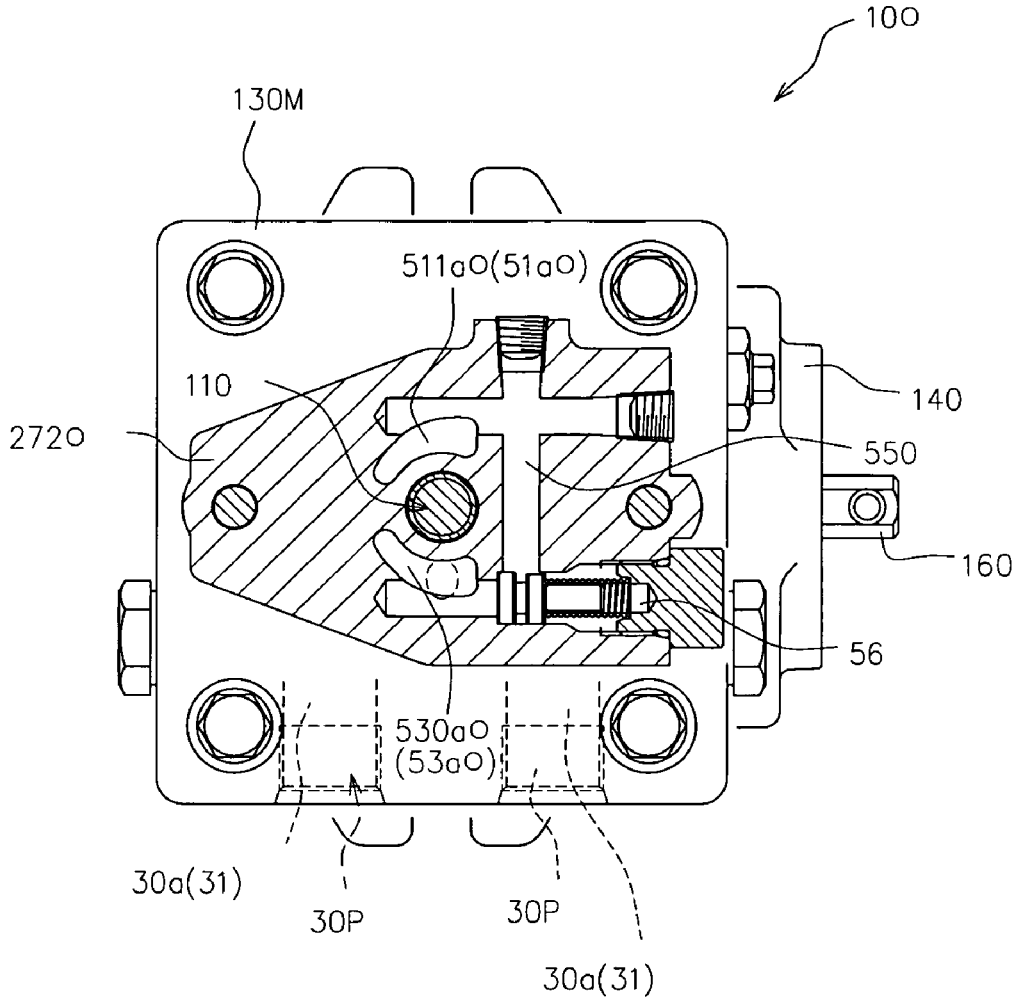
FIG. 79 is a cross sectional view taken along line 79-79 of FIG. 77.
Figure 80:
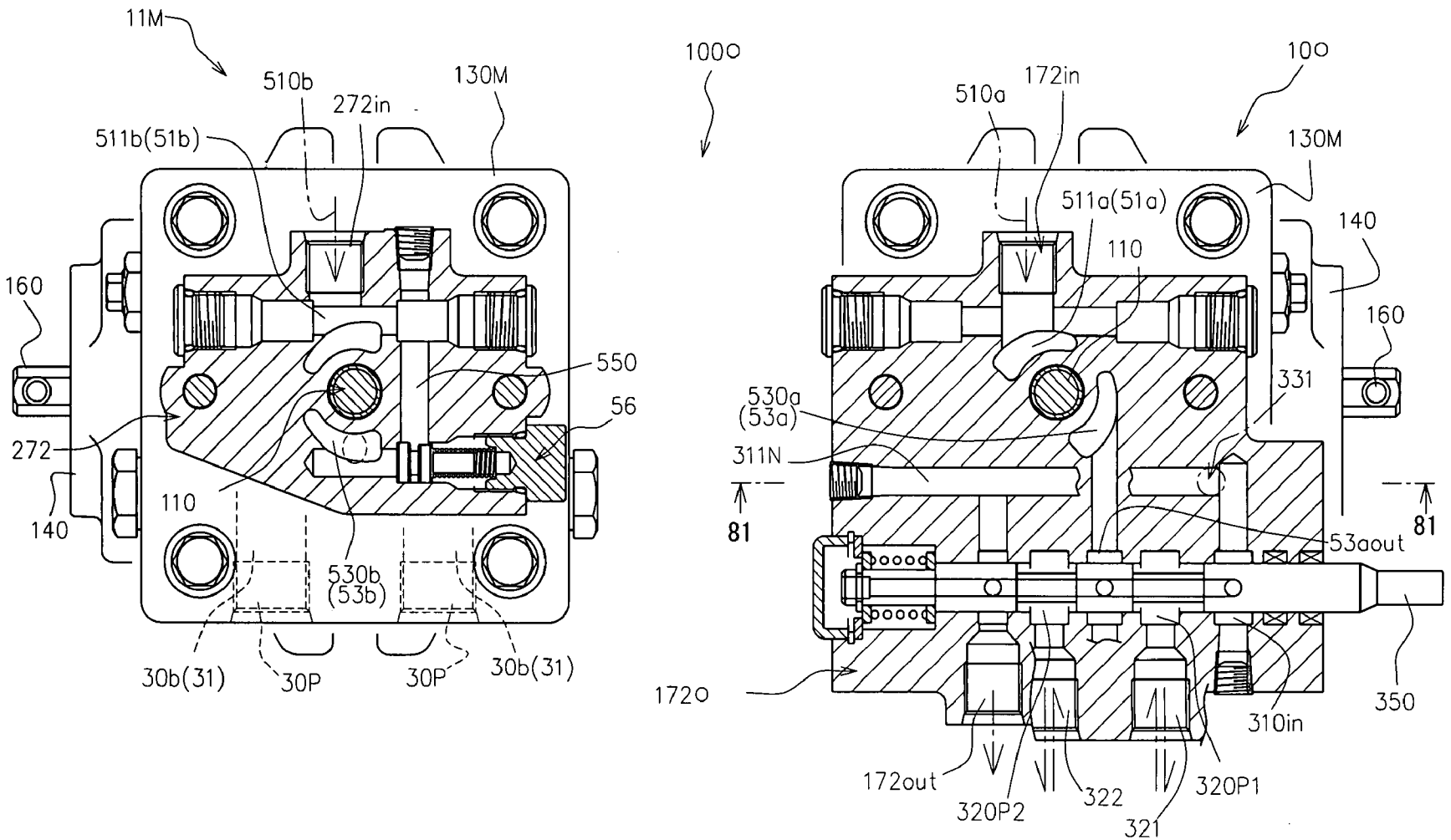
FIG. 80 is a cross sectional view taken along line 80-80 of FIG. 77.
Figure 81:
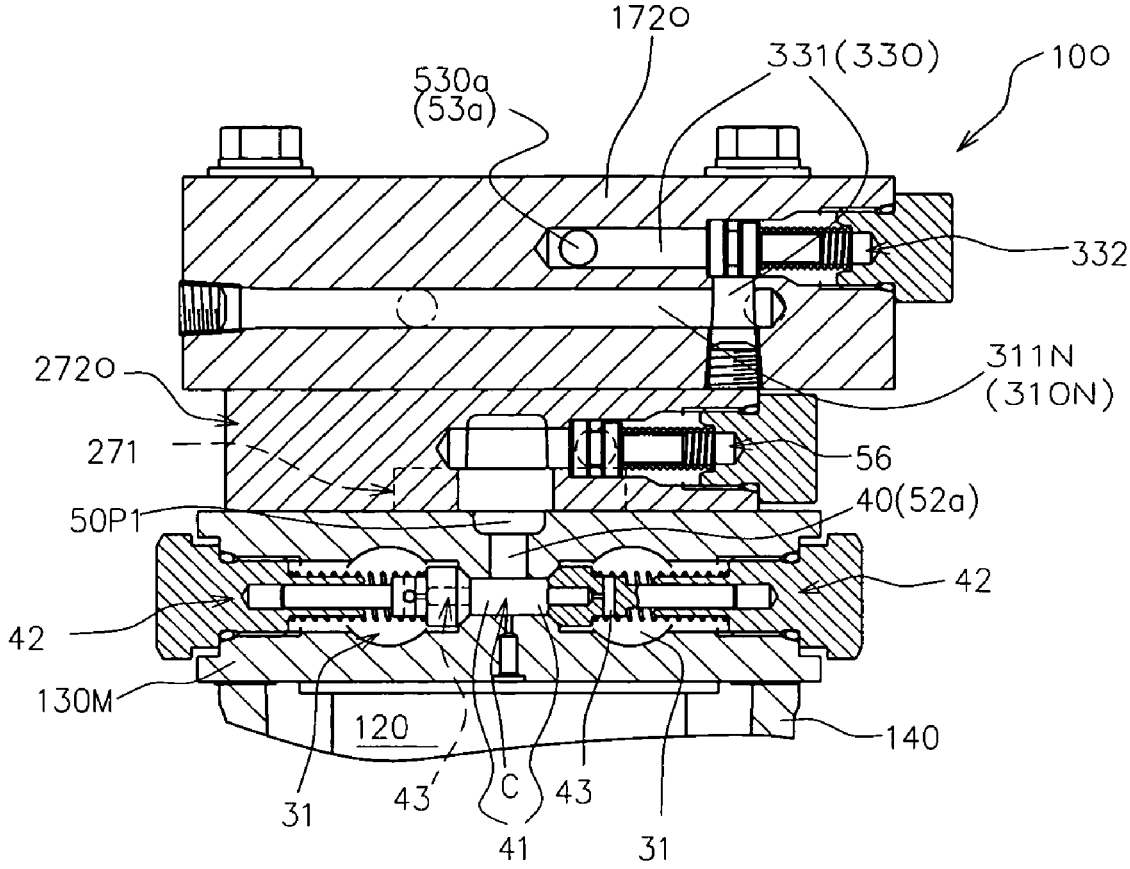
FIG. 81 is a cross sectional view taken along line 81-81 of FIG. 80.

FIG. 78 to FIG. 80 show cross sectional views taken along line 78-78, line 79-79 and line 80-80, respectively, of FIG. 77. Further, FIG. 81 shows a cross sectional view taken along line 81-81 of FIG. 80.

As shown in FIG. 76 and FIG. 77, the hydraulic pump set 100O according to this embodiment comprises a first hydraulic pump unit 10O and a second hydraulic pump unit 11M.

That is, in the hydraulic pump set 100O, the first hydraulic pump unit 10M of the hydraulic pump set 100M according to the thirteenth embodiment is changed to the first hydraulic pump unit 10O.

Specifically, as shown in FIG. 76 and FIG. 77, the first hydraulic pump unit 10O comprises the pump shaft 110, the pump body 120, the port block 130M, the pump case 140, the auxiliary pump body 171, and the charge pump body 271.

The auxiliary pump body 171 is configured so as to supply the operating oil to the external hydraulic device 300.

The charge pump body 271, on the other hand, is configured so as to supply the charge oil to the first hydraulic pump unit 10O.

In this embodiment, the charge pump body 171 and the auxiliary pump body 271 are arranged in a tandem form with respect to each other so as to be driven by the second end 112 of the corresponding pump shaft 110.

More specifically, the first hydraulic pump unit 10O comprises, in addition to the above configuration, a charge pump case 272O connected to the port block 130M so as to surround the charge pump body 271, and an auxiliary pump case 172O connected to the charge pump case 272O so as to surround the auxiliary pump body 171.

The first hydraulic pump unit 10O of the above configuration includes the pair of first hydraulic lines 30*a*, the first suction line 51*a*, the first discharge line 53*a*, the external oil pressure draw-out line 320, the return line 310N, a first charge suction line 51*a*O extending between the oil tank 15 and the charge pump body 271, a first discharge line 53*a*O for flowing the discharge oil from the charge pump body 271, the first charge line 50*a* having a first end fluidly connected to the first discharge line 53*a*O and a second end fluidly connected to each first hydraulic lines 30*a*, and the first drain line 60*a*.

In this embodiment, the first hydraulic pump unit 10O further includes the operating pressure setting line 330 for setting the operating oil pressure of the external hydraulic device 300, and the charge pressure setting line 55 for setting the oil pressure of the first charge line 50*a*, similar to the thirteenth or fourteenth embodiment.

The first charge suction line 51*a*O includes a first charge suction oil passage 511*a*O having a first end fluidly connected to the first suction line 51*a* and a second end fluidly connected to the suction part of the charge pump body 271.

In this embodiment, the first charge suction oil passage 511*a*O is configured so that the first end communicates to the first suction oil passage 511*a*.

That is, in this embodiment, the suction port 172in is used as the common suction port for both the auxiliary pump body 171 and the charge pump body 271.

Specifically, the first charge suction oil passage 511*a*O includes an upstream-side suction oil passage 512*a*O formed in the auxiliary pump case 172O, and a downstream-side suction oil passage 513*a*O formed in the charge pump case 272O.

The upstream-side suction oil passage 512*a*O is formed in the auxiliary pump case 172O so as to have a first end communicated to the first suction oil passage 511*a* and a second end opening at the surface opposing the charge pump case 272O.

The downstream-side suction oil passage 513*a*O is formed in the charge pump case 272O so as to have a first end opening at the surface opposing the auxiliary pump case 172O so as to communicate with the second end of the upstream-side suction oil passage 512*a*O, and a second end communicating to the suction part of the charge pump body 271.

The first discharge line 53*a*O is configured so as to fluidly connect between the discharge part of the charge pump body 271 and the first charge line 50*a*.

In this embodiment, the first discharge line 53*a*O includes a discharge oil passage 530*a*O formed in the charge pump case 272O.

The discharge oil passage 530*a*O has a first end communicated to the discharge part of the charge pump body 271 and a second end opening at the surface opposing the port block 130M to form the first discharge port 50P1out.

Also in the hydraulic pump set 100O of the above configuration, the operating oil of the external hydraulic device 300 can be efficiently obtained in addition to the charge oils of the first and second hydraulic pump units 10O, 11M, similar to the thirteenth and fourteenth embodiments.

Embodiment 16

Yet another embodiment of the hydraulic pump set according to the fifth aspect of the present invention will now be described with reference to the accompanying drawings.

The same reference numerals are denoted for the members same as or corresponding to those in the thirteenth to fifteenth embodiments; therefore, the detailed description thereof will not be given herein.

Figure 82:
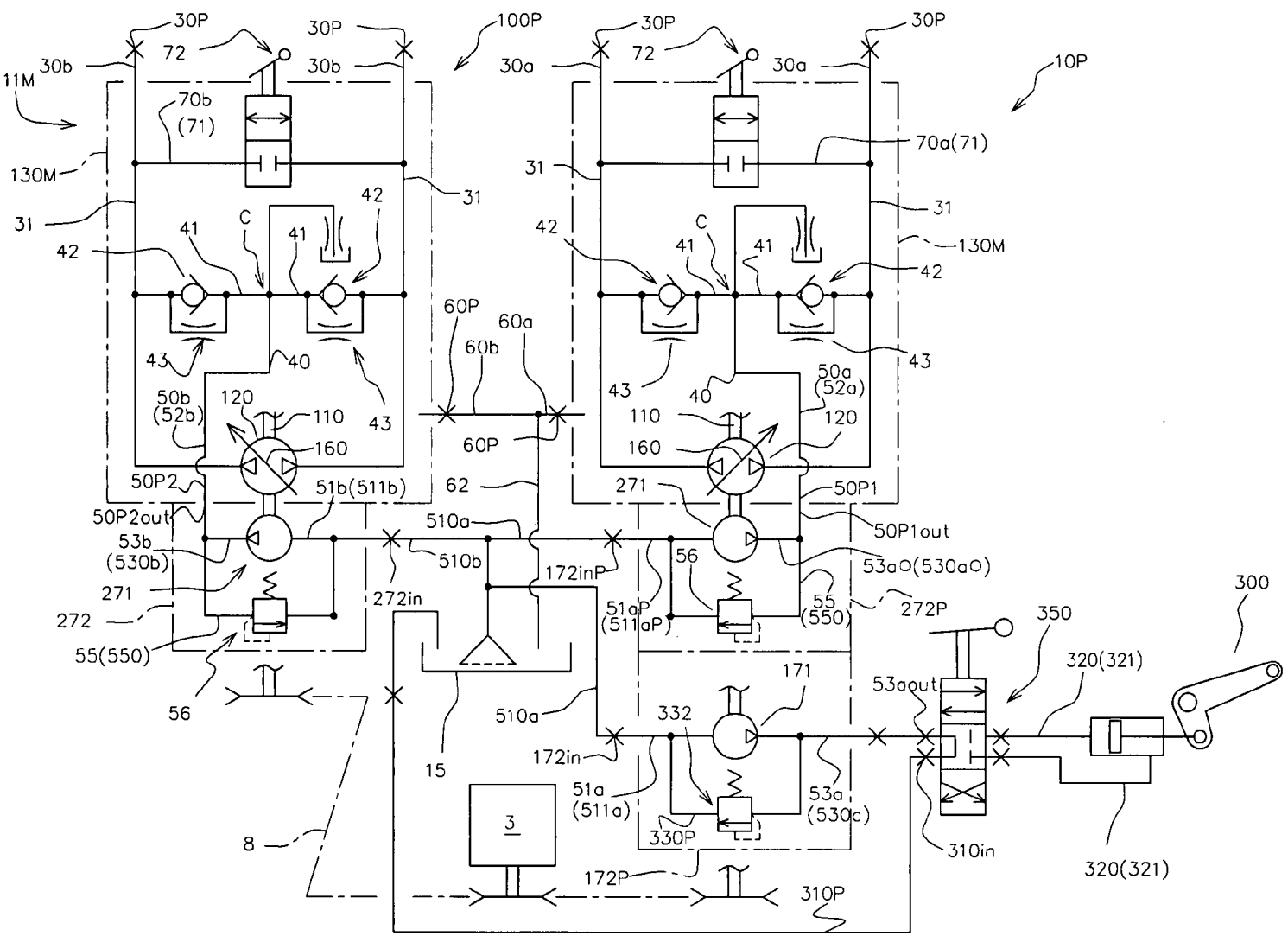
FIG. 82 is a hydraulic circuit diagram of a hydraulic pump set according to a sixteenth embodiment of the present invention.

FIG. 82 shows a hydraulic circuit diagram of a hydraulic pump set 100P according to this embodiment.

Figure 83:
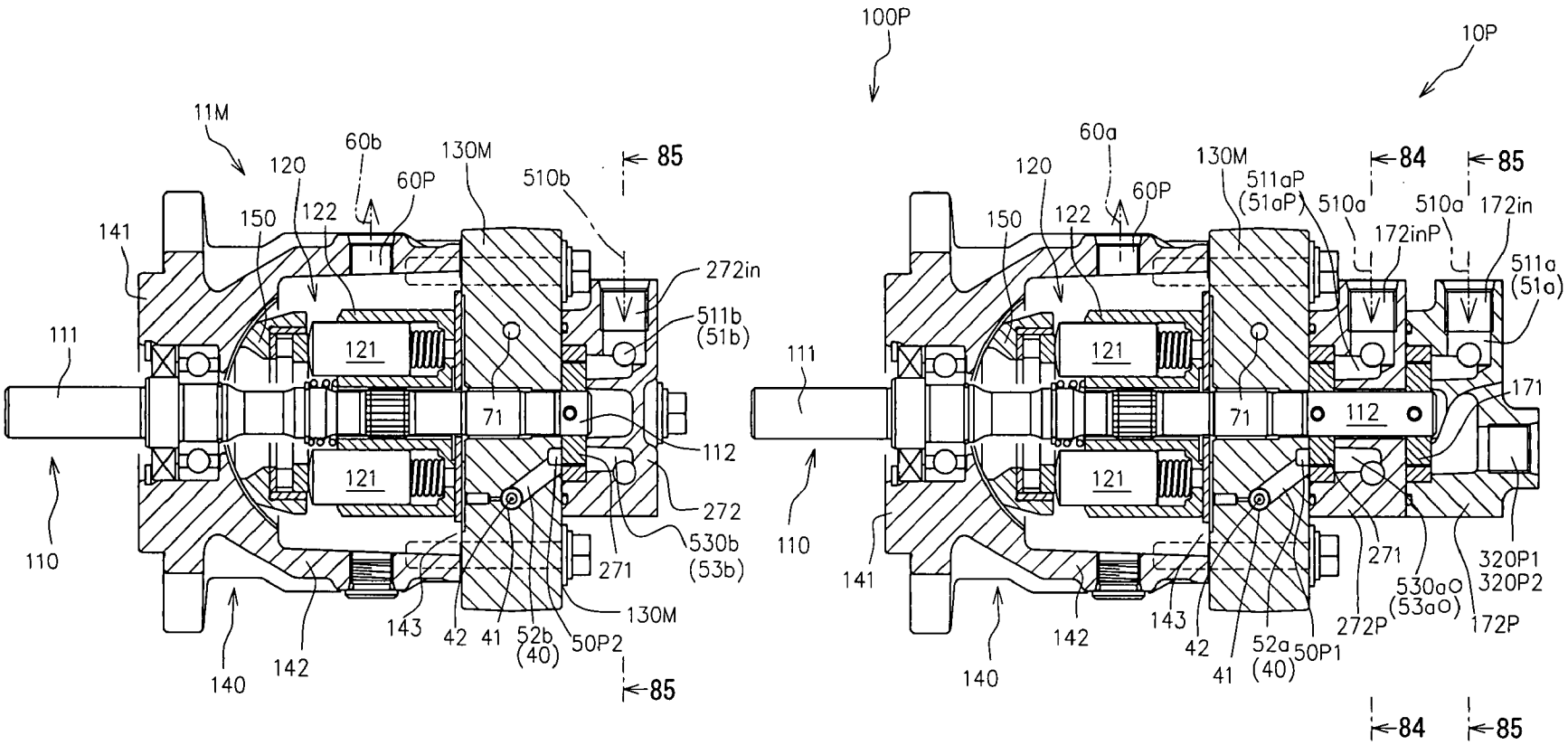
FIG. 83 is a schematic longitudinal side view of first and second hydraulic pump units of the hydraulic pump set according to the sixteenth embodiment of the present invention.

FIG. 83 shows a schematic longitudinal side view of first and second hydraulic pump units of the hydraulic pump set 100P.

Figure 84:
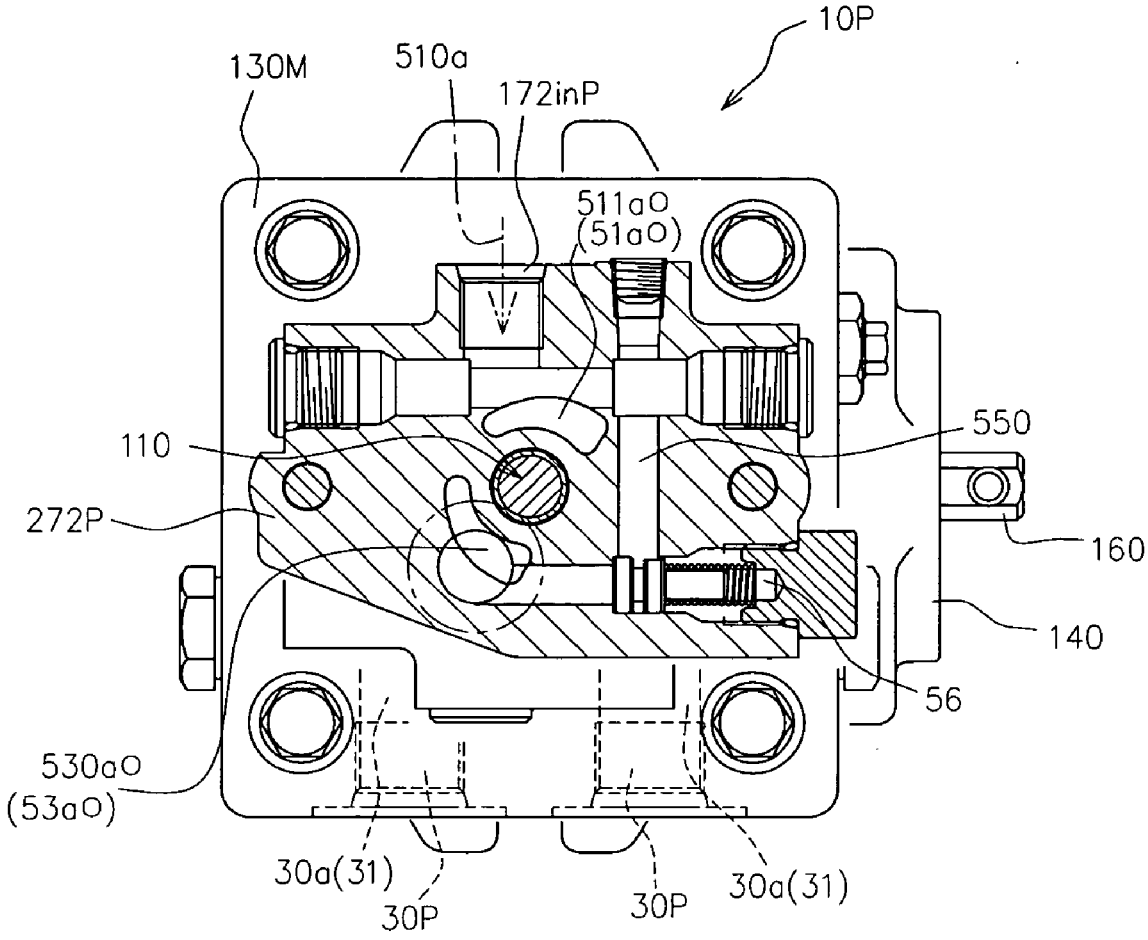
FIG. 84 is a cross sectional view taken along line 84-84 of FIG. 83.
Figure 85:
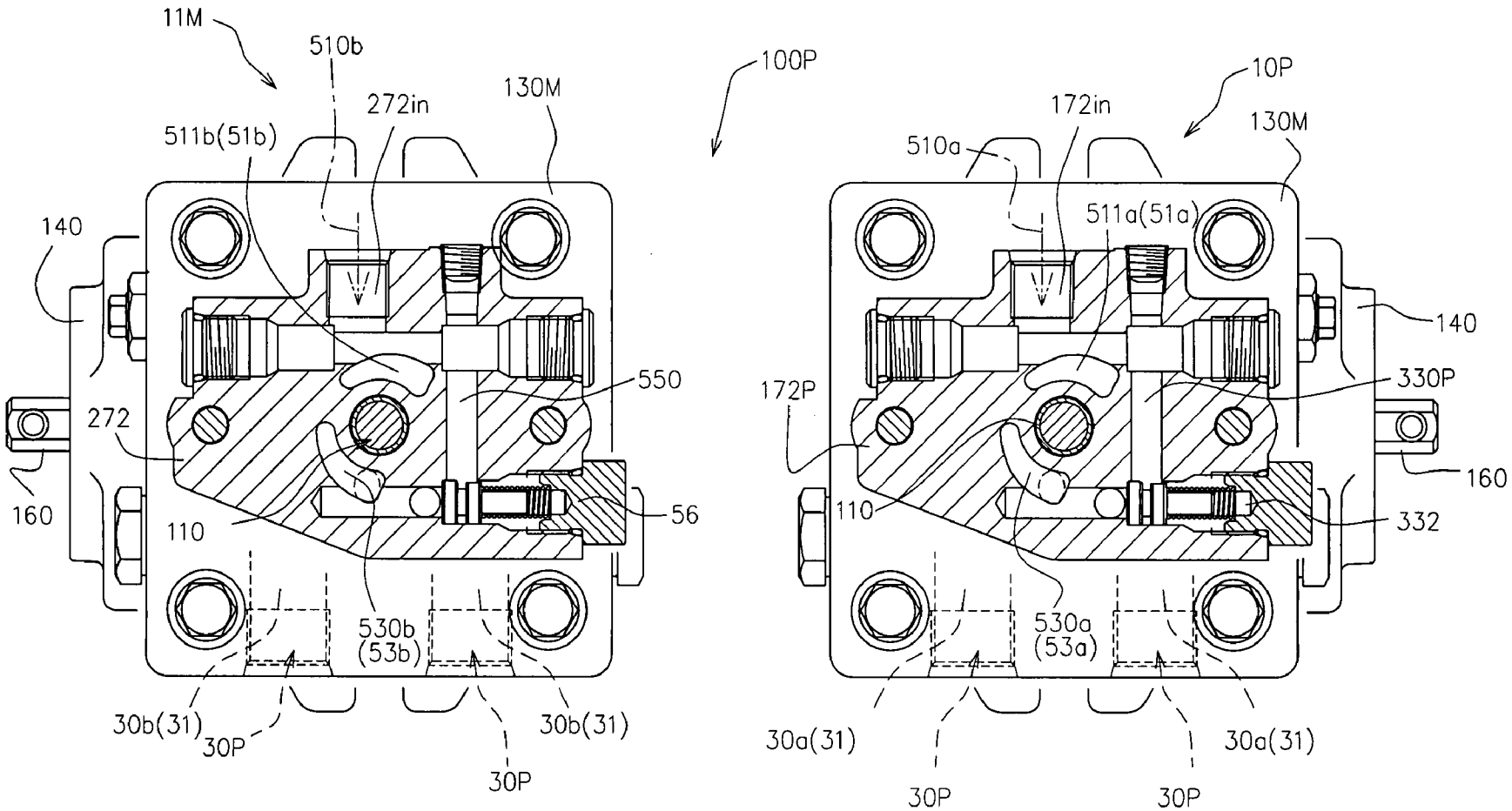
FIG. 85 is a cross sectional view taken along line 85-85 of FIG. 83.

FIG. 84 and FIG. 85 show cross sectional views taken along line 84-84 and line 85-85, respectively, of FIG. 83.

As shown in FIG. 82 to FIG. 84, the hydraulic pump set 100P according to this embodiment is substantially the same as the hydraulic pump set 100O according to the fifteenth embodiment except for the facts that the suction port of the charge pump body 271 and the suction port of the auxiliary pump body 171 are different, and that the switching member 350 is arranged apart from the first hydraulic pump unit 10P.

Therefore, the difference from the fifteenth embodiment will be described below.

More specifically, the hydraulic pump set 100P according to this embodiment includes a first hydraulic pump unit 10P and the second hydraulic pump unit 11M.

That is, in the hydraulic pump set 100O, the first hydraulic pump unit 10O of the hydraulic pump set 100O according to the fifteenth embodiment is changed to the first hydraulic pump unit 10P.

The first hydraulic pump unit 10P includes a first charge suction line 51*a*P in place of the first charge suction line 51*a*O.

Specifically, the first hydraulic pump unit 10P includes an auxiliary pump case 172P and a charge pump case 272P in place of the auxiliary pump case 172O and the charge pump case 272O of the first hydraulic pump unit 10O.

The first charge suction line 51*a*P includes a charge oil passage 511*a*P formed in the charge pump case 272P.

The charge oil passage 511*a*P has a first end opening at the external surface of the charge pump case 272P to form a suction port 172inP and a second end communicating to the suction part of the charge pump body 271.

That is, in this embodiment, the suction port 172in forms the dedicated suction port for the auxiliary pump body 171, and the suction port 172inP forms the dedicated suction port for the charge pump body 271.

Further, the first hydraulic pump unit 10P includes a return line 310P in place of the return line 310, and an operating pressure setting line 330P in place of the operating pressure setting line 330.

The return line 310P has a first end forming the input port 310in and a second end forming a conduit fluidly connected to the oil tank 15.

The operating pressure setting line 330P has a first end communicated to the discharge line 53*a* and a second end communicated to the first suction line 51*a*.

Also in the hydraulic pump set of the above configuration, the operating oil of the external hydraulic device 300 can be efficiently obtained in addition to the charge oils of the first and second hydraulic pump units 10P, 11M, similar to the thirteenth to fifteenth embodiments.

In the form in which the return oil from the external hydraulic device 300 is used as the charge oil as in the thirteenth embodiment, preferably, a diverting line 370 for bypassing a part of pressure oil of the first discharge line 53*a* to the return line 310 may be arranged; thus, the charge oil supply can be stably and reliably performed.

Figure 86:
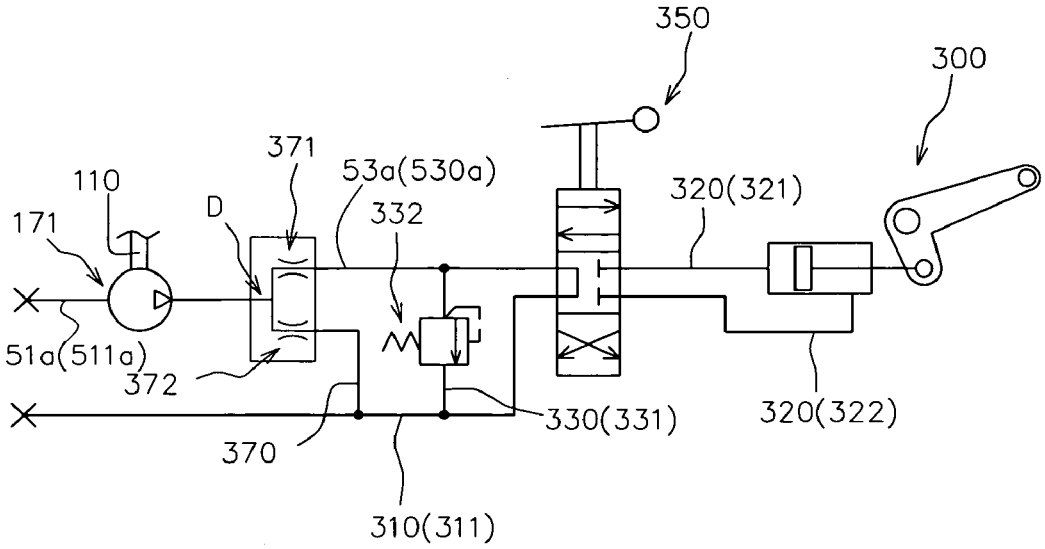
FIGS. 86(*a*) and (*b*) are part of hydraulic circuit diagrams of a modified hydraulic pump set of the present invention.
Figure 86:
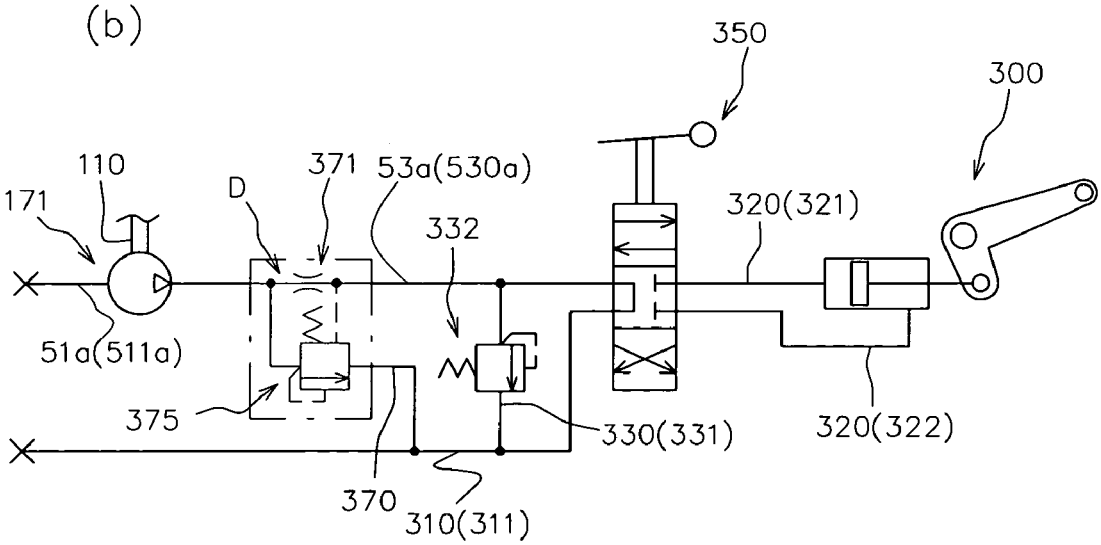

More specifically, the first hydraulic pump unit 10M according to the thirteenth embodiment further comprises the diverting line 370 having a first end communicated to the first discharge line 53*a* and a second end communicated to the return line 310, a first throttle valve 371 inserted into the first discharge line 53*a* at a downstream side in the flow direction of the pressure oil rather than a communicating point D of the first discharge line 53*a* and the diverting line 370, and a second throttle valve 372 inserted into the diverting line 370 (see FIG. 86(*a*)).

By adopting the proportional diverting valve method, in addition to the return pressure oil from the external oil pressure draw-out line 320, the pressure oil of the oil amount corresponding to the drawing ratio defined by the first throttle valve 371 and the second throttle valve 372 also flows into the return line 310 from the first discharge line 53*a*.

Therefore, the charge oil supply can be stably and reliably performed.

A control valve 375 in which the oil pressure on the downstream side in the flow direction of the pressure oil of the first throttle valve 371 serves as the pilot pressure may be provided in place of the second throttle valve 372 (see FIG. 86(*b*)).

By adopting the constant flow rate-type flow rate control valve method, an approximately constant oil amount defined by the first throttle valve 371 flows to the external hydraulic device 300, and the excess oil amount flows to the diverting line 370 regardless of the rotating speed of the auxiliary pump body 171.

Therefore, the charge oil supply can be stably and reliably performed.

Further, in the thirteenth to fifteenth embodiments, the first and second hydraulic pump units configured so that the pump shaft 110 is directed in the vertical direction are described by way of example; however, the present invention is of course not limited to this form. That is, the hydraulic pump unit configured so that the pump shaft 110 is directed in the front-to-rear direction of the vehicle or in the width direction of the vehicle may also be used.

Moreover, in the working vehicle including a single hydraulic motor unit and configured so as to transmit the output from the single hydraulic motor unit to the left and right driving wheels by way of a differential gear device, each hydraulic pump unit may be used independently.

Embodiment 17

An embodiment of a hydraulic pump unit according to the sixth aspect of the present invention will now be described with reference to the accompanying drawings.

Figure 87:
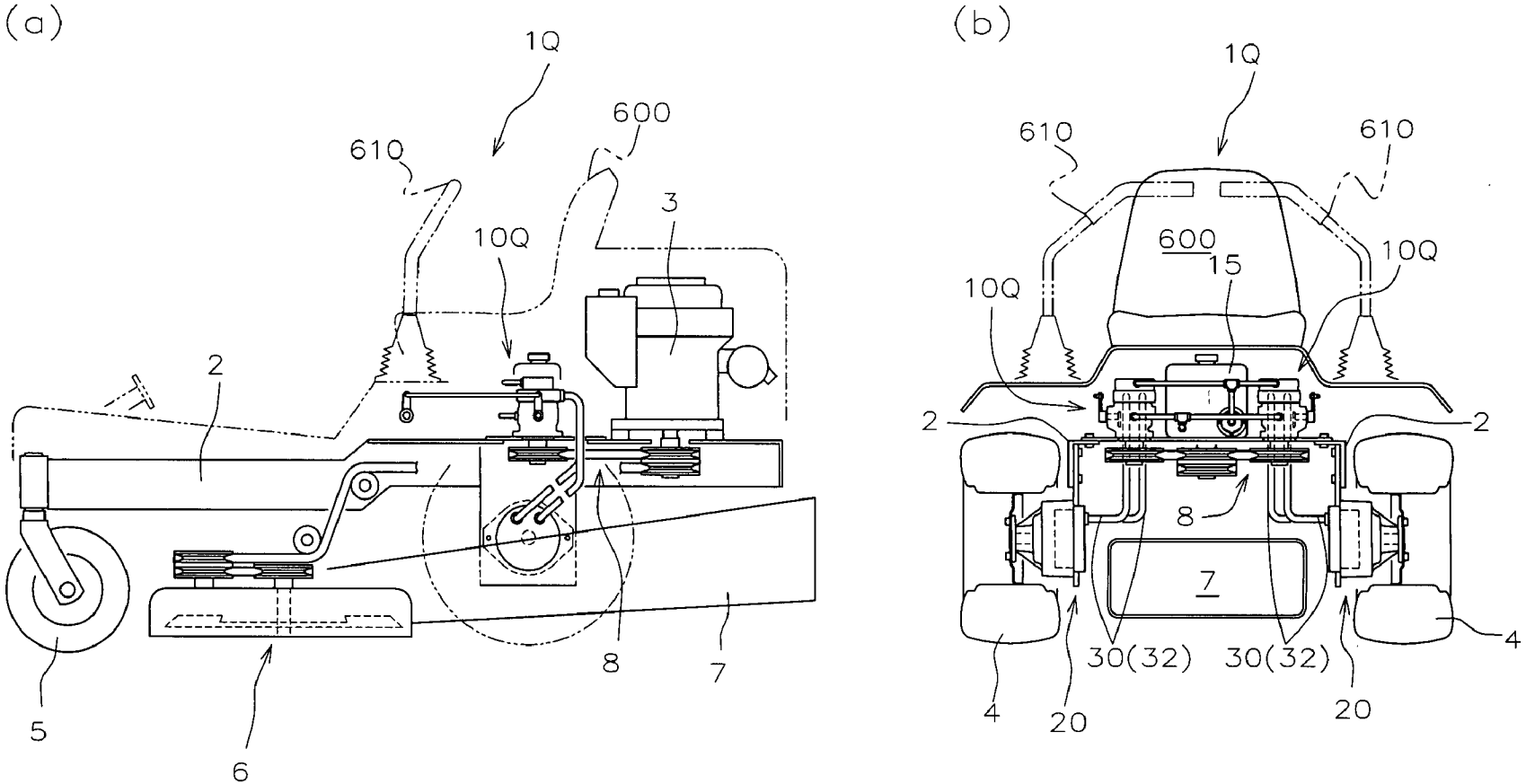
FIGS. 87(*a*) and 87(*b*) are a side view and a front view, respectively, of a working vehicle applied with a hydraulic pump unit according to a seventeenth embodiment of the present invention.
Figure 88:
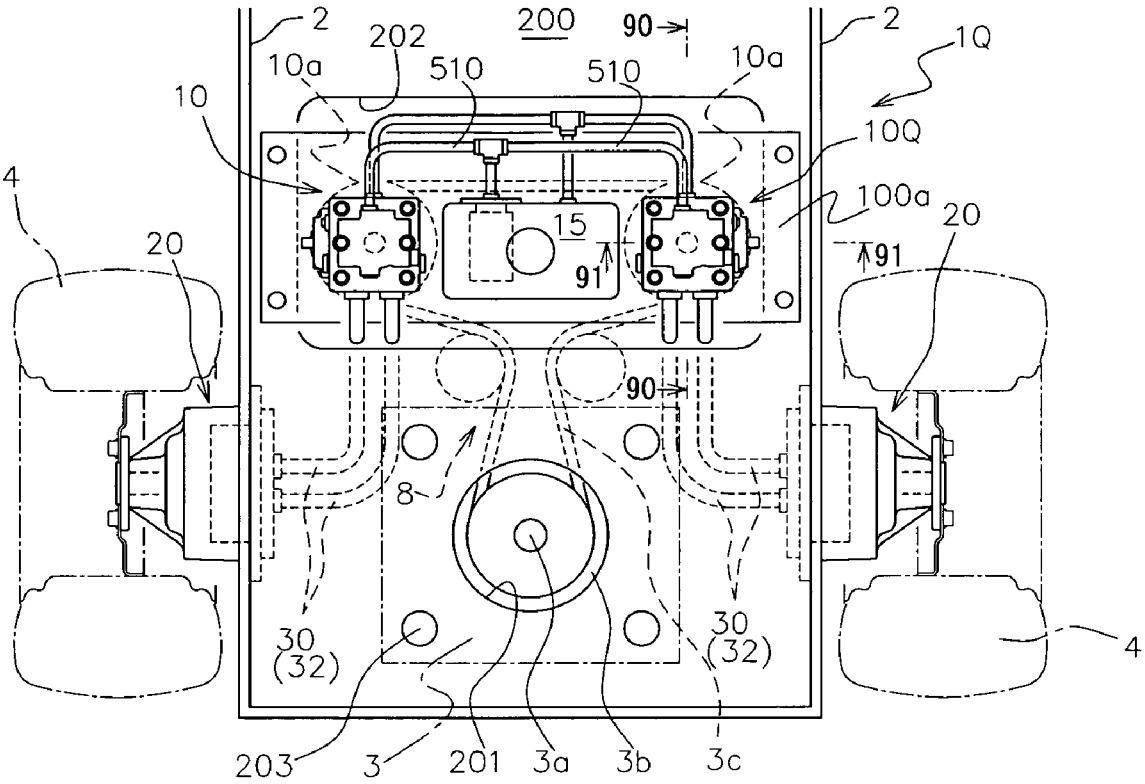
FIG. 88 is a partially developed plan view of the working vehicle shown in FIG. 87.

FIGS. 87(*a*) and 87(*b*) are a side view and a front view, respectively, of a working vehicle 1Q applied with a hydraulic pump unit 10Q according to this embodiment. FIG. 88 is a partially developed plan view of the working vehicle 1Q.

The configuration of the working vehicle 1Q will now be described.

As shown in FIG. 87 and FIG. 88, the working vehicle 1Q is a rear discharge-type riding mower capable of performing zero turn.

Specifically, the working vehicle 1Q comprises a frame 2, a driving source 3 supported by the frame 2, the hydraulic pump unit 10Q arranged in the vicinity of the driving source 3 and operatively driven by the driving source 3 by way of a transmission mechanism 8, a hydraulic motor unit 20 fluidly connected to the hydraulic pump unit 10Q, driving wheels 4 (rear wheel in this embodiment) driven by the hydraulic motor unit 20, and caster wheels 5 (front wheel in this embodiment).

The working vehicle 10Q comprises a pair of driving wheels 4, and the hydraulic motor unit 20 is arranged for each driving wheel 4.

That is, the working vehicle 1Q comprises a pair of hydraulic pump units 10Q according to this embodiment, and the pair of hydraulic pump units 10Q are fluidly connected to the pair of hydraulic motor units 20, respectively.

As shown in FIG. 87 and FIG. 88, the driving source 3 is of a vertical crankshaft type in this embodiment.

The driving source 3 is mounted on a flat plate 200 arranged on the rear side of the frame 2 by way of an elastic member 203 and, thus, is supported by the frame 2 in a vibrating manner.

Specifically, as shown in FIG. 88, a first opening 201 is formed at a central part of the flat plate 200.

The driving source 3 is attached to the flat plate 200 by way of the elastic member 203 so that a driving pulley 3*b* attached to a shaft end of the driving shaft 3*a* is positioned below the flat plate 200 through the first opening 201.

A broad second opening 202 is formed in the flat plate 200 at the front of the first opening 201. The second opening 202 is provided to operatively connect the driving source 3 and the hydraulic pump unit 10Q.

Specifically, the pair of hydraulic pump units 10Q is arranged on a common substrate 100*a* in a state spaced apart in the width direction of the vehicle.

Herein, the shaft end of the pump shaft 110 (which will be described later) passes through the substrate 100*a* and extends below the flat plate 200 by way of the second opening 202. Driven pulleys 10*a*, 10*b* are arranged on the shaft end of the pump shaft 110 so as to be positioned below the flat plate 200.

The common substrate 100*a* has a left-to-right length (length along the width direction of the vehicle) longer than a left-to-right length of the second opening, and a portion overlapping the flat plate 200 is joined to the flat plate 200.

According to the above configuration, a sub-assembly with the pair of hydraulic pump units 10Q arranged on the common substrate 100*a* in advance is incorporated into the frame 2 (flat plate 200) all at once.

After incorporation in the sub-assembly, a transmission belt 3*c* is wound between the driven pulleys 10*a*, 10*b* and the driving pulley 3*b*, and by applying tension thereto, the first and second hydraulic pump unit 10Q are rotated in the same direction as the rotating direction of the driving source 3.

In this embodiment, as shown in FIG. 87, the driving source 3 is of a vertical crankshaft type; thus, the pair of hydraulic pump units 10Q are arranged so that the rotating axis line of each pump shaft 110 extends along the vertical direction. However, if the driving source 3 is of a horizontal crankshaft type, the pair of hydraulic pump units 10Q may be arranged so that the rotating axis line of each pump shaft 110 extends along the front-to-rear direction.

Specifically, as shown in FIG. 87(*b*) and FIG. 88, the pair of hydraulic motor units 20 are also distributed and arranged in the width direction of the vehicle so as to define a space therebetween.

The working vehicle 1Q comprises, in addition to the above configuration, a mower device 6 suspended and supported in a freely rising/lowering manner between the front and rear wheels 4, 5, and a duct 7 which is arranged in the space and guides the mowed grass to a grass collecting bag (not shown) arranged at the rear of the vehicle body.

Further, in the working vehicle 1Q, a driver's seat 600 is arranged above the center in the width direction of the frame 2 at the front of the driving source 3, and a pair of left and right steering handles 610 are arranged at the front of the driver's 600 seat in a freely forward/rearward tilting manner.

The pair of steering handles 610 are operatively connected with the pair of hydraulic pump units 10Q so as to operate the pair of hydraulic pump units 10Q, respectively, and the outputs of the pair of hydraulic motor units 20 fluidly connected through a pair of operating oil conduits 32 are independently controlled by operating the pair of steering handles 610.

The pair of hydraulic pump units 10Q are also distributed and arranged in the width direction of the vehicle so as to define a space therebetween, as mentioned above.

The working vehicle 1Q comprises, in addition to the above configuration, an oil tank 15 arranged between the pair of hydraulic pump units 10Q.

The oil tank 15 stores drain oils of the hydraulic pump unit 10Q and, also, acts as a charge oil supply source for the hydraulic pump units 10Q, as described later.

Figure 89:
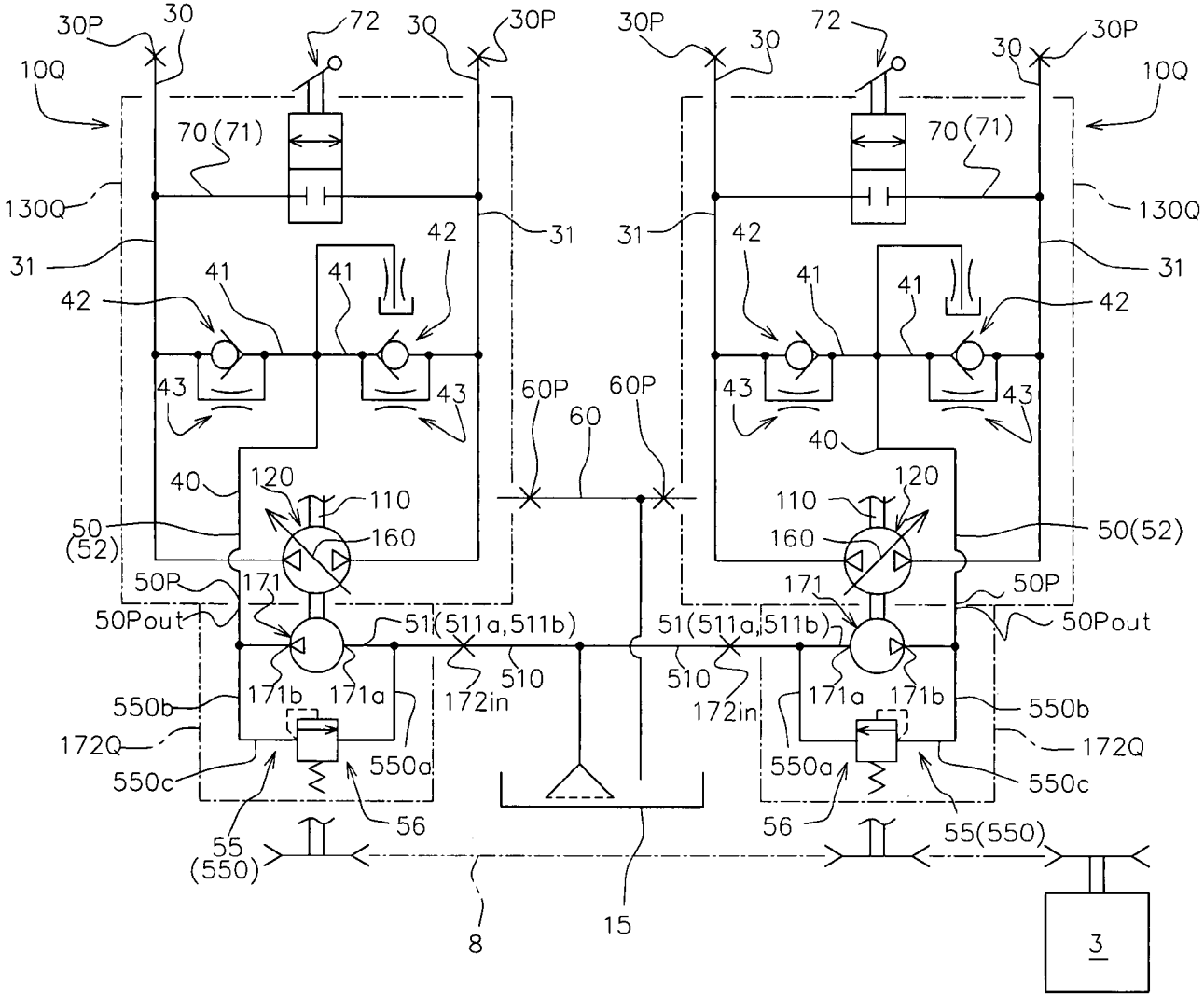
FIG. 89 is a hydraulic circuit diagram of the pair of hydraulic pump units according to the seventeenth embodiment of the present invention.

FIG. 89 shows a hydraulic circuit diagram of the pair of hydraulic pump units 10Q.

The pair of hydraulic pump units 10Q are fluidly connected to the pair of hydraulic motor units 20 by way of a hydraulic circuit (a pair of hydraulic lines 30 in this embodiment) so as to form an HST in cooperation with the corresponding hydraulic motor unit 20.

At least one of the corresponding hydraulic pump unit 10Q and the hydraulic motor unit 20 is of a variable displacement type.

In this embodiment, each of the pair of hydraulic pump units 10Q is of a variable displacement type, and each of the pair of hydraulic motor units 20 is of a fixed displacement type.

The configuration of the first hydraulic pump unit 10Q will now be described in detail.

Figure 90:
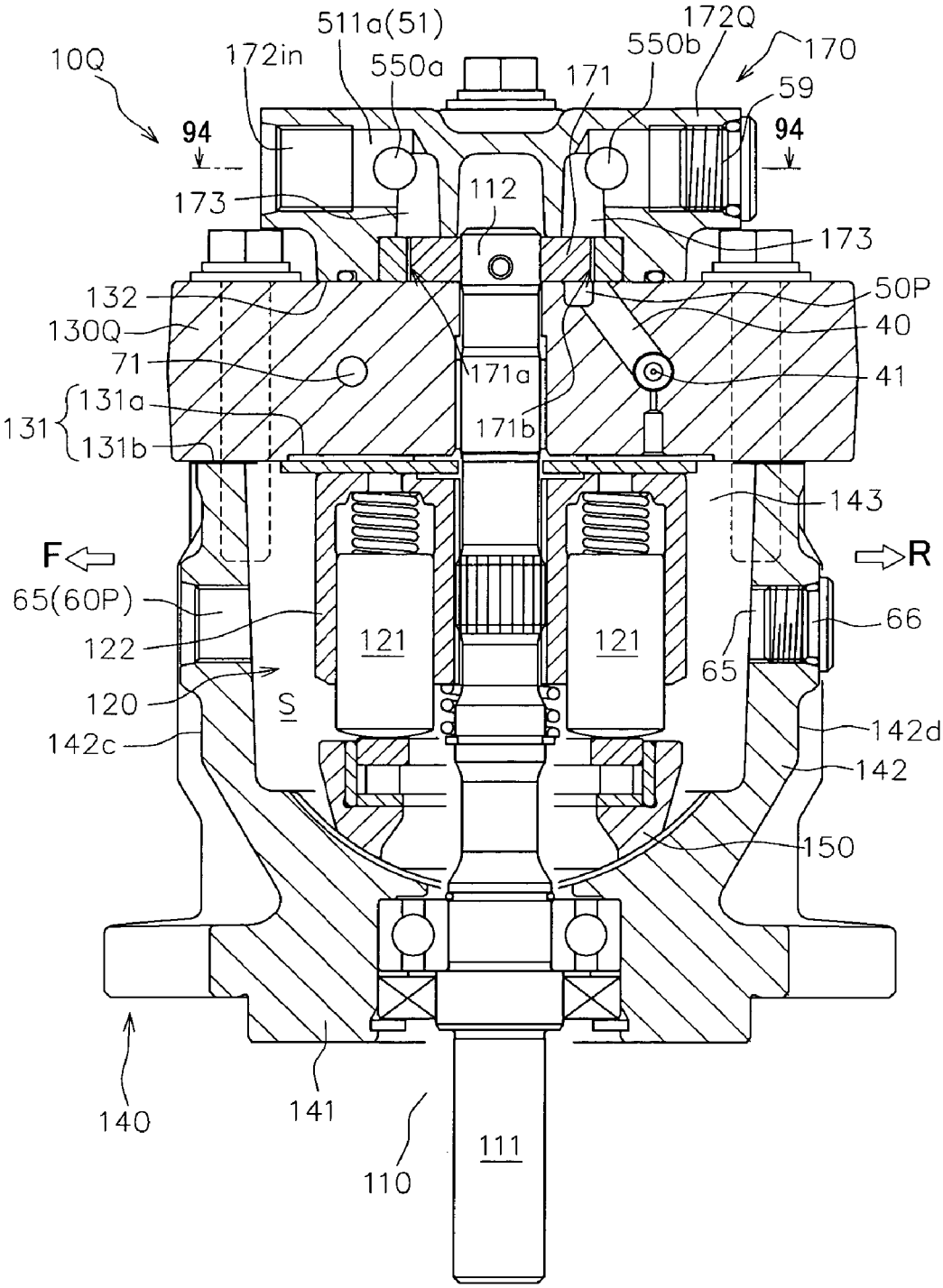
FIG. 90 is a longitudinal side view of the hydraulic pump unit taken along line 90-90 of FIG. 88.
Figure 91:
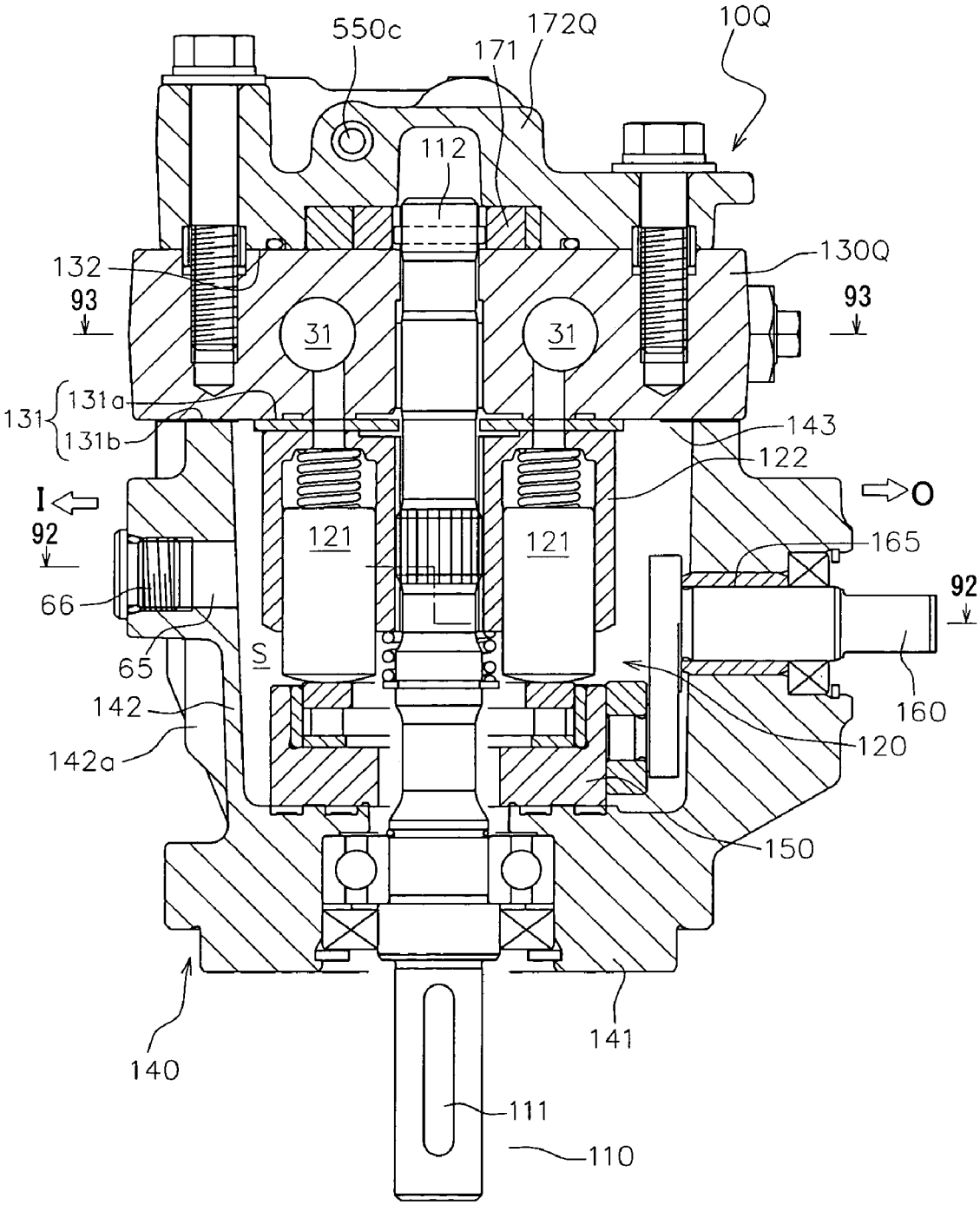
FIG. 91 is a longitudinal rear view of the hydraulic pump unit taken along line 91-91 of FIG. 88.

FIG. 90 and FIG. 91 show a longitudinal side view and a longitudinal rear view of the hydraulic pump unit 10Q taken along line 90-90 and line 91-91, respectively, of FIG. 88.

The symbols F, R, O, and I of FIG. 90 and FIG. 91 show the front in the longitudinal direction of the vehicle, the rear in the longitudinal direction of the vehicle, the outside in the width direction of the vehicle, and the inside in the width direction of the vehicle when seen from the hydraulic pump unit 10, respectively.

As shown in FIG. 90 and FIG. 91, the hydraulic pump unit 10Q comprises the pump shaft 110 operatively connected to the driving source 3, a pump body 120 rotatably driven by the pump shaft 110, a port block 130Q for supporting the pump shaft body 120 in a freely rotating manner, a pump case 140 connected to the port block 130Q so as to define a pump body accommodating space for surrounding the pump body 120, an auxiliary pump body 171 rotatably driven by the pump shaft 110, and an auxiliary pump case 172Q connected to the port block 130Q so as to surround the auxiliary pump body 171.

The pump shaft 110 is supported by an assembly, configured by connecting the pump case 140 and the port block 130Q, so that a first end 111 forming an input end extends outward from the assembly.

In this embodiment, the first end 111 extends downward from the assembly.

The first end 111 is operatively connected to the driving source 3 by way of an appropriate transmission mechanism 8 (pulley and belt in the embodiment shown in the figures) (see FIG. 87 and FIG. 88).

In this embodiment, the pump body 120 includes a piston unit 121 for performing a reciprocating movement by the rotation of the pump shaft 110, and a cylinder block 122 for supporting the piston unit 121 in a freely reciprocating manner.

As mentioned above, the hydraulic pump unit 10Q is of a variable displacement type in this embodiment.

Therefore, the hydraulic pump unit 10Q comprises, in addition to the above configuration, an output adjusting member 150 for changing the suction/discharge rates of the pump body 120, and a control shaft 160 for slanting the output adjusting member 150.

In this embodiment, a movable swash plate is used for the output adjusting member 150, and a trunnion shaft is used for the control shaft 160.

In this embodiment, the control shaft 160 extends toward the outside in the width direction of the vehicle, in order to prevent interference with the oil tank 15.

The port block 130Q and the pump case 140 are connected to each other to configure the assembly for accommodating the pump body 120.

Specifically, the pump case 140 has an end wall 141 positioned on a first end side in the direction of the pump shaft 110, and a peripheral wall 142 extending from the end wall 141 toward a second end side in the axis line direction of the pump shaft 110.

The peripheral wall 142 has an opening 143 at the second end side in the axis line direction of the pump shaft 110. The opening 143 is sized to allow the pump body 120 to be inserted thereinto.

The port blocks 130Q is connected to the pump case 140 so as to close the opening 143 while rotatably supporting the pump body 120 in cooperation with the pump case 140.

Specifically, the port block 130Q includes a first end face 131 (lower surface in this embodiment) which is orthogonal to the pump shaft 110 and faces the pump case 140.

The first end face 131 includes a support region 131*a* for supporting the pump body 120 in a freely rotating manner, and a contact region 131*b* which is positioned outward in the radius direction of the support region 131*a* and is brought into contact with the pump case 140.

The pump body accommodating space S for accommodating the pump body 120 is defined when the first end face 131 of the port block 130Q is brought into contact with the end face of the peripheral wall 142 of the pump case 140.

The oil passages and the ports formed in the port block 130Q will be described later.

The auxiliary pump case 172Q is connected to a second end face 132 (upper surface in this embodiment) on the opposite side of the first end face 131 of the port block 130Q.

Specifically, the pump shaft 110 has the first end 111 operatively connected to the driving source 3, passing through the end wall 141 of the pump case 140 and extending outward, and a second end 112 passing through the port block 130Q and extending outward.

The auxiliary pump body 171 is driven by the second end 112 of the pump shaft 110, and the auxiliary pump case 172Q is connected to the second end face 132 of the port block 130Q so as to surround the auxiliary pump body 171.

The hydraulic circuit diagram of the hydraulic pump unit 10Q will now be described.

As shown in FIG. 89, the hydraulic pump unit 10Q includes the pair of hydraulic lines 30 fluidly connecting to the corresponding hydraulic motor unit 20, a suction line 51 extending between the oil tank 15 and the auxiliary pump body 171, a charge line 50 capable of supplying a pressure oil from the auxiliary pump body 171 to each hydraulic line 30, and a drain line 60 having a first end communicated to the pump body accommodating space S and a second end communicated to the oil tank 15.

Figure 92:
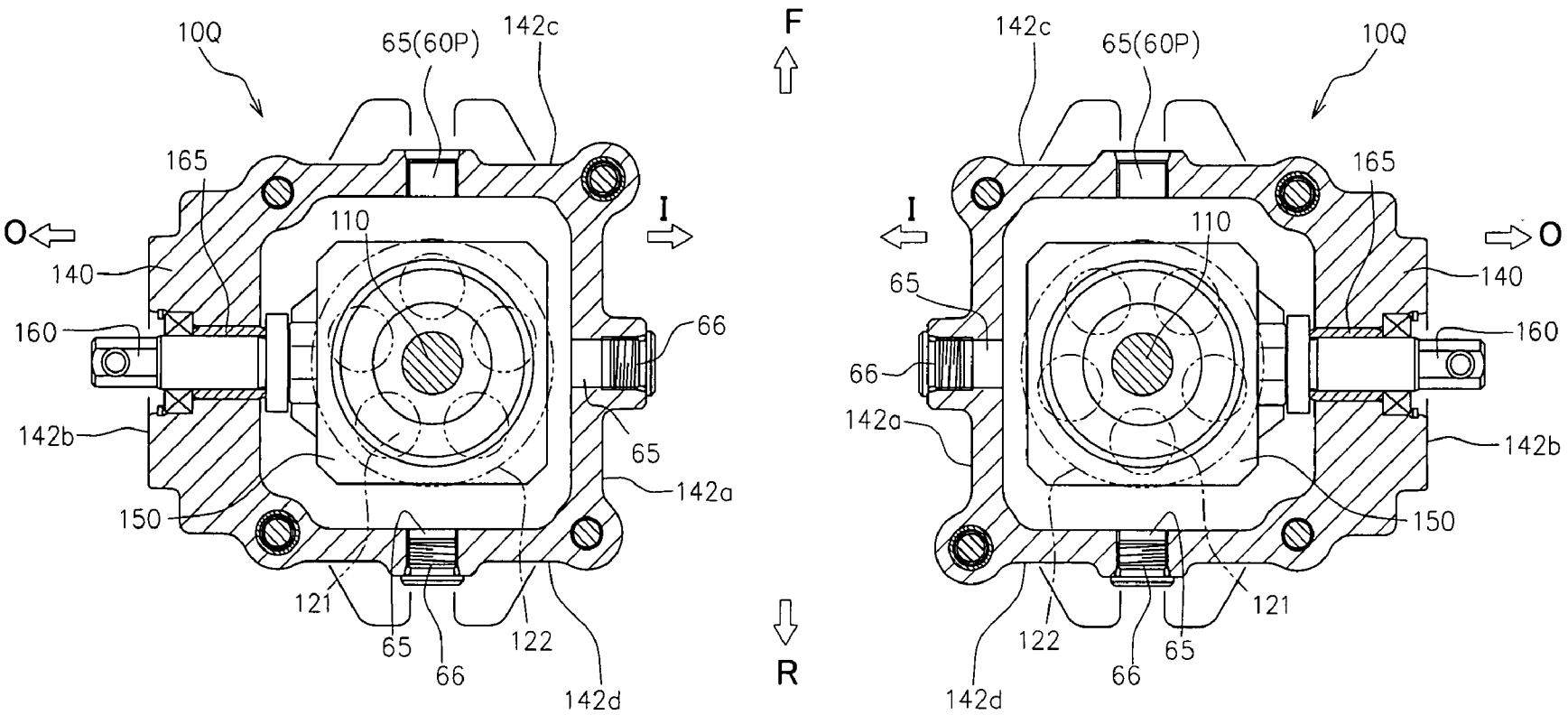
FIG. 92 is a cross sectional view taken along line 92-92 of FIG. 91.
Figure 93:
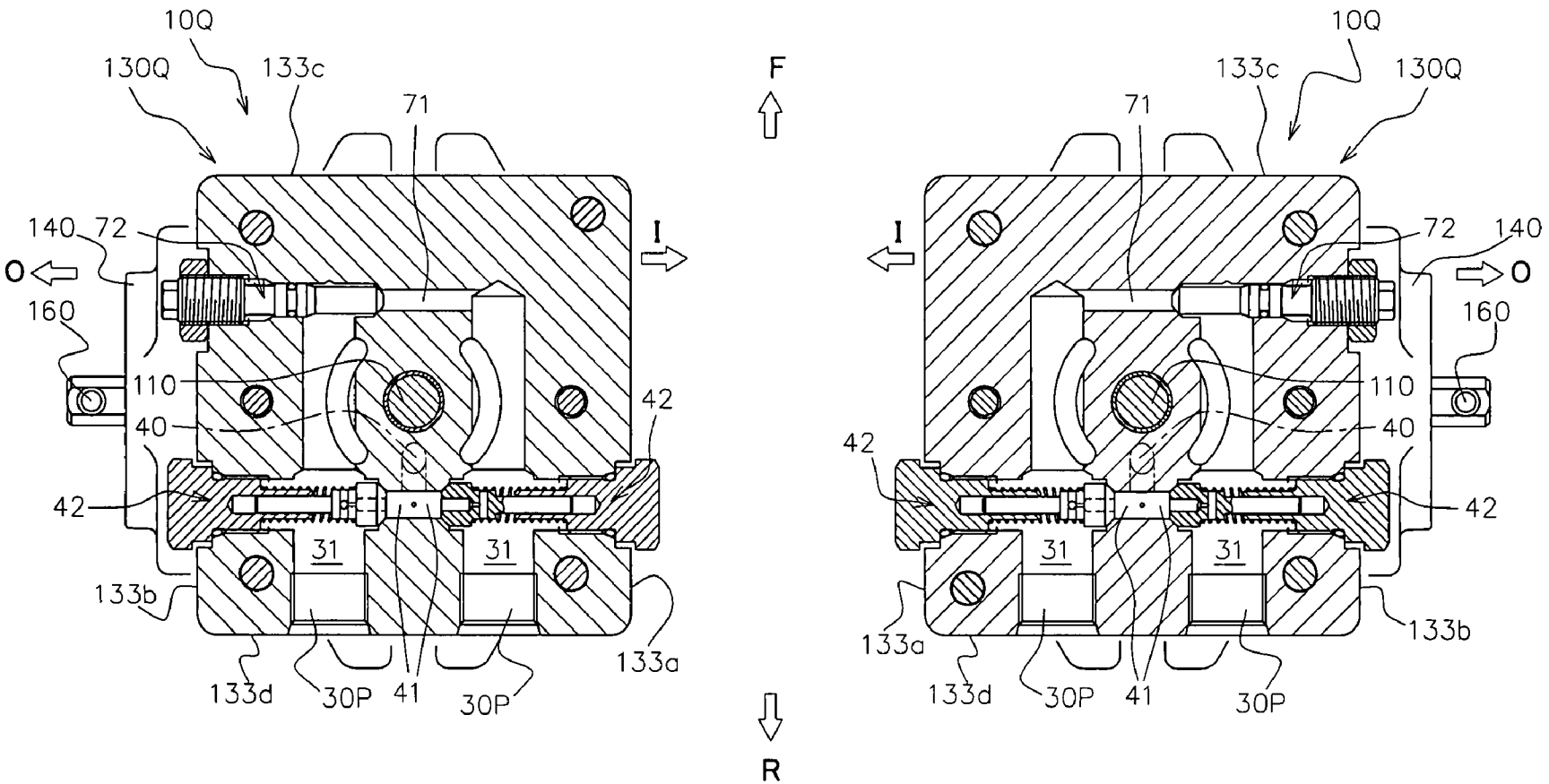
FIG. 93 is a cross sectional view taken along line 93-93 of FIG. 91.
Figure 94:
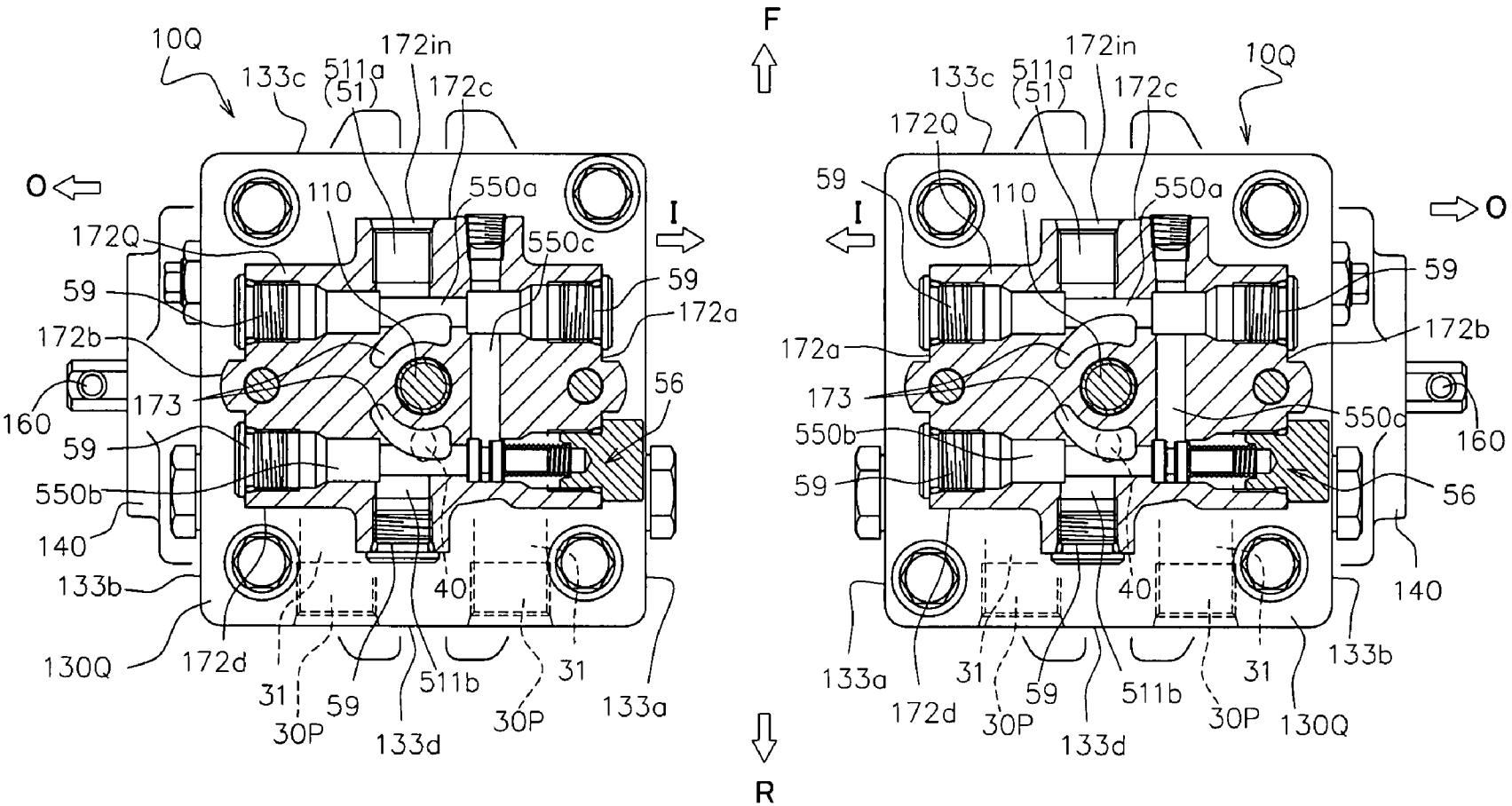
FIG. 94 is a cross sectional view taken along line 94-94 of FIG. 90 in a state where an auxiliary pump case is positioned at a first orientation.

FIG. 92 and FIG. 93 show cross sectional views taken along line 92-92 and line 93-93, respectively, of FIG. 91. FIG. 94 shows a cross sectional view taken along line 94-94 of FIG. 90.

In FIG. 92 to FIG. 94, the pair of hydraulic pump units 10Q are shown.

The symbols F, R, O, and I of FIG. 92 to FIG. 94 show the front in the longitudinal direction of the vehicle, the rear in the longitudinal direction of the vehicle, the outside in the width direction of the vehicle, and the inside in the width direction of the vehicle when seen from each hydraulic pump unit 10, respectively.

As shown in FIG. 93, the port block 130Q includes a pair of operating oil passages 31 fluidly connected to the pump body 120 to form a part of the pair of hydraulic lines 30.

Each of the pair of operating oil passages 31 has a first end opening at the external surface of the port block 130Q. The open end of each operating oil passage 31 forms the operating oil port 30P acting as a fluid connecting port to the corresponding hydraulic motor unit 20.

Specifically, the port block 130Q includes first to fourth external surfaces 133*a* to 133*d* extending approximately parallel to the pump shaft 110, in addition to the first and second end faces 131, 132.

In this embodiment, the first and second external surfaces 133*a*, 133*b* face the inside and the outside, respectively, in the width direction of the vehicle, and the third and fourth external surfaces 133*c*, 133*d* face the front and the rear, respectively, of the vehicle.

The pair of operating oil passages 31 are opened at one of the external surface (third external surface 133*c* in the embodiment shown in the figure) of the first to fourth external surfaces 133*a* to 133*d*.

The charge line 50 includes, as shown in FIG. 88, FIG. 89, FIG. 90 and FIG. 93, a charge oil passage 52 formed in the port block 130Q so as to have a first end forming the charge suction port 50P communicating to the discharge part 171*b* of the auxiliary pump body 171, and a second end communicated to each operating oil passage 31.

In this embodiment, the charge suction port 50P is arranged at the surface, which is brought into contact with the auxiliary pump case 172Q, so as to be fluidly connected to the discharge part 171*b* of the auxiliary pump body 171.

Specifically, the charge oil passage 52 includes a common charge oil passage 40 forming the charge suction port 50P, and a pair of branched charge oil passages 41 branched from the common charge oil passage 40 at the branch point C and communicated to the pair operating oil passages 31 (see FIG. 89 and FIG. 93).

A check valve 42 is arranged in each branched oil passage 41.

The check valve 42 is provided to allow the flow of the pressure oil from the charge line 50 to the pair of hydraulic lines 30, and to prevent the pressure oil from flowing in a reverse direction.

In this embodiment, the check valve 42 includes a throttle 43 (see FIG. 89); thus, a neutral state of the HST can be obtained without the need of strictly controlling the output adjusting member 150.

In this embodiment, as shown in FIG. 93, a single oil passage perforated in a direction approximately orthogonal to the pair of operating oil passages 31 is provided in the port block 130Q so as to communicate between the pair of operating oil passages 31.

The single oil passage forms the pair of branched oil passages 41.

With the above configuration, the pair of branched oil passages 41 can be efficiently provided.

More specifically, the single oil passage has both ends opened at the first and second external surfaces 133*a*, 133*b*, respectively.

The check valves 42 are attached from the first end and the second end of the single oil passage.

Further, as shown in FIG. 89, the hydraulic pump unit 10Q according to this embodiment includes a bypass line 70 selectively communicating between the pair of hydraulic lines 30.

By providing the bypass line 70, a pressure difference can be prevented from being occurred between the pair of hydraulic lines 30 when forcibly towing the vehicle at the time of fault and the like.

In this embodiment, the bypass line 70 includes a bypass oil passage 71 formed in the port block 130Q so as to communicate between the pair of operating oil passages 31, and a switching valve 72 for selectively communicating/blocking the bypass oil passage 71.

In this embodiment, the bypass oil passage 71 is formed so as to communicate the pair of operating oil passages 31 at the opposite side of the single oil passage forming the pair of branched oil passages 41 with the pump shaft 110 interposed therebetween.

With the above configuration, the single oil passage (pair of branched oil passages 41), the bypass oil passage 71, and the pair of operating oil passages 31 can be efficiently arranged.

In this embodiment, the bypass oil passage 71 has a first end opened at one of the external surface (second external surface 133*b* in the embodiment shown in the figure).

The switching valve 72 is attached from this opening so as to be externally operated.

The auxiliary pump case 172Q includes a pair of kidney ports 173 fluidly connected to the suction part 171*a* and the discharge part 171*b*, respectively, of the auxiliary pump body 171 (see FIG. 90), and a first oil passage 511*a* having a first end opened at one of the external surface to form the suction port 172 in and a second end fluidly connected to one of the kidney ports 173.

The suction port 172in is fluidly connected to the oil tank 15 by way of the suction conduit 510.

That is, in this embodiment, the suction line 51 is formed by the suction conduit 510, and the first oil passage 511*a* and one of the kidney ports 173 formed in the auxiliary pump case 172Q.

The discharge part 171*b* of the auxiliary pump body 171, as shown in FIG. 90, is fluidly connected to the charge suction port 50P formed in the port block 130Q.

That is, in this embodiment, the auxiliary pump case 172Q includes a discharge port 50Pout communicated to the discharge part 171*b* of the auxiliary pump body 171 at the surface which is brought into contact with the port block 130Q. By connecting the auxiliary pump case 172Q to the port block 130, the discharge port 50Pout is fluidly connected to the charge suction port 50P.

The hydraulic pump unit 10Q according to this embodiment further includes a charge pressure setting line 55 for setting the oil pressure of the discharge oil of the auxiliary pump body 171.

In this embodiment, the charge pressure setting line 55 includes a charge pressure setting oil passage 550 formed in the auxiliary pump case 172 so as to communicate between the discharge part 171*b* and the suction part 171*a* of the auxiliary pump body 171, and a relief valve 56 inserted into the charge pressure setting oil passage 550.

In this embodiment, as shown in FIG. 94, the first oil passage 511*a* is opened at the external surface extending approximately parallel to the pump shaft 110 of the external surfaces of the auxiliary pump case 172Q.

Specifically, the auxiliary pump case 172Q includes first to fourth external surfaces 172*a* to 172*d* each facing approximately the same direction as the first to the fourth external surfaces 133*a* to 133*d* of the port block 130Q when positioned in the following first orientation.

In this embodiment, the first oil passage 511*a* is opened at the third external surface 172*c*.

Preferably, the auxiliary pump case 172Q may include a second oil passage 511*b* having a first end opened at the external surface different from the external surface (third external surface 172*c* in the embodiment shown in the figure) where the first oil passage 511*a* is opened, and a second end fluidly connected to the other kidney port 173.

As shown in FIG. 94, in this embodiment, the second oil passage 511*b* is opened at the external surface (that is, fourth external surface 172*d*) displaced by 180 degrees about the pump shaft 110 with respect to the external surface (third external surface 172*c* in the embodiment shown in the figure) where the first oil passage 511*a* is opened.

Further, the auxiliary pump case 172Q is connectable to the port block 130Q in the first orientation in which the open end of the first oil passage 511*a* is directed in a first direction (front of the vehicle in the embodiment shown in the figure), and a second orientation in which the open end of the second oil passage 511*b* is directed in the first direction.

The above configuration allows the direction of the kidney ports 173 to match both rotating directions of the pump shaft 110 without changing the direction of the suction port 172in.

It is assumed herein that, for example, the suction port 172in is desired to be directed toward the front of the vehicle due to the relative positional relationship of the oil tank 15 and the hydraulic pump unit 10Q.

In this case, the auxiliary pump case 172Q may take a first orientation (see FIG. 94) in which the open end of the first oil passage 511*a* is directed toward the front of the vehicle, and a second orientation (see FIG. 95) in which the open end of the second oil passage 511*b* is directed toward the front of the vehicle.

Therefore, the directions of the pair of kidney ports 173 can be matched to the rotating direction of the pump shaft 110 by simply changing the relative position of the auxiliary pump case 172Q with respect to the port block 130Q.

That is, when it is desired that the pump shaft 110 is rotated toward one side (for example, counterclockwise in FIG. 94 and FIG. 95) about the axis line, the auxiliary pump case 172Q can be connected to the port block 130Q at the first orientation (see FIG. 94) so that the first oil passage 511 a forms the suction line 51.

On the other hand, when it is desired that the pump shaft 110 is rotated toward the other side (for example, clockwise in FIG. 94 and FIG. 95) about the axis line, the auxiliary pump case 172Q can be connected to the port block 130Q at the second orientation (see FIG. 95) so that the second oil passage 511*b* forms the suction line 51.

As mentioned above, in this embodiment, the directions of the pair of kidney ports 173 can be matched to the rotating direction of the pump shaft 110 by simply changing the relative position of the auxiliary pump case 172Q with respect to the port block 130Q.

Of the open ends of the first oil passage 511*a* and the second oil passage 511*b*, the open end not used as the suction port 172in is closed by the plug 59.

Further, the auxiliary pump case 172Q includes a first auxiliary oil passage 550*a* communicated to the first oil passage 511*a*, a second auxiliary oil passage 550*b* communicated to the second oil passage 511*b*, and a communicating oil passage 550*c* for communicating between the first auxiliary oil passage 550*a* and the second auxiliary oil passages 550*b*.

The first auxiliary oil passage 550*a*, the communicating oil passage 550*c* and the second auxiliary oil passage 550*b* form the charge pressure setting oil passage 550.

In this embodiment, the first auxiliary oil passage 550*a* and the second auxiliary oil passages 550*b* have both ends opening at the first external surface 172*a* and the second external surfaces 172*b*, respectively.

Of the open ends of the first oil passage 550*a* and the second oil passage 550*b*, the relief valve 56 is inserted from one of the open ends, and the other open end is closed by the plug 59.

Figure 95:
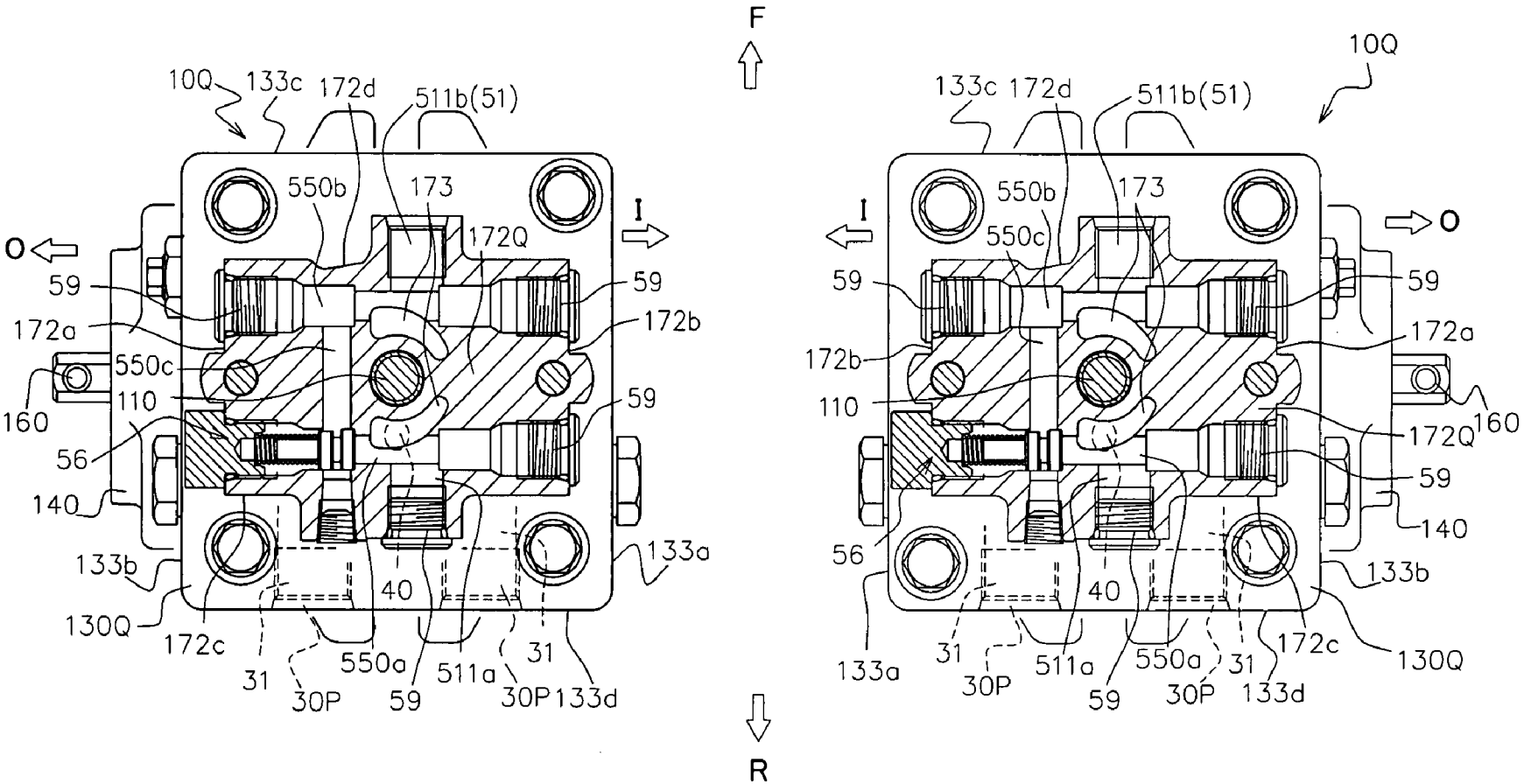
FIG. 95 is a cross sectional view taken along line 94-94 of FIG. 90 in a state where the auxiliary pump case is positioned at a second orientation.

With the above configuration, even when the auxiliary pump case 172Q is connected to the port block 130Q at either orientation of the first orientation or the second orientation, the charge pressure setting line 55 can be formed (see FIG. 94 and FIG. 95).

That is, when the auxiliary pump case 172Q is connected to the port block 130Q at the first orientation, the relief valve 56 is attached between the second oil passage 550*b* and the communicating oil passage 550*c* (see FIG. 94).

On the other hand, when the auxiliary pump case 172Q is connected to the port block 130Q at the second orientation, the relief valve 56 is attached between the first oil passage 550*a* and the communicating oil passage 550*c* (see FIG. 95).

As shown in FIG. 92, the pump case 140 includes a support hole 165 for supporting the control shaft 160 in a freely rotating manner about the axis line and a through hole 65 for opening the pump body accommodating space S outward at the peripheral wall 142.

The through hole 65 is used as the drain port 60P forming a part of the drain line 60.

Specifically, the peripheral wall 142 of the pump case 140 includes first to fourth external surfaces 142*a* to 142*d* each facing approximately the same direction as the first to the fourth external surfaces 133*a* to 133*d* of the port block 130Q.

In this embodiment, the support hole 165 is provided at the second external surface facing the outside in the width direction of the vehicle, and the through holes 65 are arranged at the remaining first, third and fourth external surfaces 142*a*, 142*c*, 142*d*.

Of these through holes, the optimum through hole (through hole 65 formed in the third external surface 142*c* in the embodiment shown in the figure) corresponding to the vehicle layout is used as the drain port 60P and the remaining through holes 65 are closed by the plugs 66.

In the hydraulic pump unit 10Q of the above configuration, the following effects can be obtained in addition to the above effects.

That is, in the hydraulic pump unit 10Q according to this embodiment, the operating oil port 30P used as the operating oil connecting port to the hydraulic actuator is provided in the port block 130Q, and the suction port 172in leading to the suction part 171*a* of the auxiliary pump body 171 is provided in the auxiliary pump case 172Q.

Therefore, in comparison with the conventional hydraulic pump unit in which both the operating oil port and the suction port are provided in the port block, the oil passage configuration in the port block 130Q can be facilitated.

Further, in this embodiment, by simply changing the relative position of the auxiliary pump case 172Q with respect to the port block 130Q, the pressure oil can be supplied in either case of when the pump shaft 110 is rotated toward one side about the axis line or when the pump shaft 110 is rotated toward the other side about the axis line, without changing the direction of the suction port 172in.

In this embodiment, the drain port 60P for externally drawing out the drain oil of the pump body 120 is provided in the pump case 140.

Therefore, in comparison with the conventional hydraulic pump unit in which the drain port is provided in the port block in addition to the operating oil port and the suction port, the oil passage configuration in the port block 130Q can be further facilitated.

Embodiment 18

Another embodiment of the hydraulic pump unit according to the sixth aspect of the present invention will now be described with reference to the accompanying drawings.

Figure 96:
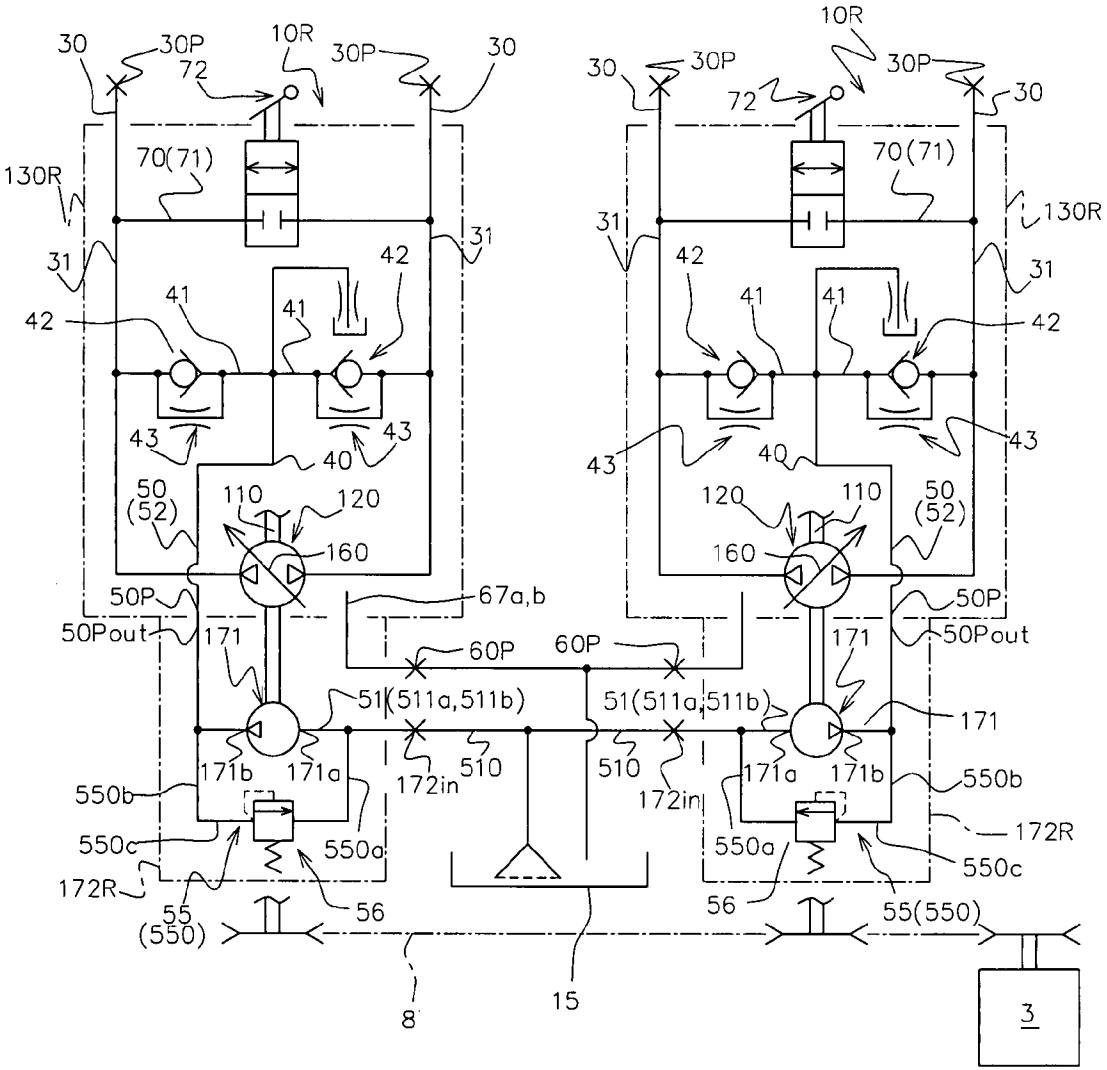
FIG. 96 is a hydraulic circuit diagram of a hydraulic pump unit according to an eighteenth embodiment of the present invention.

FIG. 96 is a hydraulic circuit diagram of a hydraulic pump unit 10R according to this embodiment.

Figure 97:
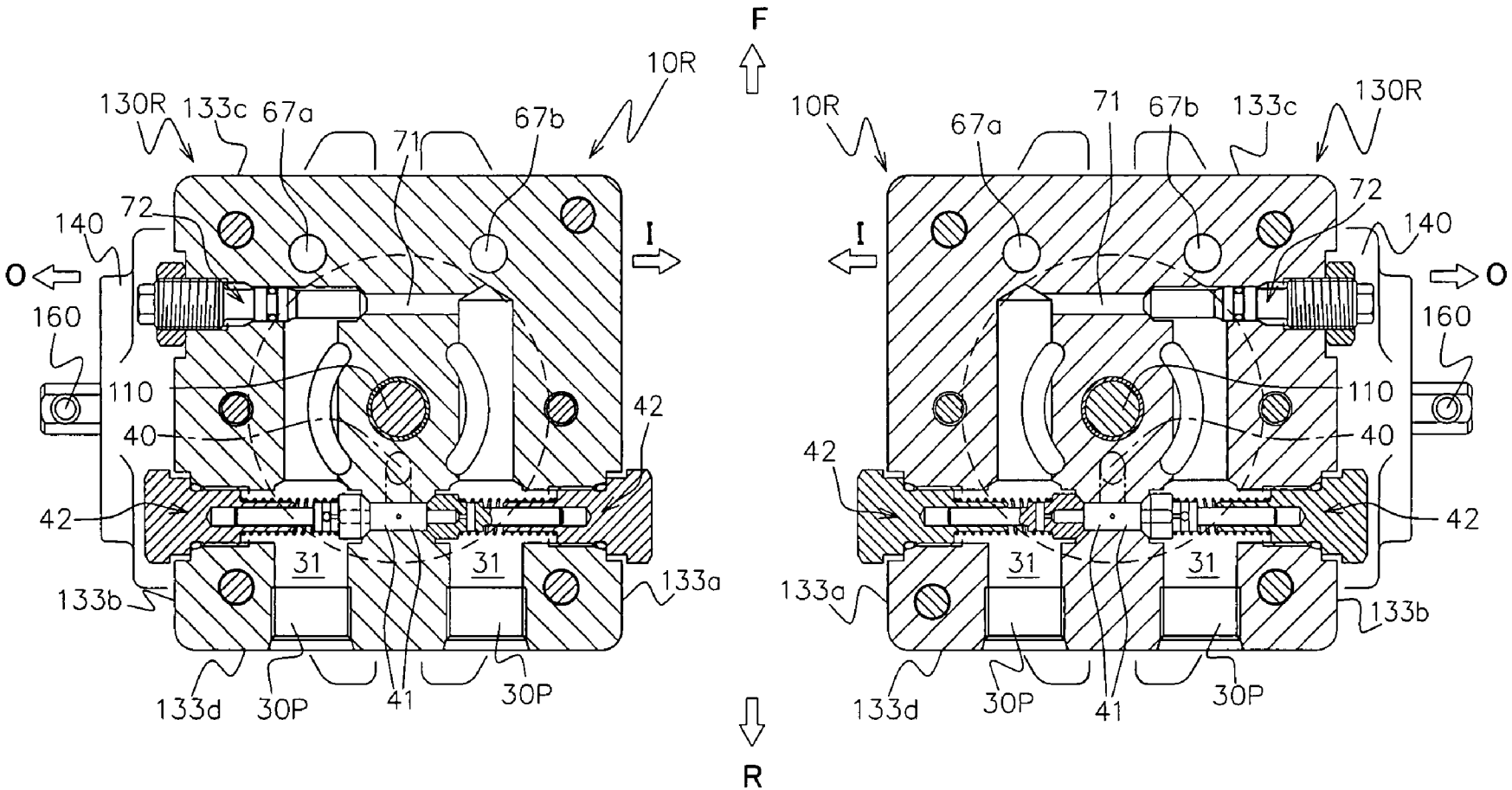
FIG. 97 is a transverse plan view of port blocks of the hydraulic pump unit according to the eighteenth embodiment of the present invention.
Figure 98:
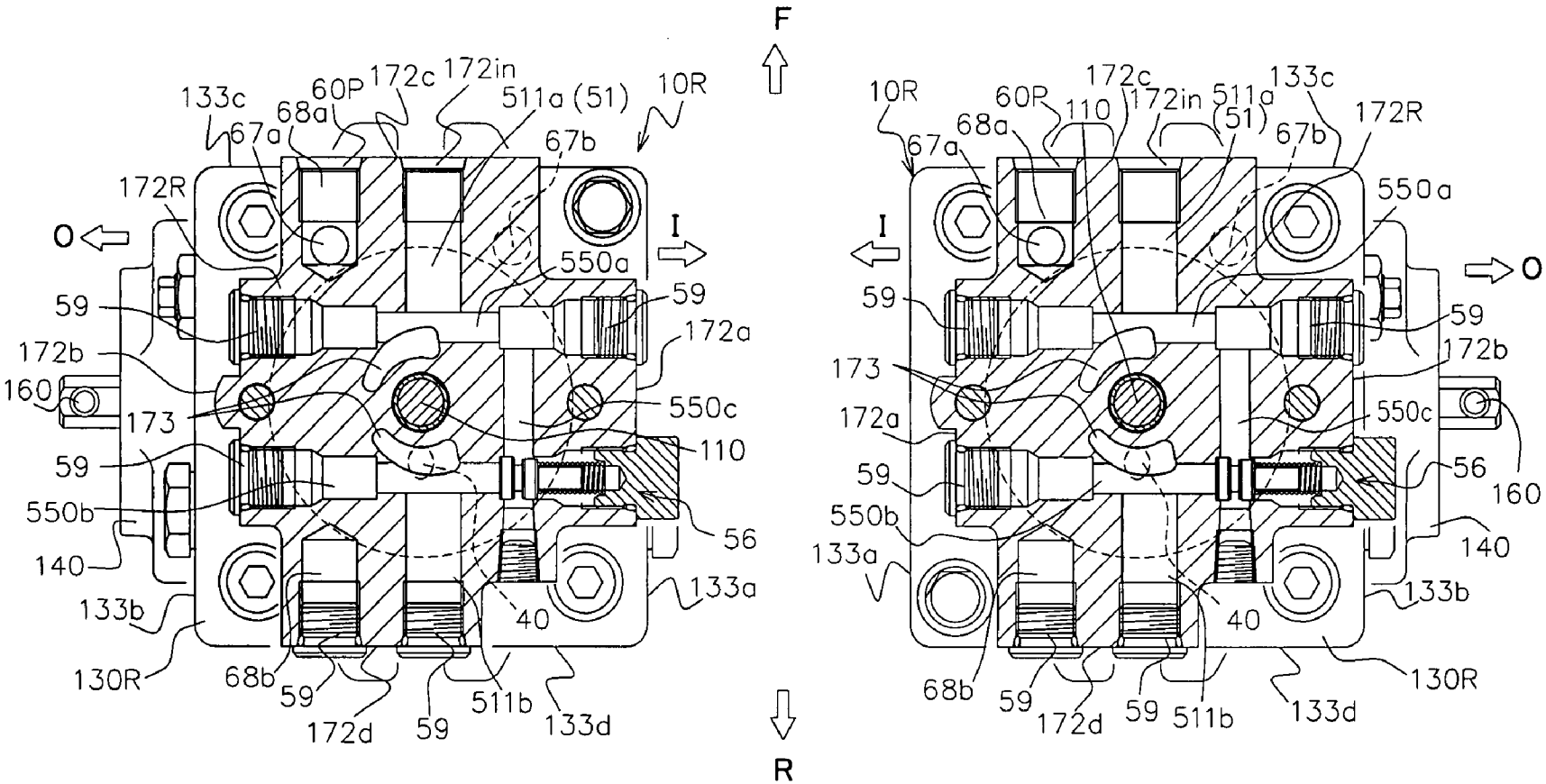
FIG. 98 is a transverse plan view of auxiliary pump cases of the hydraulic pump unit according to a first orientation of the eighteenth embodiment of the present invention.

FIG. 97 and FIG. 98 show transverse plan views of a port block 130R and an auxiliary pump case 172R of the hydraulic pump unit 10R.

FIG. 97 and FIG. 98 correspond to FIG. 93 and FIG. 94, respectively, of the seventeenth embodiment.

The hydraulic pump unit 10R according to this embodiment is changed so that the drain port 60P is provided in the auxiliary pump case 172R of the hydraulic pump unit 10Q according to the seventeenth embodiment.

That is, the hydraulic pump unit 10R according to this embodiment has substantially the same configuration as that of the hydraulic pump unit 10Q according to the seventeenth embodiment except for the drain port 60P.

Therefore, the same reference numerals are denoted for the members same as or corresponding to those in the seventeenth embodiment, and the detailed description thereof will not be given herein.

Specifically, the hydraulic pump unit 10R includes the port block 130R and the auxiliary pump case 172R in place of the port block 130Q and the auxiliary pump case 172Q of the hydraulic pump unit 10Q.

As shown in FIG. 97, the port block 130R includes a first port block-side drain oil passage 67*a* in addition to the oil passages same as in the port block 130Q.

The first port block-side drain oil passage 67*a* has a first end opening to the pump body accommodating space S and a second end opening to the surface which is brought into contact with the auxiliary pump case 172R.

As shown in FIG. 98, the auxiliary pump case 172R includes a first auxiliary pump case-side drain oil passage 68*a* in addition to the oil passages same as in the auxiliary pump case 172Q.

The first auxiliary pump case-side drain oil passage 68*a* has a first end opening to the surface, which is brought into contact with the port block 130R, so as to fluidly connect to the second end of the port block-side drain oil passage 67*a*, and a second end opening to the external surface to form the drain port 60P.

In the embodiment shown in the figures, the second end of the first auxiliary pump case-side drain oil passage 68*a* is opened at the third external surface 172*c* of the auxiliary pump case 172R.

Further, in this embodiment, the following configuration is adopted to suitably form the drain line 60 even when the auxiliary pump case 172R is connected to the port block 130R at either the first orientation or the second orientation.

That is, the port block 130R includes a second port block-side drain oil passage 67*b* in addition to the first port block-side drain oil passage 67*a*.

Further, the auxiliary pump case 172R includes a second auxiliary pump case-side drain oil passage 68*b* in addition to the first auxiliary pump case-side drain oil passage 68*a*.

When the auxiliary pump case 172R is connected to the port block 130R at the first orientation, as shown in FIG. 98, the first port block-side drain oil passage 67*a* and the first auxiliary pump case-side drain oil passage 68*a* are fluidly connected to each other, and the second port block-side drain oil passage 67*b* is closed by the auxiliary pump case 172R.

Figure 99:
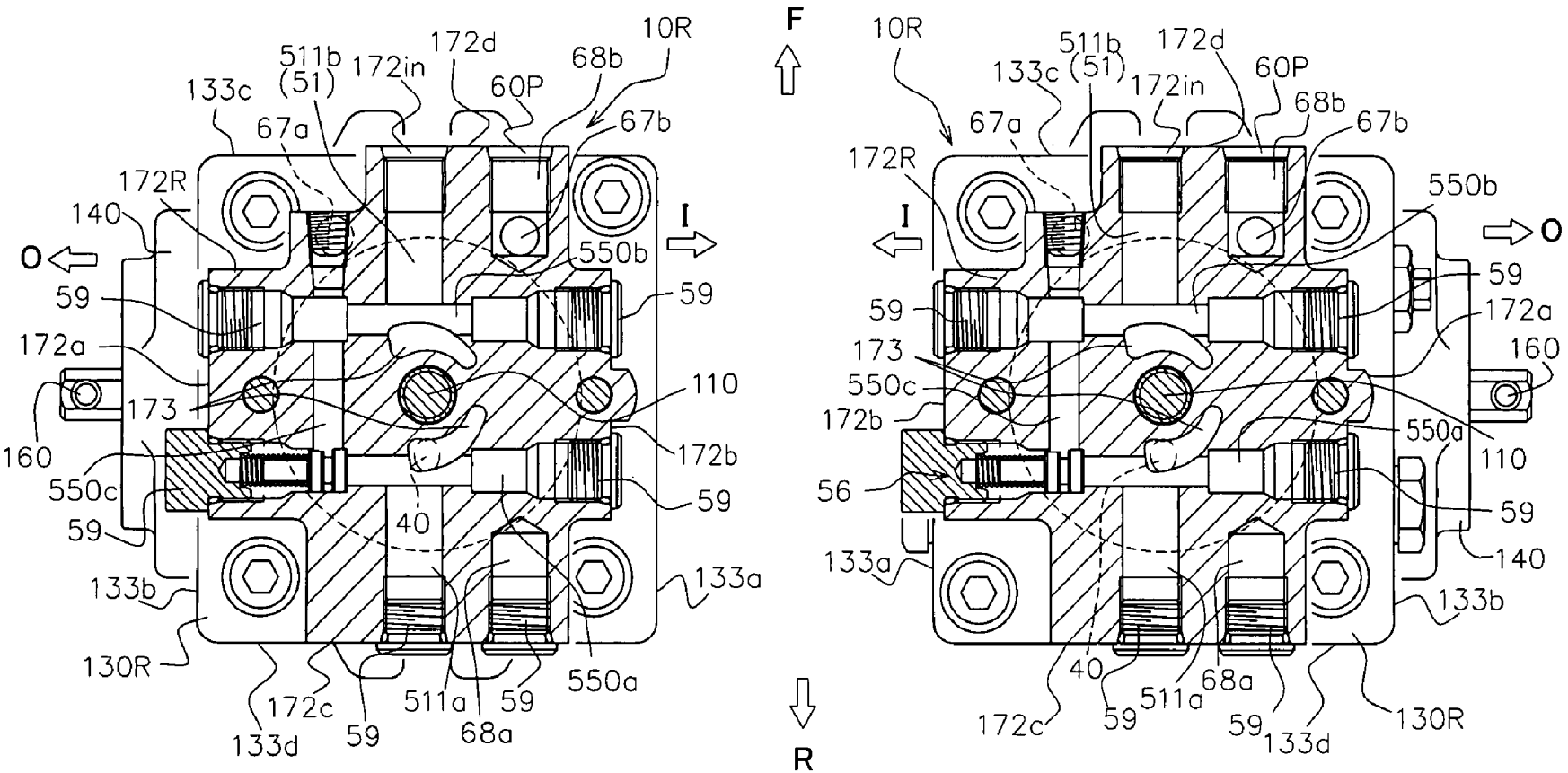
FIG. 99 is a transverse plan view of auxiliary pump cases of the hydraulic pump unit according to a second orientation of the eighteenth embodiment of the present invention.

On the other hand, when the auxiliary pump case 172R is connected to the port block 130R at the second orientation, as shown in FIG. 99, the second port block-side drain oil passage 67*b* and the second auxiliary pump case-side drain oil passage 68*b* are fluidly connected to each other, and the first port block-side drain oil passage 67*a* is closed by the auxiliary pump case 172R.

Effects similar to those in the seventeenth embodiment can be also obtained in the hydraulic pump unit 10R of the above configuration.

In the sixteenth and seventeenth embodiments, the auxiliary pump body 171 is configured so as to supply only the pressure oils to the hydraulic pump units 10Q, 10R. However, the pressure oil from the auxiliary pump body 171 may of course be used as the charge oil and as the operating oil for the external hydraulic device.

Further, in the seventeenth and eighteenth embodiments, the hydraulic pump unit configured so that the pump shaft 110 is directed in the vertical direction is described by way of an example; however, the present invention is of course not limited to this form. That is, the hydraulic pump unit may be configured so that the pump shaft 110 may be directed in the front-to-rear direction of the vehicle or in the width direction of the vehicle.

This specification is by no means intended to restrict the present invention to the preferred embodiments set forth therein. Various modifications to the hydraulic pump unit and the hydraulic pump set as well as the working vehicle as described herein may be made by those skilled in the art without departing from the spirit and scope of the present invention as defined in the appended claims.

What is claimed is:

1. A working vehicle comprising first and second hydraulic pump units operatively driven by a driving source and arranged away to each other in a width direction of the vehicle, wherein each of said first and second hydraulic pump units comprises:

a pump body;

a port block formed with an oil passage for supplying/discharging an operating fluid to/from said pump body;

a pump case connected to said port block so as to define a pump body accommodating space for surrounding said pump body;

a pump shaft for rotatably driving said pump body, said pump shaft having an input end operatively connected to said driving source, and a control shaft for changing a suction/discharge rate of the pump body;

each of first and second assemblies formed by said corresponding pump case and port block includes a first side face to an inward direction in the width direction of the vehicle so as to face the other assembly, a second side face facing to an outward direction opposite to the inward direction in the width direction of the vehicle, a third side face facing to one side in a longitudinal direction of the vehicle, a fourth side face facing to the other side in the longitudinal direction of the vehicle, a drain port for opening said pump body accommodating space outward, and a charge suction port for drawing in an oil from an oil tank in order to supply a charge oil to a hydraulic circuit fluidly connecting between the corresponding hydraulic pump unit and a corresponding hydraulic motor unit said control shaft extends outward in the width direction of the vehicle through the second side face, and said drain port is provided on the third side face or the fourth side face.

2. The working vehicle according to claim 1, wherein said charge suction port is provided on the third side face or the fourth side face.

3. The working vehicle according to claim 2, wherein each of said first and second hydraulic pump units includes a pair of operating oil passages forming a pad of the hydraulic circuit, the pair of operating oil passages being opened outward to form a pair of operating oil ports, said drain port and charge suction port are provided on one of the third or fourth side face, and said pair of operating oil ports are provided on the other of the third or fourth side face.

4. The working vehicle according to claim 1, wherein said charge suction port is provided in said port block.

5. The working vehicle according to claim 1, wherein at least one of said first and second hydraulic pump units comprises a charge pump unit including a charge pump body driven by said pump shaft, and a charge pump case connected to said pump case or said port block so as to surround the charge pump body, said charge pump case configuring said assembly with the pump case and the port block, and the hydraulic pump unit comprising said charge pump unit has said charge suction port provided in said charge pump case.

6. The working vehicle according to claim 5, wherein the hydraulic pump unit comprising said charge pump unit also has said drain port provided in said charge pump case.

7. The working vehicle according to claim 1, wherein said oil tank to which said drain port fluidly connected through a drain conduit and to which said charge suction port is fluidly connected through a charge conduit is arranged between said first side faces of said first and second assemblies.

8. A working vehicle comprising first and second hydraulic pump units operatively driven by a driving source and arranged away to each other in a width direction of the vehicle, wherein each of said first and second hydraulic pump units comprises:

a pump body;

a port block formed with an oil passage for supplying/discharging an operating fluid to/from said pump body;

a pump case connected to said port block so as to define a pump body accommodating space for surrounding said pump body; and a pump shaft for rotatably driving said pump body, said pump shaft having an input end operatively connected to said driving source;

each of first and second assemblies formed by said corresponding pump case and port block includes a first side face facing to an inward direction in the width direction of the vehicle so as to face the other assembly, a second side face facing to an outward direction opposite to the inward direction in the width direction of the vehicle, a third side face facing to one side in a longitudinal direction of the vehicle, a fourth side face facing to the other side in the longitudinal direction of the vehicle, a drain port for opening said pump body accommodating space outward, and a charge suction port for drawing in an oil from an oil tank in order to supply a charge oil to a hydraulic circuit fluidly connecting between the corresponding hydraulic pump unit and a corresponding hydraulic motor unit, and said drain port and said charge suction port are provided on the same wall surface other than the first side face of said corresponding assembly.

9. A working vehicle comprising first and second hydraulic pump units operatively driven by a driving source and arranged away to each other in a width direction of the vehicle, wherein each of said first and second hydraulic pump units comprises:

a pump body;

a port block formed with an oil passage for supplying/discharging an operating fluid to/from said pump body;

a pump case connected to said port block so as to define a pump body accommodating space for surrounding said pump body; and a pump shaft for rotatably driving said pump body, said pump shaft having an input end operatively connected to said driving source;

each of first and second assemblies formed by said corresponding pump case and port block includes a first side face facing to an inward direction in the width direction of the vehicle so as to face the other assembly, a second side face facing to an outward direction opposite to the inward direction in the width direction of the vehicle, a third side face facing to one side in a longitudinal direction of the vehicle, a fourth side face facing to the other side in the longitudinal direction of the vehicle, a drain port for opening said pump body accommodating space outward, and a charge suction port for drawing in an oil from an oil tank in order to supply a charge oil to a hydraulic circuit fluidly connecting between the corresponding hydraulic pump unit and a corresponding hydraulic motor unit, and said drain port is provided in said pump case so as to be positioned on a wall surface other than the first side face.

10. A working vehicle comprising first and second hydraulic pump units arranged away from each other in a width direction of the vehicle, wherein each of said first and second hydraulic pump units includes a pump body, a control shaft for changing a suction/discharge rate of the pump body, a first side face facing to an inward direction in the width direction of the vehicle so as to face the other hydraulic pump unit, a second side face facing to an outward direction opposite to the inward direction in the width direction of the vehicle, a third side face facing to one side in a longitudinal direction of the vehicle, a fourth side face facing to the other side in the longitudinal direction of the vehicle, and a drain port for opening a pump body accommodating space, which accommodates the pump body, outward, said control shaft extends outward in the width direction of the vehicle through the second side face, and said drain port is provided on the third side face or the fourth side face.

11. The working vehicle according to claim 10, wherein each of said first and second hydraulic pump units includes a charge suction port on the third side face or the fourth side.

12. The working vehicle according to claim 11, wherein each of said first and second hydraulic pump units has a pair of operating oil ports to which a pair of operating oil passages for fluidly connecting the corresponding hydraulic pump unit and a corresponding hydraulic motor unit are connected, said charge suction port and said drain port are provided on one of the third or fourth side face, and said pair of operating oil ports are provided on the other of the third or fourth side face.

13. A working vehicle comprising first and second hydraulic pump units arranged away from each other in a width direction of the vehicle, wherein each of said first and second hydraulic pump units includes a first side face facing to an inward direction in the width direction of the vehicle so as to face the other hydraulic pump unit, a second side face facing to an outward direction opposite to the inward direction in the width direction of the vehicle, a third side face facing to one side in a longitudinal direction of the vehicle, a fourth side face facing to the other side in the longitudinal direction of the vehicle, and a drain port for opening a pump body accommodating space, which accommodates the pump body, outward, said drain port is provided on a wall surface other than the first side face, the vehicle further comprises an oil tank to which the drain port is fluidly connected through a drain conduit, and said oil tank is arranged so that at least a part of the oil tank is positioned within a space defined by the first side faces of the first and second hydraulic pump units.

14. The working vehicle according to claim 13, wherein each of said first and second hydraulic pump units has a pair of operating oil ports to which a pair of operating oil passages for fluidly connecting the corresponding hydraulic pump unit and a corresponding hydraulic motor unit are connected, said drain port is provided on one of the third or fourth side face, and said pair of operating oil ports are provided on the other of the third or fourth side face.

* * * * *

UNITED STATES PATENT AND TRADEMARK OFFICE

CERTIFICATE OF CORRECTION

PATENT NO. : 7,316,287 B2
APPLICATION NO. : 11/102708
DATED : January 8, 2008
INVENTOR(S) : Ohashi et al.

It is certified that error appears in the above-identified patent and that said Letters Patent is hereby corrected as shown below:

Col. 88, line 67, Claim 3, line 3, the word "pad" should read as --part--.

Signed and Sealed this

Third Day of June, 2008

JON W. DUDAS
*Director of the United States Patent and Trademark Office*